US010519643B2

(12) United States Patent
Bucher et al.

(10) Patent No.: US 10,519,643 B2
(45) Date of Patent: Dec. 31, 2019

(54) SELF-CLEANING TOILET ASSEMBLY AND SYSTEM

(71) Applicant: AS AMERICA, INC., Piscataway, NJ (US)

(72) Inventors: Christophe Bucher, Hillsborough, NJ (US); David Grover, Hamilton, NJ (US); Ronald Barndt, Bethlehem, PA (US); Frank Seggio, Wayside, NJ (US); James McHale, Hillsborough, NJ (US); Chris Cicenas, Pataskala, OH (US); Matthew O'Kelly, Columbus, OH (US)

(73) Assignee: AS AMERICA, INC., Piscataway, NJ (US)

( * ) Notice: Subject to any disclaimer, the term of this patent is extended or adjusted under 35 U.S.C. 154(b) by 380 days.

(21) Appl. No.: 14/332,209

(22) Filed: Jul. 15, 2014

(65) Prior Publication Data

US 2015/0013058 A1 Jan. 15, 2015

Related U.S. Application Data

(60) Provisional application No. 61/980,514, filed on Apr. 16, 2014, provisional application No. 61/950,038, (Continued)

(51) Int. Cl.
*E03D 9/03* (2006.01)
*E03D 9/02* (2006.01)

(52) U.S. Cl.
CPC ..... *E03D 9/037* (2013.01); *E03D 9/035* (2013.01); *E03D 2009/028* (2013.01); *E03D 2201/40* (2013.01)

(58) Field of Classification Search
CPC ... E03D 9/035; E03D 9/037; E03D 2009/028; E03D 2201/40

(Continued)

(56) References Cited

U.S. PATENT DOCUMENTS 1,688,098 A 10/1928 Turner
2,745,110 A 5/1956 Lyster, Jr.

(Continued)

FOREIGN PATENT DOCUMENTS

CN 202416504 U 9/2012
GB 2431937 A 5/2007

(Continued)

OTHER PUBLICATIONS

Notice of Second Office Action dated May 18, 2017 in related Chinese Application No. 2014800508750 (w/ English translation).

(Continued)

*Primary Examiner* — Erin Deery
*Assistant Examiner* — William R Klotz
(74) *Attorney, Agent, or Firm* — Venable LLP; Michele V. Frank

(57) ABSTRACT

Toilet assemblies having various embodiments of a cleaning system are described herein which include a toilet assembly and a cleaning system. The toilet assembly has a toilet bowl, a tank, a flush valve, and a rim in fluid communication with the bowl through a rim flow path from an outlet of the flush valve to at least one rim outlet port. The flush valve is configured to operate in a flush actuation mode wherein the flush valve is able to provide flush water flow sufficient for the toilet assembly to initiate a flush siphon or provide a wash down flush and to operate in a cleaning actuation mode wherein the flush valve is only partially opened to allow for introduction of a cleaning agent and flush water mixture to the bowl that is insufficient to initiate a siphon but sufficient for cleaning the bowl. The cleaning system includes a reservoir for a liquid cleaning agent, a housing for the reservoir, a supply conduit for receiving fluid from within the reservoir and delivering it to a flush valve, a flow control device capable of controlling flow of cleaning agent and a (Continued)

control system activatable by an actuator feature to initiate a clean cycle by operating the flow control device to deliver a dose of cleaning agent to one or more rim outlets, and operating the flush valve in cleaning actuation mode to introduce flush water to carry the dose of cleaning agent through the at least one rim outlet port into the toilet bowl at a flow rate insufficient to initiate a siphon but sufficient for cleaning the bowl.

22 Claims, 58 Drawing Sheets

Related U.S. Application Data filed on Mar. 8, 2014, provisional application No. 61/908,038, filed on Nov. 22, 2013, provisional application No. 61/881,948, filed on Sep. 24, 2013, provisional application No. 61/846,427, filed on Jul. 15, 2013.

(58) Field of Classification Search
USPC ..... 4/224
See application file for complete search history.

(56) References Cited

U.S. PATENT DOCUMENTS

| | | | | |
|---|---|---|---|---|
| 3,913,151 | A | 10/1975 | Keimig | |
| 4,251,012 | A | 2/1981 | Owens et al. | |
| 4,817,216 | A | 4/1989 | Auman | |
| 5,036,553 | A | 8/1991 | Sanderson | |
| 5,152,015 | A | 10/1992 | Fourman | |
| 5,367,716 | A | 11/1994 | Huang | |
| 5,542,132 | A | 8/1996 | Jaeckels et al. | |
| 5,584,079 | A | 12/1996 | Wong et al. | |
| 5,608,923 | A | 3/1997 | Jaeckels et al. | |
| 5,729,837 | A | 3/1998 | Jaeckels et al. | |
| 5,745,928 | A | 5/1998 | Armanno, Sr. | |
| 5,867,844 | A | 2/1999 | Jaeckels et al. | |
| 5,913,611 | A | 6/1999 | Jaeckels et al. | |
| 5,918,325 | A | 7/1999 | Arita et al. | |
| 6,279,174 | B1 * | 8/2001 | Candusso | E03D 9/002 4/224 |
| 6,321,392 | B1 | 11/2001 | Sim | |
| 6,704,945 | B2 | 3/2004 | Bellmore | |
| 6,715,162 | B2 | 4/2004 | Han et al. | |
| 6,772,450 | B1 | 8/2004 | Saylor et al. | |
| 6,823,535 | B2 | 11/2004 | Tomita et al. | |
| 6,944,890 | B1 | 9/2005 | Sim | |
| 7,028,347 | B2 | 4/2006 | Sanderson | |
| 7,549,181 | B1 | 6/2009 | Davis et al. | |
| 8,095,997 | B2 | 1/2012 | Harris | |
| 8,266,733 | B2 | 9/2012 | Jensen | |
| 8,316,475 | B2 | 11/2012 | Grover | |
| 9,783,975 | B2 | 10/2017 | Bucher et al. | |
| 2002/0194671 | A1 | 12/2002 | Harbutt et al. | |
| 2003/0106145 | A1 | 6/2003 | Tomita et al. | |
| 2004/0216221 | A1 | 11/2004 | Chen | |
| 2005/0273918 | A1 | 12/2005 | Bernarducci | |
| 2006/0010592 | A1 * | 1/2006 | Matsui | E03D 5/10 4/425 |
| 2007/0113331 | A1 * | 5/2007 | Prokopenko | E03D 5/01 4/425 |
| 2008/0052812 | A1 | 3/2008 | Jensen | |
| 2009/0211003 | A1 * | 8/2009 | Harris | E03D 1/01 4/227.1 |
| 2009/0313750 | A1 | 12/2009 | Okubo et al. | |
| 2010/0058523 | A1 | 3/2010 | Wajda | |
| 2010/0088810 | A1 | 4/2010 | Sim | |
| 2010/0205727 | A1 | 8/2010 | Muhlhausen et al. | |
| 2011/0113542 | A1 | 5/2011 | Stauber et al. | |
| 2012/0198610 | A1 * | 8/2012 | McHale | E03D 11/08 4/421 |
| 2013/0219605 | A1 | 8/2013 | Grover et al. | |
| 2014/0090158 | A1 | 4/2014 | Jensen | |
| 2014/0115765 | A1 | 5/2014 | Carpenter et al. | |
| 2014/0230136 | A1 | 8/2014 | Grover et al. | |
| 2015/0013057 | A1 | 1/2015 | Bucher et al. | |
| 2015/0013058 | A1 | 1/2015 | Bucher et al. | |
| 2015/0197928 | A1 | 7/2015 | McHale et al. | |
| 2016/0002903 | A1 | 1/2016 | Grover et al. | |
| 2017/0030065 | A1 | 2/2017 | Bucher et al. | |

FOREIGN PATENT DOCUMENTS

| | | | |
|---|---|---|---|
| JP | S5816280 | U | 2/1983 |
| JP | H05214757 | A | 8/1993 |
| JP | H07310351 | A | 11/1995 |
| JP | H08128093 | A | 5/1996 |
| JP | 2000001892 | A | 1/2000 |
| WO | 2004029374 | A1 | 4/2004 |
| WO | 2009030904 | A1 | 3/2009 |
| WO | 2009105417 | A1 | 8/2009 |
| WO | 2015009751 | A1 | 1/2015 |
| WO | 2017062968 | A1 | 4/2017 |

OTHER PUBLICATIONS

Search Report completed Nov. 25, 2016 in related Singapore Application No. 11201600267W.
Written Opinion dated Dec. 7, 2016 in corresponding Singapore Application No. 11201600267W.
International Search Report and Written Opinion dated Dec. 15, 2016 in related International Application No. PCT/US2016/056311.
International Search Report and Written Opinion dated Nov. 4, 2014 in related International Application No. PCT/US2014/046741.
International Preliminary Report on Patentability dated Jan. 19, 2016 in related International Application No. PCT/US2014/046741.
Examination Report No. 1 dated Apr. 11, 2017 in related Australian Application No. 2014290129.
Notice of First Office Action dated Oct. 17, 2016 in related Chinese Application No. 2014800508750 (w/ English translation).
Extended European Search Report dated Jun. 6, 2017 in related European Application No. 14826567.1.
Japanese Office Action dated May 8, 2018 in related Japanese Patent Application No. 2016-527052 with English Translation (8 pages).
Decision on Rejection dated Jun. 4, 2018, in related Chinese Application No. 201480050875.0 (10 pages including brief English translation).
Notice of Third Office Action dated Nov. 17, 2017 in corresponding CN Application No. 2014800508750 (w/ English translation).
Written Opinion completed Oct. 19, 2017 by Intellectual Property Office of Singapore in related Singapore Application No. 11201600267W.
Non-Final Office Action dated Sep. 20, 2018 in related U.S. Appl. No. 15/698,243 (25 pages).
Chinese Office Action dated Nov. 6, 2018 in related Chinese Application No. 201480050875.0 (7 pages).
Final Office Action dated Jan. 14, 2019 in related U.S. Appl. No. 15/698,243 (17 pages).
Japanese Office Action dated Jan. 29, 2019 in related Japanese Patent Application No. 2016-527052 (8 pages).

* cited by examiner

PRIOR ART

SELF-CLEANING TOILET ASSEMBLY AND SYSTEM

CROSS-REFERENCE TO RELATED APPLICATIONS

This application claims the benefit under 35 U.S.C. § 119(e) to U.S. Provisional Patent Application No. 61/980,514, filed Apr. 16, 2014, U.S. Provisional Patent Application No. 61/950,038, filed Mar. 8, 2014, U.S. Provisional Patent Application No. 61/908,038, filed Nov. 22, 2013, U.S. Provisional Patent Application No. 61/881,948, filed Sep. 24, 2013, and U.S. Provisional Patent Application No. 61/846,427, filed Jul. 15, 2013, each entitled "Self-Cleaning Toilet Assembly and System," the disclosures of which are hereby incorporated by reference in their entirety.

BACKGROUND OF THE INVENTION

Field of the Invention

The field of the invention includes flush toilets, and more particularly certain gravity-powered wash down or siphonic flush toilets having a cleaning system with a cleaning cycle.

Description of Related Art

There are a wide variety of types of toilets and toilet assemblies having toilet bowls, including gravity-powered siphonic and wash down toilets. Siphonic toilets may include rim-fed bowls, non-jetted, rim-jetted and direct jetted bowls. Such, toilets for removing waste products, such as human waste, are well known. Typically, toilets such as gravity-powered toilets generally have two main parts: a tank and a bowl. The tank and bowl can be separate pieces coupled together to form the toilet system (commonly referred to as a two-piece toilet) or can be combined into one integral unit (typically referred to as a one-piece toilet).

The tank, if present, is usually positioned over the back of the bowl, contains water that is used for initiating flushing of waste from the bowl to the sewage line, as well as refilling the bowl with fresh water. When a user desires to flush the toilet, he pushes down on a flush lever on the outside of the tank, which lever is connected on the inside of the tank to a movable chain or lever within the tank. When the flush lever is depressed, it moves a chain or lever on the inside of the tank that acts to lift and open the flush valve, causing water to flow from the tank and into the bowl, thus initiating the toilet flush. Other toilets operate without a tank using in-line plumbing fed from a water source and in-line flush valves which actuate by action of an actuation device such as a flush handle, a push button, or the like.

There are three general purposes to be served in a flush cycle. The first is to remove any solid, liquid or other waste to the drain line. The second is cleansing the bowl to remove any solid, liquid or other waste which was deposited or adhered to the surfaces of the bowl during use. The third is exchange of pre-flush water in the bowl so that relatively clean water remains in the bowl between uses restoring the seal depth against backflow of sewer gas, and readying the toilet for the next use and flush cycle.

The second requirement, cleansing of the bowl, is usually achieved by way of the hollow rim found in most toilets that extends around the upper perimeter of the toilet bowl. Some or all of the flush water is directed through such a hollow rim channel and flows through openings positioned therein to disperse water over the entire surface of the bowl and accomplish the required cleansing.

Gravity powered toilets can be classified in two general categories: wash down and siphonic. In a wash-down toilet, the water level within the bowl of the toilet remains relatively constant at all times. When a flush cycle is initiated, water flows from the tank or other water source and spills into the bowl. This causes a rapid rise in water level and the excess water spills over the weir of the trapway, carrying liquid and solid waste along with it. At the conclusion of the flush cycle, the water level in the bowl naturally returns to the equilibrium level determined by the height of the weir.

In a siphonic toilet, the trapway and other hydraulic channels are designed such that a siphon is initiated in the trapway upon addition of water to the bowl. The siphon tube itself is an upside down U-shaped tube that draws water from the toilet bowl to the wastewater line. When the flush cycle is initiated, water flows into the bowl and spills over the weir in the trapway faster than it can exit the outlet to the sewer drain line. Sufficient air is eventually removed from the down leg of the trapway to initiate a siphon which in turn pulls the remaining water out of the bowl. The water level in the bowl when the siphon breaks is consequently well below the level of the weir, and a separate mechanism needs to be provided to refill the bowl of the toilet at the end of a siphonic flush cycle to reestablish the original water level and protective seal preventing back flow of sewer gas.

Generally, siphonic and wash-down toilets have inherent advantages and disadvantages. Siphonic toilets, due to the requirement that most of the air be removed from the down leg of the trapway in order to initiate a siphon, tend to have smaller trapways which can result in clogging. Wash-down toilets can function with large trapways but generally require a smaller amount of pre-flush water in the bowl to achieve the 110:1 dilution level required by plumbing codes in most countries (i.e., 99% of the pre-flush water volume in the bowl must be removed from the bowl and replaced with fresh water during the flush cycle). This small pre-flush volume manifests itself as a small "water spot." The water spot, or surface area of the pre-flush water in the bowl, plays an important role in maintaining the cleanliness of a toilet. A large water spot increases the probability that waste matter will contact water before contacting the ceramic surface of the toilet. This reduces adhesion of waste matter to the ceramic surface making it easier for the toilet to clean itself via the flush cycle. Wash-down toilets with their small water spots therefore frequently require manual cleaning of the bowl after use.

Siphonic toilets have the advantage of being able to function with a greater pre-flush water volume in the bowl and greater water spot. This is possible because the siphon action pulls the majority of the pre-flush water volume from the bowl at the end of the flush cycle. As the tank refills, a portion of the refill water is directed into the bowl to return the pre-flush water volume to its original level. In this manner, the 110:1 dilution level required by many plumbing codes is achieved even though the starting volume of water in the bowl is significantly higher relative to the flush water exited from the tank. In the North American markets, siphonic toilets have gained widespread acceptance and are now viewed as the standard, accepted form of toilet. In European markets, wash-down toilets are still more accepted and popular, whereas both versions are common in the Asian markets.

Gravity powered siphonic toilets can be further classified into three general categories depending on the design of the hydraulic channels used to achieve the flushing action. These categories are: non-jetted, rim-jetted, and direct-jetted.

In typical non jetted bowls, all of the flush water exits the tank into a bowl inlet area and flows through a primary manifold into the rim channel. The water is dispersed around the perimeter of the bowl via a series of holes positioned underneath the rim. Some of the holes may be designed to be larger in size to allow greater flow of water into the bowl. A relatively high flow rate is needed to spill water over the weir of the trapway rapidly enough to displace sufficient air in the down leg and initiate a siphon. Non-jetted bowls typically have adequate to good performance with respect to cleansing of the bowl and exchange of the pre-flush water, but are relatively poor in performance in terms of bulk removal. The feed of water to the trapway is inefficient and turbulent, which makes it more difficult to sufficiently fill the down leg of the trapway and initiate a strong siphon. Consequently, the trapway of a non-jetted toilet is typically smaller in diameter and contains bends and constrictions designed to impede flow of water. Without the smaller size, bends, and constrictions, a strong siphon would not be achieved. Unfortunately, the smaller size, bends, and constrictions result in poor performance in terms of bulk waste removal and frequent clogging, conditions that are extremely dissatisfying to end users.

Designers and engineers of toilets have improved the bulk waste removal of siphonic toilets by incorporating "siphon jets." In a rim-jetted toilet bowl, the flush water exits the tank, flows through the toilet inlet area and through the primary manifold into the rim channel. A portion of the water is dispersed around the perimeter of the bowl via a series of holes positioned underneath the rim. The remaining portion of water flows through a jet channel positioned at the front of the rim. This jet channel connects the rim channel to a jet opening positioned in the sump of the bowl. The jet opening is sized and positioned to send a powerful stream of water directly at the opening of the trapway. When water flows through the jet opening, it serves to fill the trapway more efficiently and rapidly than can be achieved in a non-jetted bowl. This more energetic and rapid flow of water to the trapway enables toilets to be designed with larger trapway diameters and fewer bends and constrictions, which, in turn, improves the performance in bulk waste removal relative to non jetted bowls. Although a smaller volume of water flows out of the rim of a rim jetted toilet, the bowl cleansing function is generally acceptable as the water that flows through the rim channel is pressurized by the upstream flow of water from the tank. This allows the water to exit the rim holes with higher energy and do a more effective job of cleansing the bowl.

Although rim jetted bowls are generally superior to non-jetted, the long pathway that the water must travel through the rim to the jet opening dissipates and wastes much of the available energy. Direct-jetted bowls improve on this concept and deliver even greater performance in terms of bulk removal of waste. Generally, in a direct-jetted bowl, the flush water exits the tank and flows through the bowl inlet and through the primary manifold. At this point, the water divides into two portions: a portion that flows through a rim inlet port to the rim channel with the primary purpose of achieving the desired bowl cleansing, and a portion that flows through a jet inlet port to a "direct-jet channel" that connects the primary manifold to a jet opening in the sump of the toilet bowl. The direct jet channel can take different forms, sometimes being unidirectional around one side of the toilet, or being "dual fed," wherein symmetrical channels travel down both sides connecting the manifold to the jet opening. As with the rim jetted bowls, the jet opening is sized and positioned to send a powerful stream of water directly at the opening of the trapway. When water flows through the jet opening, it serves to fill the trapway more efficiently and rapidly than can be achieved in a non jetted or rim jetted bowl. This more energetic and rapid flow of water to the trapway enables toilets to be designed with even larger trapway diameters and minimal bends and constrictions, which, in turn, improves the performance in bulk waste removal relative to non-jetted and rim-jetted bowls.

In addition to the types of toilets and their cleaning capability, there is pressure to use less water, making the cleaning function more difficult. Government agencies continually demand that municipal water users reduce the amount of water they use. Much of the focus in recent years has been to reduce the water demand required by toilet flushing operations. In order to illustrate this point, the amount of water used in a toilet for each flush has gradually been reduced by governmental agencies from 7 gallons/flush (prior to the 1950's), to 5.5 gallons/flush (by the end of the 1960's), to 3.5 gallons/flush (in the 1980's). The National Energy Policy Act of 1995 now mandates that toilets sold in the United States can use water in an amount of only 1.6 gallons/flush (6 liters/flush). Regulations have recently been passed in the State of California which require water usage to be lowered ever further to 1.28 gallons/flush. The 1.6 gallons/flush toilets currently described in the patent literature and available commercially lose the ability to consistently siphon when pushed to these lower levels of water consumption. Thus, manufacturers are being and will continue to be forced to reduce trapway diameters and sacrifice performance without development of improved technology and toilet designs.

Several inventions have thus been aimed at improving the flush performance of siphonic toilets through optimization of the direct jetted concept. For example, in U.S. Pat. No. 5,918,325, performance of a siphonic toilet is improved by improving the shape of the trapway. In U.S. Pat. No. 6,715,162, performance is improved by the use of a flush valve with a radiused inlet and asymmetrical flow of the water into the bowl.

U.S. Pat. No. 8,316,475 B2 demonstrates a pressurized rim and direct fed jet configuration for enhanced washing and adequate siphon for use with low volume water in accordance with current environmental water-use standards.

U.S. Patent Publication No. 2012/0198610 A1 shows a high performance toilet achieved by incorporating a control element in the area of the primary manifold to divide the flow of flush water entering the toilet manifold from the tank inlet into the inlet port of the rim and the inlet port of the direct-fed jet.

While the above concepts improve flush performance, and in some cases bowl cleaning as well, there are further attempts focused on improving bowl cleaning, such as that of co-pending Patent Application Publication No. 2013/0219605 A1, incorporated herein by reference, of the present applicant directed to a rimless bowl that provides enhanced cleaning without a traditional rim channel by directing all water either along an internal ledge from an inlet port or through the jet. Flow through the inlet port assists the washing function. The washing function is improved in this design.

Similarly, a toilet having a primed jet, and a rim flow path isolated from the jet flow path, as well as independent valves for the jet and rim flow paths is the subject of co-pending International Application No. PCT/US2013/069961 of the applicant herein in relevant part by reference with respect to the design and structure of the toilet, flush valves and valve backflow prevention structures therein. This application provides a toilet assembly that enables a strong flush and enhanced cleaning with very little water by minimizing air flow in the jet channel. This toilet may also be made in a rimless design with enhanced washing capability and can provide excellent cleaning.

While all improvements described above attempt to provide bowls that have strong flush capacity and good cleaning without having to clean overly much between flushing, there is still a need in the art for periodic manual cleaning of a toilet using a toilet bowl cleaning agent in the ordinary manner that consumers clean their toilet bowls. Toilet bowl brushes, gel cleaners, swaps, tablets and the like that are placed under the rim or in the tank directly or in a container are known.

Attempts have also been made to make such toilets "self-cleaning" by providing mechanisms for introduction of cleaning agent on a regular basis to work with each flush. Some such toilets have external systems that feed cleaning agent into the toilet bowl or into the rim using a controller or other external actuation mechanism. Others provide an internal reservoir with a cleaning agent or material, such as a tablet, that feeds slowly into the bowl with flush water through a tube within the overflow tube of a traditional flush valve. Programmable systems also exist that enable cleaning through the flush system.

U.S. Pat. Nos. 5,542,132, 5,608,923, 5,729,837, 5,867,844, and 5,913,611 are directed to use of a pump and controller that operates the flow of cleaning agent to the rim or bowl at a set timing and selected flow rate. In U.S. Pat. No. 5,729,837, a cleaning agent receptacle and pump are provided. The receptacle includes cleaning agent in fluid form that is pumped for cleaning after flushing into the rim directly after a flush cycle U.S. Pat. No. 6,321,392 describes placing a cleaning agent in a reservoir within the tank and above the water level. The reservoir receives fluid by conduit from the refill valve water after a flush and cleaning agent is then combined with water that passes out of the refill valve and into the toilet through the overflow tube of the flush valve. The overflow tube introduces the flush water at the base of the interior body of the flush valve. The cleaning agent is introduced with every flush.

U.S. Pat. No. 5,745,928 discloses a reservoir positioned in a toilet tank in communication with the flush and fill valves. After the flush cycle, water flows as a bypass from the flush valve, through the reservoir (which has cleaning agent such as cleaning pellets within the reservoir) and down into the toilet through the refill tube. The cleaning agent sits in the bowl for extra cleaning.

U.S. Pat. No. 6,772,450 includes a chemical injector system with a timer and controller that feeds chemical solution in through flexible, shaped tubing positioned in the bowl below rim outlet holes. The chemical agent is injected in a pressurized manner into the bowl down the side walls to clean the bowl.

U.S. Pat. No. 8,095,997 discloses a modular mounted dispenser for cleaning fluid or deodorant introduced in a controllable manner into the toilet either through the overflow tube or directly into the tank water. The controller can be responsive to a level sensor.

While all such improvements have been made, the continuous introduction of cleaning fluid that works in various prior art systems to introduce cleaning agent with repeated flushing or that allows cleaning agent to sit in the bowl has not been well received by consumers, either due to complex external systems which are hard to operate or fill and/or as a result of the overuse of cleaning agents in the flush water which can prove harmful in high concentrations to pets and children if ingested. Further, overuse of cleaning agents over time can cause damage to the internal parts within the toilet bowl such as rubber seals and the like. Finally, some of such systems are not aesthetically pleasing and have many external parts that are within plain site of the user.

There is a need in the art for a self-cleaning toilet that can operate upon demand to minimize the impact of cleaning agents in the toilet, is safer for use in homes with children and pets, and which is preferably portable and compact so that it is easy to seat and not visually undesirable. Further, there is a need in the art for such as system that provides easy dosing and replacement of cleaning agent and/or the actual cleaning system so that systems can be easily replaced, repaired and maintained by consumers without the need for special tools or a plumber.

BRIEF SUMMARY OF THE INVENTION

The invention includes a toilet assembly with a toilet and a cleaning system, a method for cleaning a toilet assembly with a toilet and such a cleaning system on a periodic basis at a user's initiation, as well as a cleaning system for use with a toilet assembly. The toilet in the assemblies herein is most preferably a toilet having an isolated rim path, although the system can be used with other types of toilets. The invention provides a self-cleaning toilet assembly. Unlike prior toilet assemblies with cleaning systems, the system does not automatically actuate with the flush cycle so that a user can clean the toilet upon his or her own actuation and upon need. In preferred embodiments, the system enables minimal exposure of humans and animals to standing cleaning agent in the flush water when not in use while providing excellent cleaning capability.

In one embodiment, the invention provides a toilet assembly with a cleaning system, comprising: (a) a toilet assembly comprising a toilet bowl defining an interior space, a toilet tank defining a tank interior, a flush valve, a rim inlet and an isolated rim flow path extending from an outlet of the flush valve to the rim inlet, wherein the flush valve is configured to deliver fluid to the rim inlet of the toilet bowl; and (b) a cleaning system comprising a reservoir for holding a liquid cleaning agent having a body defining an interior space and having an outlet port in fluid communication with the interior space of the reservoir body; a housing configured to receive the reservoir; a supply conduit in fluid communication with the interior of the reservoir and having a first end for receiving fluid from within the reservoir; a flow control device capable of controlling flow through the supply conduit; and a control system activatable by an actuator feature, wherein upon activation of the actuator feature, the control system is adapted to initiate a clean cycle by: operating the flow control device for a first period of time sufficient to deliver a dose of a liquid cleaning agent from the supply conduit to an interior space of the flush valve in a closed position, the flush valve configured for delivery of fluid to the rim inlet, and operating the flush valve to open the flush valve to introduce at least about 3 liters or more of flush water to carry the dose of a liquid cleaning agent through the rim inlet into the toilet bowl.

The assembly may further include a vent line within the cleaning system. If a vent line is provided, it is preferably configured to be in fluid communication with the interior of the reservoir and to have a first end situated to receive entrained air and/or liquid from within the reservoir and a second open end located at least above a height of a full liquid level in the reservoir.

The control system in the assembly cleaning system may also operate to at least partially close the flush valve after delivering the dose of a liquid cleaning agent and flush water through the rim inlet and into the toilet bowl. In addition the control system may operate the flush valve to deliver the dose of a liquid cleaning agent and flush water over a second period of time.

The reservoir body preferably has an outlet portion and the outlet port is located in the outlet portion. The housing may also have a seat portion configured to receive the outlet portion of the reservoir. The cleaning system may further comprise at least one peripheral seal so that the outlet portion of the reservoir fits within the seat portion of the housing in sealing engagement.

In an embodiment herein, the system may include a tube that defines a passage therethrough and has an upwardly extending first end and a second end. The first end is configured for directing fluid from the interior space of the reservoir through the passage in the tube and into the first end of the supply conduit, wherein the tube is located in the seat portion. A vent line as described above may be incorporated into the embodiment having a tube within the cleaning system. In such case, the seat portion may comprise a first opening for receiving the first end of the vent line and a second opening for receiving the first end of the supply conduit. The first end of the tube may be pointed. The first end of the supply conduit may preferably be situated within the second end of the tube when the reservoir is situated within the housing. The tube may also be situated within the seat portion so that when the outlet portion of the reservoir is in the seat portion of the seat, the tube extends through the outlet port of the reservoir and upward within the outlet portion of the reservoir. The tube may also comprise optional side opening(s) extending therethrough for fluid entering the upwardly extending end of the tube to flow into a bottom area of the outlet portion.

In an embodiment herein, the outlet port may optionally include a frangible seal capable of being penetrated by the upwardly extending end of the tube or a liquid supply valve fitting if a liquid supply valve is incorporated as described elsewhere herein. The bottom area of the outlet portion in this embodiment may be defined as an area below the frangible seal when the reservoir is fully seated within the housing, and wherein the upwardly extending end of the tube or liquid supply valve fitting passes through the frangible seal when the reservoir is fully seated within the housing.

The flow control device may be any of a mechanized valve, a peristaltic pump, a piston pump, a gear pump, or a gear motor. The outlet port of the reservoir may be covered by a frangible cover, such as, for example, a foil, a septum, a foil with a polymeric backing, or a membrane.

The toilet assembly may further comprise in one embodiment herein a tank lid having an upper surface and configured to be seated on top of the tank, wherein the upper surface of the tank lid is configured to receive the housing and includes an area configured to receive a seat portion of the housing. The tank lid may further comprise at least one opening, and preferably at least two openings, extending therethrough configured for receiving a lock mechanism. The lock mechanism may comprise at least one lock body having a first end and a second end. The second end may be configured for extending through the at least one opening(s). The lock mechanism in such embodiment further comprises a locking cap on the first end of the at least one lock body for releasably locking the lock mechanism to secure the tank lid. The lock body may be a locking rod and/or the lock mechanism may be a snap-fit or rotating quick-lock locking mechanism.

The tank may further have a cover configured to be positioned over the tank lid having an opening therein for accessing a panel having an actuator button thereon.

In such an embodiment, the tank lid may further comprise an actuator opening extending therethrough for allowing extension of at least a portion of a lift arm actuator assembly comprising at least one gear actuated by a lift arm actuator gear motor, wherein the at least one gear is capable of engaging a lift arm to move the lift arm, either by, for example, pivoting or rotation, to controllably open the rim flush valve, wherein the lift arm is in operable connection to the flush valve through a direct or indirect linkage. The lift arm may also be in operable connection with a flush handle, and the flush handle and lift arm connected so as to operate the flush valve during a conventional flush cycle upon depression of the flush handle and the lift arm actuator assembly is preferably arranged so as to operate the flush valve without depression of the flush handle by operation of the lift arm actuator gear motor and the at least one gear.

The cleaning system in the assembly preferably also includes a bottom tray configured to hold the reservoir and housing, and a top lid, wherein the bottom tray and top lid are configured to as to be positioned on a top of the toilet tank so that the top lid sits in place of a standard tank cover and the bottom tray sits within the interior of the tank above the flush valve.

The cleaning system in the assembly preferably includes a flush valve operation mechanism for controllably opening the flush valve in response to the actuator feature. The flush valve operation mechanism in one embodiment includes a gear motor activatable by the control system for operating the flow control device. The flush valve operation mechanism may optionally include a lift rod in communication with a linkage connected to a flapper lift mechanism seated around a valve body of the flush valve, the lift rod being mechanically actuated by the gear motor, and the gear motor being mechanically operative with a cam mechanism for moving the lift rod upon contact. The flush valve operation mechanism may also alternatively comprise a lift arm actuator assembly comprising at least one gear actuated by a lift arm actuator gear motor, wherein the at least one gear of the lift arm actuator assembly is capable of engaging the lift arm actuator assembly so as to move a portion of a lift arm in the lift arm actuator assembly so that the lift arm can controllably open the rim flush valve, wherein the lift arm is in operable connection to the rim flush valve through a direct or indirect linkage.

The cleaning system may further comprise a lift arm actuator assembly comprising a gear actuated by a lift arm actuator gear motor, wherein the at least one gear is capable of engaging the lift arm actuator assembly so as to rotate the lift arm so that it can controllably open the rim flush valve, wherein the lift arm is in operable connection to the rim flush valve through a direct or indirect linkage. Such an embodiment may further comprise a gear motor housing for enclosing the gear motor and mounting the at least one gear, the gear motor housing being configured so as to be positioned within a toilet tank. In one embodiment, the gear motor housing may further extend upwardly through at least one opening in the housing for the reservoir. Such a gear motor housing may have a mounting flange for securing the gear motor housing to the reservoir housing or to a tray configured to hold the reservoir and the reservoir housing.

The control system in the assembly may be further adapted to at least partially close the flush valve after delivering the flush water with the dose of a liquid cleaning agent and to open the flush valve again after a third period of time to purge an interior of a toilet bowl with at least about 3 l of new flush water at an end of the clean cycle. In such an embodiment, the toilet in the assembly may be configured so that the flush valve is a rim flush valve and the toilet further comprises a direct-fed jet, a jet flush valve and a separate jet flow path and the control system in the assembly may then also operate to open the jet flush valve to release at least about 0.5 l of flush water, and preferably at least about 1.0 l of flush water, to the jet path at about the same time the rim channel re-opens to introduce flush water to purge the toilet bowl.

In one embodiment of the toilet assembly above, the cleaning system may comprise a liquid supply valve positioned so as to be situated in fluid communication with the outlet port of the reservoir and in fluid communication with the supply conduit.

The reservoir body in such embodiment may have an outlet portion and the outlet port may be located in the outlet portion. Further, the housing may have a seat portion configured to receive the outlet portion of the reservoir when the reservoir is seated in the housing, wherein the liquid supply valve defines a liquid supply valve passage therethrough and the liquid supply valve has an first upper end for directing fluid from the interior space of the reservoir through the valve passage and into the first end of the supply conduit and the liquid supply valve has a second end.

In this embodiment, the assembly may also comprise a valve fitting in communication with the second end of the liquid supply valve for connecting the second end of the liquid supply valve to the first end of the supply conduit.

The assembly may also include various liquid supply valves such as one of an umbrella valve, a duckbill valve, a spring loaded valve, a rotating valve, a vented elastomeric valve, and a flap elastomeric valve, In another embodiment herein, liquid supply valve may include a comprise a first mechanized valve and a second mechanized valve, and the assembly may further comprise a dosing chamber configured to retain a dose of a liquid cleaning agent from within the interior space of the reservoir, the dosing chamber defining an interior space, having an inlet port and having an outlet port, wherein the inlet port of the dosing chamber is in fluid communication with an outlet port of the first mechanized valve and the outlet port of the dosing chamber is in fluid communication with an inlet of a second mechanized valve, and wherein an outlet of the second mechanized valve is in fluid communication with a first end of a supply conduit. The housing in such an embodiment may have a seat portion configured to receive the reservoir and the dosing chamber.

The control system in such an embodiment is preferably adapted to operate the flow control device by operating the first mechanized valve to load the interior space of the dosing chamber with a dose of a liquid cleaning agent, and then operating the second mechanized valve for the first period of time sufficient to deliver the dose of a liquid cleaning agent from the interior of the dosing chamber into the supply conduit and into an interior space of a closed flush valve configured for delivery of fluid to a rim inlet of a toilet bowl. The control system may operate the first mechanized valve to load the dose of a liquid cleaning agent prior to operating the second mechanized valve for the first period of time.

The reservoir and the dosing chamber may be aligned in this embodiment at an angle with respect to a transverse plane through the housing.

The toilet assembly of the invention preferably further includes a direct-fed jet, the flush valve is a rim flush valve and the toilet assembly further comprises a second flush valve operable for introducing flush water to the direct-fed jet in the toilet. The fluid path for the rim flush valve and the jet flush valve are separate from each other and the jet flush path preferably remains in a primed state before and after a flush cycle.

The second end of the supply conduit is also preferably in fluid communication with an interior of an overflow tube connected to the rim flush valve.

The actuator feature in the assembly herein may be a button positioned under a top lid and accessible through an opening in the top lid. The actuator feature may also be a button positioned on a top surface of the top lid. The actuator feature may also further be a button positioned on a side of the toilet tank.

The second end of the supply conduit may be positioned so as to deliver fluid into an interior of an overflow tube connected to the flush valve, and preferably to a rim flush valve. The second end of the supply conduit may also be positioned so as to introduce a dose of a liquid cleaning agent into a bottom of the flush valve, or to introduce a dose of a liquid cleaning agent into the toilet bowl through an opening in a rim flow path upstream of the rim inlet.

The invention also includes a method for periodically cleaning a toilet in a toilet assembly with a cleaning system, the method comprising providing a toilet assembly as described above and elsewhere herein, activating the control system by the actuator feature to initiate the clean cycle; operating the flow control device and opening it for the first period of time sufficient to deliver the dose of a liquid cleaning agent from the supply conduit to the interior space of a flush valve in a closed position; and operating the flush valve to open the flush valve and introduce at least about 3 liters of flush water along with the dose of a liquid cleaning agent through the rim inlet and into the toilet bowl.

The toilet assembly in the method preferably further includes a direct-fed jet, the flush valve is a rim flush valve and the toilet assembly further comprises a second flush valve operable for introducing flush water to the direct-fed jet in the toilet. The toilet assembly in the method preferably also has a fluid path for the rim flush valve is isolated from the jet flush valve. Preferably, in such an embodiment, the jet flush valve remains in a primed state before and after a flush cycle. The control system in the assembly provided in the method preferably operates to introduce the flush water and the dose of a liquid cleaning agent over the second period of time, and the method further comprises operating the flush valve to at least partially close the flush valve after introducing the flush water with the dose of a liquid cleaning agent; and operating the flush valve to open the flush valve again after a third period of time to purge the interior of a toilet bowl with new flush water at an end of the clean cycle.

The invention also includes a cleaning system for use with a toilet assembly, comprising a reservoir for holding a liquid cleaning agent having a body defining an interior space and having an outlet port in fluid communication with the interior space of the reservoir body; a housing configured to receive the reservoir; a supply conduit in fluid communication with the interior of the reservoir and having a first end for receiving fluid from within the reservoir; a flow control device capable of controlling flow through the supply conduit; and a control system activatable by an actuator feature, wherein upon activation of the actuator feature, the control system is adapted to initiate a clean cycle by: operating the flow control device for a first period of time sufficient to deliver a dose of a liquid cleaning agent from the supply conduit to an interior space of a closed flush valve configured for delivery of fluid to a rim inlet of a toilet bowl, and operating the flush valve to open the flush valve to introduce flush water with the dose of a liquid cleaning agent into a rim inlet of a toilet bowl.

In the cleaning system herein, an optional vent line may be provided in fluid communication with the interior of the reservoir and configured to have a first end situated to receive entrained air and/or liquid from within the reservoir and a second open end located at least above a height of a full liquid level in the reservoir.

The control system may be adapted so as to introduce flush water and a liquid cleaning agent over a second period of time, and operate further to at least partially close the flush valve after delivering the flush water and the dose of a liquid cleaning agent.

The reservoir body preferably has an outlet portion and the outlet port is located in the outlet portion. The housing may have a seat portion configured to receive the outlet portion of the reservoir.

The system may further comprise at least one peripheral seal so that the outlet portion of the reservoir fits within the seat portion of the housing in sealing engagement.

In one embodiment, the system may include a tube defining a passage therethrough and having an upwardly extending first end and a second end, the first end for directing fluid from the interior space of the reservoir through the passage in the tube and into the first end of the supply conduit, wherein the tube is located in the seat portion and the seat portion may have a second opening for receiving the first end of the supply conduit. The first end of the tube may be pointed. The first end of the supply conduit may be situated within the second end of the tube when the reservoir is situated within the housing. The tube may be situated within the seat portion so that when the outlet portion of the reservoir is in the seat portion of the seat, the tube extends through the outlet port of the reservoir and upward within the outlet portion of the reservoir. The tube may also comprise optional side opening(s) extending therethrough for fluid entering the upwardly extending end of the tube to flow into a bottom area of the outlet portion. In an embodiment having a tube, the system may also further comprise an optional vent line in fluid communication with the interior of the reservoir and configured to have a first end situated to receive entrained air and/or liquid from within the reservoir and a second open end located at least above a height of a full liquid level in the reservoir, in which case, the seat portion may also comprise a first opening for receiving the first end of the vent line The outlet port in the cleaning system may have a frangible seal capable of being penetrated by the upwardly extending end of the tube or a liquid supply valve fitting, wherein the bottom area of the outlet portion is defined as an area below the frangible seal when the reservoir is fully seated within the housing, and wherein the upwardly extending end of the tube or the liquid supply valve fitting passes through the frangible seal when the reservoir is fully seated within the housing.

The flow control device in the system may be a mechanized valve, a peristaltic pump, a piston pump, a gear pump or a gear motor. The cleaning system flow control device may also comprise a gear motor activatable by the control system for operating the flow control device.

The outlet port of the reservoir in the cleaning system herein may be covered by a frangible cover. The frangible cover may comprise a foil, a septum, a foil having a polymeric-backing or a membrane.

The cleaning system may also comprise a flush valve operation mechanism. In one embodiment the mechanism may include a lift rod in communication with a linkage connected to a flapper lift mechanism seated around a valve body of the flush valve, the lift rod being mechanically actuated by the gear motor, and the gear motor being mechanically operative with a cam mechanism for moving the lift rod upon contact. The flush valve operation mechanism may also alternatively comprise a lift arm actuator assembly comprising at least one gear actuated by a lift arm actuator gear motor, wherein the at least one gear is capable of engaging the lift arm actuator assembly so as to move a lift arm in the lift arm assembly so that the lift arm can controllably open the rim flush valve, wherein the lift arm is in operable connection to the rim flush valve through a direct or indirect linkage. Such an embodiment may also include a gear motor housing for enclosing the gear motor and mounting the at least one gear, and the gear motor housing may be configured so as to be positioned within a toilet tank and to extend upwardly through at least one opening in the housing for the reservoir. The housing in the assembly may further include a mounting flange for securing the gear motor housing to the reservoir housing or to a tray configured to hold the reservoir and the reservoir housing.

The cleaning system may further comprise a bottom tray configured to hold the reservoir and housing, and a top lid, wherein the bottom tray and top lid are configured to as to be positioned on a top of a toilet tank so that the top lid sits in place of a standard tank cover and the bottom tray sits within an interior of a toilet tank above a toilet flush valve.

The control system, for example, using a flush valve operation mechanism, may be further adapted to at least partially close the flush valve after delivering the dose of a liquid cleaning agent and to open the flush valve again after a third period of time to purge an interior of a toilet bowl with new flush water at an end of the clean cycle.

The invention also includes a toilet assembly having a cleaning system, comprising: (a) a toilet assembly comprising a toilet bowl defining an interior space, a toilet tank defining a tank interior, a flush valve, a rim in fluid communication with the interior of the bowl through a rim flow path extending from an outlet of the flush valve to at least one rim outlet port, wherein the flush valve is configured to deliver fluid to the rim and wherein the flush valve is configured to operate in a flush actuation mode wherein the flush valve is able to provide flush water flow sufficient for the toilet assembly to initiate a flush siphon or provide a wash down flush and to operate in a cleaning actuation mode wherein the flush valve is only partially opened to allow for introduction of a cleaning agent and flush water mixture to the bowl that is insufficient to initiate a siphon but sufficient for cleaning the bowl; and (b) a cleaning system comprising a reservoir for holding a liquid cleaning agent having a body defining an interior space and having an outlet port in fluid communication with the interior space of the reservoir body; a housing configured to receive the reservoir; a supply conduit in fluid communication with the interior of the reservoir and having a first end for receiving fluid from within the reservoir; a flow control device capable of controlling flow through the supply conduit; and a control system activatable by an actuator feature, wherein upon activation of the actuator feature, the control system is adapted to initiate a clean cycle by: operating the flow control device for a first period of time sufficient to deliver a dose of a liquid cleaning agent from the reservoir to one or more rim outlets, and operating the flush valve in a cleaning actuation mode to open the flush valve so as to introduce flush water to carry the dose of a liquid cleaning agent through the at least one rim outlet port into the toilet bowl at a flow rate insufficient to initiate a siphon but sufficient for cleaning the bowl.

In the above-embodiment, the flush valve may introduce flush water at a flow rate that is about 20% to about 80% slower in the cleaning actuation mode than the flow rate through the flush valve during a normal flush mode, and preferably about 40% to about 60% slower in the cleaning actuation mode than the flow rate through the flush valve during the normal flush mode. In addition, flush water may enter the valve in a flush actuation mode over a period of about 2 s to about 30 s. Flush water and cleaning agent may be introduced into the bowl and have a residence time of about 30 s to about 30 min. for cleaning the bowl.

In one particular embodiment of this assembly, the bowl may be a direct-fed jet, siphonic, gravity-powered bowl. The bowl may alternatively be a rim-fed jetted siphonic bowl, a non-jetted siphonic gravity-powered bowl or a gravity-powered wash-down bowl.

Further, in an alternative embodiment of this assembly, the flush valve may be a flapper-type flush valve with a poppet feature in the valve cover for use in opening the valve during the cleaning actuation mode. Alternatively, the flush valve may be a flapper-type flush valve with a hook and catch feature for use in opening the valve during the cleaning actuation mode. In yet another embodiment, the flush valve may be a poppet-type flush valve, wherein a poppet-type valve cover opens the flush valve in a normal flush mode and the flush valve has a side port having a cover thereon for use in opening the valve during the cleaning actuation mode.

Such a toilet assembly embodiment may also be used in a method for periodically cleaning a toilet in a toilet assembly with a cleaning system. The method comprises providing a toilet assembly as noted above, which may be used on various conventional toilet assembly configurations; activating the control system by the actuator feature to initiate the clean cycle; operating the flow control device and opening it for the first period of time sufficient to deliver at least one dose of a liquid cleaning agent from the supply conduit to an interior space of a flush valve in a closed position; and operating the flush valve to open the flush valve to introduce flush water along with the at least one dose of a liquid cleaning agent through the at least one rim outlet port into the toilet bowl at a flow rate insufficient to initiate a siphon but sufficient for cleaning a toilet bowl in a toilet assembly.

A further embodiment of the invention based on the above-noted embodiment suitable for use in various conventional toilet designs includes a cleaning system for use with a toilet assembly, comprising a reservoir for holding a liquid cleaning agent having a body defining an interior space and having an outlet port in fluid communication with the interior space of the reservoir body; a housing configured to receive the reservoir; a supply conduit in fluid communication with the interior of the reservoir and having a first end for receiving fluid from within the reservoir; a flow control device capable of controlling flow through the supply conduit; and a control system activatable by an actuator feature, wherein upon activation of the actuator feature, the control system is adapted to initiate a clean cycle by: operating the flow control device for a first period of time sufficient to deliver a dose of a liquid cleaning agent from the reservoir to one or more rim outlets of a toilet assembly, and operating a flush valve in a toilet assembly in a cleaning actuation mode to open a flush valve in a toilet assembly so as to introduce flush water to carry the dose of a liquid cleaning agent through at least one rim outlet port of a toilet assembly into a toilet bowl of a toilet assembly at a flow rate insufficient to initiate a siphon but sufficient for cleaning a toilet bowl in a toilet assembly.

Such a cleaning system may be used in a non-jetted, siphonic, gravity-powered bowl, a rim-jetted, siphonic, gravity powered bowl, or a gravity-powered, wash-down bowl. The control system may operate a flush valve in a toilet assembly that is a flapper-type flush valve with a poppet feature in the valve cover for use in opening the valve during the cleaning actuation mode. It may also operate a flush valve in a toilet assembly that is a flapper-type flush valve with a hook and catch feature for use in opening the valve during the cleaning actuation mode. It may further operate a flush valve in a toilet assembly that is a poppet-type flush valve, wherein a poppet-type valve cover opens the flush valve in a normal flush mode and the flush valve has a side port having a cover thereon for use in opening the valve during the cleaning actuation mode.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
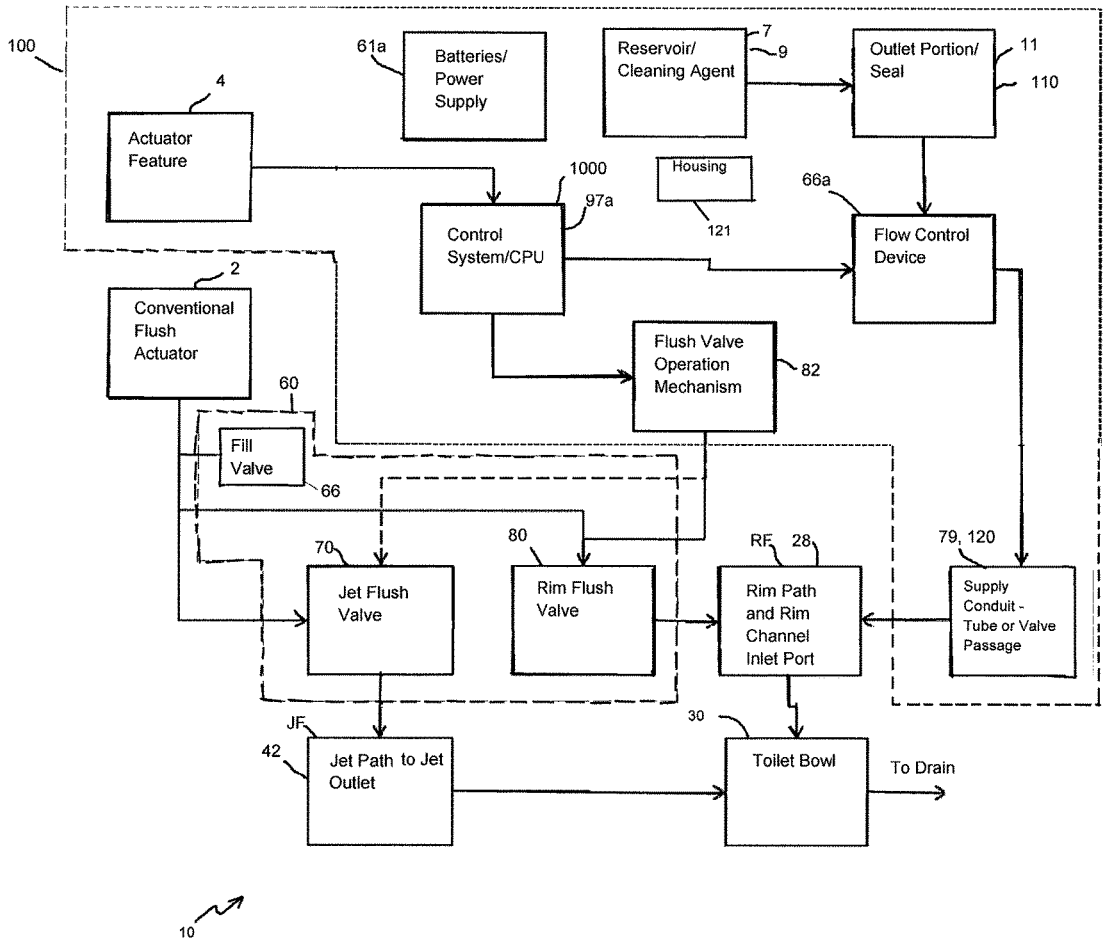
FIG. 1 is a schematic flow diagram of a cleaning system for a toilet assembly according to an embodiment of the invention.

The invention includes a toilet assembly including a toilet and various embodiments of a cleaning system for use with the in the toilet assembly as described herein as well as a method for periodically cleaning a toilet using such a cleaning system. The cleaning systems herein provide a clean cycle, which may be actuated by a user at any time the user wants to clean the toilet. The clean system operates outside the conventional flush cycle and automatically shuts down after cleaning so that upon subsequent use of the toilet, the toilet will flush in the normal manner. Liquid cleaning agents are thus delivered only during the clean cycle and not with every flush cycle. The clean cycle can also include a purge step to remove the cleaning agent from the bowl to the drain line. Such a clean cycle thus does not overuse cleaning agents or leave them sitting in the bowl between cleaning, making it safer for the environment and friendly to pets and children who may be otherwise harmed by toxic cleaning agents in flush water. The system can be set to leave the cleaning fluid in the bowl for one or more desired and/or pre-set period(s) of time before activating a "purge" or "rinse" cycle.

In one embodiment, the system can provide the option of providing a small or intermittent dosage of cleaning fluid with each flush as a user selection. This can be done as an alternative option programmed into the PLC, or more preferably by various other options available to one skilled in the art, for example, using the flush in an automatic mode so that a small dose can be added before the valves are opened. While this increases power use on the system, battery capacity can be increased or an electric connection such as AC current can be provided.

Alternatively, a timer may be employed to add a small dose on a regular set interval, such that when a subsequent manual flush is actuated, after the additional material is introduced, the manual flush water would wash the smaller amount of cleaning agent into the bowl. In addition to the timer mechanism, a sensor may be provided to alert the system when the manual flush cycle is activated so as to avoid addition of several timed doses of cleaning agent without an intermittent flush.

As used herein, words such as "inner" and "outer," "upper" and "lower," "forward" and "backward," "front" and "back," "left" and "right," "upward" and "downward" and words of similar import are intended to assist in understanding the preferred embodiment of the invention with reference to the accompanying drawing Figures and with respect to the orientation of the toilet assembly as shown in the Figures, and are not intended to be limiting to the scope of the invention or to limit the invention scope to the preferred embodiment as shown in the Figures. The embodiments 10, 200, 300, 400, 500, 700, 800, 900, 1200, 1300, 1400, 1500, 1600, 1700, 1800 and 1900 herein each use like reference numbers to refer to analogous features of the invention as described herein and as shown in the drawings, such that absent language to the contrary describing an alternative configuration for a particular feature, one skilled in the art would understand based on this disclosure and the drawings attached hereto that description of one such feature is applicable in another embodiment describing an analogous feature unless otherwise specified.

With reference to FIGS. 1-4 and 6-27, a preferred assembly 10 having a toilet 30 and cleaning system 100 is described for use in the toilet assembly with cleaning system assembly herein. The preferred toilet assembly 10 in this embodiment and cleaning system 100 are operable in the configuration as shown, but it should be understood based on this disclosure that the cleaning system may be adapted and programmed for a variety of toilets. This is discussed further below in embodiments 1600, 1700 and 1800. While gravity-powered siphonic flush toilets are preferred, whether single or multi-flush models, wash-down toilets can also be used in the cleaning systems herein with some modification or adaptation as described in further detail in embodiments 1600, 1700 and 1800 below. A most preferred toilet for this embodiment is one with an isolated rim flow path as described in detail herein. As shown in FIGS. 2, 8, 9 and 16, the preferred toilet has two independent flush valves, a rim flush valve 80 and a jet flush valve 70. The rim flush valve 80 has an overflow tube 190 that serves to direct water from the tank to the rim or rim channel when the level of water in the tank exceeds the height of the overflow tube. The fill valve 66 refills the tank after a flush cycle or cleaning cycle. It also has a conduit 138 for providing water to the bowl through the overflow tube 190 when a flush cycle is ended and the bowl needs to be refilled to restore the seal depth against backflow of sewer gases.

The preferred toilet assembly described herein operates effectively in view of the desire to avoid formation of a siphon (or otherwise reduce the percentage of cleaning fluid that would exit to the drain line before the "hold" period) during the cleaning cycle, as it is a design which keeps the rim and jet paths separate. One such toilet is described by the applicant herein in co-pending International Patent Application Publication No. WO 2014/078461, which describes the features and operation of such toilet and its flush valves, including the flush valve designs having a peel-back flapper feature, various backflow prevention mechanisms, use of internal valve web structures and double chain mechanisms useful so as to fully lift or peel-back the valve covers for controlled operation, and to the extent of the description of the toilet and such flush valve features, and their operation, is incorporated herein by reference.

The toilet assembly 10 has a toilet bowl 30 as described in International Patent Application Publication No. WO 2014/078461 and further hereinbelow. The assembly includes toilet bowl 30 defining an interior area 36, a toilet tank 60 defining a tank interior 119, a flush valve 80 and a rim inlet port 28. The flush valve 80 is preferably configured to deliver fluid to the rim inlet port 28 of the toilet bowl 30, which in the case of a toilet having an isolated rim and jet path and separate rim and jet flush valves as described herein, may incorporate a rim inlet port 28 to the bowl through a conventional series of rim outlet ports from a rim channel around the bowl in a rim-containing embodiment, or as described hereinbelow, through a single side rim inlet port 28 that injects rim flow water from the rim flow path out of the rim flush valve 80 directly into the side of a rimless toilet bowl embodiment for extra cleaning action. The cleaning system used in the toilet assembly may be any of those used in embodiments noted herein 10, 200, 300, 400, 500, 700, 800, 900, 1200, 1300, 1400, 1500 or 1900.

The toilet assembly 10 preferably includes a direct-fed jet 20, a rim flush valve 80 and a second jet flush valve 70 operable for introducing flush water to the direct-fed jet 20 in the toilet. The fluid path RF for the rim flush valve 80 and the jet fluid path JF for the jet flush valve 70 are kept separate from each other in this embodiment. In the clean cycle, the jet flush valve 70 remains closed and, preferably and optionally, the jet fluid path is maintained in a primed state before and after the clean cycle and before a flush cycle in ordinary flush operation. However, if a purge step is added, the jet flush valve may be also opened during the purge step to release a quantity of additional water as described above.

The second end of the supply conduit in this embodiment is in fluid communication with an interior of the overflow tube 190 that is connected to the rim flush valve 80. While separate rim and jet tank compartments may be used with separate fill valves, separate flush actuation mechanisms and separate overflow tubes as described in International Application Publication No. WO 2014/078461, an embodiment with an open tank, a single flush actuator that can operate both flush valves and a single overflow tube on the rim flush valve is preferred. However, based on the disclosure herein, it will be understood to one skilled in the art that multiple compartments and/or one or more flush valves and associated mechanisms may be used with the clean system herein without departing from the spirit or scope of the invention.

The rim flush valve 80 may be fitted with or work in conjunction with a flush valve operation mechanism 82, such as a flapper lift rod lift mechanism 82*a* using a lift rod as described further below in communication with a linkage and connected to a flapper lift mechanism also as described below or by using one or more various lift arm actuator assemblies 140.

The flapper lift mechanism is positioned on or around a valve body of the rim flush valve and the lift mechanism upon mechanical actuation by a gear motor when actuated by the control system, can lift and manually operate the rim flush valve during the clean cycle and/or a flush cycle. In a conventional flush cycle, the rim and jet flush valves are preferably operated by a flush actuator as described herein. The flush handle may be part of the flush valve operation mechanism 82 as described for example in this embodiment 10 as well as embodiments 500 and 1900 to open the rim flush valve. Or the flush valve operation mechanism 82 may be a form of mechanized flapper lift mechanism with a lift rod as in the embodiment 400. Various flush operation mechanisms may operate by a gear motor activatable by the control system for operating the flush valve. A flow control device for metering of solution, using a gear pump and/or gear motor, a peristaltic pump, a rotating device and the like which operate, for example, a mechanized or other liquid supply valve, may also be incorporated in the cleaning system for use with the toilet bowl described herein in the toilet assembly of the invention. All other aspects of the various embodiments of the cleaning system described herein may be incorporated in the assemblies herein.

The siphonic flush toilet assembly preferred herein maintains a primed closed jet fluid pathway including a jet channel by isolating the fluid flow introduced into the bowl assembly so as to deliver different fluid volumes from a jet flush valve and a rim flush valve, preferably through separate jet path and rim path inlets. This provides a more powerful performance in comparison to more traditional, gravity-flush siphonic toilets that operate with air-filled jet channels and must expel the air to minimize turbulence and flow restriction, and also as a result, the preferred primed closed jet fluid pathway and isolated rim path contribute to a better cleaning action and clean cycle.

The toilet bowl assembly 10 of the present embodiment may incorporate an optional jet manifold for receiving fluid from the jet valve outlet and delivering the fluid from the jet valve outlet to a jet inlet port and into a jet channel. However, because the jet path is closed, use of an additional manifold area is not necessary. The closed jet fluid path maintains the jet channel in a perpetually primed state, and isolates it from entry of air into the channel. This is accomplished by (1) isolating the jet channel from the rim channel, (2) closing the jet channel flush valve in a standard flush cycle before the level of water in the tank falls to the level of the opening of the flush valve, (3) preventing air flow from entering the jet channel(s) and any optional jet manifold, which in one embodiment may include establishing a seal depth in a jet trap in the sump area to assist in blocking air from entering the jet channel outlet and/or (4) configuring and operating the assembly to ensure that the water level in the jet trap does not fall to a level that enables air to travel back up and into the jet channel when the siphon breaks.

In general, the ratio of the volume of fluid to the rim inlet port of the toilet to the volume of fluid to the jet path also affects toilet performance. In conventional, siphonic-jetted toilets, about 70% of the flush water is required to power the jet and initiate the siphon, leaving only about 30% to cleanse the bowl through the rim function. In the preferred primed toilet used in the assemblies herein, much less water is required to initiate the siphon, which allows more water to be used in cleaning the bowl. Applicants have determined that more than about 50% or more of the flush water can be directed to the rim inlet port for significant improvement in bowl cleaning. In preferred embodiments, more than about 65% and in some instances more than about 70% of the water can be directed to the rim function.

In addition to the above-noted factors, another method for maintaining a sufficient seal depth of water in the sump area and/or for preventing backflow of air into the jet channels from the sump is to maintain a slower flow of water through and from the jet channels while the siphon is breaking in a normal flush operation outside of the clean cycle. For example, to initiate the siphon when the sump is empty, flow through and from the jet channel outlet port should be above about 175 ml/s, traveling at a velocity of about 23.4 cm/s for a typical jet outlet port of about 747 $mm^2$. This figure may be adjusted for variations in jet outlet port dimensions and may be as high as 1100 ml/s or more for certain embodiments. The flow should occur for about 0.1 seconds to about 5 seconds. To generate the siphon for flushing in a trapway while still maintaining sufficient depth in the sump area and/or keeping air from entering the jet outlet port, the flow rate through the jet channel should be about 950 ml/s or more up to about 1500 ml/s at a velocity of about 127 cm/s or more for the same jet port outlet size and for a trapway having an average diameter of about 2.125 in. Flow should continue until the siphon has ended and the level of water in the sump stabilized, generally for about 1 second to about 5 seconds.

Controlling such flush valve actuation for the jet flush valve and the rim flush valve can be done in a number of ways in the various embodiments herein. One way is through the use of electromagnetic valves, as disclosed and described in U.S. Patent Application Publication No. 2009/0313750 A1 and U.S. Pat. No. 6,823,535, which are incorporated herein by reference in relevant part. The valve control method can also be accomplished through purely mechanical methods, such as by modifications to dual inlet flush valves like those disclosed in U.S. Pat. No. 6,704,945, also incorporated herein by reference in relevant part. Alternatively, a flush actuation arm or bar balanced for optimal performance of the two flush valves in sequence as shown in co-pending International Patent Application Publication No. PCT/US2014/278461 and its related filings may be used. Such mechanisms may or may not require adjustment to operate effectively with the automatic flush valve operation mechanism in place to compensate for the weight of the mechanism or to adjust to its operating parts.

Sufficient post-flush depth in the sump area and/or stopping water from entering the closed jet fluid pathway through the jet outlet port can also be achieved by maintaining flow of water to a rim shelf in a rimless toilet as shown herein while the siphon is breaking. As the toilet system described herein includes separate channels and valve mechanisms for controlling flow to the rim and jet, the system can be designed to continue flow through the rim inlet port during the siphon break. The flow of water to the rim inlet port is preferably sufficient to maintain the level of water in the sump area above the height of the jet outlet port, yet insufficient to maintain the siphon in the trapway. In this manner, added security can be provided for maintaining the jet channel free of air, reducing the dependence on a seal depth in the sump area. It should be noted that the flow through the jet and rim can also be utilized together to maintain sufficient post-flush depth in the sump area.

A related area in which the present assembly incorporating a cleaning system and a toilet working together provide an improvement over the prior art is in high-efficiency, siphonic toilets with flush volumes below 6.0 liters, preferably below 4.8 liters and in some cases below 2.0 l. The embodiments of the toilet bowl assembly of the present invention herein described are able to maintain resistance to clogging consistent with today's toilets having no greater than about 6.0 liters/flush in a single flush toilet or dual-flush toilet assembly while still delivering superior bowl cleanliness at reduced water usages. As much less water is required through the jet channel to initiate the siphon, the primed toilet assembly embodiments herein enable production of ultra-high efficiency toilets that can function up to no greater than about 4.8 liters per flush, and preferably can function at or below about 3.0 liters per flush and as low as about 2.0 liters per flush.

Moreover, a further, related area in which the present invention provides an improvement over the prior art is when used with siphonic toilets having larger trapways. By altering the size of the trapway, water consumption and toilet performance can be significantly affected. In the present invention, the toilet bowl assembly herein is able to stay primed in siphonic toilets of various trapway sizes and volumes because of the reduction in turbulence and restriction to flow achieved through the closed jet fluid pathway that is primed along the jet path, which permits the toilet bowl assembly to maintain excellent flushing and cleansing capabilities.

FIGS. 1-27 show a first assembly embodiment 10 with a toilet bowl 30 and the cleaning system herein to form a toilet bowl assembly 10 including any of the cleaning systems of this embodiment or embodiments 200, 300, 400, 500, 700, 800, 900, 1200, 1300, 1400, 1500 or 1900 herein. The toilet includes at least one jet flush valve assembly 70 having a jet flush valve inlet 71 and a jet flush valve outlet 13. The jet flush valve assembly may have a variety of configurations and may be any suitable flush valve assembly known or to be developed in the art. Preferably, it is configured to be similar to that described in co-pending U.S. Patent Application Publication No. 2014/0090158 A1, incorporated herein in relevant part by reference for description of such valves and the use of a weighted cover. As shown, the jet flush valve assembly 70 has a shorter valve height profile than the rim flush valve assembly 80, for controlling flow through the jet flush valve assembly. Each of the rim flush valve assembly 80 and the jet flush valve assembly 70 has a respective cover 105, 15. An optional float 17 may be attached thereto via a chain or other linkage. As described in co-pending U.S. Patent Publication No. 2014/0090158 A1, such features help provide advanced performance and control of buoyancy in the particular flush valve design. However, it should be understood that other flush valve assemblies can be used operating on the principles of the invention and provide improved flushing capability. Further, such floats are entirely optional.

Figure 2:
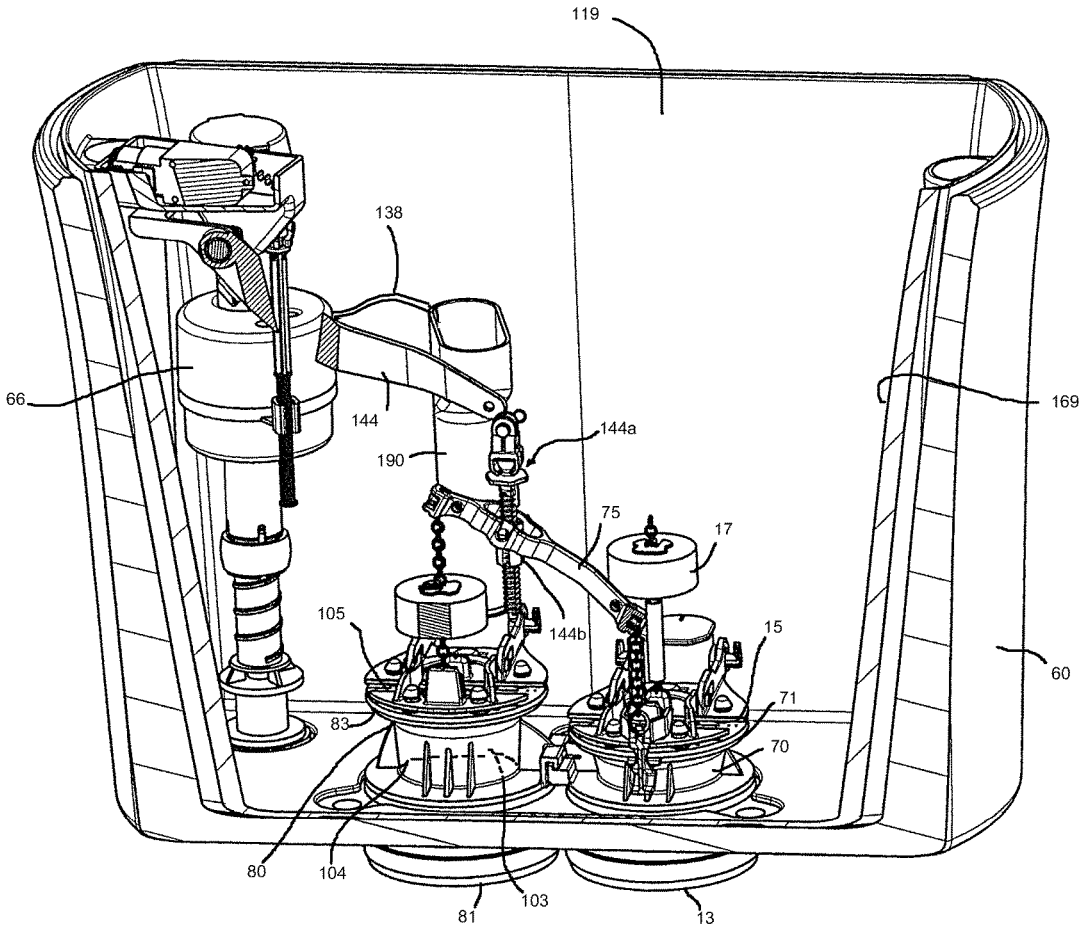
FIG. 2 is a perspective view of the interior of a toilet tank having flush valves for use with a cleaning system according to an embodiment of the invention and as part of a toilet assembly herein.
Figure 3:
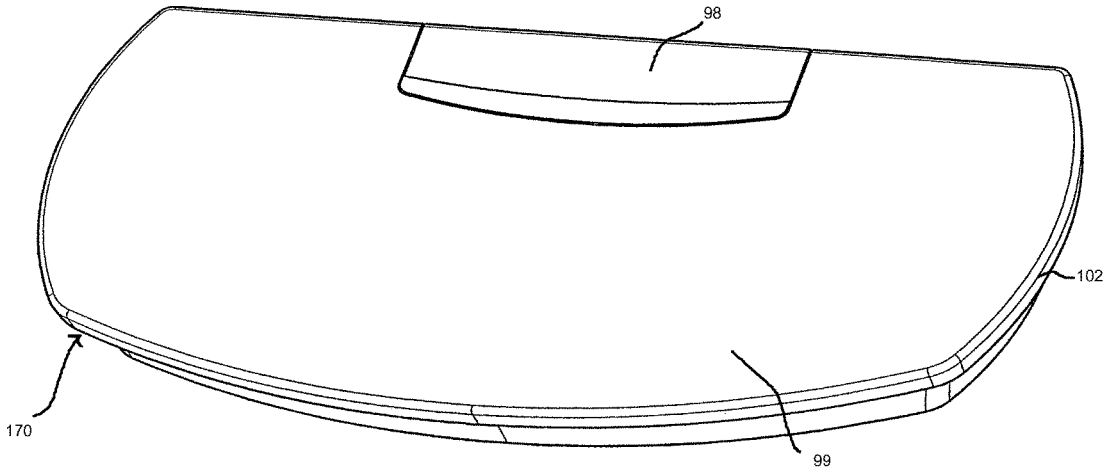
FIG. 3 is a perspective view of a cleaning system tank lid assembly according to an embodiment of the invention.
Figure 3A:
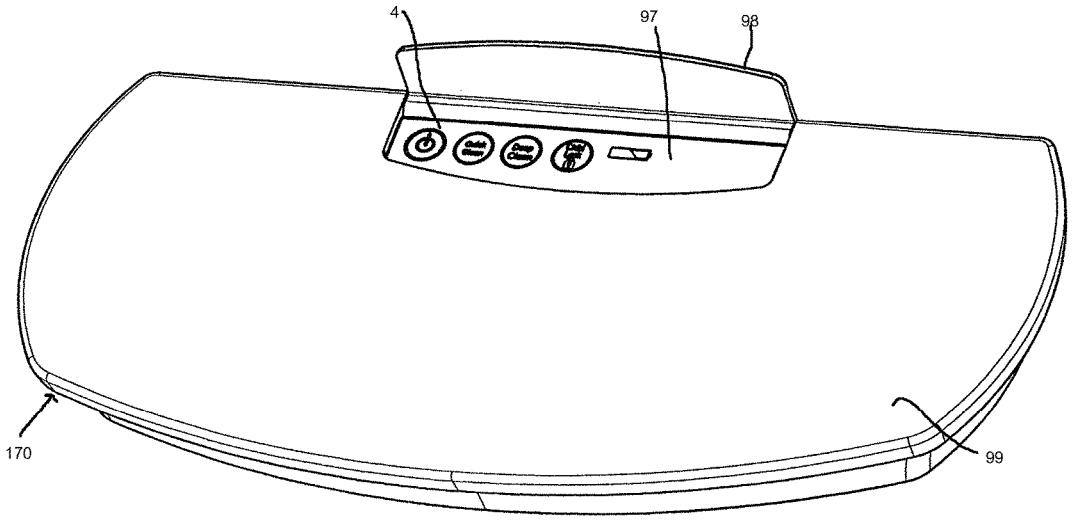
FIG. 3A is a perspective view of the cleaning system tank lid assembly of FIG. 3 with the control panel open
Figure 8:
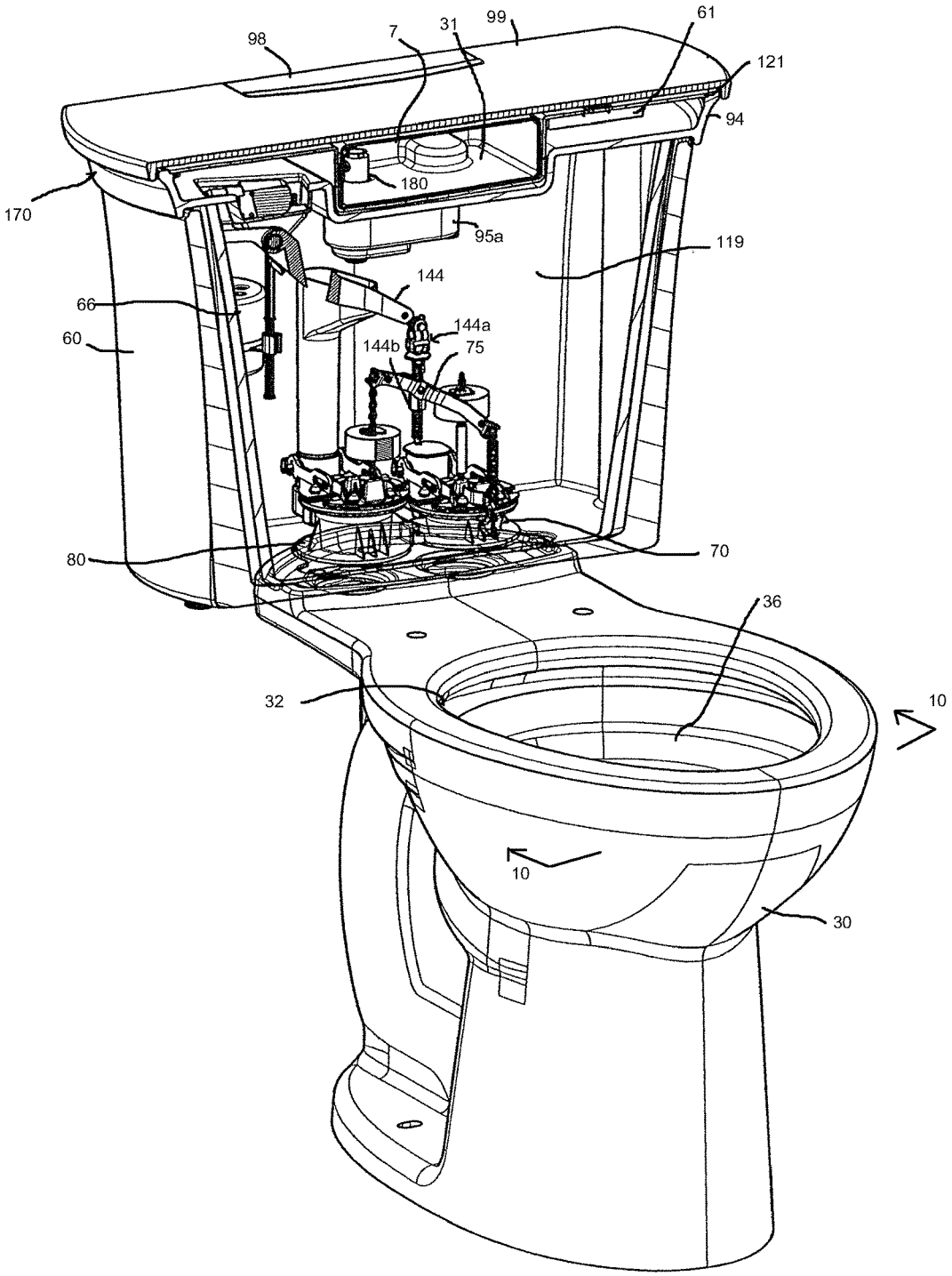
FIG. 8 is a perspective view of a toilet bowl assembly according to one embodiment of the invention showing an interior of the tank having rim and jet flush valve assemblies.
Figure 9:
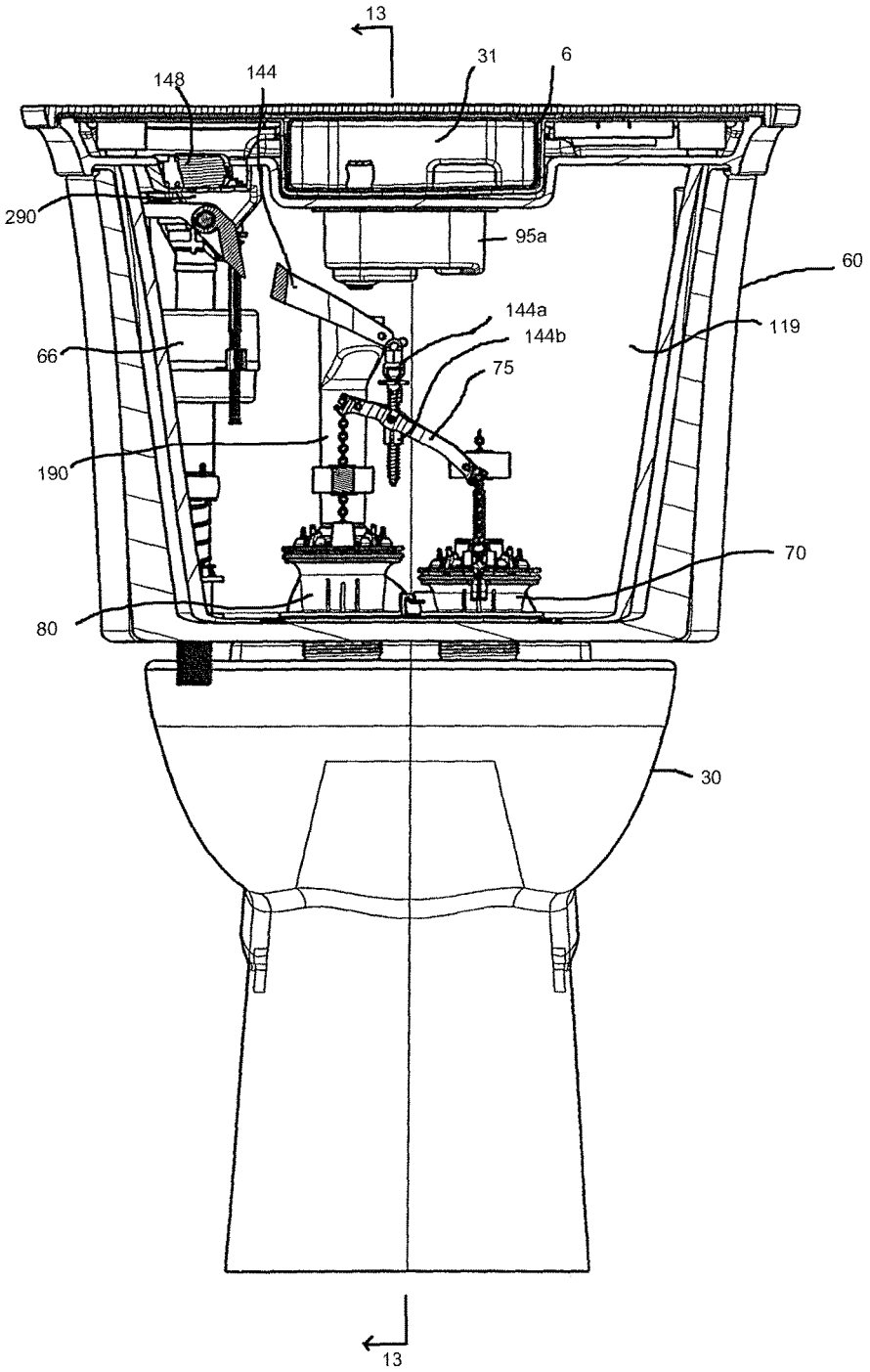
FIG. 9 is a front elevational view of the toilet bowl assembly of FIG. 8 showing the interior of the tank.

The jet flush valve assembly 70 delivers fluid from its jet flush valve outlet 13 to a closed jet fluid pathway 1. The closed jet fluid pathway 1 includes the jet channel 38 and, optionally it may include an optional jet manifold 12 as shown for example in FIG. 10. Such manifold may be omitted without altering operation. At least one rim flush valve assembly, such as flush valve assembly 80 in FIGS. 2, 8 and 9 is also provided. Each rim valve assembly has a rim flush valve inlet 83 and a rim flush valve outlet 81, the rim flush valve 80 may be any suitable flush valve assembly as noted above so long as it is configured for delivery of fluid from the outlet 81 of the rim flush valve 80 directly or indirectly to a rim inlet port 28.

In the embodiment shown, the rim 32 is of a "rimless" design in that fluid is introduced into the bowl 30 through a rim inlet port 28 and travels along a contour or geometric feature(s) formed into the interior surface 39 of the bowl 30. That is, the contour may be one or more shelf(s) 27 or similar features formed along an upper perimeter portion 33 of the bowl 30. The shelf(s) also referred to herein as a rim shelf 27 extend generally transversely along the interior surface 39 of the bowl 30 in an upper perimeter portion 33 thereof from the rim inlet port 28 at least partially around the bowl. The toilet bowl 30 may be of a variety of shapes and configurations and may have a variety of toilet seat lids and/or lid hinge assemblies. As toilet seat lids are optional, they are not shown in the drawings, but any suitable lid known or to be developed may be used with the invention.

Figure 10:
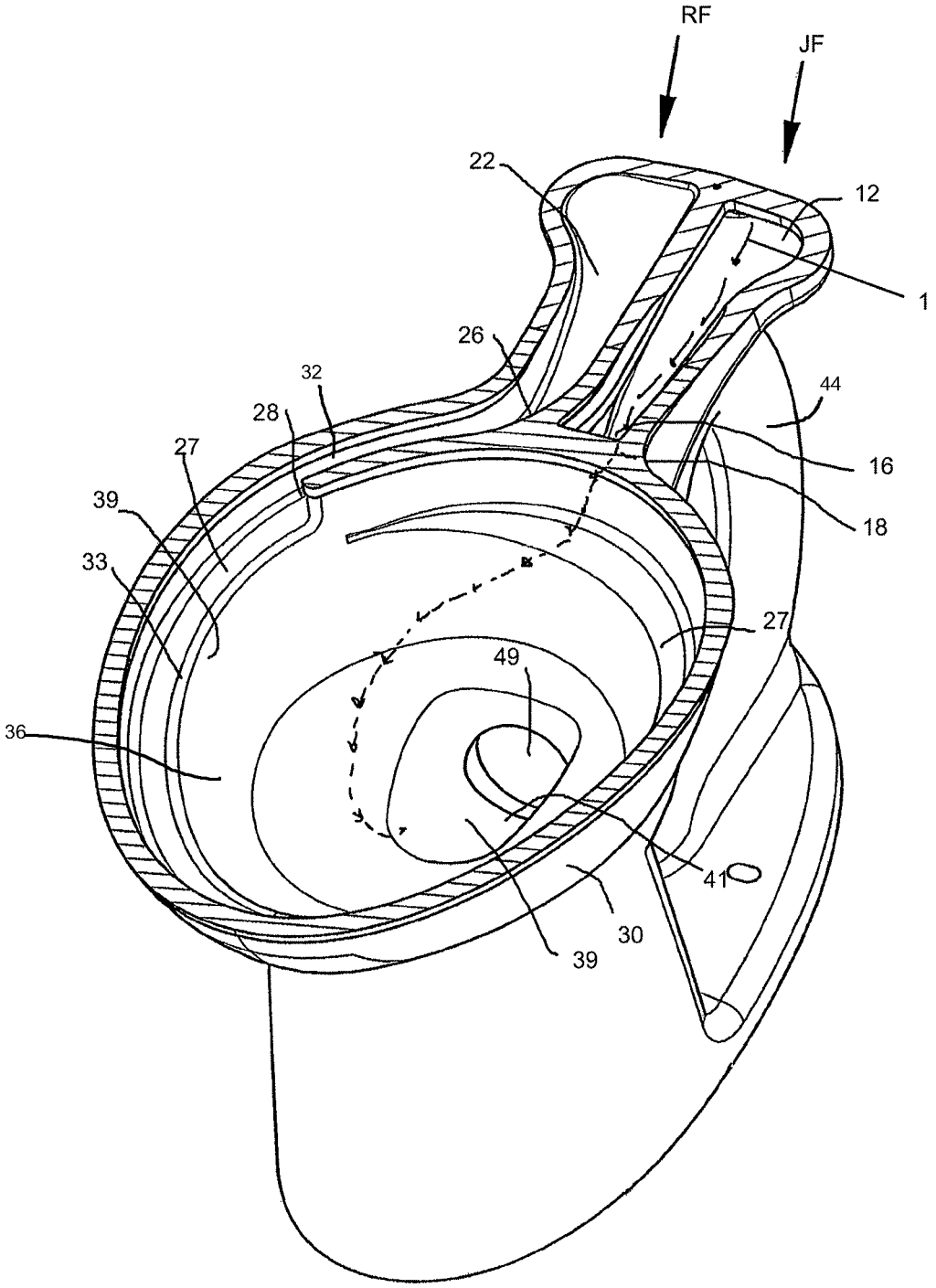
FIG. 10 is a perspective transverse cross-sectional view of the toilet assembly of FIGS. 1-2 and 8 taken along line 10-10 of FIG. 8.
Figure 11:
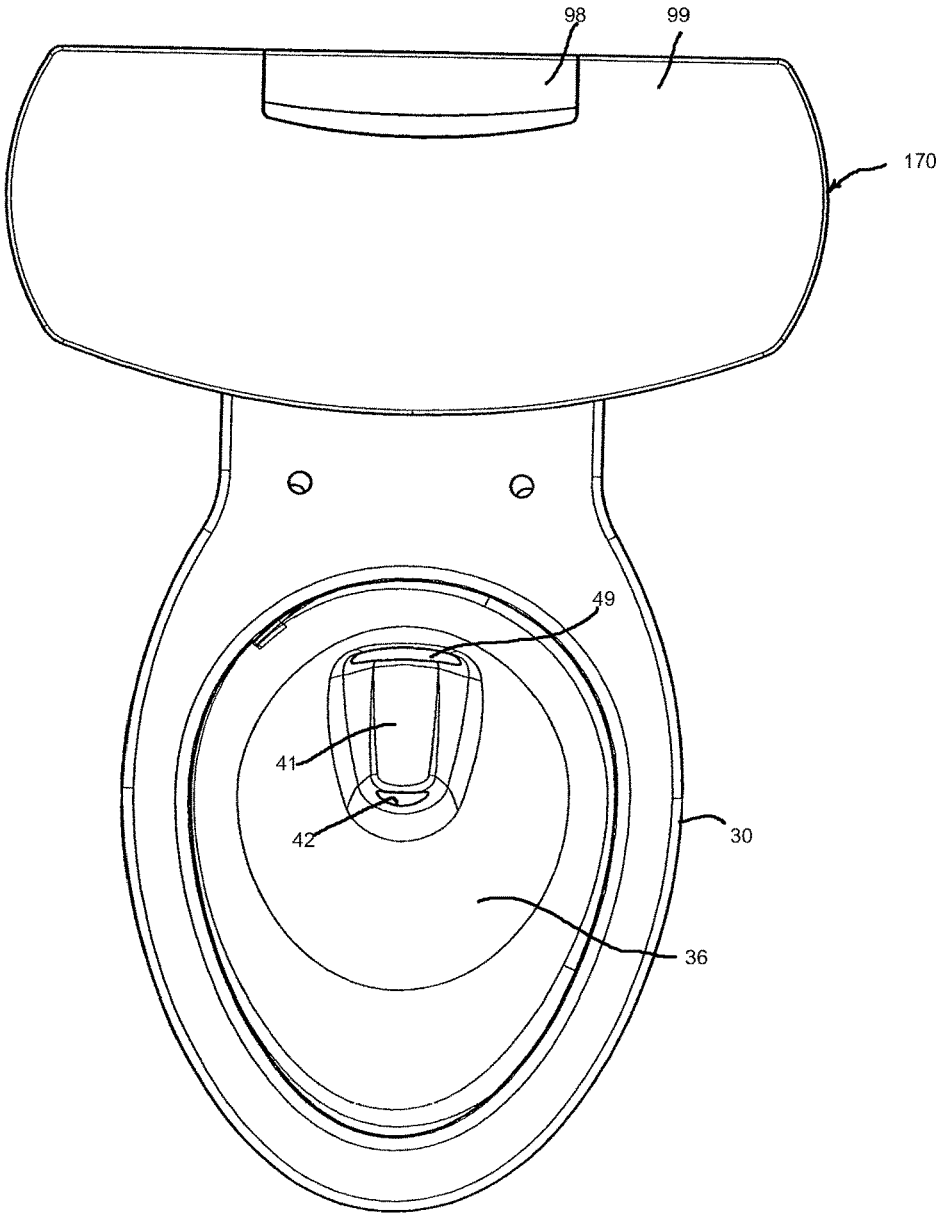
FIG. 11 is a top elevational view of the toilet assembly of FIG. 8.
Figure 12:
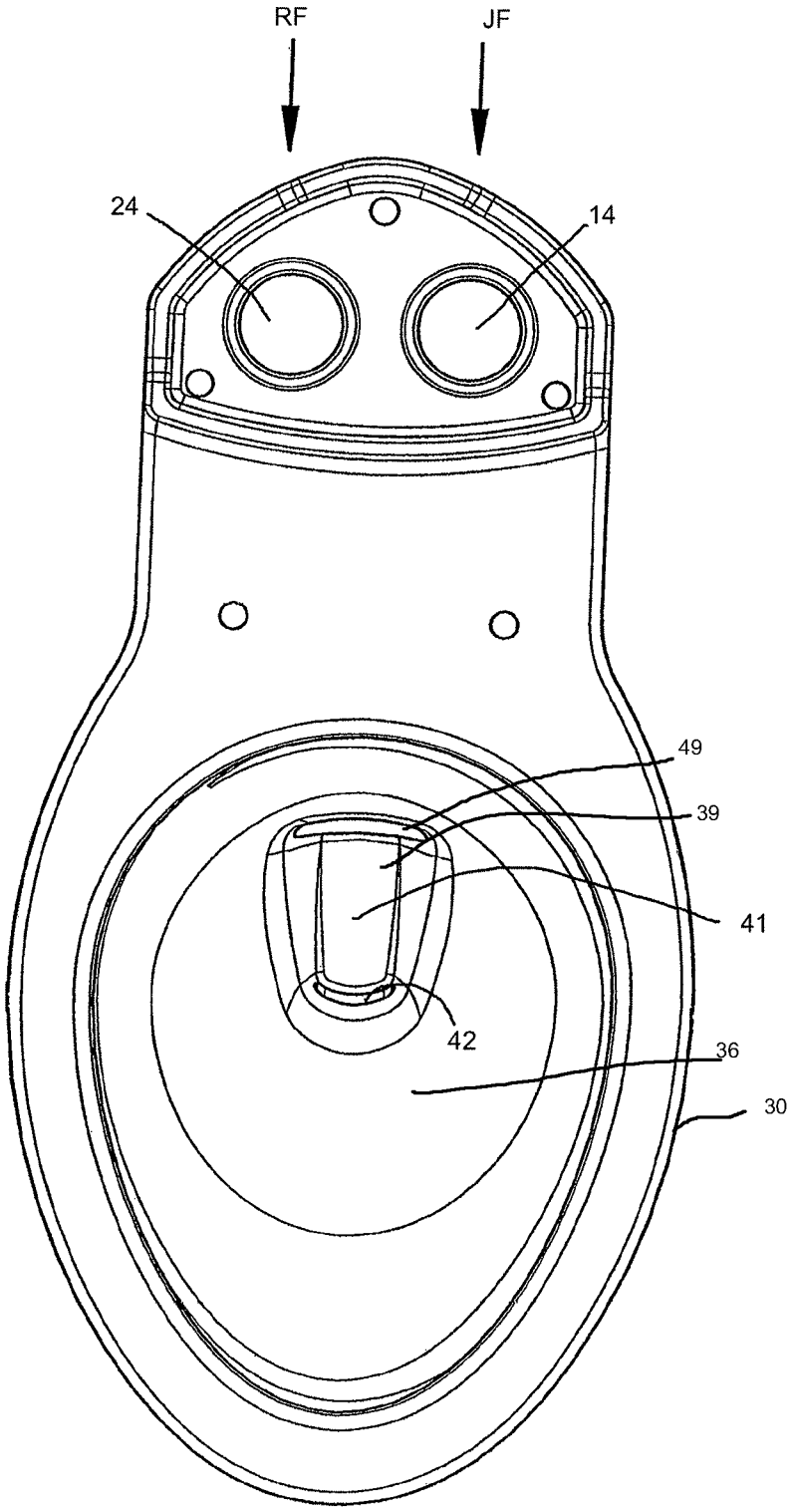
FIG. 12 is a top elevational view of the bowl portion of the toilet assembly showing the jet opening and the rim opening.

As shown in FIG. 10, the shelf 27 can extend around almost the entire interior surface before terminating to induce a vortex flow effect for cleaning A rim shelf design can also accommodate multiple rim shelves and multiple rim inlets as described in co-pending U.S. Patent Application Publication No. 2013/0219605 A1, incorporated herein by reference in relevant part with respect to the description of the rimless features and their operation.

It should also be understood that standard rim channels having a rim inlet(s) that feed(s) into a rim channel defined by a more conventional upper rim, and having one or more rim outlet ports for introducing washing water into the interior area of the bowl may also be used in the embodiment described herein. If a standard rim channel instead of a rimless design is adopted, such rim may be non-pressurized or may be modified to deliver pressurized flow by adopting features such as those described in U.S. Pat. No. 8,316,475, incorporated herein by reference with respect to the toilet assembly design. The rim features of that patent may be incorporated into assembly to create a more conventional rim design of the invention without departing from the scope of the invention.

The bowl assembly also includes a jet 20 defining at least one jet channel 38. The jet 20 has an inlet port 18 in fluid communication with the outlet 13 of the jet flush valve 70 and a jet outlet port 42 positioned in a lower or bottom portion 39 of the bowl 30. The jet outlet port may be configured in varying cross-sectional shapes and sizes for discharging fluid to a sump area 40 of the bowl 30. The sump area 40 is in fluid communication with an inlet 49 to the trapway 44 having a weir 45. The closed jet fluid pathway 1 includes the jet channel 28. The jet flush valve 70 is preferably positioned at a level L above the weir 45 of the trapway. The closed jet fluid pathway 1 preferably extends from the outlet 13 of the jet flush valve 70 to the outlet port 42 of the jet 20. Once the assembly is primed, the closed jet fluid pathway 1 is capable of remaining primed with fluid to keep air from entering the closed jet fluid pathway before actuation of and after completion of a standard flush cycle. However, during a clean cycle, when using the control system to operate the rim flush valve 80 independently, the jet flush valve remains inactive during the clean cycle, but may be used when the system operates to effect a purge at the end of the clean cycle.

The closed jet fluid pathway may include an optional jet manifold 12 having a jet manifold inlet opening 14 that is shaped to engage the outlet 13 end of the jet flush valve assembly 70 and that receives fluid from the outlet 13 of the jet flush valve assembly 70. However, the jet valve may exit directly to a separate jet channel path that travels from the outlet 13 of the jet valve assembly 70 through to the bottom of the jet and the jet outlet 42 without an optional, jet manifold area. If present, the jet manifold 12 also has a jet manifold outlet opening 16 for delivery of fluid to the jet inlet port 18. If present, the jet inlet port and the manifold outlet opening are essentially the same opening on either side of a wall defining the manifold. The toilet bowl assembly 10 may similarly also have an optional, separate, rim manifold 22. If used, the optional rim manifold 22 has a rim manifold inlet opening 24 configured for engaging the outlet 81 end of the rim flush valve assembly 80 and for receiving fluid from the outlet 81 of the rim flush valve assembly 80. The rim manifold if present would have an outlet opening 26 for delivery of fluid to a rim inlet(s) and/or to the rim inlet port 28. In such an embodiment, the rim 32 (whether configured as a conventional rim channel with outlet ports (pressurized or non-pressurized) or as a rimless shelf as shown herein) may extend at least partially around the bowl with the rim inlet port 28 being in fluid communication with the rim manifold outlet opening 26. It is also acceptable that a separate flow channel runs directly from the outlet 81 of the rim flush valve 80 to the rim inlet port 28.

The assembly as noted above includes a tank 60 capable of being connected in any manner to receive fluid from a source of fluid for flushing use, such as having the tank fill valve be connected when installed to be in fluid communication with a supply line delivering city water, tank water, well water or the like. Upon installation of the assembly, the tank 60 can accept a flow of fluid through the tank into the fill valve 66. The tank preferably has at least one fill valve 66. The fill valve may be any suitable fill valve commercially available or to be developed so long as it provides an adequate supply of water to maintain desired volume in the tank to serve the functions described in this disclosure. The tank 60 may be one large open container holding both the rim and jet flush valve assemblies as shown herein. The tank may also be modified as described above to have at least one jet reservoir and at least one a rim reservoir if desired. If a divided reservoir is provided, the jet reservoir may include a fill valve or a separate jet fill valve along associated with the at least one jet flush valve assembly 70, and the rim reservoir may include the at least one rim flush valve assembly and a tank or rim fill valve. This design is described in co-pending International Patent Application Publication No. WO 2014/078461 A1, incorporated herein with respect to the description of the use of separate jet and rim tanks. If desired, such a rim reservoir may further accommodate an overflow tube on the rim flush valve assembly 80. An open tank with a single tank reservoir, however, is preferred.

The toilet assembly 10 of the embodiment of FIGS. 1-27 is capable of operating at a flush volume of no greater than about 6.0 liters, and preferably no greater than about 4.8 liters, and even more preferably no greater than about 2.0 liters.

The sump area 40 of the bowl preferably has a jet trap 41 defined by the interior surface 39 of the bowl 30. The jet trap 41 has an inlet end 46 and an outlet end 50. The inlet end 46 of the jet trap receives fluid from the jet outlet port 42 and the interior area 37 of the bowl 30 and the outlet end 50 of the jet trap 41 receives that flow which enters into the inlet 49 to the trapway 44. The jet trap has a seal depth. The seal depth may be varied along with the jet paths and the measurement of the depth and all such variations may be readily incorporated into and operable in the embodiment 10. Such variations are described in detail in International Publication No. 2014/078461, incorporated herein in relevant part to describe variations in jet path and seal depth options for this particular toilet assembly.

To maintain a siphonic flush toilet assembly such as assembly 10 in a primed state, the initial step is to provide a toilet bowl assembly having the features as described hereinabove, wherein the closed jet fluid pathway 1 having at least one jet channel 38 therein extends from the outlet 13 of the jet flush valve 70 to the outlet 42 of the jet 20 so that once primed, the closed jet fluid pathway is capable of remaining primed with fluid to keep air from entering the closed jet fluid pathway before actuation of and after completion of a flush cycle. The flush cycle is preferably actuated by any suitable actuator such as flush actuator 2. In one preferred embodiment, the chinaware exterior and the actuator 2 are formed from or incorporate materials that provide an antimicrobial surface. The flush actuator 2 may be a standard flush handle, or as shown herein, adapted to be part of a valve actuation mechanism as described further below. After initiating the flush cycle by a flush actuator, such as a handle, the handle is in some manner in operative connection (which may be detachable or not detachable) to a flush activation lift arm 144. A mechanism as described in this embodiment or embodiments 500, 1900 may also be provided.

The handle 2 is in operative connection with a lift arm that connects to a pivot rod or similar device. As shown, it connects through a rotatable connector or linkage to a flush activation bar 75. As shown, the lift arm 144 connect to a rotatable linkage connector 144*a*, which may rotate transversely or at an angle and which may be adapted as shown to have a longitudinal adjustment connection 144*b* for adjusting the positioning and balance for optimized opening of the flush valves. Such adjustment may be pre-set by a manufacturer and/or adjustable for further modification and alignment by the installer or user. Any hinge, pin connection, washer or other rotating connector may also be used. The flush activation bar 75 preferably is configured to have a balance point for movable connection to the activation lift arm 144 through a linkage, which is preferably in some manner movable. A movable and rotatable linkage 144*a* may be used as shown connects the flush activation lift arm and its linkage to the flush activation bar 75 at a preferred balance point. The balance point is chosen by design to operate with the flush valves so as to specifically and mechanically time the opening of each valve when the handle is depressed to actuate the flush cycle in a normal flush cycle. When the handle is depressed, the flush activation lift arm and linkage are pushed upward and along with them the end of a mechanism having a relevant linkage such as adjustable, movable and rotatable connector 144*a* which is connected to the flush activation bar 75. This in term pulls up on the activation bar 75. As shown, the mechanism may also be longitudinally adjusted for different tank heights and value configurations using a longitudinally adjustable connector such as connector 144*b* as shown.

As a conventional flush cycle is activated, fluid is provided through the at least one jet flush valve assembly and the at least one rim flush valve assembly. The configuration of the closed jet fluid pathway is such and the timing of the flush cycle optimized so as to maintain the closed jet fluid pathway in a primed state after completion of a flush cycle.

In one embodiment of the method herein, after actuating the flush cycle, the flush activation bar is operated by the flush actuator handle and lift arm so as to provide fluid through the at least one jet flush valve assembly at a flow rate sufficient to keep air from entering the jet outlet and to generate a siphon in the trapway. The flow rate is then lowered through the jet channel for about 1 second to about 5 seconds until the siphon breaks; and the flow rate is then raised again after the siphon breaks to stabilize the level of water in the sump area.

Fluid is also preferably provided through the at least one rim flush valve assembly during the flush cycle. When first installed, the toilet may require an initial priming by providing a flow rate through the jet flush valve assembly outlet sufficient to keep air from entering the jet outlet port until the sump fills with fluid. The toilet assembly is capable of being self-priming. Self-priming, as that term is used herein, means that all air becomes expelled from the jet channel when the toilet is in a state causing the jet channel to have air.

The toilet is typically in that state, for example, when the toilet is first installed as noted above, although other situations, such as plumbing work or maintenance also can cause such a situation. The user may, of course, manually intervene to prime the toilet assembly upon installation, or as configured, the toilet can self-prime over one or more of the first several flushes of the toilet without user manual intervention. With respect to the toilet assembly 10 in this embodiment, the toilet is able to expel virtually all air in only about three flushes, although more or less may be required depending on individual toilet geometry. For self-priming to be complete, the flow rate of fluid through the jet flush valve needs to be greater than the flow rate of fluid exiting the jet outlet port so as to provide sufficient energy to displace the air. This can be accomplished through modification of the jet channel and/or the jet outlet port geometry and/or cross-sectional area and/or by modification of the flush valve to enhance performance. Thus it is preferred to use a jet flush valve that can contribute a high energy and strong velocity flow into the closed jet fluid pathway through the jet channel. Suitable valves are described in U.S. Pat. No. 8,266,733 and in co-pending U.S. Patent Application Publication No. 2014/0090158 A1, as well as in the various embodiments of jet flush valves described in International Publication No. WO 2014/078461 in FIGS. 35-68 thereof. Each of these references may be referred to for an understanding of the various flush valves which may be used, and are incorporated herein by reference with respect to their teaching of valves having streamlined valve body configurations and having a radiused inlet and/or a weighted cover and/or elevated valve body if desired. Other suitable flush valves are commercially available and may be adapted herein.

The two flush valves can be opened and closed simultaneously, or opened and closed at different timing during the flush cycle to further optimize performance both for the cleaning cycle as well as in operation of the conventional flush cycle. To achieve a cleaner bowl with cleaner post-flush water during a conventional flush cycle to work to enhance the benefit of the cleaning system in the assembly, it is desirable to open the rim flush valve prior to opening the jet flush valve. In preferred embodiments for a 6.0 liters/flush for a conventional flush cycle outside of a clean cycle or after a clean cycle, the rim flush valve is opened immediately upon initiation of the flush cycle and closed at about 1 second to about 5 seconds into the cycle, whereas the jet flush valve is opened at about 1 second to about 5 seconds into the cycle and closed at about 1.2 seconds to about 10 seconds.

Another embodiment may include a dual flush toilet assembly that opens a dual flush valve as rim flush valve immediately upon initiation of the flush cycle, which then triggers the jet flush valve (either a single or a dual flush valve) to open after the rim dual flush valve. The amount of water delivered to the rim for cleansing pre-siphon would be about 1 liter/flush to about 5 liters/flush, and preferably about 2 liters to about 4 liters/flush, and the amount of water delivered through the jet flush valve to establish a siphon would be about 1 liter/flush to about 5 liters/flush.

The siphonic flush toilet bowl assembly for use in a cleaning system according to the invention having a primed jet path as described above may further include, in preferred embodiments in the jet flush valve, a back-flow preventer mechanism. The back-flow preventer mechanism may be one or more of a hold-down linkage mechanism, a hook and catch mechanism, a poppet mechanism, and/or a check valve. The rim and/or jet flush valves may also include a flush valve cover that is at least partly flexible and is able to be peeled upwardly upon opening as shown herein. Such an embodiment may also include a back-flow preventer mechanism. The flush valve covers may also include hinged arms to assist in lifting the cover and/or one or more grommets for attachment of a chain for lifting the cover for better performance. Such backflow prevention mechanisms and associated flush valve covers, including flexible covers are described in detail in co-pending International Patent Application Publication No. WO 2014/078461, which is incorporated herein in relevant part with respect to the design and operation of a variety of embodiments of such backflow prevention mechanisms, valve covers and hinged lift mechanisms for use in an isolated jet path toilet.

Jet flush valve performance in such a toilet can be enhanced by providing the "peel-back" or partial opening valve covers that facilitate self-priming of the jet. Such "peel-back" covers provide more control in opening valves generally. Further, as the embodiment herein provides a primed and closed jet-path, when the toilet requires plunging, the optional back-flow prevention devices such as that shown here and as described in co-pending International Patent Application Publication No. WO 2014/078461 may be provided to the jet flush valve (and/or to the rim flush valve if desired).

As noted above, the jet 20 has an inlet port 18 in fluid communication with and through any optional jet manifold outlet opening 16 for receiving fluid from the jet valve outlet opening 13. However, the jet inlet port may also be located at the outlet of the jet flush valve. The jet outlet port 42 is configured for discharging fluid from the jet channel 38 to a sump area 40, which is in fluid communication with a trapway 44. The jet outlet port 42 preferably has a height $H_{jop}$ (measured longitudinally across the outlet port in one embodiment herein, of about 0.5 cm to about 15 cm, preferably about 0.5 cm to about 8 cm, and most preferably about 0.5 cm to about 4 cm. If the jet channel is round, this measurement may also be similar or close to the inner diameter of the jet channel 38. Regardless of the height, however, the cross-sectional area of the jet outlet port should be maintained at an area of about 2 $cm^2$ to about 20 $cm^2$, more preferably of about 4 $cm^2$ to about 12 $cm^2$, and most preferably of about 5 $cm^2$ and 8 $cm^2$. In one embodiment herein, the height of the jet outlet port 42 at an upper surface 54 or uppermost point is preferably positioned at a seal depth below an upper surface 56 of the inlet 49 to the trapway 44 as shown and as measured longitudinally through the sump area 40. The seal depth x preferably is about 1 cm to about 15 cm, more preferably about 2 cm to about 12 cm, and most preferably about 3 cm to about 9 cm to help prevent passage of air into the jet channel 38 through outlet port 42. This distance should also preferably be equal to or below the minimum level 59 of fluid in the sump area 40 to avoid a break in the jet channel 38 and to maintain a primed state in the jet flow path 1, from the outlet of the jet valve to the outlet of the jet, including through the jet channel 38 and any optional jet manifold 12 of the toilet bowl assembly 10, with fluid from the jet flush valve assembly 70 or other flush valve before actuation of and after completion of a flush cycle.

As discussed above, maintaining a primed jet path, i.e., a closed jet fluid path 1, greatly reduces turbulence and resistance to flow, improves toilet performance, and enables lower volumes of water to be used to initiate siphon. Air in the jet channel 38 or any optional area along the closed jet path hampers the flow of flush water and restricts the flow of the jet 20. Furthermore, air in the jet path, if not efficiently evacuated or purged, can be ejected through the jet outlet port 42 and enter into the trapway 44, which can retard the trap siphon and affect clearance of bowl 30 fluid and waste. Other variations of such toilets as described in International Patent Application Publication No. WO 2014/078461 may also be used in the assemblies 10 herein, and use of a primed, rimless toilet design having enhanced flush action in combination with the cleaning system of embodiments 10, 200, 300, 400, 500, 700, 800, 900, 1200, 1300, 1400, 1500 and 1900 described herein, while preferred, should not be considered limiting to the scope of this invention disclosure.

With reference to FIGS. 1-27, a toilet assembly, generally referred to herein as 10 and a cleaning system, generally referred to as 100 according to one embodiment of the invention are shown. In the cleaning system 100, a reservoir 6 is provided for holding a liquid cleaning agent. The reservoir may have varied shapes and configurations, however, a compressed generally rectangular shape is shown and is preferably chosen to economize space within the tank lid assembly (see FIGS. 4-5). The reservoir 6 may be formed of a variety of materials which should be resistant to degradation from cleaning agents and preferably lightweight. Examples of suitable polymeric and polymeric composite materials are known in the art, including moldable polyolefin homopolymers and copolymers such as linear low density polyethylene, high density polyethylene, polypropylene, and polyethylene-polypropylene copolymer, polyvinyl chloride materials, polyethylene terephthalate, polycarbonate, polylactic acid, polyurethanes, polystyrenes, polyacrylonitrile-butadiene-styrene, and the like as well as copolymers and functionalized derivatives thereof (e.g., polymers having functional groups on their backbone for static electric properties, bonding properties, and the like).

The reservoir preferably holds sufficient cleaning agent solution to enable multiple clean cycles before the reservoir needs to be replaced and/or refilled. In preferred embodiments, the reservoir may hold from about 250 ml to about 2,000 ml, and preferably about 500 ml to about 1,000 ml of liquid cleaning agent. The clean cycle would introduce additional flush water from the tank fill valve of about 4 l to about 15 l, and preferably about 9 l for an average flush volume in a standing, filled toilet bowl holding about 2 l to about 6 l, preferably about 2 l to about 5 l. The clean cycle along with the additional flush volume would introduce from about 20 ml to about 60 ml of liquid cleaning agent, preferably about 25 ml of liquid cleaning agent for a given cleaning. This provides an average dilution factor of about 50:1 to about 300:1 of flush water to liquid cleaning agent in the bowl during the clean cycle.

For a reservoir body generally rectangular in transverse cross-section, the reservoir preferably is about 10 cm to about 20 cm in length l by about 5 cm to about 15 cm in width w, wherein the length and width are measured transversely in a plane P-P' across the bottom surface 51 of the reservoir, and about 2 cm to about 8 cm in depth d as measured in a direction perpendicular to the plane P-P'.

The reservoir 6 has a body 7 defining an interior space 31 for holding a liquid cleaning agent 9. It is preferred that for desirable flow properties and for ease of pumping, the cleaning agent solution has a viscosity close to that of water. The cleaning agent solution is preferably an aqueous solution according to those known in the art or to be developed, such as quaternary ammonium compounds, bleach, or acidic-based cleansers. Commercially available quaternary ammonium-based cleaning products such as Professional LYSOL® Brand Antibacterial All Purpose Cleaner can be well suited and deliver sanitizing or disinfecting efficacy. Citric acid-based agents or other green cleaning agents (ecologically friendly) may also be used. Various optional additives in varying amounts may be added as noted below. Citric acid-based cleaning agents include lemon, orange or grapefruit-based cleaning agents. Other suitable cleaning agents for the cleaning agent solution herein include grape seed oil, vegetable oils combined with one or more of mild peroxide agents, surfactants, and the like.

The cleaning agent solution may have one or more various optional ingredients, including a pigment or colorant additive to provide a visual alert that the cleaning agent is being introduced and is present in the toilet bowl during the clean cycle. Other additives, such as preservatives, thixotropic agents and rheological modifiers, may further be used in the cleaning agent solution, as well as a fragrance additive for providing a clean smell to the bowl upon cleaning (pine scent, lemon scent, orange scent, floral scent, etc.). In addition, other agents for foaming, color change or effervescence (bubbling) may be provided if desired to demonstrate cleaning action.

As the cleaning agent will pass through the flush valve mechanism and into the toilet bowl, as well as through the toilet trapway and sewer pipes, it is preferred not to include corrosive or other materials that would have a negative, erosive and/or corrosive effect on the equipment contacted. It is also preferred that the cleaning agent solution be safe and approved for introduction into a sewer system or housing in a home septic system.

The body 7 of the reservoir 6 preferably has an optional outlet portion 11. The reservoir also has an outlet port 19 in fluid communication with the interior space 31 of the reservoir body 7. As used herein, "in fluid communication" means that the one element of the assembly is structurally positioned so as to be open to flow from or to another element.

The outlet portion 11 may be located and defined by the shape of the body of the reservoir at various locations on the reservoir. As shown, the outlet port 19 is positioned in the optional outlet portion 11 and defined thereby in a downward facing configuration. The optional outlet portion may have a variety of shapes, and is preferably downwardly extending for facilitating gravity flow from the reservoir 6 but may also be placed on other locations of the body 7. As shown, the outlet portion 11 has a cross-sectional shape that is generally circular to facilitate laminar flow through the outlet portion 11, but can also be generally rectangular, elliptical, triangular or other shapes as well.

Figure 5:
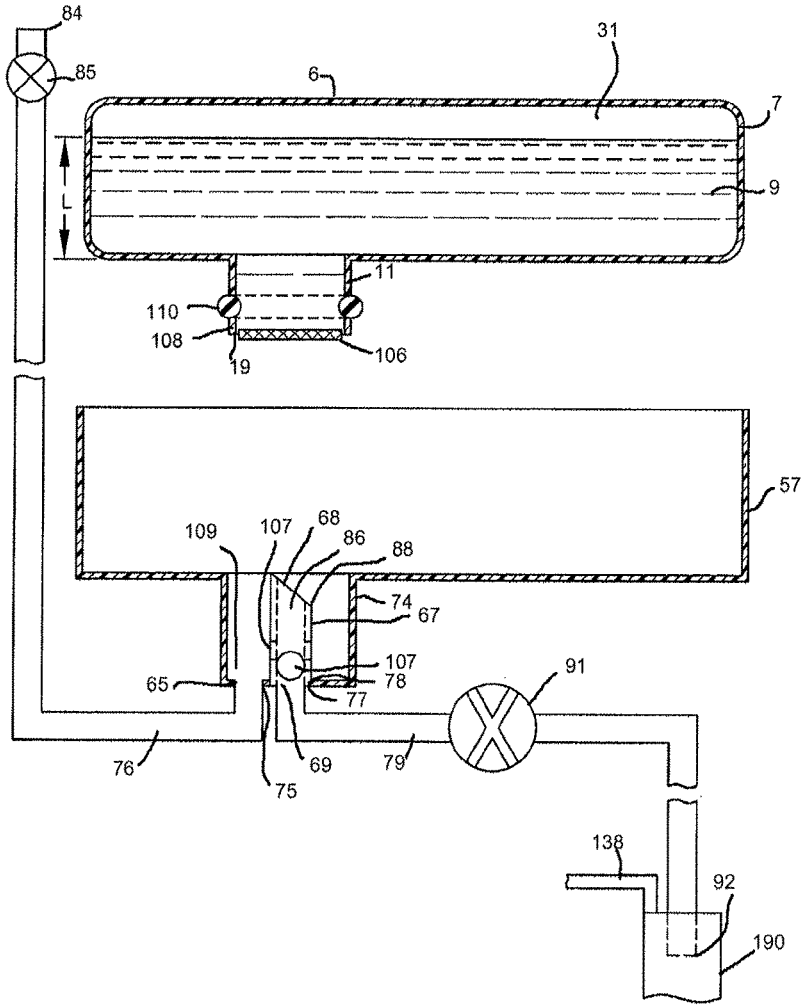
FIG. 5 is a schematic cross-sectional view of a reservoir and associated supply conduit and vent line according to an embodiment of the cleaning system.
Figure 6:
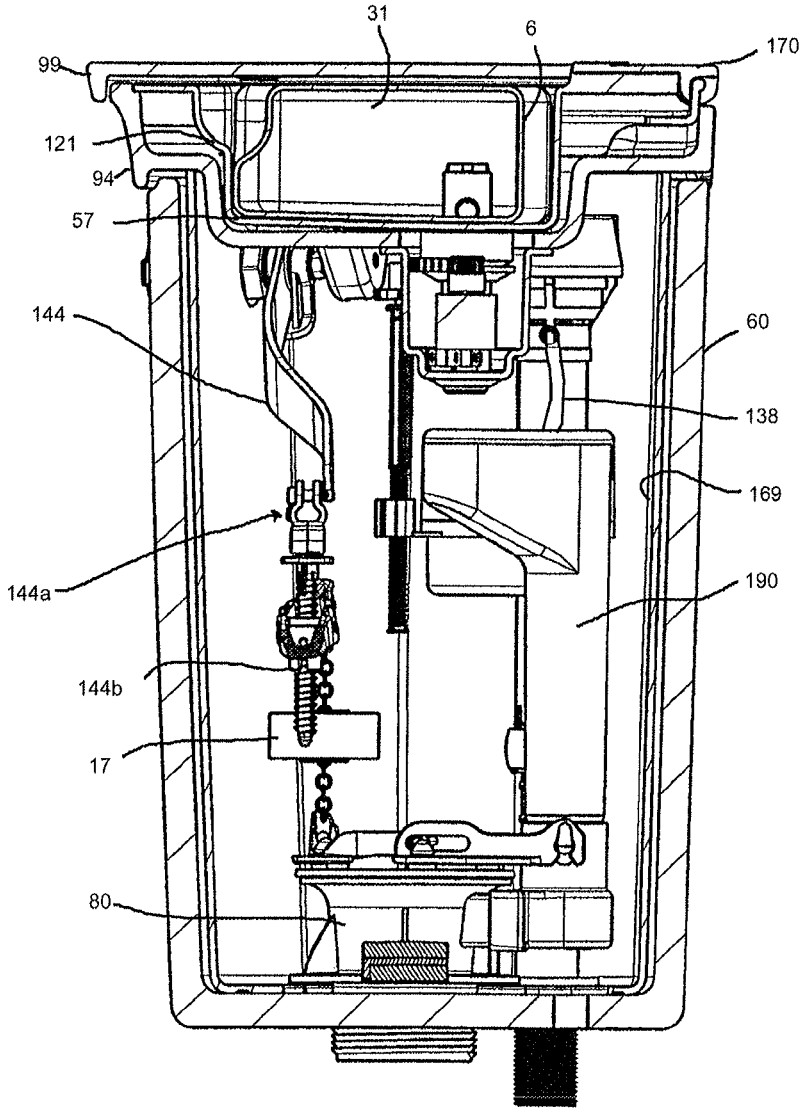
FIG. 6 is cross-sectional view taken along line 6-6 of FIG. 16 of the tank portion of the toilet assembly according to the invention shown in FIG. 16 and having a cleaning system according to FIG. 3 showing the linkage, flapper lift mechanism and lift rod for the flush valve having an overflow tube and funnel.
Figure 7:
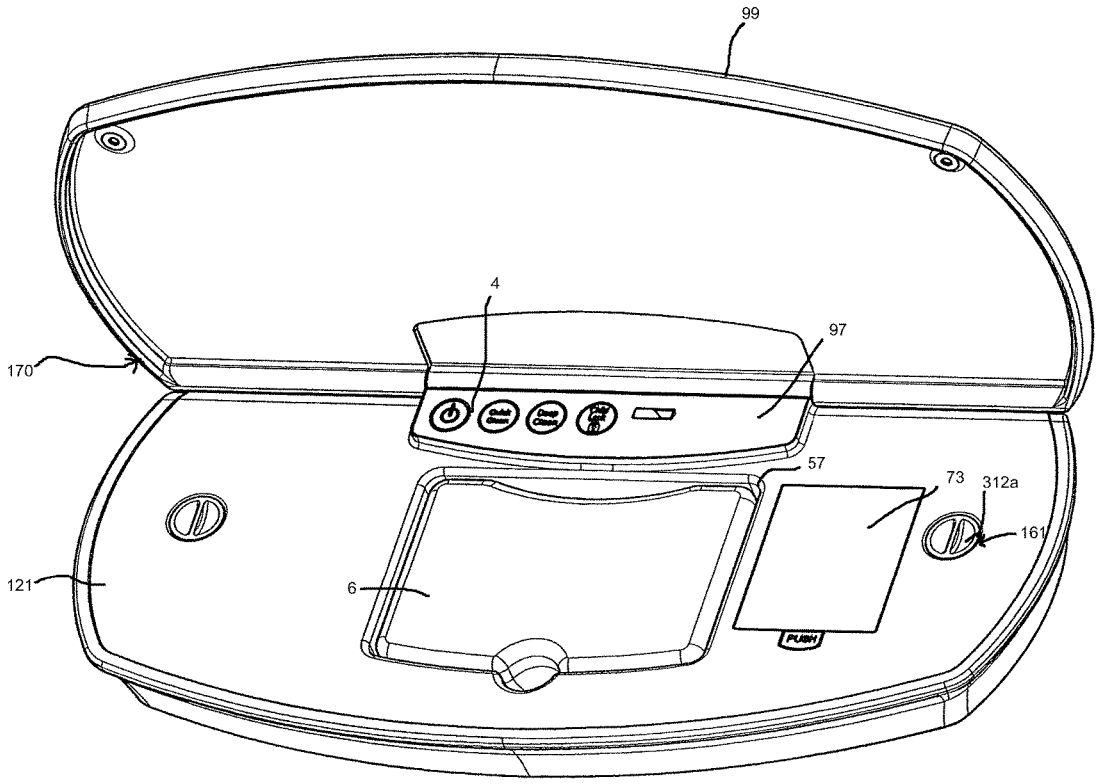
FIG. 7 is a perspective view of the cleaning system tank lid assembly of FIG. 3 with the upper tank lid open.

As shown schematically in FIG. 5, various optional configurations of supply conduits for use in flow control devices herein may be inserted into an opening including use of a tube design or insertion of a liquid supply valve. Each will be explained as alternatives for preferred use in the present embodiment. When using a tube and supply conduit design as a flow control device 66*a*, an optional opening 77 is provided to the outlet and fits within a tube 67. The tube 67 may be positioned so as to be situated within the outlet portion 11 when the reservoir 6 is seated in the seat 57 of the housing 121. A similar tube may also optionally be provided for facilitating venting in the reservoir if desired, but is not shown in this embodiment (see embodiment of FIG. 39). The optional tube 67 defines a passage 86 therethrough. The tube 67 has an upwardly extending first end 88 for directing fluid from the interior space 31 of the reservoir 6 through the passage 86 and into the first end 78 of the supply conduit 79 through the second end 90 of the tube 67 which has the opening 69 therein for liquid leaving the outlet portion 11 through outlet port 19 into the first end 78 of the supply conduit when the reservoir is seated in seat 57.

Figure 23:
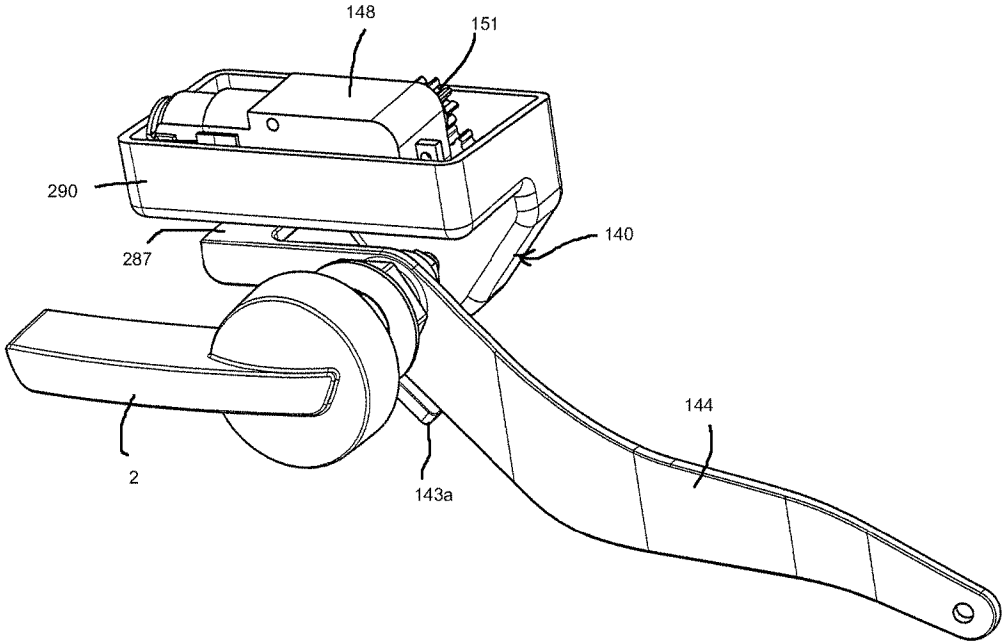
FIG. 23 is a front perspective view of the lift arm actuation assembly of FIG. 19 mounted on a gear motor housing with a gear motor assembly.
Figure 26:
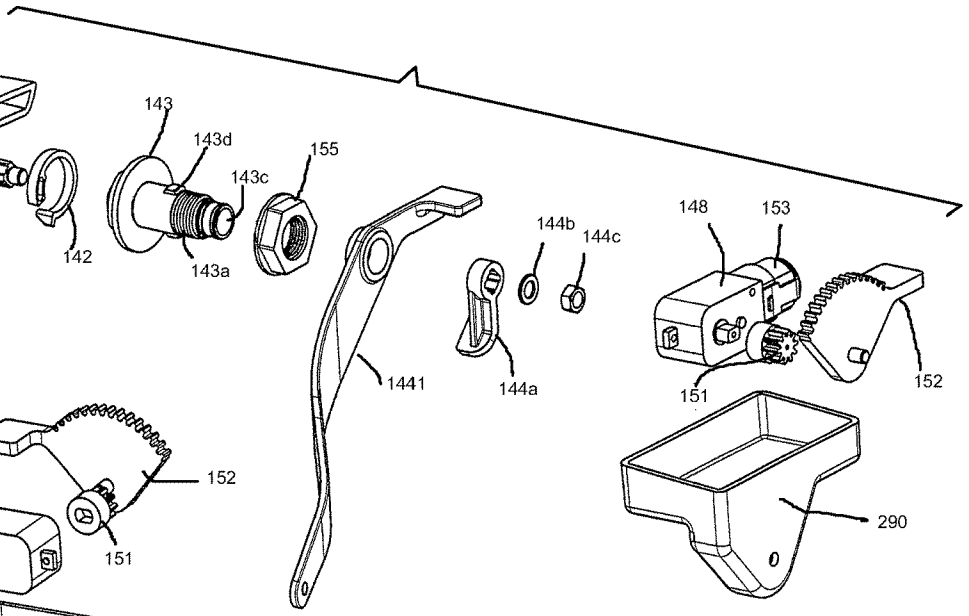
FIG. 26 is an exploded rear perspective view of the lift arm actuation assembly, gear motor housing and gear motor assembly of FIG. 23.
Figure 25:
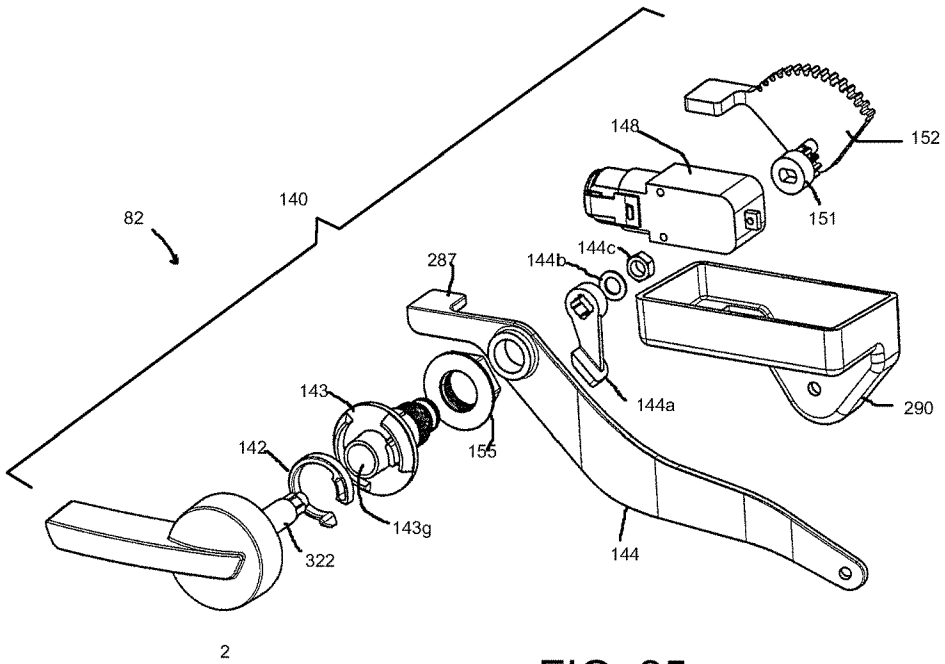
FIG. 25 is an exploded front perspective view of the lift arm actuation assembly, gear motor housing and gear motor assembly of FIG. 23.

The upwardly extending first end 88 may be configured so as to direct fluid into the tube and/or to push through a frangible cover if used. It may be curved and blunt or tapered or pointed, depending on the frangible cover used and the desired flow characteristics into the tube. In one embodiment, the first end 78 is configured like an injection-type needle for a specific flow characteristic as shown in FIG. 23 described further below.

The tube 67 may include one or more optional side opening(s) 107 extending therethrough for fluid entering the upwardly extending end 88 of the tube to flow into a bottom area 108 of the outlet portion 11. When the reservoir is seated in the housing 121, the bottom area 108 of the optional outlet portion is seated within a corresponding bottom area 109 of the seat portion 74. Preferably, a peripheral seal 110 is provided, such as an elastomeric or polymeric o-ring between the outlet portion 11 and the seat portion 74 for sealing engagement between the parts. The o-ring seal 110 may sit in an optional groove in the exterior of the outlet portion. The o-ring seal 110 is preferably positioned so that fluid leaving the tube 67 through side openings 107 fills the bottom area 108 of the outlet portion 11 and does not pass above the o-ring thus sealing a defined area 108 at the bottom of the outlet portion below the seal 110 and the frangible cover 106 when the reservoir 6 is fully seated within the housing 121. If desired, this area 108 as well as the area of the supply conduit upstream of any further mechanized valve, motor, or other flow control device can be pre-sized to hold the desired dose of cleaning agent when the cleaning agent is in a primed state.

In the embodiment shown in FIG. 5 and other embodiments of the reservoir and outlet portion described herein, the outlet port 19 of the reservoir, as noted above, may be covered by a frangible cover 106. The use of a frangible cover enables maintaining a seal on the reservoir when a cap or other closure is removed from the reservoir (such as would be the case for commercial sales of the reservoir filled with cleaning agent solution in advance of use) since the reservoir port 19 is positioned in the preferred embodiment of assembly 10 to face downwardly. The frangible cover 106 may be a foil or other membrane capable of being easily penetrated by the upwardly extending end of the tube but not so frail as to completely tear upon penetration. Suitable materials include, for example, an aluminum packaging foil with a thickness sufficient to provide such properties and/or having a frangible plastic membrane backing. Such materials are known in the packaging art for use on other cleaning agents (such as dishwasher cleaning liquids), milk or juice cartons or pharmaceuticals and vitamins to provide protective coverings to avoid product tampering or loss of product if the cap is removed in the store. The type of frangible cover is not critical. Preferably, the frangible cover 106 is formed of a polymer-backed aluminum foil. In commercial sale, a removable lid can be provided over the frangible seal for protective reasons.

A supply conduit 79 used herein may be any suitable tubing or conduit, and in assembly 10 may be a flexible conduit suitable for fluid flow and resistant to the cleaning agent solution chosen, such as polymers noted above for forming the reservoir as well as various thermoplastic elastomers and flexible polymers, for example, Tygon® tubing or other flexible hose may be used. The supply conduit 79 preferably includes or is communication with a flow control device such as one or more valves, a gear pump, piston pump, peristaltic pump, motor or similar control device for regulating flow. In the embodiment shown in FIG. 5, the flow control device 66*a* is a mechanized valve 91 for controlling flow through the supply conduit which is regulated and opened and closed in response to a programmed cycle in the control system 1000.

In response to the actuation feature 4, the control system 1000 actuates a mechanized valve 91 or similar flow control device, for a period of time (providing a set flow rate through the tube or other supply conduit) sufficient to deliver a dose of the liquid cleaning agent 9 from the reservoir 6 and within the initial portion of the supply conduit 79 upstream of the mechanized valve 91 through the valve 91 and into the remaining portion of the supply conduit which then exits the second end 92 of the supply conduit. At the same time, any entrained air from the solution may pass into an optional vent path to displace the solution. Such a mechanized valve may be a one-way or adjustable ball valve or similar valve that is electronically and automatically actuatable by the control system 1000. The valve may be a solenoid or pneumatic valve as well. It may be operated by a gear or peristaltic pump or a gear motor.

The assembly further may be configured as a tank lid 170 that sits on top of a tank 60. The bottom portion of the tank lid 170 may be configured as a tray 94 and may also incorporate a further receptacle for holding a gear pump and/or a gear motor or as shown may have an opening 96 to accommodate a housing for a actuator motor 23 and other components of a valve operation mechanism in the form of a lift arm actuation assembly as described further below.

A further receptacle and/or opening 95 to accommodate the supply conduit and/or a supply valve assembly and associated gear motor as described further below. The gear motor (which may also be a gear pump if desired) for the liquid supply function as with the gear motor 23 may be activated by the control system 1000. The activation of a gear motor such as gear motor 187 will allow cleaning fluid to exit the reservoir by opening valve 180 The gear motor 187 can also operate a mechanized valve such as valve 91. If used, a gear pump may be any suitable small volume gear pump which can be automatically and electronically actuated. Other pumps such as peristaltic or piston pumps may also be used. Suitable gear motors are those that are electronically and automatically actuatable. A gear pump may be used if the system includes a pump or may use a gear motor to facilitate gravity flow.

For use in operating the flush valve, the system may also have a cam or other similar mechanism (see FIG. 39) which can be used in conjunction with the rotating shaft of such a gear motor for assisting in controlled, actuated operation of a mechanized valve or valves as well as the flush valve in the toilet as described further below.

As shown, the supply conduit opening may be in the seat portion as shown in FIG. 5. The seat portion 74 of the seat 57 may include a second opening 77 for receiving a first end 78 of a supply conduit 79. While the supply conduit herein is shown as a tube such as a flexible tubing it should be understood based on the various embodiments of the disclosure herein, that a "supply conduit" as that term is used herein may be a single supply conduit or any passageway through a device that provides fluid communication from the reservoir interior 31 so that cleaning agent flows from an exit in the reservoir into either the overflow tube 190 of a flush valve, into a flush valve or into any designated location between the reservoir and the entrance of flush water and cleaning fluid in mixture into the toilet bowl (whether through a rim inlet directly into the bowl or into a rim inlet entering a rim channel so that flush water and cleaning fluid enter through a traditional rim channel and associated rim channel outlets into the bowl). Thus various alternatives are described in the application wherein a supply conduit is a piece of tubing, a molded piece or a series of parts that collectively form a passage for introducing cleaning agent from the reservoir into the bowl through various passages in fluid communication. It is not necessary that the supply conduit be fully enclosed over all of its length, for example, a funnel may form part or all of the supply conduit and direct cleaning agent into an overflow tube to perform the supply function while being open to the atmosphere within the tank. The supply conduit can introduce fluid by gravity through a funnel and into an opening in a funnel, then, for example, into an overflow tube without a sealed closure. Thus, unless used more specifically for a particular embodiment, "supply conduit" is used herein in its broadest sense to describe any mechanism to provide fluid communication from within the reservoir interior space through the reservoir exit and into the entrance into the bowl along any point in the rim flow path: from overflow tube to flush valve and/or directly to the rim flow into the bowl (which may be a direct rim inlet, an inlet into a rim channel with one or more rim outlets (with or without an intervening manifold) or at any injection point along a rim flow path prior to bowl entry, and further may or may not be a fully enclosed conduit.

The second end of the supply conduit can be introduced into the flush water at various locations. For example, the second end of the supply conduit may be positioned at the bottom 93 of tray 94 through opening 95 therein and end at that point, or as shown, may be positioned to continue to flow cleaning agent through the supply conduit in the form of a funnel 166 into the overflow tube 190 of the flush valve 80 or may continue to flow fluid directly into the overflow tube without a funnel, such that the supply is in fluid communication with a rim inlet for rim flow into the toilet bowl 30. The tray 94 is seated below the housing and holds the housing 121. The cleaning system preferably may includes an optional lower tray on a bottom of the system 100. The bottom of the tray 94 is preferably configured to lie at least about 4 in. to about 5 in. above the water line in the toilet tank 60 when installed, although this may vary depending on the height and water level in the tank for a given tank design. The tray is preferably configured to hold the reservoir 6 and housing 121 and a top lid 99. The tray 94 and top lid 99 are configured so as to be positioned on top of a toilet tank 60 so that the lid 99 sits in place of a top surface of a conventional tank cover and the bottom tray 94 sits within an interior space 119 of a toilet tank 60 above a toilet flush valve. However, the tank lid 170 in other respects looks in use and sits on the tank in appearance as a conventional tank cover.

The tank is preferably of standard toilet tank dimensions in transverse cross-section so that the clean system may be retrofit on existing toilets. However, it is also within the scope of the invention to provide the clean system in specialty sizes in the transverse plane of the toilet (length and width of the lid) and/or to provide the clean system with toilets having specialty sized tanks to accommodate design variation in the size of the clean system for different embodiments as described herein. For purely aesthetic reasons, it is preferred that the tank be as close to conventional tank dimensions as possible.

When activated by the actuator feature 4, the control system 1000 in the clean system 100 receives a signal to carry out various functions. The liquid cleaning agent is pre-loaded into the outlet portion and supply conduit upstream of any mechanized valve or liquid supply valve. The first loading of cleaning fluid may require an initial programmable feature to prime the system and pre-load the cleaning agent, such as by an initial actuation timing to prime the unit. A separate "initiate" button may be provided to the control panel if desired for pre-priming the unit upon installing a new cleaning fluid container. Once in place and pre-loaded, the control system 1000 operates the mechanized valve or other liquid supply valve for a first period of time sufficient to deliver a dose of the liquid cleaning agent from the reservoir 6 through the supply conduit 79 and into the interior space 103 of a flush valve 80 with its flapper in the closed position. The flush valve into which the fluid is introduced is preferably one which has an overflow tube 190 and/or is configured for receive and deliver fluid such as flush water to a rim inlet port 28 of a toilet bowl 30.

Figure 17:
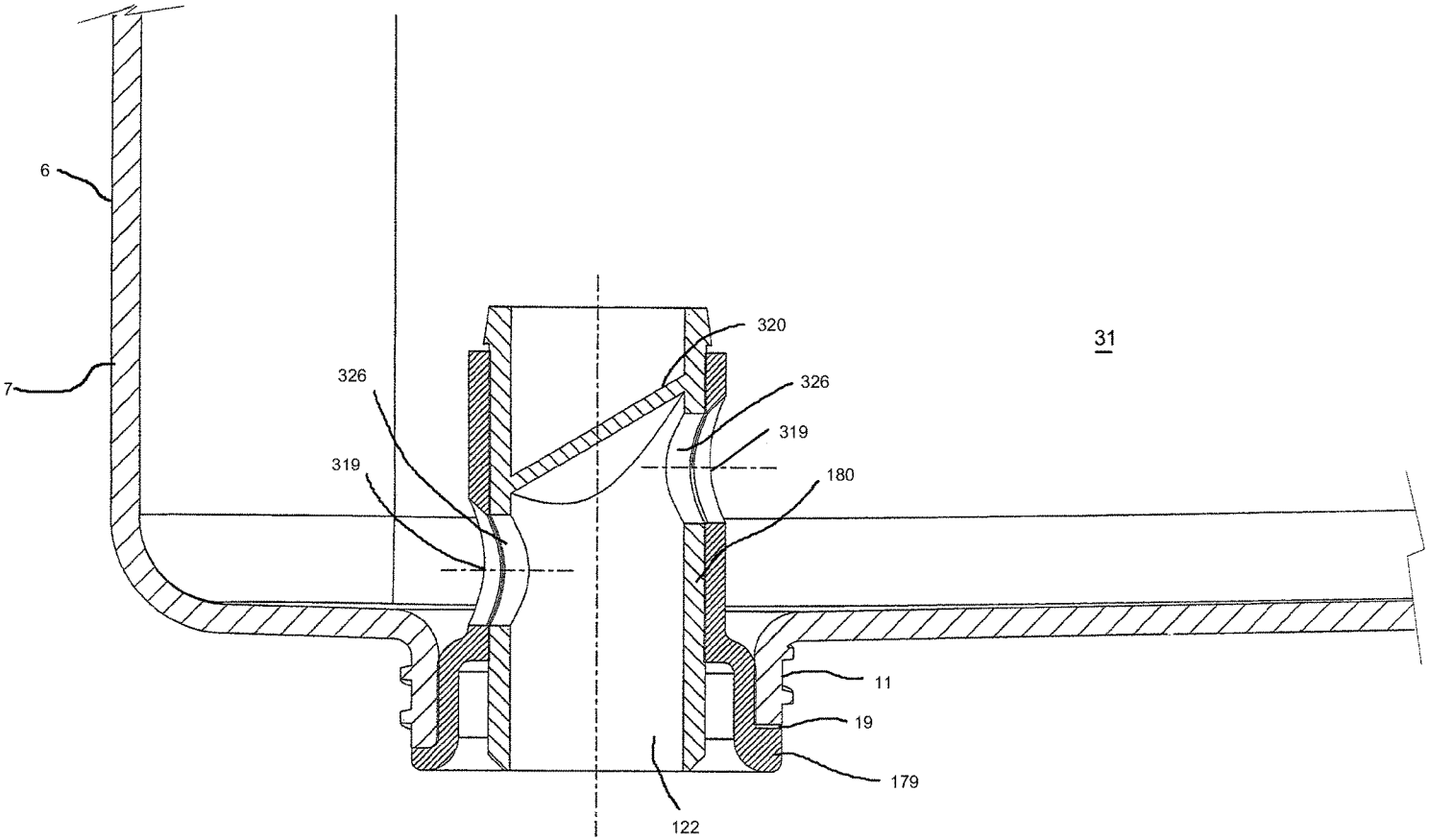
FIG. 17 is a partial and enlarged longitudinal cross-sectional view of the reservoir of the clean system of FIGS. 1 and 3.
Figure 18:
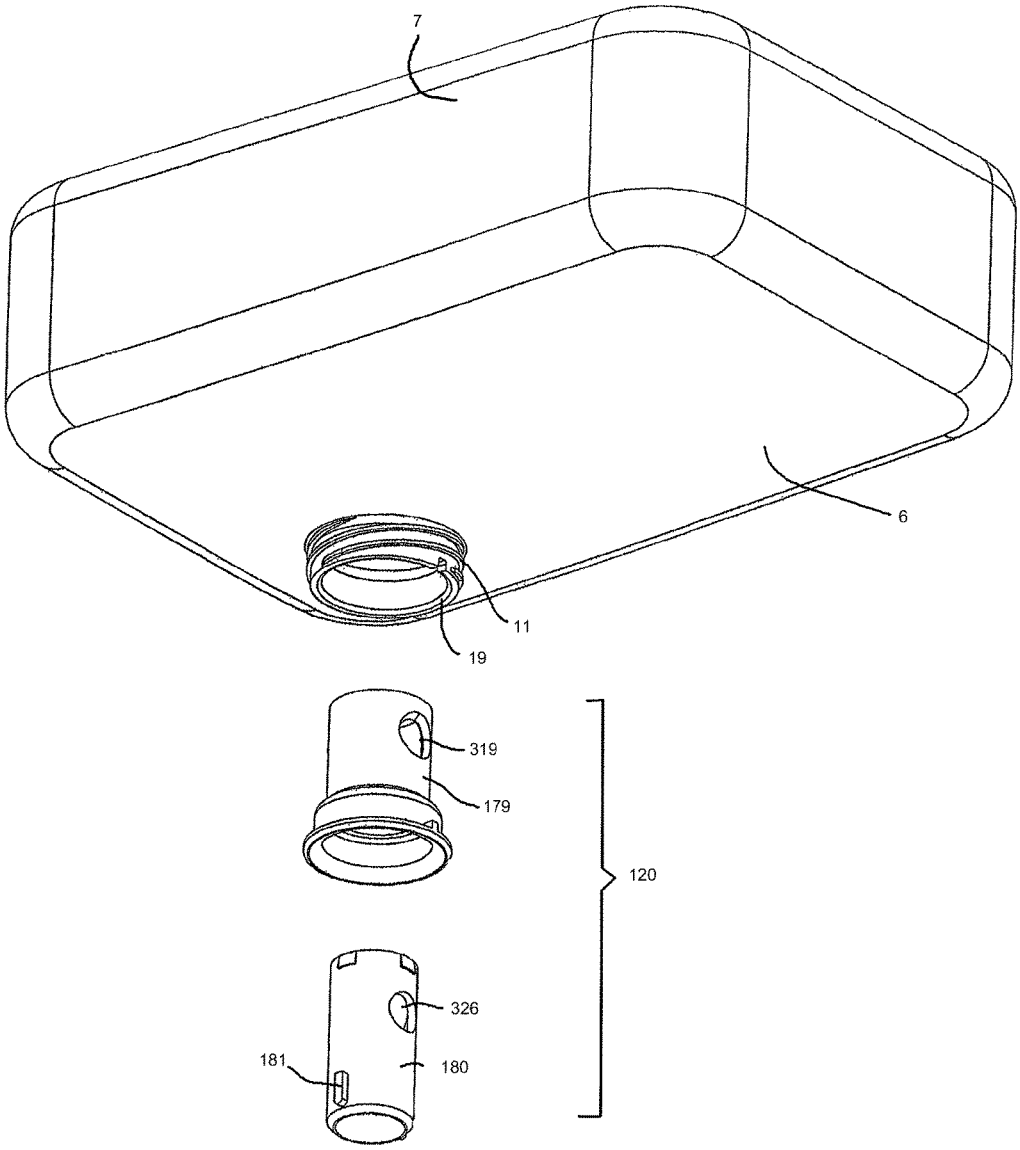
FIG. 18 is an exploded perspective view of the reservoir and liquid supply valve of the clean system of FIGS. 1 and 3.
Figure 20:
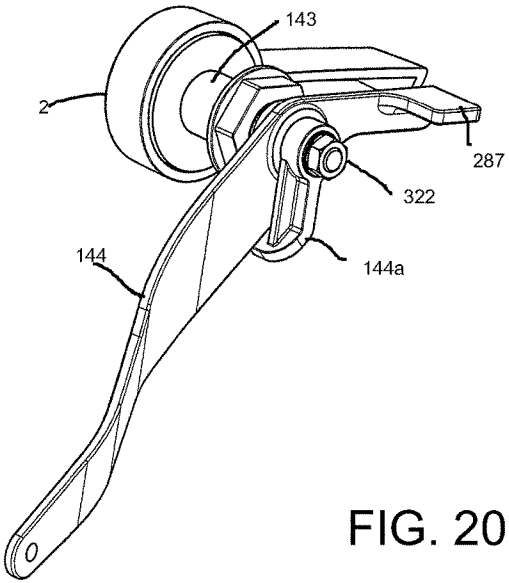
FIG. 20 is a rear perspective view of the lift arm actuation assembly of FIG. 19.
Figure 19:
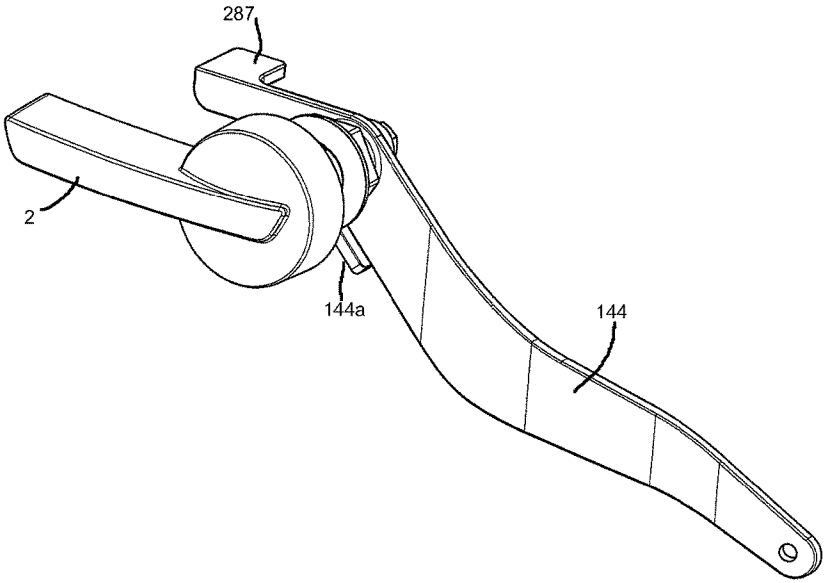
FIG. 19 is a front perspective view of a lift arm actuation assembly for the toilet assembly of FIG. 8 and the clean system of FIGS. 1 and 3.

A more preferred reservoir 6 is shown in non-schematic form in FIGS. 17 and 18. As with the schematic reservoir described above with respect to FIG. 5, the dimensions may be the same as those noted above, and the reservoir body 7 defines the interior space 31. The reservoir has an outlet port 19 on an outlet portion 11 thereof as described above which can be threaded for a mating cap when a separate replacement container is separately sold.

Figure 4:
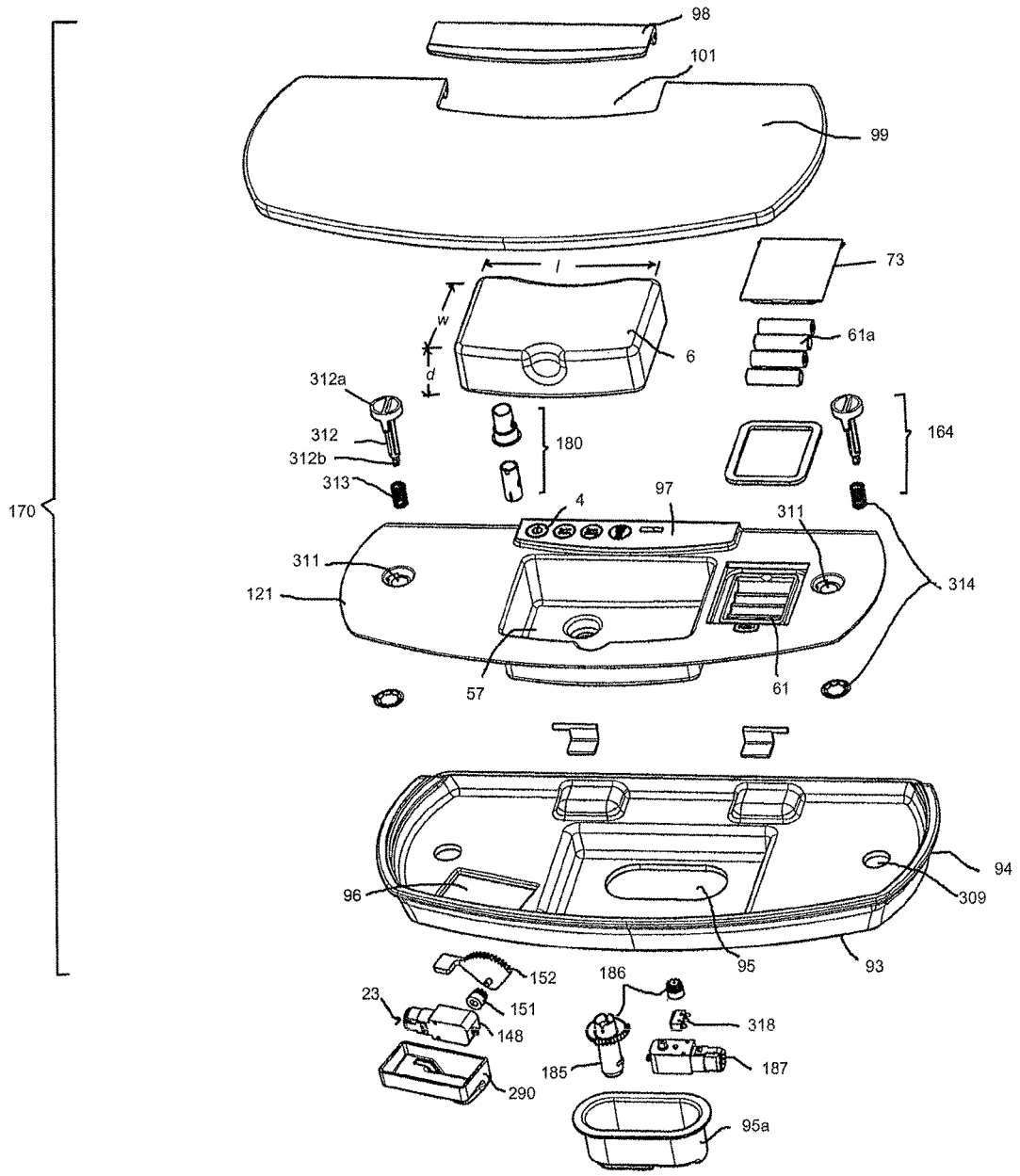
FIG. 4 is an exploded view of the embodiment of the cleaning system tank lid assembly according to FIG. 3.

Instead of a tube as described above for use with a tubing-like supply conduit, the reservoir of FIGS. 4, 17 and 18 includes a liquid supply valve 120. As shown a liquid supply valve 120 operated by a gear motor and valve actuator is positioned as part of a flow control device 66*a* so as to be an alternative to a tube and mechanized valve as in the schematic reservoir described above and is situated similarly though within the outlet portion 11 of the reservoir 6 when it is seated in the reservoir seat 57 in a complementary reservoir housing 121. The liquid supply valve 120 defines a passage 122 therethrough for release of cleaning fluid. The valve 120 has a stationary valve insert 179 which is positioned so as to cover an interior valve plug 180. The valve plug is operable to rotate by a valve tube actuator 185 operated by gear(s) 186 and a gear motor 187 having an optional limit switch 318. As the control system 1000 actuates the valve to release cleaning fluid, the stem of the valve gear motor 187 turns, and operates the tube actuator 185 which engages the valve plug 180 until a stop 181 on the plug 180 is contacted. When the valve is open, openings 319 in the stationary valve insert 179 and openings 326 in the rotating valve plug 180 are aligned. When the valve is closed, the openings are no longer in alignment. Cleaning agent may enter the open valve through openings 319. The valve plug includes an interior baffle 320 that helps guide cleaning agent liquid downwardly and guides trapped air upwardly for venting purposes. The valve can also be partially opened to partially align the openings and dispense cleaner at a lower flow rate.

A cleaning agent solution as described above may be directed by gravity feed from the interior space 31 of the reservoir 6 through openings 319 in the valve insert 179 and valve plug 180, then into the passage 122 in the valve 120 and through the interior thereof into a supply conduit which may be tubing as described in the schematic embodiment or as shown can be formed as a direct entry path through the tube actuator 185 by way of the interior 188 of the actuator 185 into a funnel 166 and into the overflow tube 190 all of which are in fluid communication either to a supply conduit or are acting together as a supply conduit as shown.

In this embodiment and others like it describe below where the liquid supply valve is directly actuated, a separate flow control device is not needed to actuate the valve because the valve itself is the flow control device for delivery of cleaning fluid. Thus, as used herein, it should be understood that a "flow control device" or metering mechanism may be any mechanism, including the liquid supply valve in various embodiments described herein or may be configured as a separate valve located along the supply conduit such as a mechanized valve 91 as noted above schematically in FIG. 5 so long as there is a flow control device independently controlling flow from the reservoir.

As with other embodiments herein, upon activation of the actuator feature (such as actuator feature 4), the control system is preferably adapted to initiate the clean cycle by operating the valve 120 for a first period of time sufficient to deliver a dose of the liquid cleaning agent solution to a location along the flow path in fluid communication with the inlet of cleaning agent and flush water into the bowl, for example, either to a supply conduit and then to the interior space of a valve body of a closed flush valve (such as valve 80) or more preferably as shown through a supply conduit in the manner of the interior 188 of the actuator 185 into the funnel 66 and then directly or by gravity flow into the overflow tube 190. The cleaning agent enters the flow path in fluid communication with the inlet of cleaning agent and flush water, which is configured for delivery of fluid to either a rim inlet port of a toilet bowl or to a conventional rim channel inlet(s) and then through one or more rim channel outlets. Such valve 120 (as with other valve embodiments below) can be connected so as to feed directly to the overflow tube 190 above the flush valve, and preferably to an isolated rim valve 80 as in the preferred embodiment herein, and to a feed directly to a rim inlet into the bowl or to a rim inlet of a conventional rim channel and out through one or more outlet ports.

All that is required is that the cleaning agent combine with flush water at some point along a flush water path downstream of the reservoir and upstream of the point where flush water with cleaning agent enters the bowl. In this embodiment 10, the valve 120 can controllably release cleaning agent for combining with flush water at some point prior to bowl entry.

The control system 1000 operates the flush valve 80 to open the flush valve to introduce the dose of a liquid cleaning agent with flush water over the second period of time as noted herein, to at least partially close the flush valve after delivering the dose of a liquid cleaning agent also as described herein and to open the flush valve again, and optionally any jet flush valve 70 in the assembly, if desired after a third period of time (holding time) to purge the interior of a toilet bowl with new flush water at an end of the clean cycle.

The liquid supply valve 120 has the actuator passage (and may have other fittings as well if desired) to either connect the liquid supply valve 120 to the first end of the supply conduit or to act itself as a supply conduit as shown. The system may further include an optional gear pump as noted above in addition to the gear motor 187, also activatable by the control system 1000 for operating any optional mechanized valve like valve 91 or may be configured to operate along with the actuation system as described herein. The reservoir 6 may be seated in a housing 121 and bottom tray 94 configured as shown able to hold a reservoir. The liquid supply valve 120 and reservoir 6 may also incorporate one or more of the venting channels, openings or vent mechanisms described herein although a vent is not shown in FIGS. 17 and 18.

The control system 1000 is activatable and can be initiated by an actuator feature 4. The actuator feature may be a variety of features that a user can manually activate when a clean cycle 100 is desired. For example, the actuator feature may be a switch, a toggle, a button, a touchpad with a series of button options as shown or the like. It may also be remotely activatable by using a remote control and infrared response mechanism as are known in the art, for example, for initiating a flush cycle in an automatic flush toilet. As shown in the drawings and in the embodiment shown as an non-limiting example, the actuator feature 4 is at least one button on a panel. The button is electrically connected in a usual manner to a switch mechanism to send a signal to activate the control system 1000. Upon activation of the actuator feature 4, the control system 1000 is adapted to initiate the clean cycle.

The control system 1000 in one embodiment has a programmable controller for setting the clean cycle features on a set timing sequence. Suitable control systems may include a programmable logic controller (PLC) or a programmable logic relay (PLR) depending on the number of functions. In addition, an Arduino system using open-source programmable software programmed to the timing sequence, sensors and a logic board for inputs and outputs may be used as well. A small, microcomputer may be also used with a touch screen interface for easy interaction of the user and which can also be programmed with a level sensor (not shown) and other sensor mechanisms to give feedback to the user such as liquid level, system errors or the need for maintenance. A wide variety of control systems may be used and the present options listed should not be considered limiting. It is preferred that the system, once programmed has a storage memory for storing the program sequence and may also have an active access memory and interactive software for re-programming the control system or sequence if desired or for downloading upgrades to the program, accessing the Internet or other options as desired, in any suitable manner known in the art or to be developed. The control system preferably is located at or near the actuator feature for easy wiring and connection.

Figure 13:
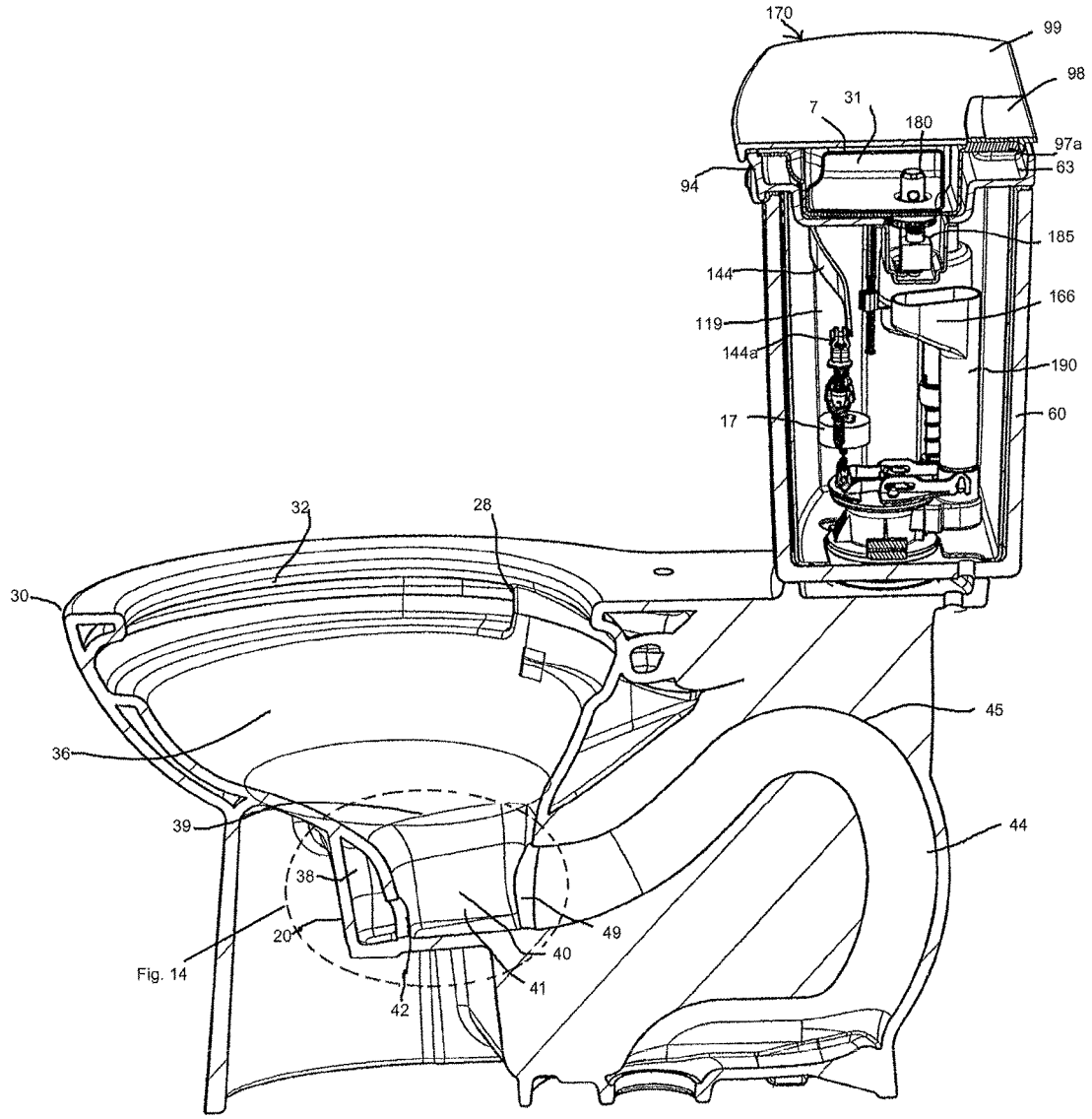
FIG. 13 is a longitudinal cross-sectional view of the toilet assembly of FIG. 8 taken along line 13-13 of FIG. 9 with the flush valves omitted.
Figure 14:
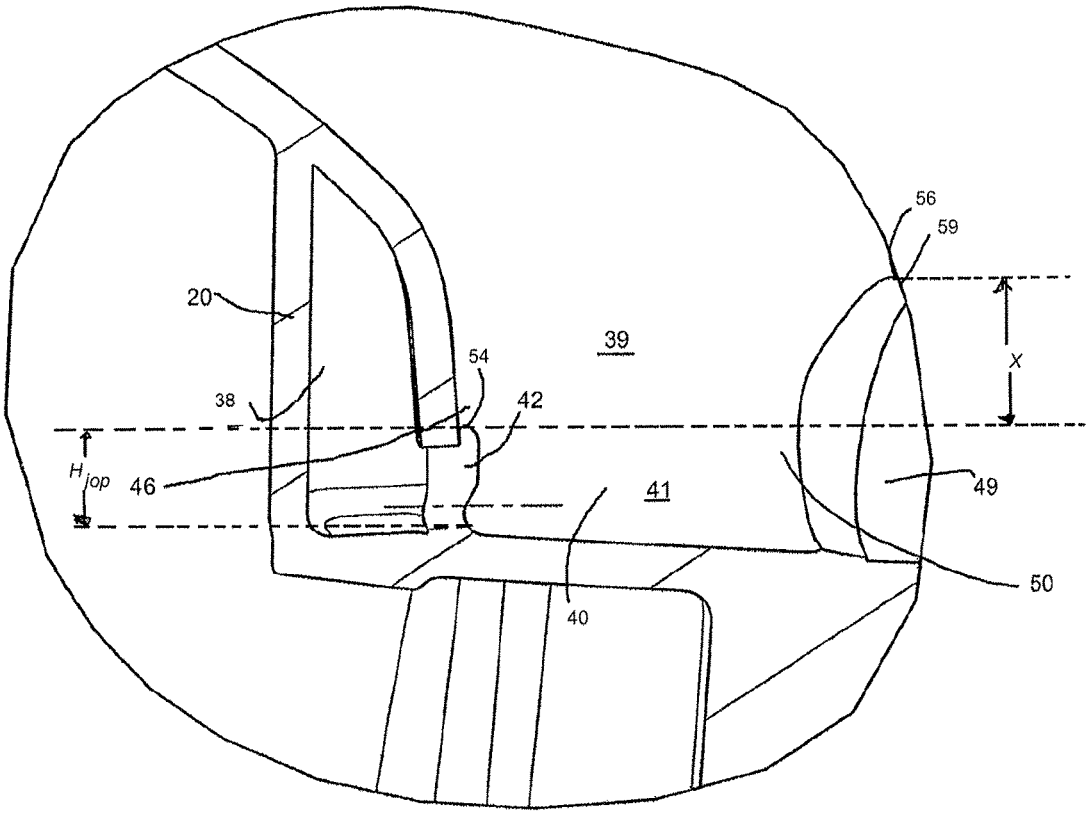
FIG. 14 is a greatly enlarged portion of the toilet assembly of FIG. 13 showing the jet outlet.
Figure 15:
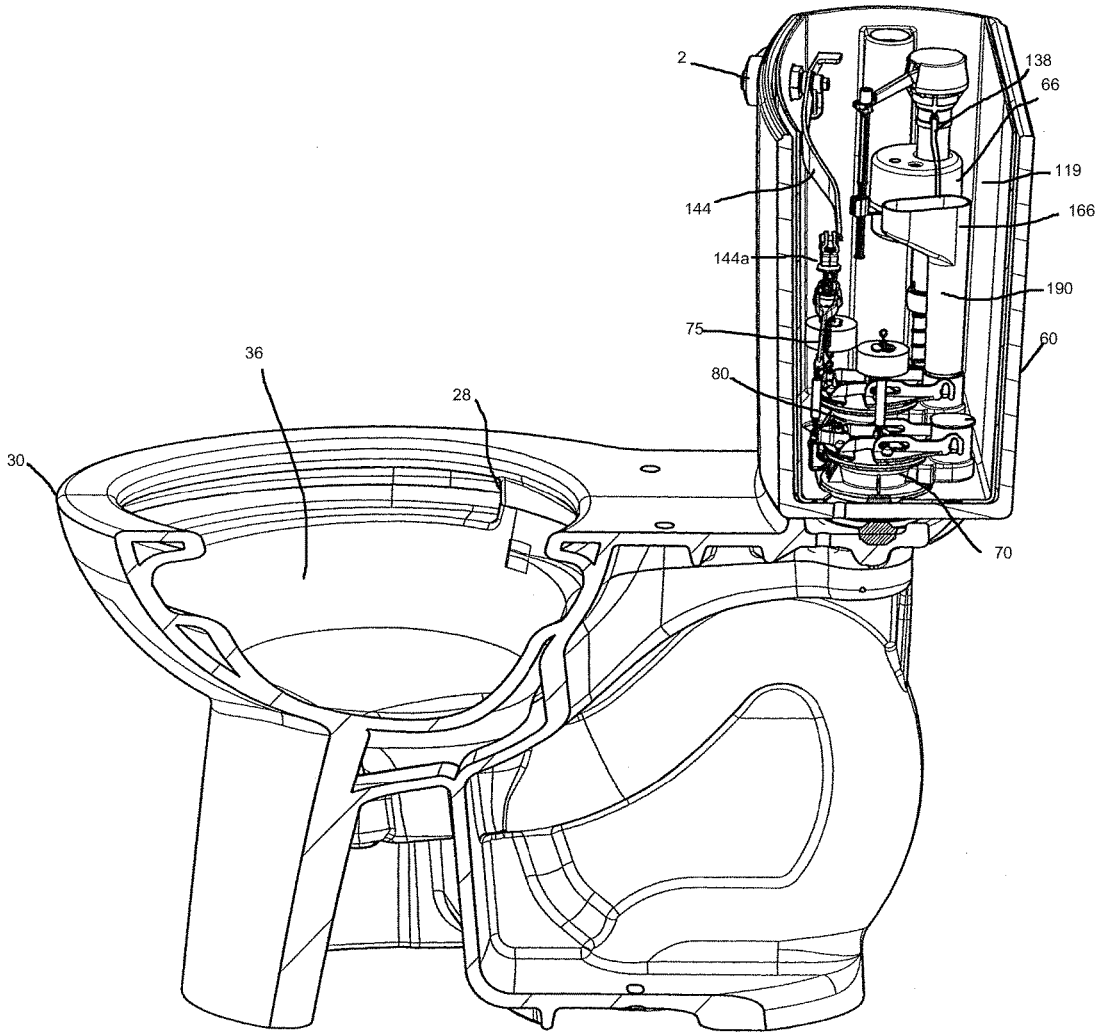
FIG. 15 is a longitudinal cross-sectional view of FIG. 16 taken along line 15-15.
Figure 16:
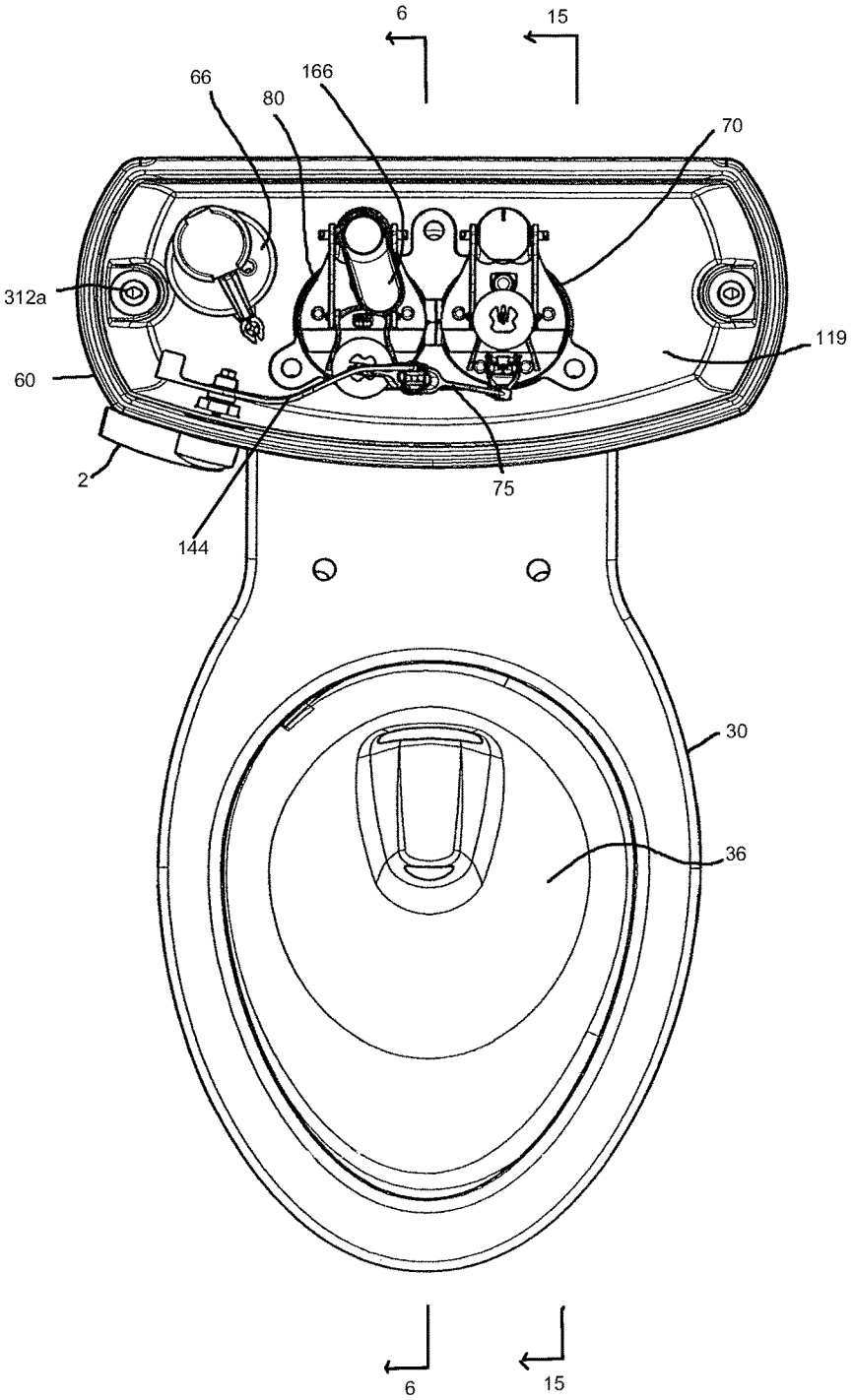
FIG. 16 is a top plan view of the toilet assembly of FIG. 8 having the lid removed from the tank.

As shown, the control system 1000 panel 97 is placed on the tank lid 170 on the housing and is in electrical communication with the actuator feature 4. However, it should be understood that the actuator feature may be placed at a wide variety of locations on the toilet assembly 10, including on a side or front of the tank 60, including near the handle or flush actuation 2 feature. In the embodiment shown, the actuator feature 4, shown as at least one button, is located on the panel 97 on the housing and the CPU 97*a* is located below the panel 97 in a recess 63 in the housing as best seen in FIG. 13. Additional buttons or controls for other features of the control system as desired either may be provided on the panel 97. The top cover 99 preferably overlays and protects the control system panel 97. When the tank lid 170 with the housing 121 is on top of the tank 60, it acts as a wholly separate tank lid. The cover 99 may have an edge 102 or similar indented feature if desired to give the toilet a clean upper lid appearance. As an option, a hinged door 98 may be provided to cover an opening 101 in the lid cover 99 that overlays the panel 97. A finger lift feature may be provided to make the door 98 easy to lift for a user. The user opens the door 98 in the lid 99 to access the actuator button 4 and control panel 97 which are accessible on the portion of the housing that appears through the lid opening 101 under the door 98. The hinged door 98, lid 99, and tray 94 can be composed of various materials and molded thermoplastic or thermosetting polymers, but are preferentially in one embodiment composed of a formable polymer such as urea-formaldehyde or Duraplast™

The cleaning system 100 further includes a housing 121 configured to receive the reservoir 6. The housing seats the reservoir in a seat 57 as well as provides a battery receiving well 61 for receiving a plurality of batteries 61*a*. The well 61 may include typical features for connection with the poles of the desired size batteries lined up to contact such poles and sized to receive the desired battery size. An optional cover 73 may be provided to the top of the battery well 61.

If the reservoir has different features, such as an outlet portion as shown, the housing 121 preferably has a seat portion 74 configured to receive such features, including the optional outlet portion 11 of the reservoir. The seat portion 74 should have a shape complementary to the shape of the outlet portion 11 or other feature to stably receive the outlet portion or area of the reservoir where the outlet port is located. It need not be overly tight and should be configured so that a user can easily slide a reservoir in and out of the housing for changing and/or refilling the reservoir when needed. If desired, a snap fit feature or holding feature (not shown) may be provided for an optional snug fit within the scope of the invention, but is not necessary to the invention.

With reference to a schematic reservoir in FIG. 5, optional openings may be provided in the housing for access also to any vent lines and/or the supply conduit as described further herein which are in fluid communication with the interior of the reservoir as needed. As shown, such optional openings are located in the housing at the base of the seat portion 74, the housing may incorporate a first hole 65 for receiving a first end 75 of the vent line 76. The hole is sized and configured for the vent line, and the vent line may have a variety of sizes from about 1 mm to about 10 mm. Any optional vent line may also be formed within the material of the housing itself. Thus, the hole 65 may extend only part way through the housing and communicate with a passage through the body of the housing material so that it vents at the top of the housing above the liquid level L in the reservoir, when the reservoir is seated. Thus, the vent line 76 is configured to have its first end 75 situated to receive entrained air and/or liquid from the outlet portion 11. It further has a second open end 84 located at least above a height of a full liquid level L in the reservoir. The second open end may also have an optional check valve 85 for also keeping the exiting and/or entering air and/or liquid from passing in the wrong direction in the one-way vent line.

While the tank lid 170 may have the features as shown, it is also within the scope of the invention to vary the physical access to the control panel 97. For example, a portion of a full lid cover seated over the housing may itself be hinged so that a full section of the lid folds upwards to reveal a control panel beneath the lid cover. Such a design may be useful if it is desired to open a larger area for use of a touch screen for example. In addition, a solid lid cover may be used if the actuator feature is placed at a remote location on the toilet, such as on the front or side of the tank 60 or is remotely actuatable using a remote control system.

The system also includes a flush valve operation mechanism 82 as describe briefly above. This feature in a preferred embodiment is described herein in further detail with reference to FIGS. 19-26. The flush actuator handle 2 is connected to flush valve actuator lift mechanism in the form of a lift arm actuator assembly 140 (as best shown in FIGS. 23-26). The lift arm actuator assembly 140 is adapted to operate independently of a flush actuator handle 2. That is, when normal flushing mode is enabled, the flush actuator handle 2 engages a lift arm 144 to open the valve or valves in the toilet as described above, but when the cleaning system is engaged, and the control system is activated, the handle 2 would not operate or move along with the lift arm mechanism, and instead it would be independently operated as described below. The lift arm actuator assembly 140 is adapted with features to enable the flush actuator handle 2 to operate in a first standard mode to simply work with the lift arm 144 and the flush activation bar 75 for opening the flush valves such as flush valve 80 and/or 70 for standard operation, or to operate in a second clean cycle mode.

The assembly 140 includes a lift arm 144 which can be connected to and/or engage a standard flush lift mechanism (such as the flush activation bar and rotatable linkage connector assembly described above) to operate the valves as desired (rim and jet valves in the preferred embodiment, or at least one flush valve if using a convention toilet of the types as described in embodiments 1600, 1700 and 1800). When in the clean cycle mode, the assembly 140 will lift the rim flush valve 80. The lift arm 144 is directly engaged by the assembly 140.

Figure 22:
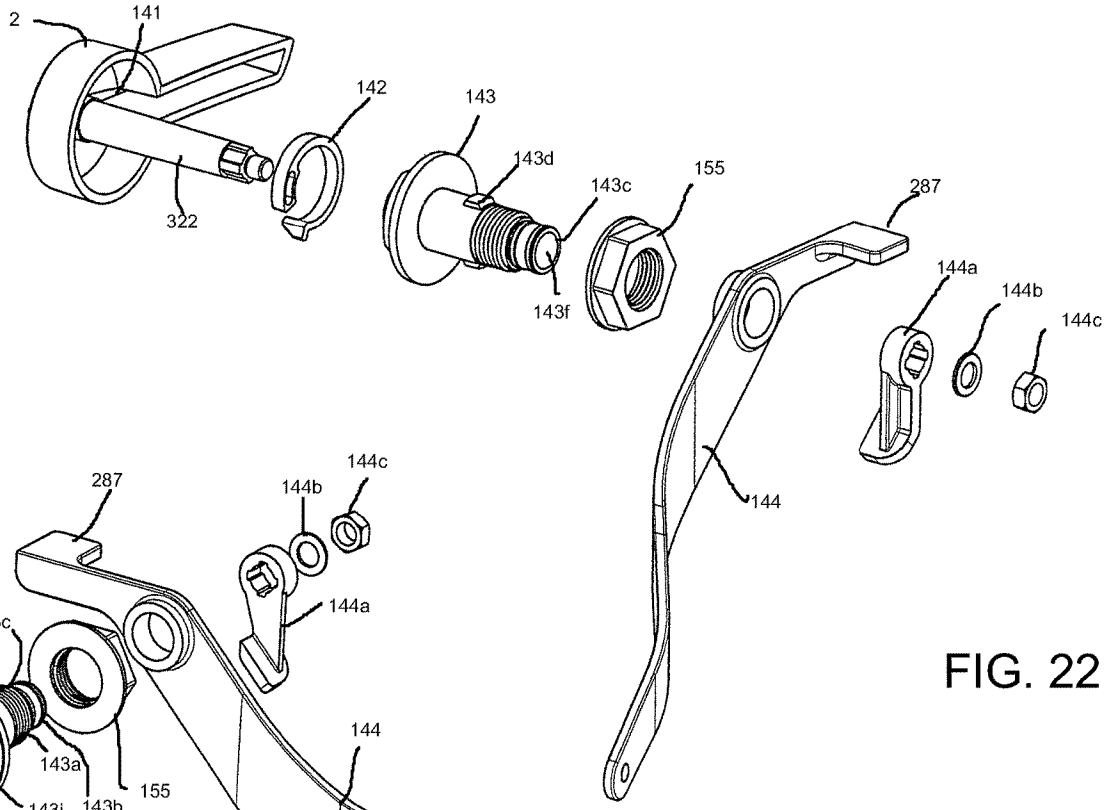
FIG. 22 is an exploded rear perspective view of the lift arm actuation assembly of FIG. 19.
Figure 21:
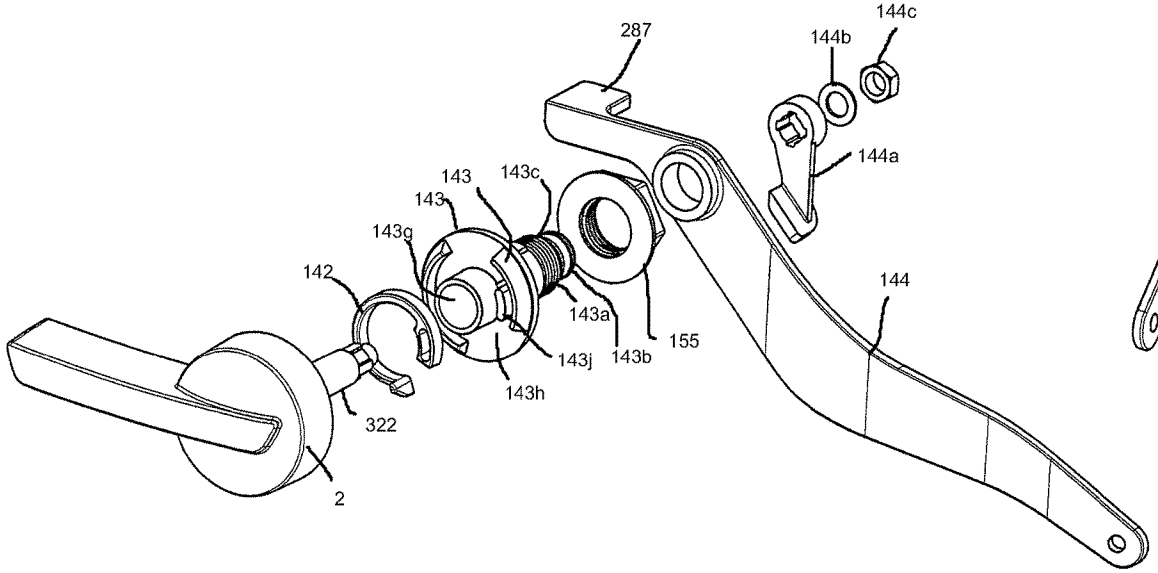
FIG. 21 is an exploded front perspective view of the lift arm actuation assembly of FIG. 19.
Figure 24:
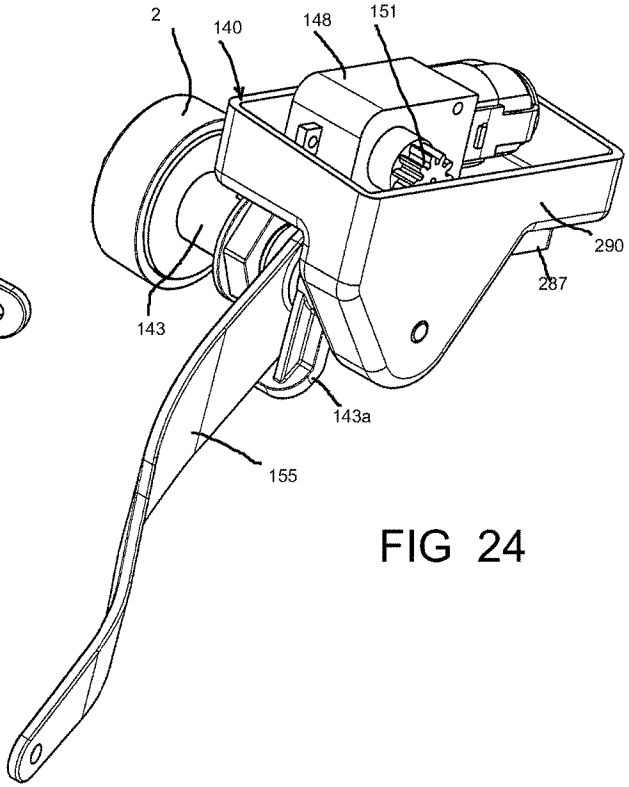
FIG. 24 is a rear perspective view of the lift arm actuation assembly, gear motor housing and gear motor assembly of FIG. 23.

The lift arm 144 has an extension 287 as best seen in FIGS. 21 and 22. Such an extension may have varying shapes, and here is shown as an angled tab. The extension tab engages the housing 290 for the gear motor 148 as described below. The lift arm is also mechanically operated in the clean mode by receiving tab 144*a*. The actuator gear 152 is positioned in a well of the gear motor housing 290. The housing 290 may be molded of any of the polymeric or other materials noted above, and may be a single piece, or multiple attachable/detachable pieces. It is preferred that the housing be in some manner detachable if easy access to interior parts is desired in maintenance of the system. As shown the actuator gear 152 is configured to fit into the housing.

The housing 290 may be one or two-piece. The gear motor housing 290 is configured to sit and/or extend from an opening 96 in the lower tray 94 of the reservoir housing 121 when assembled. It may, if desired extend further upwardly through the opening.

As the lift arm extension 287 and gear motor housing 290 make contact, the lift arm 144 is actuated to operate the opening mechanism for the flush valve.

During the clean cycle, the controller 1000 engages the gear motor 148 in the lift arm actuator assembly 140. The actuator assembly gear motor 148 is thus preferably in electronic communication with the controller. The gear motor 148 as shown is positioned in the gear motor housing 290 and is thus kept dry and protected during operation. The gear motor and associated limit switches 153 are thus positioned in the housing 290 which can be secured to the tray 94 by any suitable method.

In operation, the pinion gear 151 engages the actuator gear 152 which is in the gear motor housing 290. When the pinion gear 151 turns, it is positioned so as to operate the actuator lift arm 144 extension 287 as a trip lever which contacts the gear motor housing 290 which will then limit movement of the lift arm 144 to open the flush valve(s).

In operation, the controller activates the gear motor 148 that operates pinion gear 151. Pinion gear 151 engages and moves along actuator gear 152. The lift arm 144 will operate the valve mechanism until the housing 290 contacts the extension 287 on the lift arm 144 which halts operation. Limit switches 153 can also be utilized to stop the lift arm at the desired position. In preferred embodiments in toilet designs incorporating isolated rim and jet channels, the lift arm is preferably moved to a position sufficiently high to open the rim flush valve but insufficiently high to open the jet flush valve. The lift arm can thus operate either directly in connection with the rim flush valve or through a connecting or linking mechanism, to controllably lift the cover and open the flush valve for the clean cycle. When the controller turns off the gear motor, the action stops and can be reversed by controlled operation of the gear motor. In a normal flush cycle when the gear motor is not operating, the lift arm would then operate the normal flush mechanism without moving to engage the gears which would remain positioned so as not to contact the lift arm extension.

In embodiments with conventional toilet designs, for example, rim-fed jetted bowls, the lift arm can be raised to open only the partial flow mode of the flush valve (see for example FIGS. 31-36). As an alternative to limit switches, a feedback loop from the motor power draw can be used to sense increases and decreases in force upon the lift arm, thereby allowing the PLC to determine the position of the flush valve.

Thus, in the clean cycle, when the gear motor returns the mechanism to its original position, and the handle 2 would operate in standard flush mode. In normal flush mode, the handle 2 has internal ribs 141 that interact with stud 143. The handle also has a flush handle axle 322 that passes through the passageway 143*g* of the stud and engages the actuator gear 152 shown. The stud 143 operates with a torsion stop device 142 against the handle ribs 141 in use. A nut 155 or similar fastening mechanism secure the stud 143 against the handle 2 for operation with the stop device 142 in normal use.

The lid 170 preferably has a lock mechanism 164. The housing 121 has at least one opening 311 and as shown herein has at least two such openings. Similar openings 309 are provided through the tray 94 for receiving the lock. The number of the parts or locks in the lock mechanism (one or more) may vary provided that the lid 170 is stable. Such lock mechanism(s) is/are optional but advantageous for safety and security as well as smooth operation of the gear and cleaning system. The opening(s) 311 extend through the housing 121. They are shaped, sized and otherwise configured for receiving a lock mechanism such as that shown, but the openings may vary to accommodate other and more varied designs.

The lock mechanism in the embodiment shown (see FIGS. 4 and 7) may include as shown herein at least one extending fastener 312, and preferably at least two or more such fasteners, each having a screwable or turnable head 312*a* for extending through the various opening(s) noted above and a second locking end 312*b* which may be configured in various ways to engage a mating locking feature. As shown, a snap end 312*b* fits within a quick lock securement. A snap washer assembly 314 may be provided having a compression spring 313, a push nut/or and washer or similar features. A compression spring 313 may be provided for adjustably locking the fasteners 312. Such lock features then fit within receiving tube(s) 168 within the liner 169 shown in FIG. 2, which liner and tubes can be placed in a toilet tank such as tank 60. Other lock mechanisms could be used (such as a long rod lock, or a screw on cap with interior threads to engage threaded end of a locking rod; other snap fit engagements and the like).

As the reservoir housing, tray and tank lid are integrated they are easily removed for maintenance as one assembly after unlocking the assembly from the liner of the tank, at any time the interior of the tank needs to be accessed. The tank lid 170 may be formed of chinaware like the toilet or its tank or formed of a polymeric material such as a molded composite or molded thermoplastic or thermosetting polymer. The tank may further have a cover 99 in the tank lid 170 so as to fit over the reservoir housing 121 and be positioned thereon for a clean appearance, while still providing easy access for replacement or refilling of the reservoir. The cover 99 should be shaped, sized or otherwise configured to be positioned on top of the tank lid 170 and may have an access opening 101 (or optional door as described in other embodiments herein) as described above for viewing and accessing a control panel/electronic assembly 97 which may also have an actuator button thereon or touch pad control.

The liner 169 may be formed of a variety of materials such as polyvinyl chloride or similar water-safe polymer materials. A small air gap between the liner and the tank can be used to provide anti-condensation properties. The liner may also be used to form the locking rod receiving tubes as shown. A funnel 166 or similar guide feature is preferably also provided to guide or direct flow of cleaning agent from the reservoir directly into the downstream flow for combination with flush water before entering the bowl. As shown, it would direct water into a supply conduit and/or an overflow tube 190. In preferred embodiments, the cover 99 contacts the top of the liner to provide a more consistent vertical and horizontal positioning of the cover with respect to the lift arm mechanism.

The lift arm as discussed above is preferably in operable connection to the flush valve 80 and also may be connected to a jet valve as those described above through a direct or indirect linkage, which linkage may be adjustable. The lift arm 144 is preferably also in operable connection with the flush handle 2, and the flush handle and lift arm 144 may also be connected as described above so as to operate the flush valve during a normal flush cycle. The lift arm actuator assembly is also arranged so as to operate the flush valve without the handle by operation of the lift arm actuator gear motor 148 and at least one gear 151, 152. Thus, during the clean cycle, the user need only use an actuator button or touch pad or other actuator feature 4 (shown as at least one button herein) to engage cleaning and will not see operation of the handle nor need to depress the flush handle. Once the cleaning cycle is over and the flush handle is actuated, the toilet returns to normal flushing.

Upon depressing the button contact is made on the lower portion of the panel 97 to a CPU 97*a* or Arduino assembly for actuating the control system 1000. The control system then actuates the timing of the gear motor 148 for the lift arm assembly 140 and also regulates the timing of release of cleaning agent from within a reservoir shown as reservoir 6.

After introduction, the liquid cleaning agent and flush water remain in the toilet bowl for a predetermined amount of holding time of about 1 min. to about 30 min., preferably about 5 min. to about 25 min. before the cycle ends and a normal flush action will purge the cleaning agent in the flush water and remove the cleaning agent from the bowl. The toilet is then set for normal operation on the next use.

The mechanized valve 91, or gear motor 187 in this case, is operated and opens the liquid supply valve 120 to release a dose of fluid. The dose is predetermined for programming purposes and would be programmed for a set time based on the volumetric flow rate of the cleaning agent through the conduit selected, in this case, the liquid supply valve into the overflow tube through the funnel. The timing should be set so that about 20 ml to about 60 ml of liquid cleaning agent, preferably about 25 ml of liquid cleaning agent passes from the supply conduit, in this case the liquid supply valve passageway to the interior space 103 of the flush valve 80 in communication with the rim inlet port 28. The supply conduit may introduce the cleaning agent solution either by direct injection to an overflow tube of the rim flush valve 80 or via an injector mechanism (not shown) positioned at the base of the flush valve 80 in communication with the interior space 103 inside the rim flush valve's valve body 104. Alternatively, the supply conduit may be configured to bypass the flush valve 80 entirely and pass out of the tank 60 through an opening or along the side of the tank 60 to re-enter the toilet into the rim either through an optional rim manifold or other location on the rim flush path as described herein at any location prior to and upstream of the rim inlet port 28 so that the cleaning agent may be introduced with the additional flush water in admixture.

In the embodiment shown, the cleaning agent flows from the actuated mechanized valve 91 and/or the liquid supply valve 120 to deliver at least one initial dose for a first period of time of about 2 s to about 10 s to deliver the desired quantity of cleaning agent solution to the interior space 103 of the rim flush valve through the overflow tube 190.

The control system 1000 is also configured and programmed to operate the flush valve 80 to mechanically open the flush valve 80 so as to introduce the dose of the liquid cleaning agent with flush water over a set, second period of time. This period of time allows for a slower opening of the flush valve then in a normal flush so that the flush water in the tank can run down into the non-operating toilet for a longer period of time to allow for distribution of the cleaning agent in dilution with the flush water and to hold within the toilet for a set period of time. As the flush valve is normally operated through a flush actuator 2 such as a flush handle and associated linkage mechanism, absent an especially modified flush valve operation mechanism as described herein, the control system requires a separate mechanism for the controlled mechanical opening of the flush valve at the correct time (after dosing) and for the second period of time.

The flush valve is opened so as to deliver approximately 4 l to about 15 l, and preferably about 9 l from within the tank to the toilet. This takes from about 3 s to about 15 s and preferably about 9 s, although the timing can be varied for different systems if desired. The toilet preferably does not have an activated jet during the clean cycle, if such a design is possible, to avoid the toilet dumping the cleaning agent and flush water into the trapway until a sufficient cleaning has been achieved. However, in a conventional, siphonic flush toilet, the control of the flush valve becomes important and preferably a mechanism is provided to block the trapway during this step in the clean cycle and avoid loss of water tipping over the weir. Thus, it is preferred in the present embodiment to incorporate a toilet into the assembly having an isolated rim path and jet path in embodiment 10 so that the jet path can be separate from the operation of the clean cycle.

If more than a cleaning function is desired, and the user would like to clean and disinfect or sanitize, then the cleaning cycle may be modified to optimize the disinfection and/or sanitization function with cleaning. To more readily achieve the bacteria kill levels required by the US EPA for sanitization or disinfection claims, it is advantageous to add dose the bowl in two dosing steps. A first dose may be administered and held and then a second dose of cleaning agent with the last 500 to 1000 ml of water in the cleaning cycle. This ensures that a relatively high concentration of active ingredients remains in the bowl for the residence time of the hold cycle. A higher concentration of cleaning fluid and longer hold cycle are beneficial in reaching the EPA required efficacy levels.

In the preferred embodiment shown, having an isolated rim flow path for the toilet assembly 10, the toilet has a separate jet flush valve mechanism 70, so that operation of the control system 1000 to mechanically and controllably open the rim flush valve 80 will not open the jet flush valve 70, thereby avoiding the formation of a siphon in the trapway and allowing for a more effective clean cycle. The control system 1000 mechanically opens the rim flush valve 80 by lifting its flapper 105 at a controlled rate for a set period of time to deliver the desired cleaning agent and diluting flush water flow through the valve to the rim inlet port.

The control system 1000 then at least partially closes the flush valve after delivering the dose or doses of a liquid cleaning agent during the second period of time (note that the second period of time may include one or more dosing steps with intervening hold periods as noted above for disinfection and/or sanitization). After dosing is completed, the control system then will hold operation for a further, third period of time to allow residence of the cleaning solution in the bowl to achieve the desired level of disinfection and/or cleaning action. The water is held until it settles and for an optimal cleaning time of about 1 min. to about 30 min., preferably, about 5 min. to about 25 min.

After the cleaning period of time or "cleaning hold time," the control system may be optionally programmed to further mechanically re-open the flush valve to purge the interior area 36 of the toilet bowl 30. Optionally, the jet flush valve (as described further hereinbelow) may also be opened during introduction of purge water from the rim (although the timing may vary as to the point of initiation of the opening of the jet flush valve), to introduce additional water and initiate a siphon in the trapway to expel a greater quantity of the cleaning fluid to the drain line and accomplish a more complete purge. Alternatively, the control system may be programmed to simply stop the clean cycle at the end of the hold period. The user would then simply actuate the flush actuator (handle) to start a normal flush cycle which introduces new flush water to purge the bowl at an end of the clean cycle. The first option is preferred as it ensures that no cleaning agent is left in the bowl in the event the user forgets to initiate a further flush to purge the bowl as a safety feature, but both options are acceptable and within the scope of the invention herein.

Figure 27:
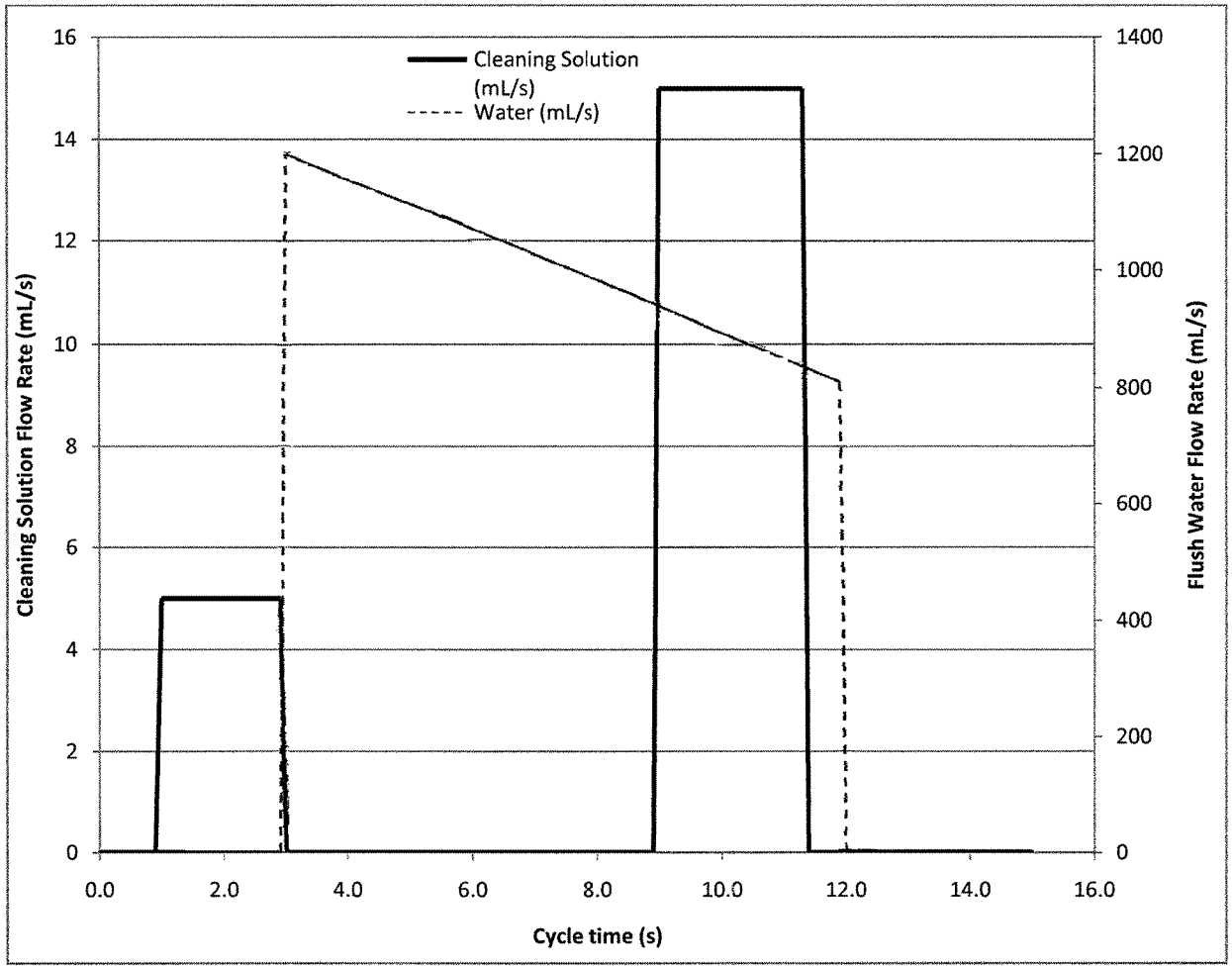
FIG. 27 is a graphical representation of the relationship of cleaning agent solution flow rate and flush water flow rate with respect to the cleaning cycle time.
Figure 28:
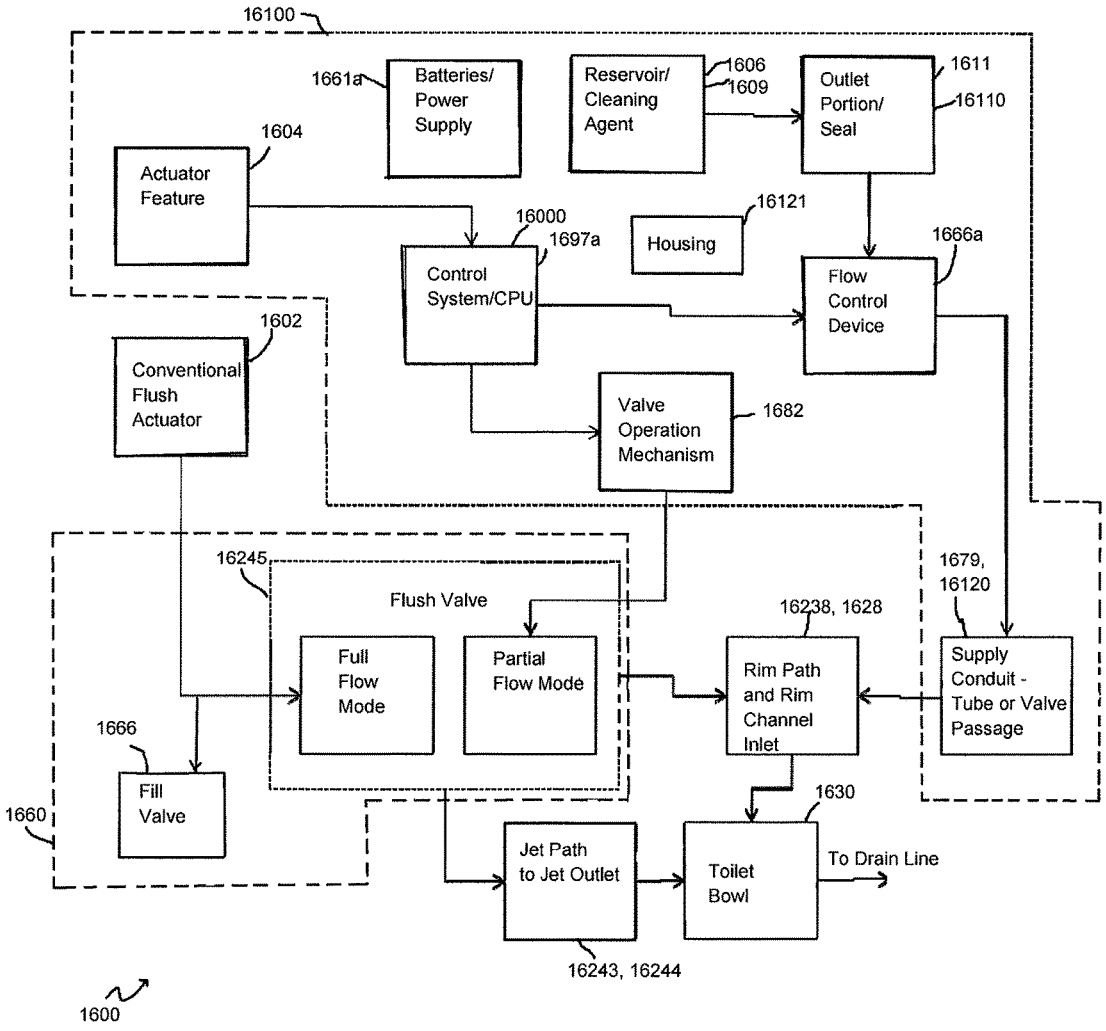
FIG. 28 is a schematic flow diagram of a cleaning system for a toilet assembly according to a further embodiment of the invention using a conventional flush toilet.

Preferred timing of cleaning solution and flush water delivery according to embodiment 10 is shown in FIG. 27. At the start of the cycle, cleaning solution is dispensed from the reservoir by partially opening the valve to provide a flow rate of approximately 5 ml per second for a 2 second duration, delivering approximately 10 ml of cleaner. This initial dose is then dispersed throughout the bowl by opening of the rim flush valve via the lift arm mechanism. Water then flows from the tank to the rim outlet port at a rate of about 1200 ml/sto about 800 ml/s for about 9 seconds, decreasing flow rate as the height of water drops in the tank. About 3 seconds before the end of the water delivery, a larger dose of 30 ml of cleaning fluid is added with the last 2 liters of water, leaving a higher concentration of active ingredients in the bowl for the upcoming hold period. The control system, for example, the PLC will then enter a hold period of 15 minutes, after which a purge cycle will be initiated wherein the lift arm is driven to full extension, opening both the rim and jet flush valves to initiate a standard flush with siphon, evacuating the spent cleaning solution to the drain line and refilling the bowl with clean water.

In this clean embodiment as described above, after initiation of the clean cycle at about 1 second into operation, a dosage time occurs that is the second time period but divided into two dosing step periods 2-1 and 2-2. The first dosing period runs for a few seconds (here about 2 s) introducing about 10 ml to the bowl (at a flow rate of about 5 ml/s). Flush water is introduced and the bowl is held while clean cycle operation occurs for a further period of about 6 s. At that time, an additional about 35 ml of cleaning solution are introduced at a rate of about 15 ml/s over a couple more seconds (here about 2.3 s) while flush water continues to be added but at a rate decreasing over time from close to about 1200 ml/s at about 3 seconds into the cycle down to about 800 ml/s at about 12 seconds into the cycle. This alternative clean cycle with a double dosing step may be used to optimize disinfection in a cleaning and disinfecting cycle to achieve desired levels of sanitary cleaning for the disinfection of germs.

A rimless toilet design may also be incorporated such as those described in International Patent Publication No. WO 2009/030904 A1 or U.S. Patent Application Publication No. 2013/0219605 A1 and International Patent Publication No. WO 2014/078461, each incorporated herein by reference with respect to a description of the operating rimless toilets and their features. In the embodiment shown in WO 2014/078461, the rim is a "rimless" design in that fluid is introduced into the bowl through a rim inlet port 28 travels along a contour or geometric feature(s) formed into the interior surface of the bowl 30. The contour may be one or more shelf(s) 27 or similar features formed along an upper perimeter portion of the bowl. As shown in FIG. 13, the embodiment herein is shown with a similar feature in that it includes a shelf inset into the bowl's chinaware. The shelf(s) also referred to herein as a rim shelf 27 extend generally transversely along the interior surface of the bowl in an upper perimeter portion thereof from the rim inlet port 28 at least partially around the bowl and in an inset contour of the interior surface of the bowl 30.

The toilet bowl 30 may be of a variety of shapes and configurations as with toilet 10 in embodiment 100 described herein, and may have a variety of toilet seat lids and/or lid hinge assemblies. As such lids and are optional they are not shown in the drawings, and any suitable lid known or to be developed may be used with the invention.

As shown in FIG. 13, the shelf 27 can extend around almost the entire interior surface. It terminates to induce a vortex flow effect for cleaning. A rim shelf design can also accommodate multiple rim shelves and multiple rim inlets as described in co-pending U.S. Publication No. 2013/0219605 A1, incorporated herein by reference in relevant part in terms of describing rimless features. A similar design as shown in U.K. Patent Application No. GB 2 431 937 A or any future variations of such designs, wherein the bowl is formed without the traditional hollow rim and water is directed around a contoured interior surface of the bowl in an upper perimeter portion forming a shelf or similar geometrical feature in the contour of the bowl surface as shown that allows fluid to pass around at least a partial path around the bowl entering the interior of the bowl at a location(s) which are transversely displaced form the rim inlet may be used as well. It should also be understood that standard rim channels having a rim inlet port that feeds into a rim channel defined by a traditional upper rim, and having one or more rim outlet ports for introducing washing water into the interior area of the bowl may also be used in the embodiment described herein. Such rim may be pressurized or not pressurized.

In the toilet assembly 10 of embodiment 100, as noted above, the shelf 27 may be inset. The shelf 27 is in a contour having a depth as measured transversely from the interior surface of the toilet bowl into the contour and a height measured longitudinally from the shelf 27 to an upper surface 47 above the shelf which parameters define the width or transverse size of the shelf. The contour can have an inwardly extending portion and an upper surface above the shelf 27 that extends along the shelf but changes in size to provide a deeper shelf in the area where the contour has a first depth and a first height which is somewhat larger than the depth to accommodate strong flow of fluid from the rim inlet port, and maintaining a reasonably large shelf size in a position approximately mid-way between the rear and front of the bowl as rim flow continues along the shelf towards the front of the bowl. While the depth of the shelf is relatively constant, the contour height begins to elongate towards the front of the bowl. For example, the depth may remain between about 15 mm to about 30 mm in the beginning of the rim contour through the mid-way location and to between about 10 mm to about 30 mm in the front of the bowl. Height in these locations varies from about 35 mm to about 55 mm at the outset of flow through the mid-way location to about 40 mm to about 55 mm at the front of the bowl.

As flow continues to the opposite side of the bowl at the mid-way point traveling back from the front of the bowl towards the rear of the bowl, the depth is still relatively constant (although somewhat smaller at the rear of the bowl, but the height can elongate further, e.g., from about 45 mm to about 60 mm at the mid-way point to the rear of the bowl where it is about 50 mm to about 65 mm). As the height elongates, the shelf 27 decreases in size and ultimately terminates.

A number of toilet assemblies may be used with the cleaning system and method herein and various embodiments described herein. Suitable toilets for use with the clean system include all gravity operated siphonic flush valve toilets, as well as single and multiple flush toilets and wash down toilets. Those with a pressurized rim and direct jetpath as in U.S. Pat. No. 8,316,475, incorporated herein in relevant part with respect to the structure and operation of the bowl, may be used. Also useful with the cleaning system in toilet assemblies herein are toilets having control features to regulate rim and jet flow as described in U.S. Patent Application Publication No. 2012/0198610 A1, also incorporated herein in relevant part by reference concerning the operation and features of the toilet therein.

The invention also includes a toilet assembly having a cleaning system, that includes a toilet assembly comprising a toilet bowl defining an interior space, a toilet tank defining a tank interior, a flush valve, a rim in fluid communication with the interior of the bowl through a rim flow path extending from an outlet of the flush valve to at least one rim outlet port, wherein the flush valve is configured to deliver fluid to the rim and wherein the flush valve is configured to operate in a flush actuation mode. The flush valve is able to provide flush water flow sufficient for the toilet assembly to initiate a flush siphon or provide a wash down flush and to operate in a cleaning actuation mode wherein the flush valve is only partially opened to allow for introduction of a cleaning agent and flush water mixture to the bowl that is insufficient to initiate a siphon but sufficient for cleaning the bowl. The cleaning system also includes a reservoir for holding a liquid cleaning agent having a body defining an interior space and having an outlet port in fluid communication with the interior space of the reservoir body. Many of these features have already been describe above with respect to embodiment 10. However, in this embodiment, the toilet assembly may be a more conventional toilet.

The system includes a housing configured to receive the reservoir, a supply conduit in fluid communication with the interior of the reservoir and having a first end for receiving fluid from within the reservoir and a flow control device capable of controlling flow through the supply conduit. A control system activatable by an actuator feature is also provided, wherein upon activation of the actuator feature, the control system is adapted to initiate a clean cycle by: operating the flow control device for a first period of time sufficient to deliver a dose of a liquid cleaning agent from the reservoir to one or more rim outlets, and operating the flush valve in a cleaning actuation mode to open the flush valve so as to introduce flush water to carry the dose of a liquid cleaning agent through the at least one rim outlet port into the toilet bowl at a flow rate insufficient to initiate a siphon but sufficient for cleaning the bowl.

In a conventional toilet such as a direct-fed, non jetted toilet or a wash down toilet, the flush valve may introduce flush water at a flow rate that is about 20% to about 80% slower in the cleaning actuation mode than the flow rate through the flush valve during a normal flush mode, and preferably about 40% to about 60% slower in the cleaning actuation mode than the flow rate through the flush valve during the normal flush mode. In addition, flush water may enter the valve in a flush actuation mode over a period of about 2 s to about 30 s. Flush water and cleaning agent may be introduced into the bowl and have a residence time of about 30 s to about 30 min. for cleaning the bowl.

In one particular embodiment of this assembly, the bowl may be a direct-fed jet, siphonic, gravity-powered bowl. The bowl may alternatively be a rim-fed, jetted siphonic bowl, a non-jetted siphonic gravity-powered bowl or a gravity-powered wash-down bowl.

Further, in an alternative embodiment of this assembly, the flush valve may be a flapper-type flush valve with a poppet feature in the valve cover for use in opening the valve during the cleaning actuation mode. Alternatively, the flush valve may be a flapper-type flush valve with a hook and catch feature for use in opening the valve during the cleaning actuation mode. In yet another embodiment, the flush valve may be a poppet-type flush valve, wherein a poppet-type valve cover opens the flush valve in a normal flush mode and the flush valve has a side port having a cover thereon for use in opening the valve during the cleaning actuation mode.

In addition to the preferred primed jet path toilet described above in embodiment 10 with separate rim and jet flow, the concept of the cleaning system and methods herein may also be adapted for standard toilets, preferably siphonic or wash-down toilets with non jetted or rim-fed jetted construction for reasons described below.

Figure 29:
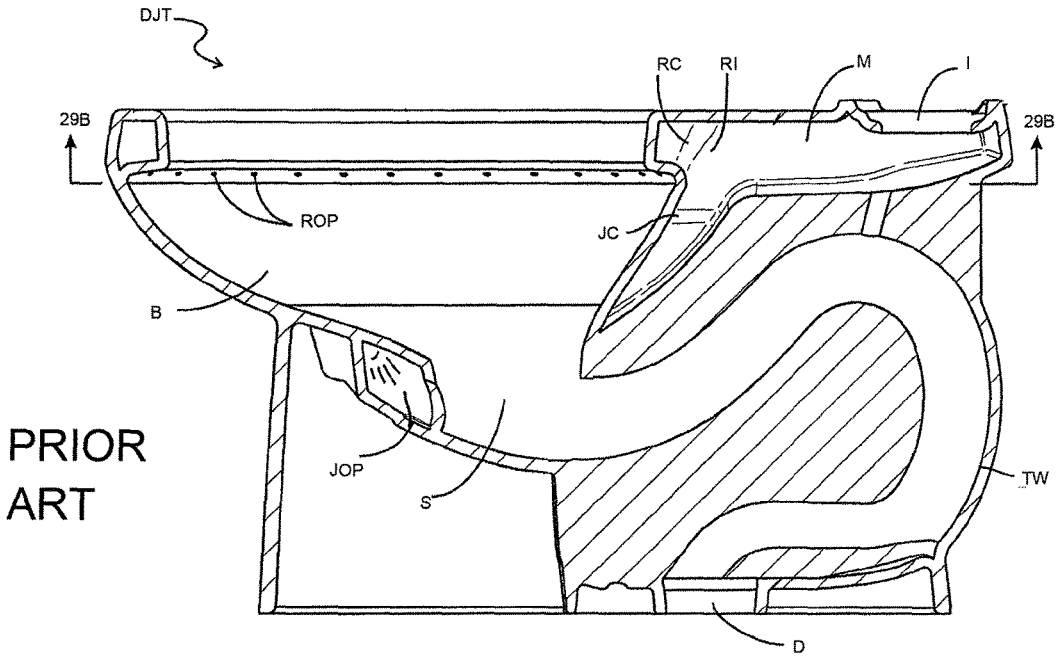
PRIOR ART FIG. 29
FIG. 29 is a longitudinal cross-sectional view of the prior art toilet of FIG. 29A taken along line 29-29 of FIG. 29A.
Figure 29A:
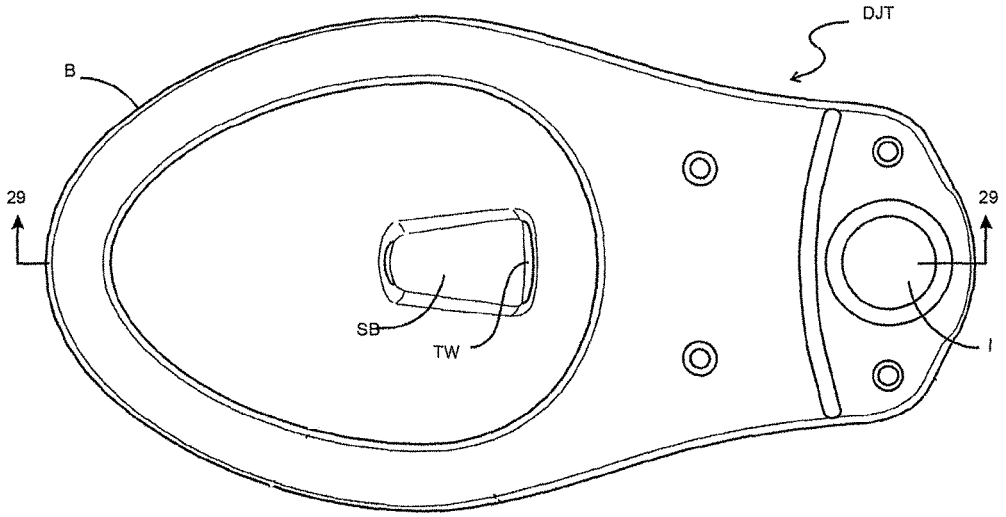
FIG. 29A PRIOR ART
FIG. 29A is a top elevational view of a toilet bowl prior art direct-fed jet toilet bowl demonstrating a direct-fed jet flow path that is not isolated from the rim path.
Figure 29B:
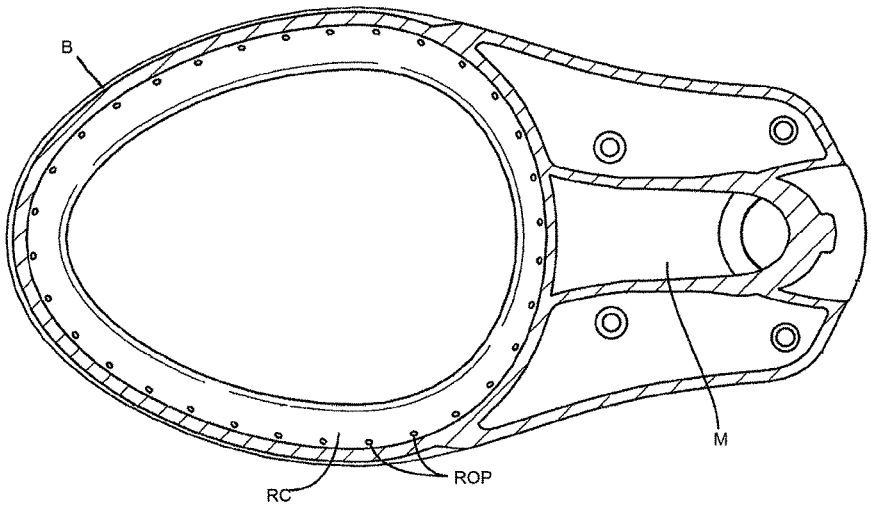
FIG. 29B is transverse cross-sectional view of the toilet bowl of FIG. 29A taken along line 29B-29B.

Direct-fed jet bowls are currently a large portion of toilets sold in the North American and Asian markets for bulk removal of waste. However, while the cleaning systems herein may be adapted for such bowls, they are not preferred for the strongest cleaning action. The reason may be explained with respect to the structure of a such a bowl. An example of a prior art direct-fed jet, siphonic gravity flush bowl is shown in FIGS. 29, 29A and 29B. As can be seen flow into the bowl through inlet I enters a manifold M and splits into a rim channel RC at rim inlet RI and into a jet channel JC. The benefit of the self-cleaning systems herein includes the ability to deliver cleaning fluid to the bowl via a prolonged flow of water to provide a degree of swirling action and turbulent rotating movement that disperses the cleaning agent over the substantially all or the complete surface of the bowl to provide for both mechanical and chemical cleaning action.

This is accomplished by adding the mixture of cleaning agent and flush water at a flow rate that is sufficiently high to carry it over the required surfaces and provide required mechanical action but not high enough to initiate a siphon. Imitation of a siphon would carry a large quantity of the cleaning agent from the bowl B into the drain line D before the cleaning agent had sufficient residence time to accomplish its true cleaning and/or sanitizing potential.

In the prior art direct jetted toilet DJT shown in FIG. 29, if the flush water and cleaning agent are delivered at a slower rate, insufficiently high to initiate a siphon, most of the flush water would enter the jet channel JC and flow through the jet outlet port JOP into the sump S and trapway TW. The jet channel is "downhill" with respect to the manifold M and rim inlet RI so that gravity pushes most of the water into the jet channel. Insufficient water and cleaning agent are able to arrive in the rim channel RC and exit rim outlet ports ROP to accomplish the desired cleaning action. When such direct-jetted toilet systems are flushed at their full, design intended flow rate, only about 30% of flush water crosses over the jet inlet to the jet channel JC to make it to the rim outlet ports, and this occurs only because the flow rate from the flush valve exceeds the maximum flow rate achievable through the jet channel and jet outlet port, causing water to back up in the jet channel and enter the rim inlet port. Thus, the cleaning systems herein would likely send most of the cleaning agent to the sump and out the drain, imparting little cleaning action to the surface of the bowl above the waterline. The cleaning systems herein may be adapted and used with a prior art direct jetted toilet as shown in FIG. 29 or a similar design, however, the cleaning action above the water line will not be as effective as that of other toilet constructions discussed herein.

Figure 30:
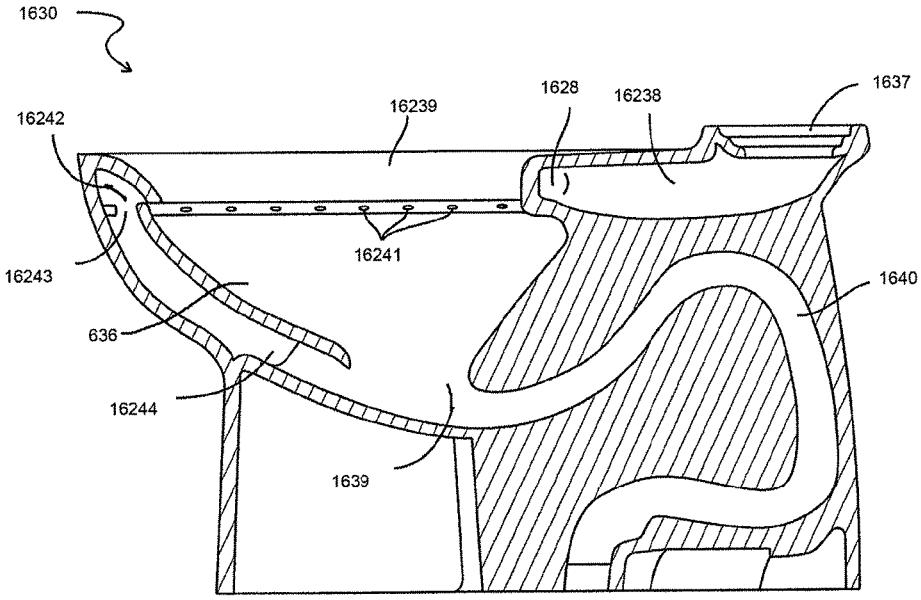
FIG. 30 is a longitudinal cross-sectional view of a further prior art toilet bowl having a rim-fed jet and demonstrating a rim-fed jet flow path.

The cleaning systems herein can be adapted to other standard toilets with minor modifications as described below. As shown in FIG. 30, a rim-fed jetted bowl 1630 may be adapted for use in a further embodiment of the system herein, referred to as embodiment 1600. In embodiment 1600, all of the systems of embodiments herein, including various valve opening mechanisms, flush actuators, alternative reservoirs including motorized cam-operated, and other cleaning agent introduction valves of embodiments 10, 300, 400, 500, 700, 800, 900, 1200, 1300, 1400, 1500 and 1900 may be used with the toilet assembly 1630 of the present embodiment. Thus, only the distinct aspects that adapt the system for use in a standard rim-jetted toilet bowl assembly, other than the toilet 1630 and its flush valve operation as described below would be otherwise the same. To the extent there are variations in the bowl and valve, they are described herein. In a rim-fed jetted bowl, the self-cleaning system can function well due to the toilet geometry. A typical rim-fed jetted bowl is shown in FIG. 30 as bowl 1630 (although other rim-fed designs may be used). Flush water will flow in such a geometry from the bowl inlet 16237 into a primary manifold 16238 in a manner known in the art for such toilet bowls. From the primary manifold, flow exits into an open rim channel formed by an upper hollow rim inlet port 1628.

As used herein, "rim inlet port" in a rimless design is the port through which flush water enters the bowl area through an opening that enables swirling flow around the interior of the bowl, such as along a rim shelf 27 as described above in the prior embodiments, or is the entry opening into a traditional rim channel formed in a hollow peripheral upper rim around the toilet. Such a hollow rim defining a rim channel is well known in the art. There may be one or two inlets 1628 in that flow can pass out of the manifold 16238 in only one direction though a hollow rim 16239 defining an interior rim channel 16240 or may pass in two opposite directions through two ports so that flow passes from the primary manifold 16238 at the rear of the bowl 1630 on each side of the rim channel towards the front of the bowl.

Several outlet ports 16241 are formed in the rim facing the interior 636 of the bowl 1630. Such outlets may be all of equal size or have some which are larger for additional washing action if desired.

As flow reaches the front of the rim-fed jetted bowl 1630, it passes over a rim-fed jet inlet 16242 of a rim-fed jet 16243 and downwardly through the jet 16243 to a rim-fed jet outlet 16244. Thus water enters the bowl from the rim either through the rim channel outlets 16241 or through the rim-fed jet outlet 16243 into the sump area which leads to a trapway.

When the cleaning system herein is configured to include a rim-fed jetted bowl 1630, a greater quantity of cleaning agent and flush water will enter the bowl through the rim through outlets 16241 so that less water is directed to the sump and trapway. Thus, if flow rate and valve release are controlled as discussed below, sufficient residence time may be obtained to allow for good functioning of the cleaning systems of any of embodiments 10, 300, 400, 500, 700, 800, 900, 1200, 1300, 1400, 1500 and 1900 on a standard rim-fed bowl 1630.

Typical non-jetted gravity-powered bowls have a configuration like that of a rim-fed jetted bowl as shown in FIG. 30, with the exception that the rim channel remains solid and there is no rim jet. The bowl remains a solid wall in its front portion with no jet running from the rim to the sump. Such non jetted bowls can also function well with the cleaning systems herein in that all flush water must exit a hollow rim (such as that shown above for bowl 1630) through rim outlet port(s). In such designs, it is also more common that one or more of the rim outlet ports will be made larger than the typical rim outlet ports to provide more flow of flush water in a desired location, generally near the front of the bowl so as to give a stronger stream of flush water directed to the entrance of the trapway for the bowl in a manner that mimics a jet action bowl. Like a siphonic non-jetted bowl, there are also similar bowls known as wash-down bowls that typically have a slightly different toilet geometry with respect to the trapway and rim outlets. Wash-down bowls are generally of construction similar to that of non-jetted siphonic bowls, with the exception that the trapway is not designed to support a siphon. The trapways of wash-down toilets are generally larger in cross-sectional area and of relatively simple P-trap or S-trap geometry for wall and floor outlet installations, respectively. Instead of the traditional rim, with multiple outlet ports, they are often constructed with an open underside to the rim to allow for higher flow rates into the bowl and more efficient carry of waste over the weir of the trapway.

Installation of cleaning systems as described hereinabove in rim-jetted, non-jetted or wash-down standard toilets is more effective than other standard toilet designs in that cleaning agent and flush water can be directed from rim outlet ports (or an open rim) in a greater quantity onto the surface of the bowl for cleaning and less is wasted in the trapway and sump area.

As such traditional bowls that are conducive to the cleaning systems herein differ from the primed manifold bowl having an isolated jet path as described in detail in prior embodiments and in International Application Publication No. WO 2014/078461, it is necessary to take account of the lack of the isolated rim and jet paths, and separate rim and jet valves when introducing cleaning agent to the bowl through the rim as there is now, in most of such standard bowls only a single flush valve that introduces fluid to a manifold and/or rim channel for introduction to the bowl.

A slower rate is required for introduction of flush water and cleaning agent to avoid initiation of the siphon effect in the rim-fed jetted or non jetted bowls, or avoid a more powerful flush in the case of a wash-down toilet. Such siphon or power flush can otherwise prematurely carry too much cleaning agent out of the bowl through the trap before it accomplishes the intended cleaning action. It is also important to hold the flush valve open for a longer duration than a normal flush during the cleaning cycle. This is accomplished by providing modified flush valve designs for achieving the slower rate and longer clean cycle residence time when the clean cycle is initiated, which would not work appropriately with a standard flush valves in a standard toilet. Standard flush valves come in a variety of configurations, including flapper cover valves that have a hinged cover opening or poppet valves that have a central axis for upward floatation of a cap or lid cover.

Figure 31:
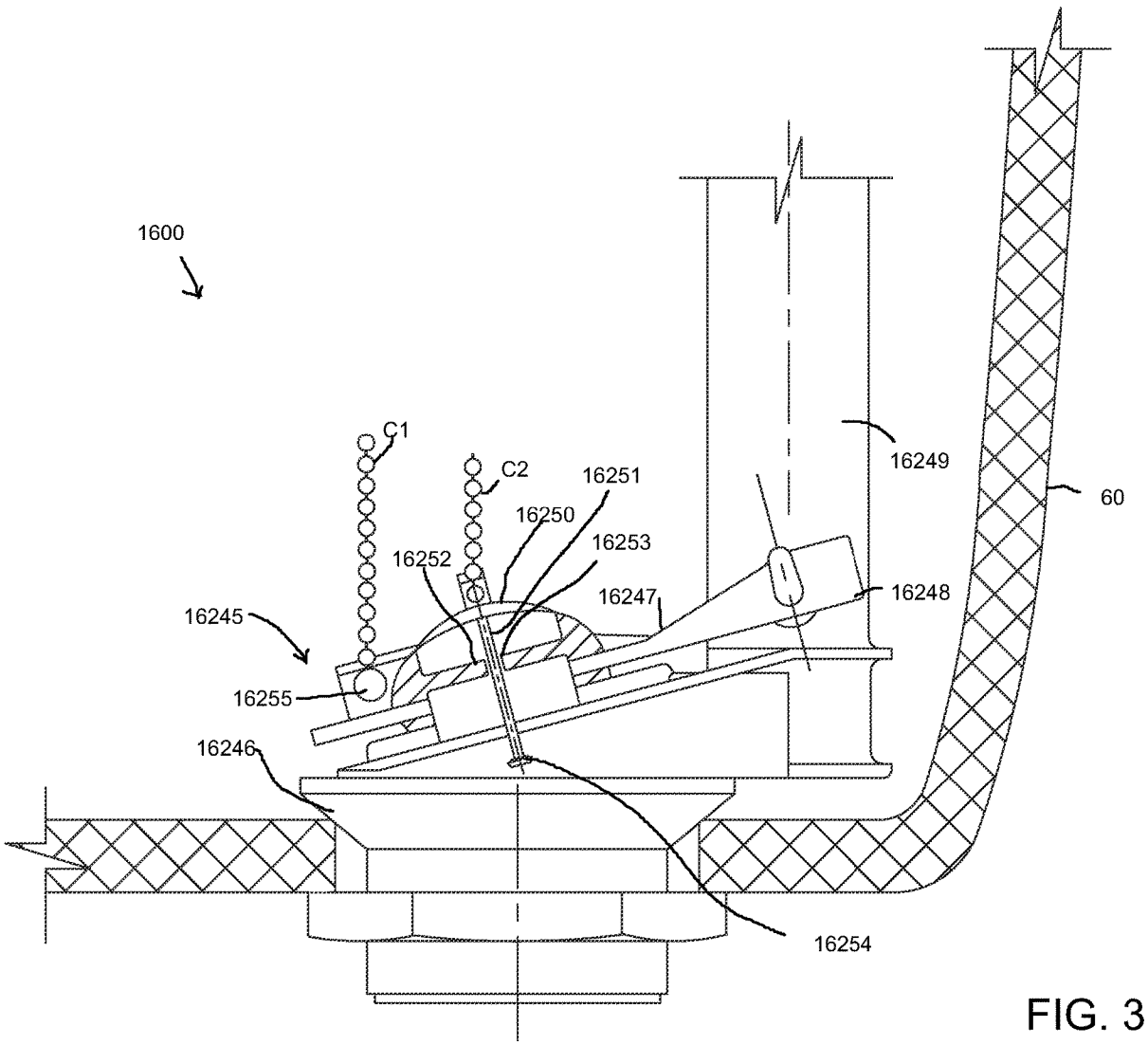
FIG. 31 is a side-elevational view of a flush valve according to an embodiment of the invention suitable for use in a cleaning system with a conventional toilet, wherein the valve has a flapper cover with a poppet feature in the closed position.
Figure 32:
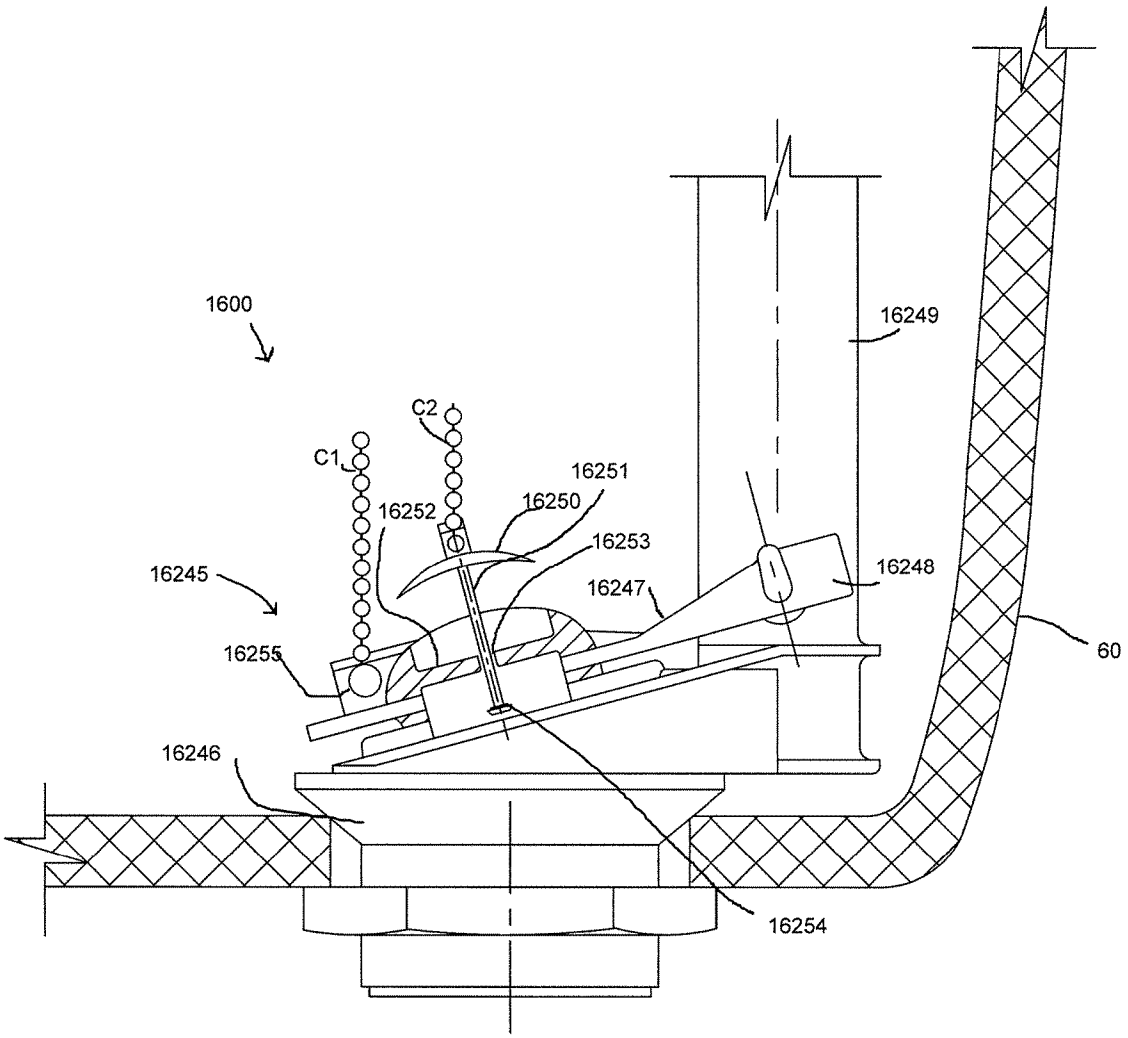
FIG. 32 is a side-elevational view of the flush valve according to FIG. 31 in the open position for the clean cycle of the systems herein.

The modified valves will be further explained with respect to a first flush valve 16245 for use in an embodiment using the rim-fed jetted bowl 1600 of FIG. 30, although it should be understood that other types of standard bowls (such as wash down or non-jetted) may also use the modified flush valve 16245 as described herein. As such, embodiment 1600 includes a combination of the toilet 1600 with the flush valve shown in FIGS. 31 and 32, wherein the valve is in the closed and open positions, respectively. The flush valve 16245, as shown in FIGS. 31 and 32 has a valve body 16246 that is seated in an opening in a tank 1660 which may be the same as tank 60 in embodiment 10 herein. The valve 16245 has flapper-type cover 16247 with a poppet feature as described below. The cover 16247 is connected to the flush valve body 16246 at a hinge mount 16248 located on the overflow tube 16249 (the overflow tube may be like the overflow tube 190 previously described). The poppet feature 16250 has a guide rod 16251 or other coaxial guide structure to enable it to move reciprocally through a guide ring 16252 defining an opening 16253 for receiving the guide rod 16251. The end of the guide rod is either sized larger and/or is configured so as to have a stop feature 16254 that keeps the guide rod 16251 from passing fully out of the guide ring 16252 when moving upward so as not to detach from the cover 16247.

When poppet activation chain C2 is pulled upward, the poppet feature 16250 moves upward opening the area blocked by the poppet feature 16250 when against the cover 16247. Water enters at a rate sufficient to carry cleaning fluid (which can, for example be introduced through the overflow tube 16249) and accomplish the cleaning action desired using the cleaning systems herein without initiating a siphon. Chain C2 is attached to the top of the poppet feature 16250 through a link, grommet or similar feature.

When the clean cycle is complete, and normal flushing is again desired, the flush actuator will pull upward on chain C1 which is attached at the link 16255 and pulls the entire cover 16247 upward to allow water from the tank 60 to enter through a larger valve inlet opening spanning the interior of the valve body to achieve a flow rate sufficient to initiate a siphon for normal flushing action.

Figure 33:
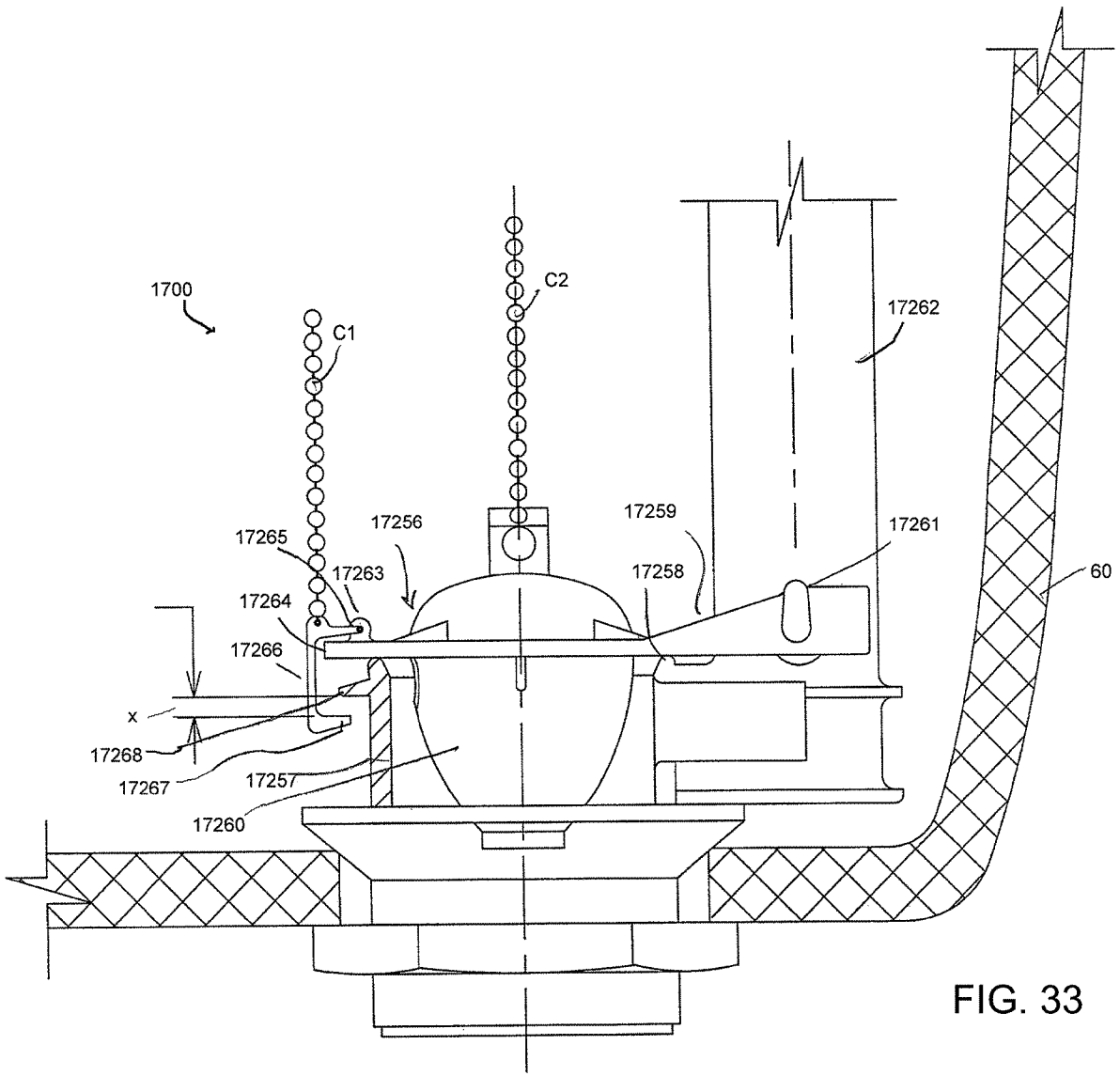
FIG. 33 is side-elevational view of a flush valve according to an alternative embodiment of the invention suitable for use in a cleaning system with a conventional toilet, wherein the valve has a flapper cover with a bulb and hook and catch feature in the closed position.
Figure 34:
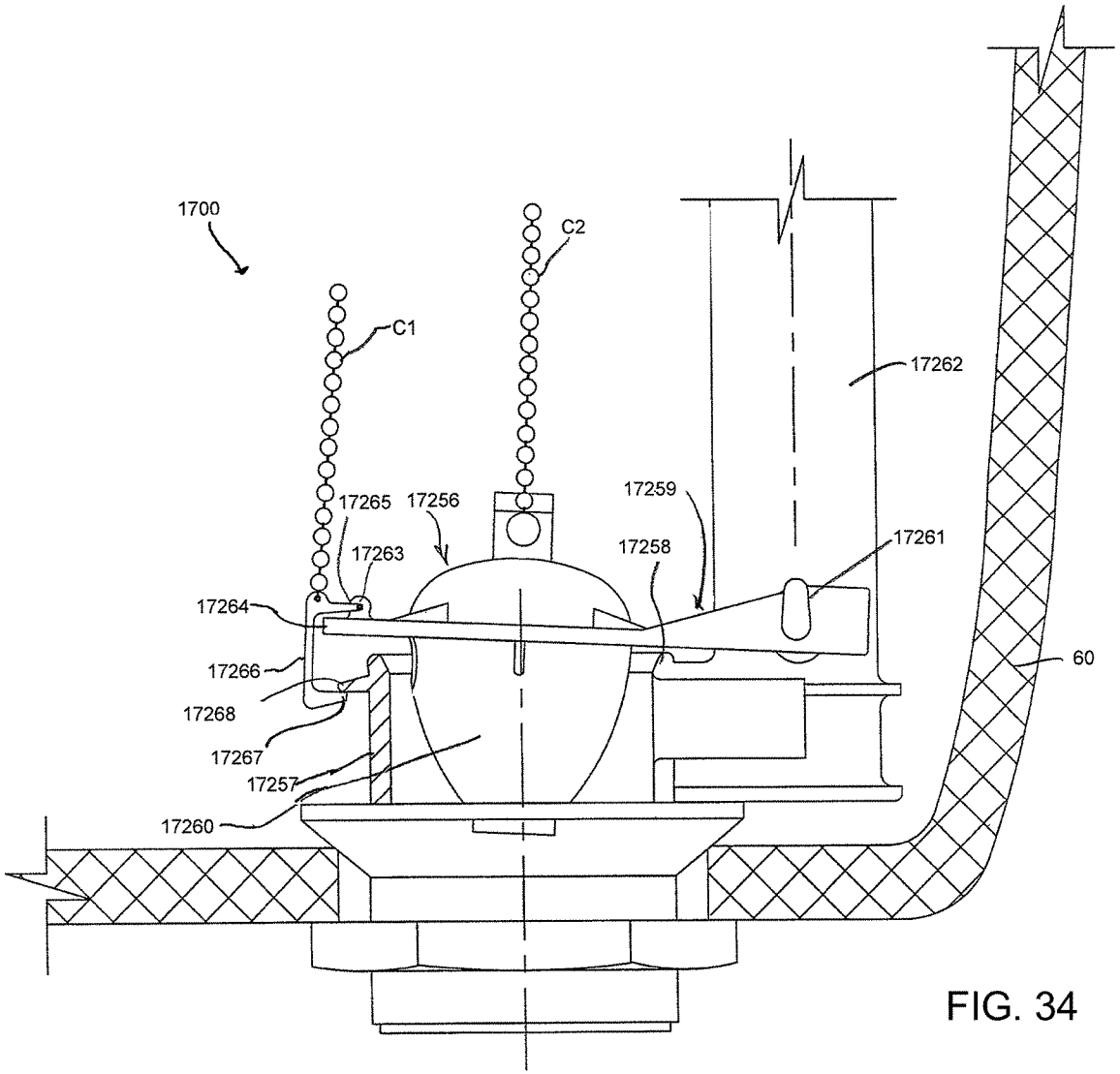
FIG. 34 is a side elevational view of the flush valve according to the embodiment of FIG. 33 in an open position for the clean cycle of the systems herein.

In another embodiment of a flush valve for use with the standard toilets described above, as demonstrated by embodiment 1600, a further alternative valve for use in a system having such toilets is shown in FIGS. 33 and 34 and identified as embodiment 1700. It should be noted that it is being explained with reference to the toilet of 1600, but could be used with any of the standard toilets described above. Embodiments 1600, 1700 (and 1800 described below) may use any of the systems, mechanical parts, and method steps as illustrated above for the cleaning systems described in embodiment 10 or in other embodiments herein, such as embodiments, 200, 300, 400, 500, 700, 800, 900, 1200, 1300, 1400, 1500, and 1900 with the exception that embodiments 1600 and 1700 use one or more types of standard gravity-powered siphonic or wash down toilets, particularly non-jetted, rim-jetted or wash down toilets, and employ as a result modified valves as described herein, as opposed to the toilet 10 and variations thereof described in prior embodiments in which the toilet has an isolated rim and jet flow and a primed jet path.

In valve 1700, in FIGS. 33 and 34, a valve 17256 is shown having a flapper-type cover with a bulb and a hook and catch feature. The flush valve 17256 has a valve body 17257 shown in cross-section having a laminar, generally cylindrical interior and a radiused inlet 17258. Flapper cover 17259 has a buoyant bulb 17260 for assisting in lift and floating of the flush valve in normal flushing operation. The cover 17259 is attached to the valve body 17257 at a hinge mount 17261 on the overflow tube 17262 (which may be like other overflow tubes described herein). A further hook hinge mount 17263 is provided on a first, front end 17264 of the flapper cover 17259 opposite the side of the flapper cover hinge mount 17261.

The hook hinge mount 17263 engages a first mounting end 17265 of a hook 17266. As shown in FIG. 33, the flush valve is closed and the cover 17259 is in contact with the top of the valve body 17257 at the radiused inlet 17258. In this position, the second catching end 17267 of the hook 17266 is hanging loose and does not engage the valve body. Water cannot flow into the flush valve 17256 in this position. When a regular flush cycle is initiated, the hook 17266 is sized so as to rotate and swing around the catch 17268 when the flush actuation chain C1 is raised by the flush actuator of the toilet (which may be any of those flush actuators described in the cleaning systems noted herein or a standard flush actuator). This opens the flapper cover 17259 as in FIG. 34 to completely to allow sufficient flush water to enter the valve to initiate a siphon and flush the bowl or in the case of a wash down toilet to allow enough water to enter the trapway. For the hook 17266 to have such clearance, a gap x sufficient of about 1 mm to about 6 mm when in a resting position as shown in FIG. 33.

In a cleaning cycle using a cleaning system according to embodiment 1700, cleaning cycle actuation chain C2 is raised using the mechanisms described herein so as to lift the flapper cover 17259 to a point where the second end 17267 of the hook 17266 engages the catch 17268. This allows a gap between the cover 17259 and the radiused inlet 17258 on the top of the valve body for allowing limited flush water at a lower flow rate to enter the flush valve. This lower rate is sufficient to carry the cleaning agent which may be introduced into the valve body through the overflow tube 17262 into the standard toilets described herein, and provide the swirling, mechanical agitation needed but without sufficient flow to initiate a siphon.

Figure 35:
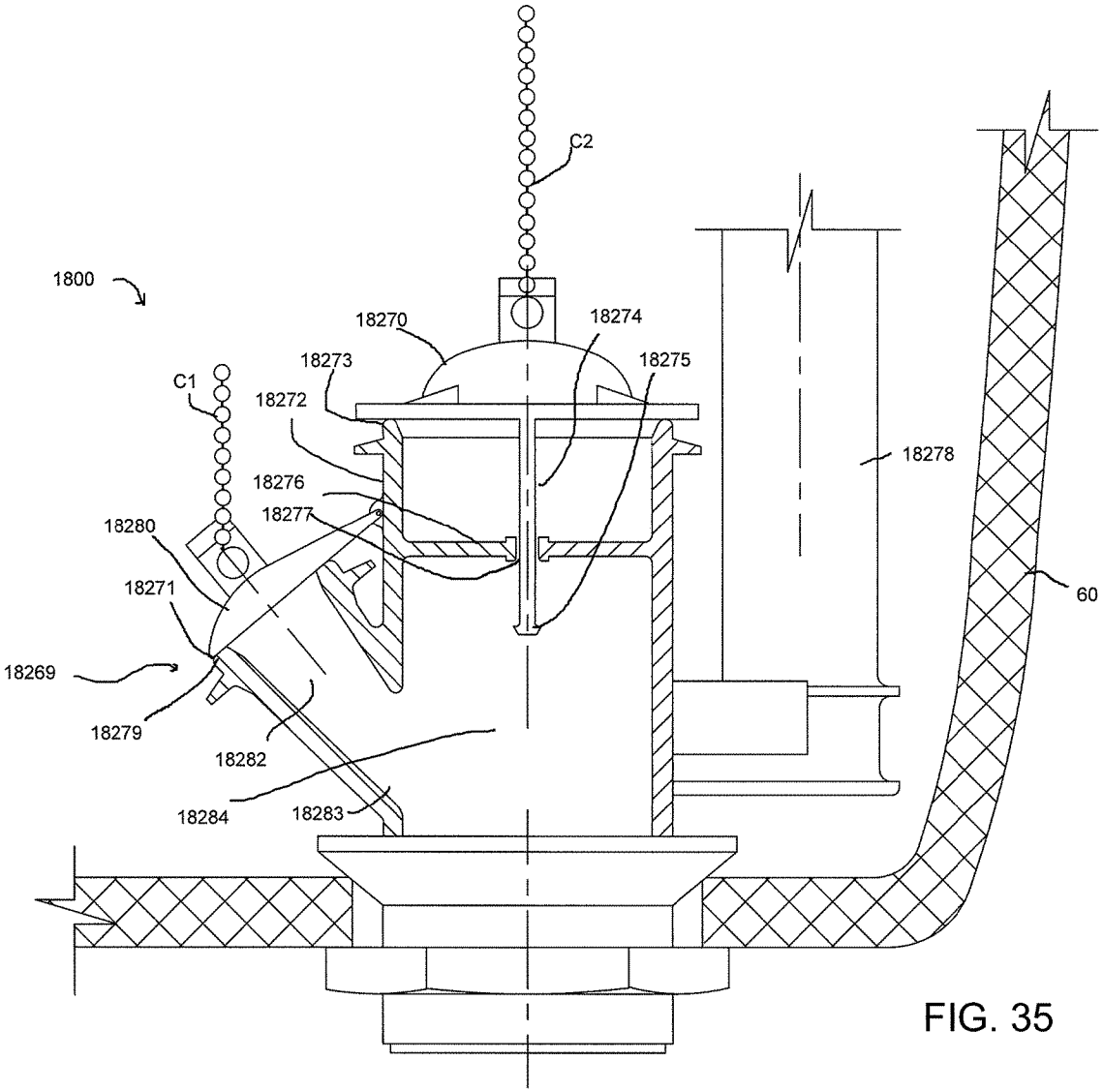
FIG. 35 is a side elevational view of a flush valve according to a further alternative embodiment of the invention suitable for use in a cleaning system with a conventional toilet, wherein the valve has a separate flapper-covered side port in the closed position.
Figure 36:
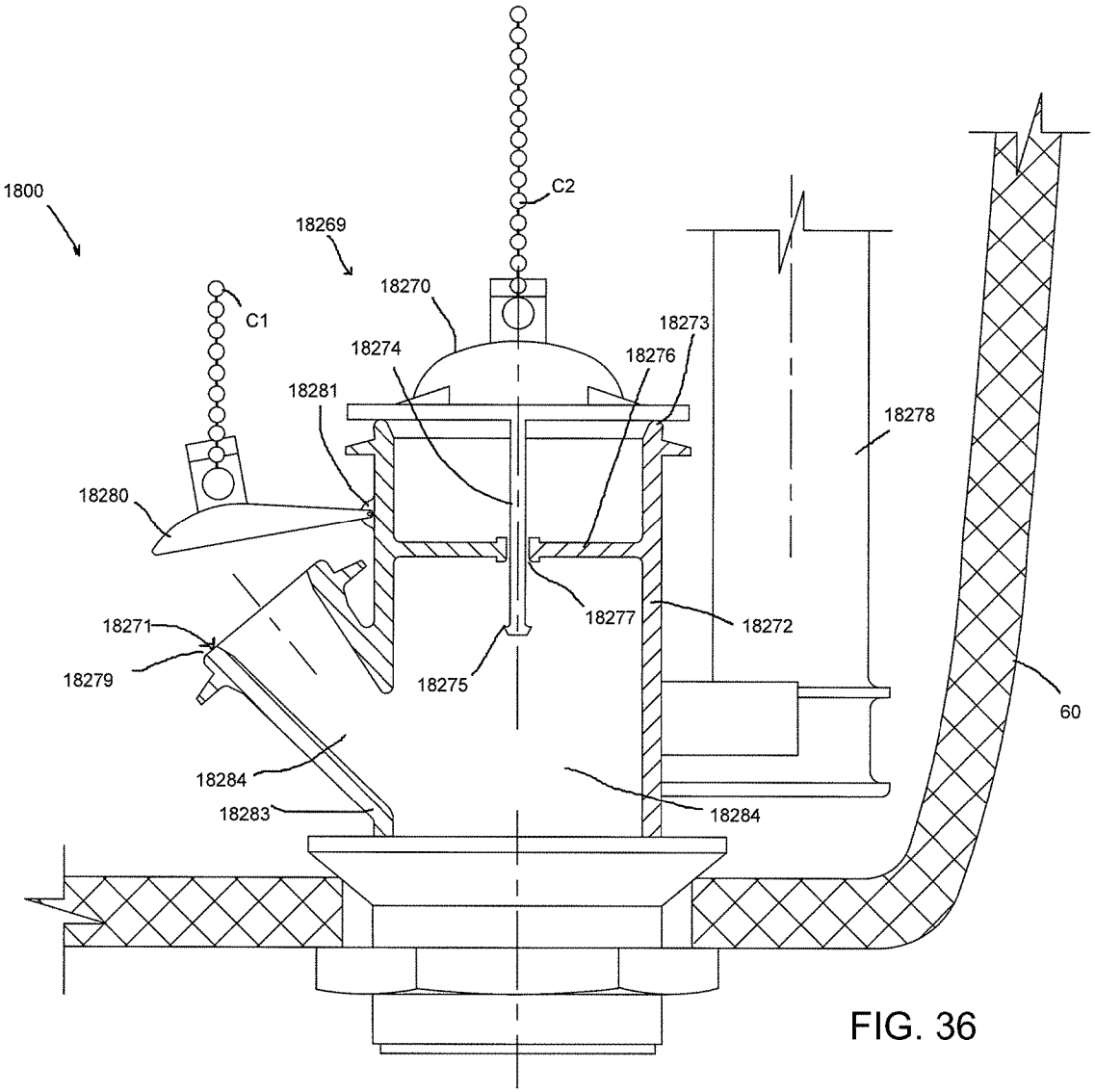
FIG. 36 is a side-elevational view of a flush valve according to FIG. 35 in the open position for the clean cycle of the systems herein.
Figure 37:
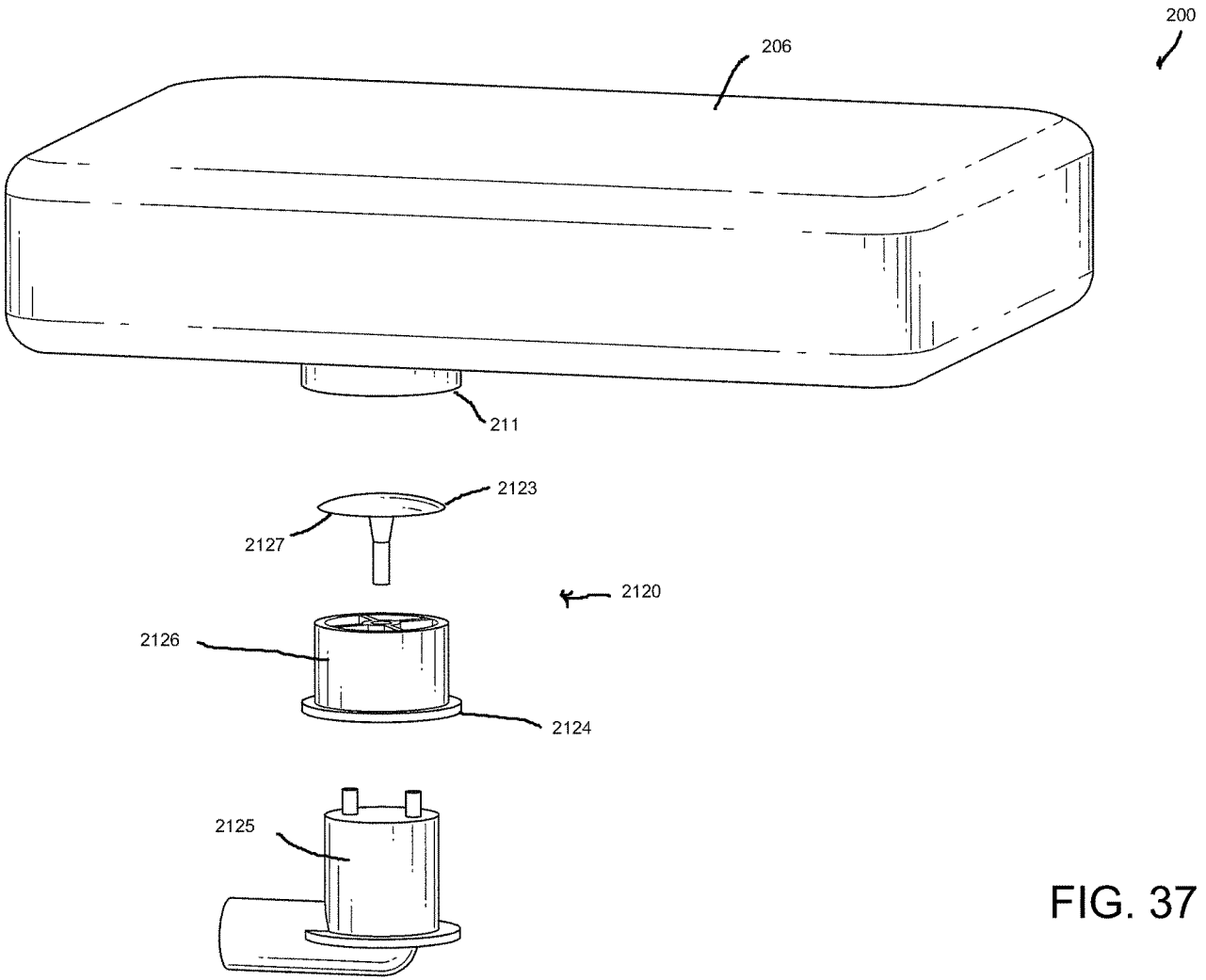
FIG. 37 is an exploded view of an alternative reservoir assembly including a fluid supply valve for use in an alternative embodiment of the clean systems herein.

In a further embodiment of a flush valve for use with the standard toilets described above, as demonstrated by embodiments 1600, a further alternative valve for use in a system having such toilets is shown in FIGS. 35 and 36 and identified as embodiment 1800. It should be noted that it is being explained with reference to the toilet of 1600, but could be used with any of the standard toilets described above. As with embodiments 1600 and 1700, embodiment 1800 may use any of the systems, mechanical parts, and method steps as illustrated above for the cleaning system described in embodiment 10 as well as in other embodiments 200, 300, 400, 500, 700, 800, 900, 1200, 1300, 1400, 1500 and 1900 herein, with the exception that embodiments 1600, 1700 and 1800 use one or more types of standard gravity-powered siphonic or wash down toilets, particularly non-jetted, rim jetted or wash down toilets, and employ as a result modified valves as described herein, as opposed to the toilet 10 and variations thereof described in embodiment 10 in which the toilet has an isolated rim and jet flow and a primed jet path.

In valve 1800, in FIGS. 35 and 36, a valve 18269 is shown having a poppet-type cover 18270 with a side port 18271. The flush valve 18269 has a valve body 18272 shown in cross-section having a laminar, generally cylindrical interior and a radiused inlet 18273. The poppet cover 18270 has a depending guide rod 18274 for guiding in a centrally axial manner the poppet cover upward during a standard flush cycle and back to a closed position when the cycle is complete during a normal flush operation. The guide rod 18274 has a stop 18275 at its end that engages a guide ring 18276 having an opening 18277 therethrough axially aligned with and configured to receive the guide rod. The valve 18269 also includes an overflow tube 18278 (which may be like other overflow tubes described herein).

The side port 18271 has a first end 18279 (which may optionally be provided with a radiused edge) having a side port cover 18280. The cover has a hinge 18281 (although it may have any suitable opening mechanism). The side port has a passage 18282 therethrough that extends from the first end 18279 of the side port 18271 to a second end 18283 which is in fluid communication with the interior 18284 of the valve body 18272. The side port cover 18280 is operable by a first chain C1 in FIG. 35 actuated during a clean cycle operation by the control system as described above. In a standard flush cycle, the cover 18270 is lifted by a second chain C2 shown in FIG. 35.

In operation, as shown in FIG. 35, the flush valve is closed and the cover 18270 is in contact with the top of the valve body 18272 at the radiused inlet 18273. In this position, the side port 18271 is closed and the cover 18280 of the side port is also closed. Water cannot flow into the flush valve 18270 in this position. When a regular flush cycle is initiated, the chain C2 is activated so as to pull cover 18270 upward when the flush actuation chain C2 of FIG. 35 is raised by the flush actuator of the toilet (which may be any of those flush actuators described in the cleaning systems noted herein or a standard flush actuator). This opens the poppet-type cover 18270 completely to allow sufficient flush water to enter the valve to initiate a siphon and flush the bowl or in the case of a wash down toilet to allow enough water to enter the trapway. At the end of a flush cycle, the cover 18270 would close and the valve would be back in the initial closed position.

In a cleaning cycle, using a cleaning system according to embodiment 1800, the cleaning cycle actuation chain C1 of FIG. 35 is raised using the mechanisms described herein so as to lift the side port cover 18280 to allow only limited flow of flush water to enter the side port 18271 as shown in FIG. 36. The side port is configured and/or sized to allow limited flush water at a lower flow rate to enter the flush valve. This lower rate is sufficient to carry the cleaning agent which may be introduced into the valve body through the overflow tube 18278 into the standard toilets described herein, and to provide the swirling, mechanical agitation needed but without sufficient flow to initiate a siphon.

Other embodiments may also be similarly designed to work in a manner wherein the valve opens partially in some manner for a lower rate flush water entry into a valve body during the clean cycle sufficient to enable cleaning agent to combine and enter the toilet for an active cleaning operation, while insufficient to initiate a siphon, and then a separate flush using full flow rate to engage standard flushing to purge the bowl of cleaning agent and introduce new flush water. For example a flush valve may be configured with a standard poppet lid and coaxial guide rod to allow a full flush operation with a flush activation poppet lift chain and also to have a side opening (which may be an extension body) having a separate, smaller opening path and hinged lid operable on a separate cleaning cycle actuation chain.

For each of the valves and proposed embodiments of flush valves for standard toilets described herein, optional features may be provided for use with the valves described for standard toilets when employed in cleaning systems herein (as in embodiments 1600, 1700 and 1800) including use of a radiused inlet as is known in the art and shown in embodiment 1700 (and if desired for a particular flow path); an elevated valve body, if desired and preferably if it does not negatively impact the cleaning flow rate through the valve during the cleaning actuation; a backflow preventer mechanism such as any of those in International Patent Application Publication No. WO 2014/078461 for controlling valve operation and opening rate; an overflow vent scoop as described in co-pending U.S. Non-Provisional application Ser. No. 14/183,290 of applicant herein; interior baffles for flow direction; additional attached floats (as in U.S. Patent Application Publication No. 2014/0090158 A1) which may be hooked on either a flush actuation chain or a cleaning cycle actuation chain for optimizing valve timing; and the like.

For optimal operation, in a conventional bowl, such partially opened valves open in gaps or are partially lifted a optimized distance (or have separate side openings), etc. (Partial Flow Mode) to allow flow in a rate that is sufficient for good cleaning with the cleaning agent/flush water mixture, but not sufficient to initiate a siphon in a bowl that does not have an isolated jet path. Acceptable gaps in embodiment 1700 are such that the flow rate achieved through the partially opened valve is between about 20% and about 80% of the full flush flow rate for a given toilet design (i.e., the flow rate required to achieve complete siphon or complete wash-down action), and partial openings above the inlet of the valve body in an embodiment such as 1600 are of similar measurements as is the area available to allow flow through the side opening port in embodiment 1800. Preferably, the flow rate achieved through the partially opened valve is between about 40% and about 60% of the full flush flow rate for a given toilet design. The standard flush actuator (whether electronic or a standard flush handle (or mechanized handle as noted herein)) is then preferably engaged to purge the bowl in a standard flush cycle.

In operation for all of the flush valves described herein, a cleaning cycle actuator 1604 (such as an actuator button or mechanized actuation handle with gear drive, etc. as described herein) is activated. The control system 16000 as described above operates the system to initiate one of the various embodiments noted above for controlled introduction of a cleaning agent from a reservoir 1606 through a liquid supply valve 16120 or other valve assembly into an overflow tube 16190 or other entry point in the flush valves described in embodiments 1600, 1700, and 1800 prior to introduction of flush water to the toilet 1630 through a rim inlet port 1628 (whether a rim inlet port in a separate and isolated rim valve as in the primed toilet of embodiment 10 or a rim inlet port to a rim channel as in a standard toilet such as non-jetted bowl, a rim-fed jetted bowl or a wash down bowl. The flush valve in each bowl is actuated by the control system 16000 such as a CPU to open the flush valve for controlled release of cleaning agent mixed with flush water into the bowl without the bowl flushing/siphon initiation causing unwanted loss of cleaning solution before the cleaning cycle is complete as described in detail above. At the end of the cleaning residence time, a conventional flush may be actuated in a normal manner (or through a programmed actuation) to release full flow of clean flush water to the bowl and purge the cleaning agent/flush water mixture from the clean cycle and debris removed by the cleaning agent.

As with the variations in toilet assemblies and varying flush valves to accommodate the different operation of different toilet assemblies, the embodiments herein may be varied by providing alternative flow control devices 66*a*, such as by using various modifications of a liquid supply valve 120 as described above and in some cases modified reservoirs to work with variations in the liquid supply valves or to provide additional features. The following provides various alternative liquid supply valve embodiments.

Figure 38:
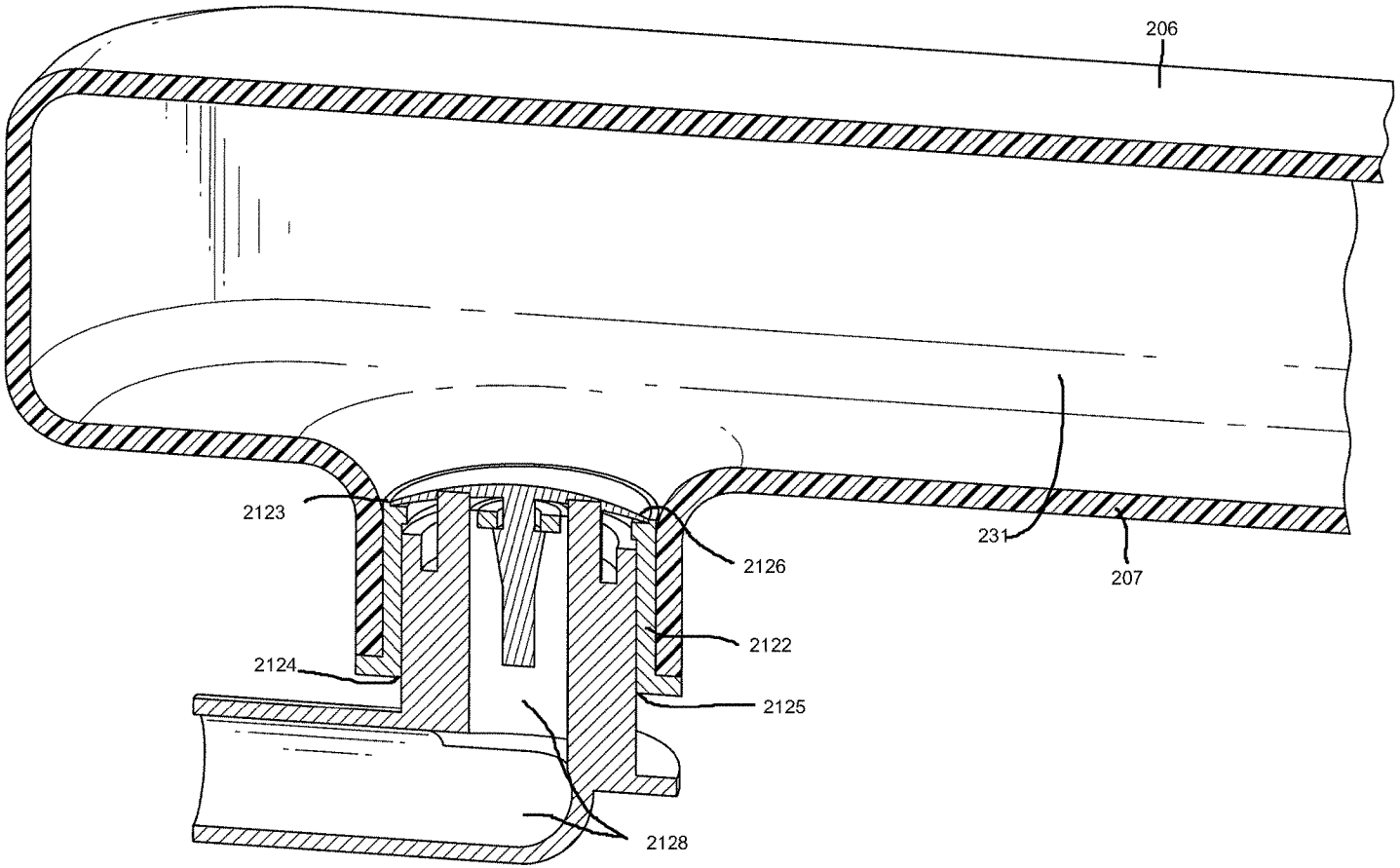
FIG. 38 is an enlarged longitudinal cross-sectional view of the valve assembly of FIG. 37.

With reference to FIGS. 38 and 38, in a further embodiment 200 herein, the cleaning system as noted above is in all other respects the same as cleaning system 100 of embodiment 10 noted above, with like numerals being used to indicate like parts throughout, with the exceptions noted below. This embodiment includes an alternate reservoir and liquid delivery system. In this embodiment 200, a reservoir 206 has a liquid supply valve 2120 positioned so as to be situated within the optional outlet portion 211 of the reservoir 206 when it is seated in a complementary housing. The liquid supply valve 2120 defines a passage 2122 therethrough that receives the valve fitting 2125. The valve 2120 has a first upper end 2123 for directing cleaning agent solution or other fluid from the interior space 231 of the reservoir 206 through the passage 2122 in the valve body 2126 and through the interior 2128 of the fitting 2125 when in place. Such fitting may act as a feed to a overflow tube or to a first end 78 of a tubing type of supply conduit or another similar supply conduit pathway into the flush valve of the toilet assembly. The valve 2120 also has a second lower end 2124 through which the fitting 2125 passes.

In embodiment 200, a mechanized valve 91 (as shown in FIG. 5 and which may be the same as the valve in embodiment 100) may also used as in conjunction with the liquid supply valve 2120 as an alternative flow control device and is preferably capable of controlling flow through a supply conduit 79 or into an overflow tube. The control system 20000 is also activatable by an actuator feature such as actuator feature 4 in embodiment 10. Upon activation of the actuator feature 4, the control system 20000 is adapted to initiate a clean cycle by operating a mechanized valve 91 as noted above for a first period of time sufficient to deliver a dose of the liquid cleaning agent solution 9 from a supply conduit 79 and/or an overflow tube 190 to an interior space 103 of a valve body 104 of a closed flush valve 80 configured for delivery of fluid to a rim inlet port 28 of a toilet bowl 30 as noted above in embodiment 10. The control system 20000 may be programmed and include features as noted above with respect to control system 1000. The control system 20000 also operates the flush valve 80 to open the flush valve to introduce the dose of a liquid cleaning agent with flush water over the second period of time as noted above, to at least partially close the flush valve after delivering the dose of a liquid cleaning agent also as described above and to open the flush valve again, and optionally any jet flush valve in the assembly, if desired after the third period of time (holding time) to purge the interior of a toilet bowl with new flush water at an end of the clean cycle.

The liquid supply valve 2120 may have the valve fitting 2125 in communication with the second end 2124 of the liquid supply valve 2120 for connecting the second end 2124 of the liquid supply valve to a first end 78 of the supply conduit 79. The liquid supply valve 2120 may be a variety of suitable valves used in the art for this purpose having different valve seals 2127, for example, the seal may be an umbrella valve, a duckbill valve, a spring loaded valve, a rotating valve, a vented elastomeric valve, and a flap elastomeric valve. As shown, the liquid supply valve 2120 has an umbrella valve seal. As with the embodiment 100, the system may further include a gear pump and/or a gear motor 23 also activatable by the control system 20000 for operating a mechanized valve 91. The reservoir 206 may be seated in a housing 121 and bottom tray 94 configured to hold the alternate 206 reservoir and housing 121 and a top cover 99 in a tank lid 170 in the same manner as embodiment 10, wherein the bottom tray 94, housing 121 and lid cover are configured to as to be positioned on a top of a toilet tank 60 so that the top lid or lid insert sits in place of a standard tank cover and the bottom tray sits within an interior of a toilet tank above a toilet flush valve. The tray 94 and housing 121 may be modified by one skilled in the art to take account of the valve fittings and shape as described above.

Figure 39:
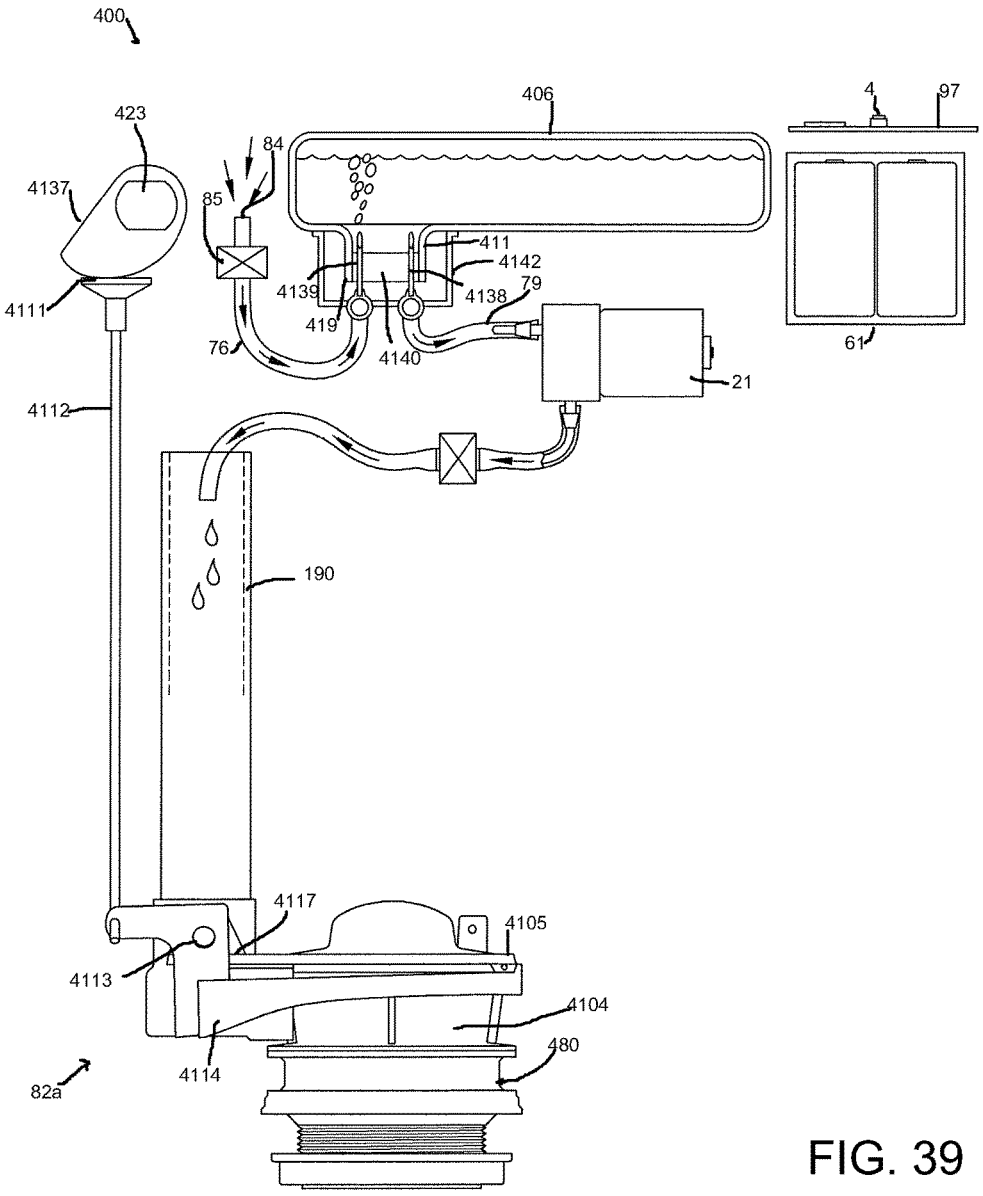
FIG. 39 is a schematic diagram of the features of an alternative reservoir for use in a further embodiment of the clean systems herein having piercing injection needle-type tubes in the housing seat and an alternative flapper lift mechanism.
Figure 40:
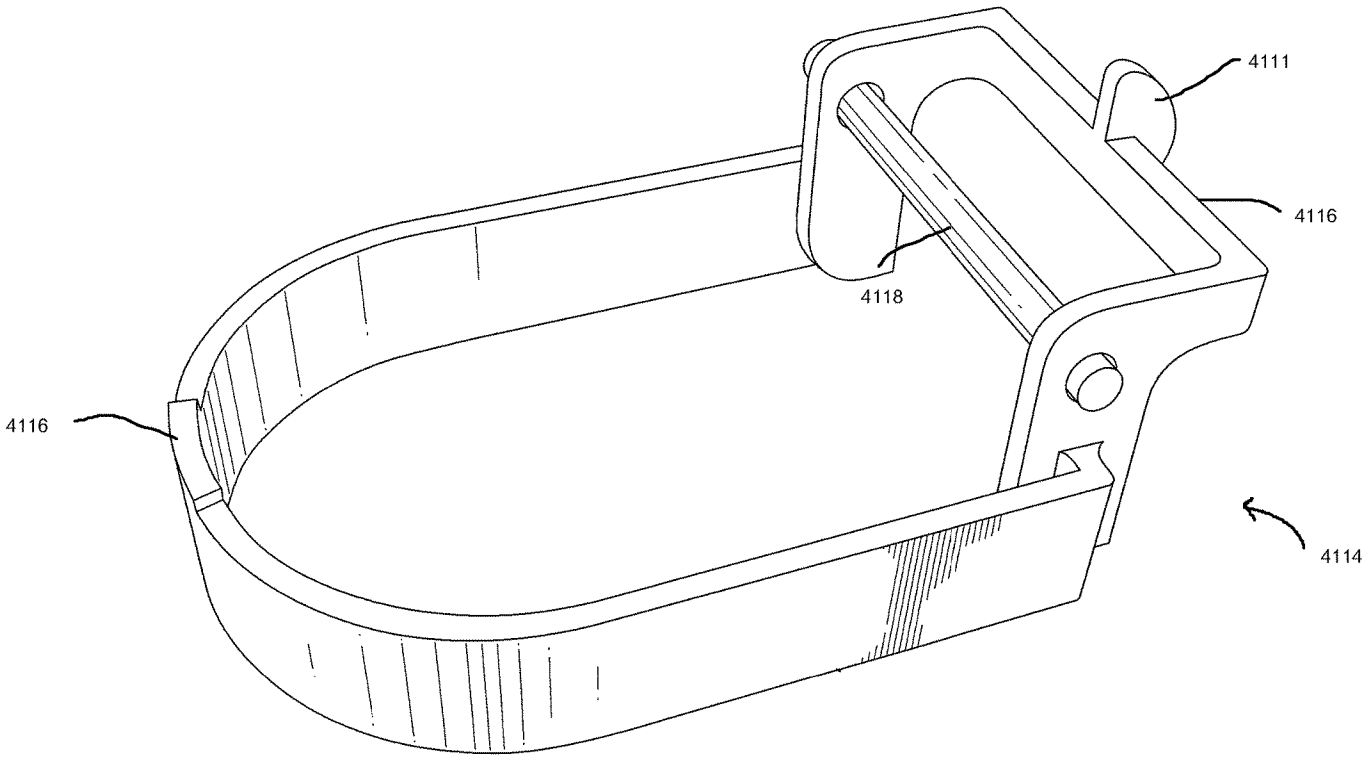
FIG. 40 is an enlarged perspective view of the flapper lift mechanism of FIG. 39.

With reference to FIGS. 39-40, a further embodiment of the cleaning system 400, includes a reservoir 406 having a body 407 that has an outlet portion 411 with outlet port 419 closed by an elastomeric septum 4140. The septum 4140 allows for a tube in the form of a piercing injection-like needle 4138 to pass through to as to establish fluid communication through the needle into the supply conduit 79. Fluid from within reservoir 406 passes by way of gear pump 21 to the inlet of an overflow tube 190 into a flush valve which is a rim flush valve 80.

An optional vent line 76 is provided with a check valve 85 near the second end 84 of the vent line 76 for pulling air into the reservoir to replace air in the interior area 431 of the reservoir 406. An optional second vent needle 4139 is shown for passing such air and/or fluid with entrained air into the system.

The flush valve 80 as shown operates using a cam 4137, to operate a lift rod 4112 after the cam engages the contact 4111. The control system 40000 would be the same in operation as control system 1000 and the system may include the control panel 97, actuator 4 and batteries 61*a* within a battery compartment 61 in the housing that may also be the same as that of embodiment 10 although it should be understood that the seat 4142 will be configured to receive outlet portion 411 and the associated supply conduit 79 and vent line 76.

To mechanically lift the flapper 4105, a flush valve operation mechanism 82*a* in this embodiment is provided that has a lift rod 4112 in communication with a linkage 4113 connected to a flapper lift mechanism 4114 seated around a valve body 4104 of the flush valve 480 which is otherwise the same as valve 80. The flapper lift mechanism 4114 is configured to wrap around the valve body 4104 in a complementary shape (although it need not be so and may also extend only partially around and still function properly). As preferred, the flapper lift mechanism extends around the valve body so as to give an even lift when actuated. The front portion 4115 of the lift mechanism is preferably curved around the valve body around the flapper opening area (front and sides of the valve body). As shown, it is a generally flat piece of a width in the longitudinal direction sufficient to be situated just under the edge of the flapper to catch it and lift the flapper when actuated. The rear portion 4116 of the flapper lift mechanism 4114 has a rod 4118 positioned slightly higher than the front portion 4115 of the flapper lift mechanism to sit below the flapper hinge 4117. The rear portion 4116 of the flapper lift mechanism further has an outer piece having a contact piece 4111 for being acted on by the lift rod 4112.

In use, when the gear motor 423 is activated by the control system and to open the flapper cover 4105, the gear motor turns the pivotable lift rod 4112 so that the lift rod pushes downwardly to push on the contact piece 4111 which pushes down on the rear portion 4116 of the flapper lift mechanism 4114, so that the front portion 4115 of the mechanism 4114 is naturally pushed upwardly lifting the flapper 4105 in a controlled manner consistent with the programmed timing of the gears in the gear motor. The gear motor may have a cam or similar device on its shaft to push the contact piece in operation. The use of the flapper lift mechanism 4114 and lift rod 4112 enable a system design wherein the cleaning system 400 is essentially untethered to the other components of the flush tank and toilet allowing it to be easily removed for servicing, repairs or replacement.

The assemblies as noted above may have a variety of reservoir designs useful in embodiments such as 10 noted above. Further examples of such reservoirs are now described along with alternative valves with reference to FIGS. 41-56.

Figure 42:
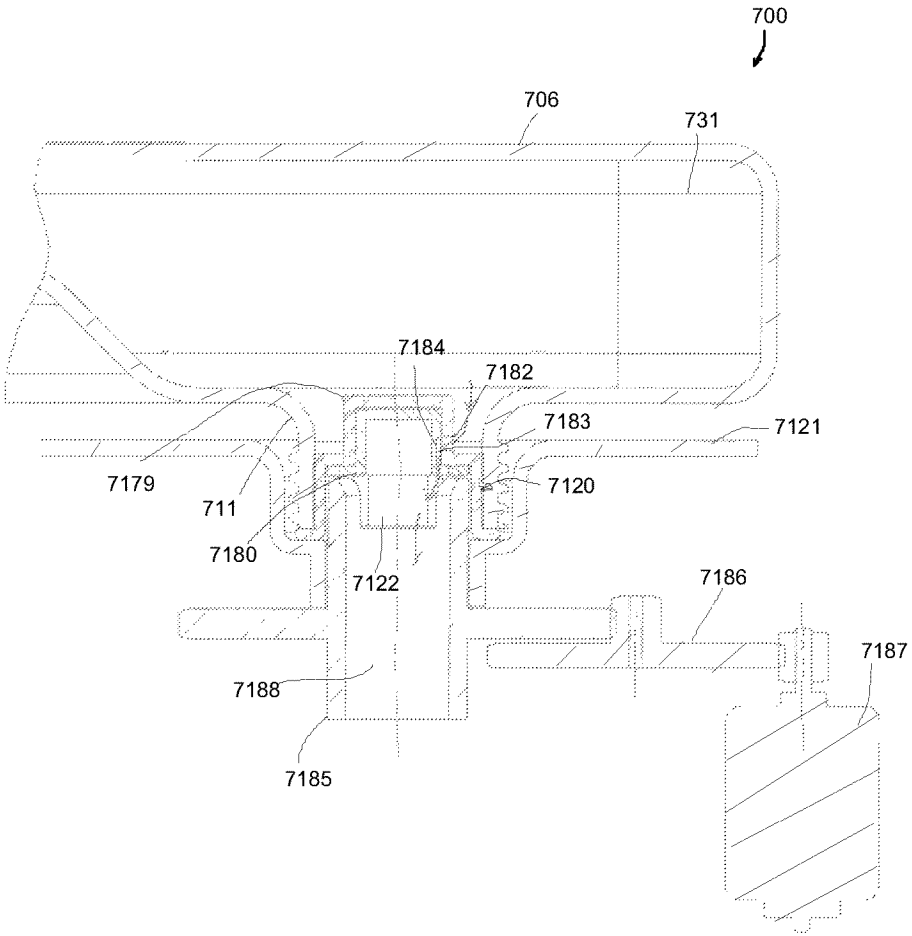
FIG. 42 is a longitudinal cross-sectional view of the reservoir and gear motor of FIG. 41.
Figure 41:
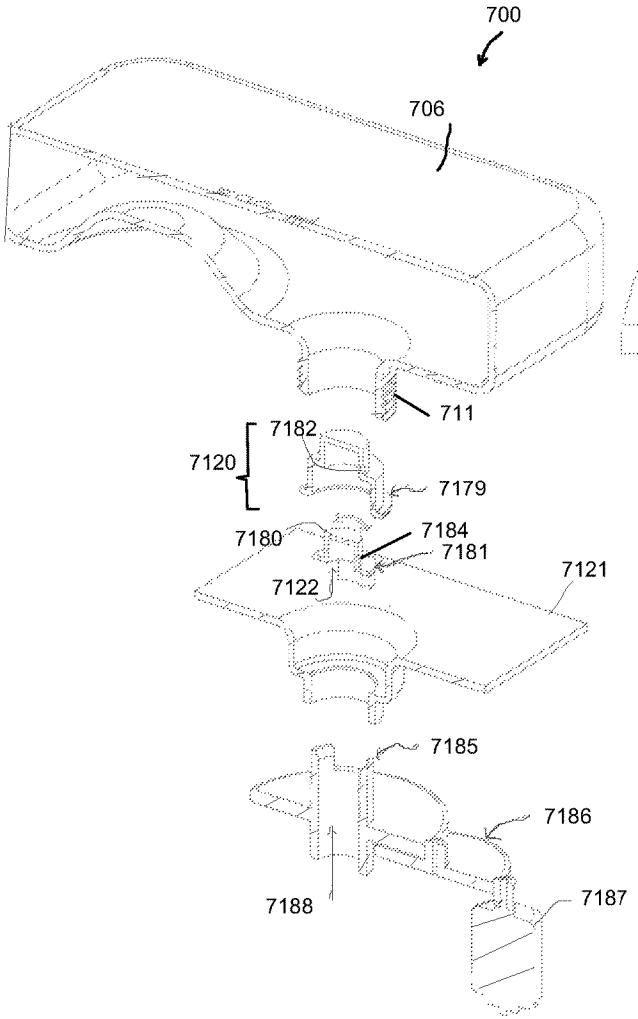
FIG. 41 is an exploded longitudinal cross-sectional view of a reservoir and gear motor for use in cleaning systems described herein.

First with reference to FIGS. 41-42, a further embodiment 700, which may have a cleaning system as noted above is shown with reference to an alternative reservoir and operable valve, which is in all other respects may be the same as embodiment 10 and used in embodiments 500, 1600, 1700, 1800 or 1900 as noted herein, with like numerals being used to indicate like parts throughout. This embodiment includes an alternate reservoir as described. In this embodiment 700, a reservoir 706 has a liquid supply valve 7120 positioned so as to be situated within the optional outlet portion 711 of the reservoir 706 when it is seated in a complementary housing 7121 (which may be any of the housings noted above). The liquid supply valve 7120 defines a passage 7122 therethrough for release of cleaning fluid.

The valve 7120 has a stationary valve insert 7179 which is positioned so as to cover an interior valve plug 7180. The valve plug is operable to rotate by a valve actuator 7185 operated by gear(s) 7186 and gear motor 7187. As the control system 70000 (analogous to other control systems described herein) actuates the supply valve 7120 to release cleaning fluid, the motor turns, and operates the actuator which engages the valve plug 7180 until stop 7181 on the plug 7180 is contacted.

A cleaning agent solution may be directed by gravity feed from the interior space 731 of the reservoir 706 through the passage 7122 in the valve 7120 and through the interior into a supply conduit which may be like any of those noted above and which would be in fluid communication to the supply conduit by way of the interior 7188 of the actuator 7185. In embodiments like 700 and others where the valve is directly actuated herein, a separate valve flow control device is not needed as the valve itself is acting as a motorized flow control device for delivery of cleaning fluid. Thus, as used herein, a "flow control device" may be any mechanism, including the various exit valve embodiments described in embodiment 700 and other similar designs or a separate valve located along the supply conduit for independently controlling flow.

As with other embodiments, upon activation of the actuator feature therein, the control system is preferably adapted to initiate the clean cycle by operating the valve 7120 as noted above for a first period of time sufficient to deliver a dose of the liquid cleaning agent solution to a location along the flow path in fluid communication with the inlet of cleaning agent and flush water into the bowl, for example, to a supply conduit and then to the interior space of a valve body of a closed flush valve (such as valve 80) configured for delivery of fluid to either a rim inlet port of a toilet bowl as noted elsewhere herein or to a traditional rim channel inlet and then one or more rim channel outlets. Such valve 7120 (as with other valve embodiments herein) can be connected so as to feed directly to the overflow tube above the flush valve, to an isolated rim valve as in the preferred embodiment herein, to a feed directly to a rim inlet into the bowl or to a rim inlet of a traditional rim channel and out through one or more outlet ports. All that is required is that the cleaning agent combine with flush water at some point along a flush water path downstream of the reservoir and upstream of the point where flush water with cleaning agent would enter the bowl. In this embodiment 700, the valve 7120 can controllably release cleaning agent for combining with flush water at some point prior to bowl entry.

The control system may be programmed and include features as noted above with respect to control system 1000 and other embodiments. The control system also operates the flush valve 80 to open the flush valve to introduce the dose of a liquid cleaning agent with flush water over the second period of time as noted above, to at least partially close the flush valve after delivering the dose of a liquid cleaning agent also as described above and to open the flush valve again, and optionally any jet flush valve in the assembly, if desired after the third period of time (holding time) to purge the interior of a toilet bowl with new flush water at an end of the clean cycle.

The liquid supply valve 7120 has the actuator passage (and may have other fittings as well if desired) to connect the liquid supply valve 7120 to the first end of the supply conduit. As with the embodiments 10, 200 the system may further include a gear pump 21 and/or a gear motor 23 also activatable by the control system for operating a mechanized valve like valve 91 or may be configured to operate along with the lift arm actuation system as described in embodiment 10 above. The reservoir 706 may be seated in a housing and/or a bottom tray configured as in embodiment 10 to hold the alternate reservoir 706 (or a lid and housing as in embodiment 600). The valve and reservoir 706 may also incorporate one or more of the venting channels, openings or vent mechanisms described herein although a vent is not shown in FIGS. 41-42.

Figure 44:
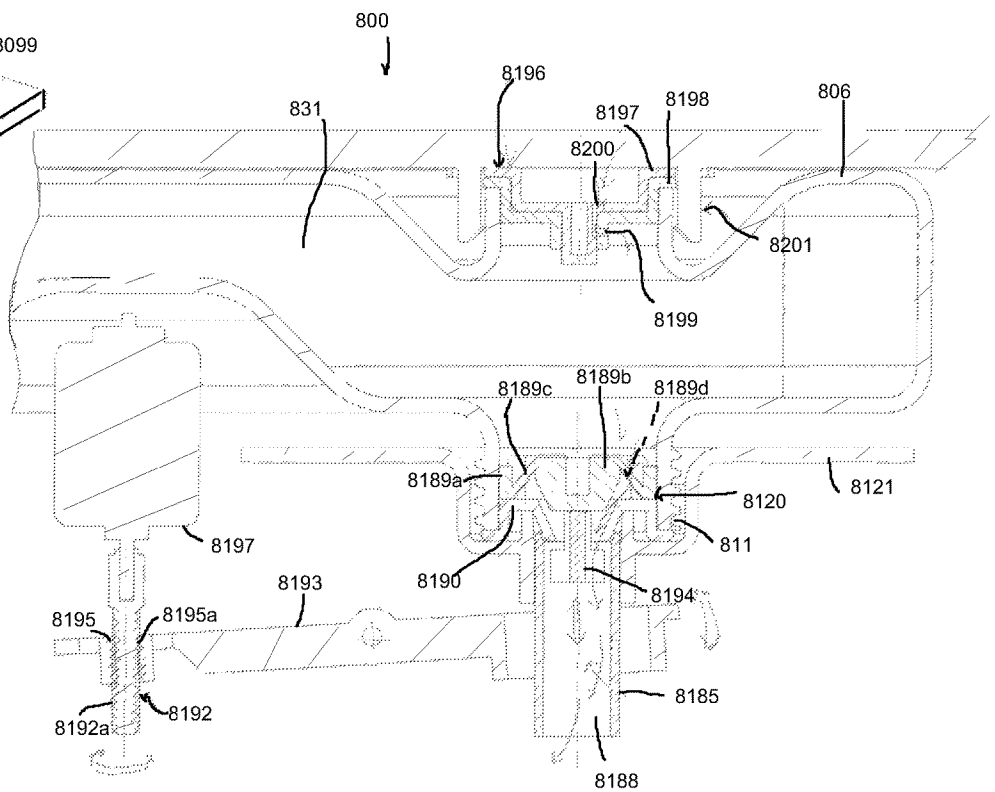
FIG. 44 is a longitudinal cross-sectional view of the reservoir and gear motor of FIG. 43.
Figure 43:
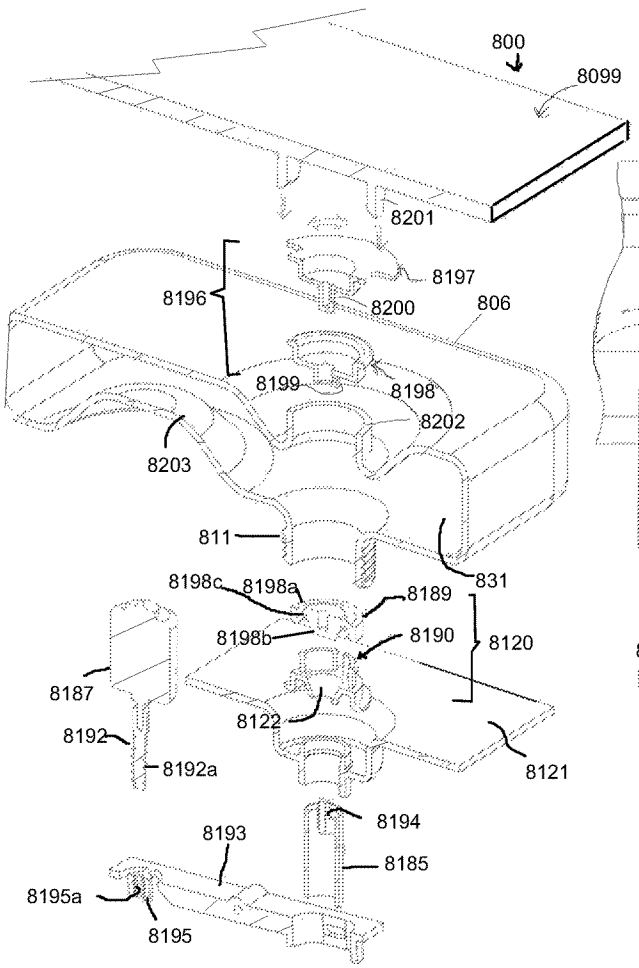
FIG. 43 is an exploded longitudinal cross-sectional view of a further reservoir and gear motor for use in the cleaning systems described herein.

With reference to FIGS. 43-44, a further embodiment 800 is shown in part and is similar to or used in embodiments 10, 500, 1600, 1700, 1800 or 1900 as discussed below, where like parts are analogous, but provides an alternative reservoir 806 and an alternative valve 8120. It would be in other respects the same as the assemblies in the other embodiments noted, with like numerals being used to indicate like parts throughout. In this embodiment 800, a reservoir 806 has a liquid supply valve 8120 positioned so as to be situated within the optional outlet portion 811 of the reservoir 806 when it is seated in a complementary housing 8121. The liquid supply valve 8120 directs a cleaning agent solution or other fluid from the interior space 831 of the reservoir 806 through the valve 8120 when in place and into and through an interior 8188 of an actuator 8185 which is in fluid communication with a first end of a supply conduit such as those described in embodiment 10.

In operation, valve 8120 includes an elastomer valve 8189 and a valve body 8190. The elastomer valve has an outer ring 8189*a* and a central elastomer plug 8189*b*. The ring 8189*a* is connected to the plug 8189*b* by a series of ribs 8189*c* leaving pass through openings 8189*d* therebetween. A motor 8197 having a screw pin 8192 having threads 8192*a* turns within screw receiving hole 8195 having mating threads 8195*a*. As the screw turns, the pivot arm 8193 engages the actuator 8185 and pushes its plunger 8194 into a passage 8122 in the valve body 8190 to engage elastomer valve 8189 and pushes up on the plug 8189*b* of the elastomer valve 8189. When the plug is no longer seated snugly within the valve body 8190 in passage 8122, a gap is opened between the valve body and the elastomer valve for cleaning agent to flow between elastomer valve ribs 8189*c* in spaces 8189*d*.

In this embodiment, a mechanized valve 91 (shown in prior embodiments) may optionally also be used as an additional flow control device and if so is preferably for controlling flow through the supply conduit. The control system may be activatable by an actuator feature as described elsewhere herein. Upon activation of the actuator feature, the control system is adapted to initiate a clean cycle by operating a mechanized valve 91 or a motor as described herein in conjunction with the valve 8120 as noted above for the first period of time sufficient to deliver a dose of the liquid cleaning agent solution from the supply conduit to an interior space of a valve body of a closed flush valve configured for delivery of fluid to a rim inlet port of a toilet bowl as noted above. The control system may be programmed and include features as noted above with respect to control system 1000. The control system will also operate the flush valve to open the flush valve to introduce the dose of a liquid cleaning agent with flush water over the second period of time as noted above, to at least partially close the flush valve after delivering the dose of a liquid cleaning agent also as described above and to open the flush valve again, and optionally any jet flush valve in the assembly, if desired after the third period of time (holding time) to purge the interior of a toilet bowl with new flush water at an end of the clean cycle.

The liquid supply valve 8120 having the actuator may be fitted so as to be in fluid communication through the actuator passage 8188 to the supply conduit. The elastomeric valve configuration may be modified as well. The reservoir 806 may be seated in any housing described herein.

Also as shown, in this embodiment 800, an optional vent assembly 8196 is provided. The vent assembly 8196 has a quarter turn cap 8197 which fits within an insert 8198 so that an opening 8199 in the insert 8198 will align in the open position with a channel 8200 formed between the cap 8197 and the insert 8198 when assembled. The cover 8099 which may be otherwise like other covers and inserts for the tank(s) herein may be configured so as to have depending pins 8201 that interfere with the cap and engage the cap so that it is preferably positioned in the air intake and open position. When open, air is pulled inward through the channel as the reservoir empties and liquid flows downwardly through the valve 8120. The air vent assembly 8196 may seat within an inlet opening 8202 provided in the reservoir 806. An alternate inwardly shaped portion 8203 may also be formed in a lower portion of the reservoir to provide a stacking feature for storing and transport of replacement reservoirs. It should be understood that the vent assembly 8196 and other features such as shaped portion 8203 may be provided also to any other reservoir assembly herein in addition to or in place of any existing vent lines provided.

Figure 46:
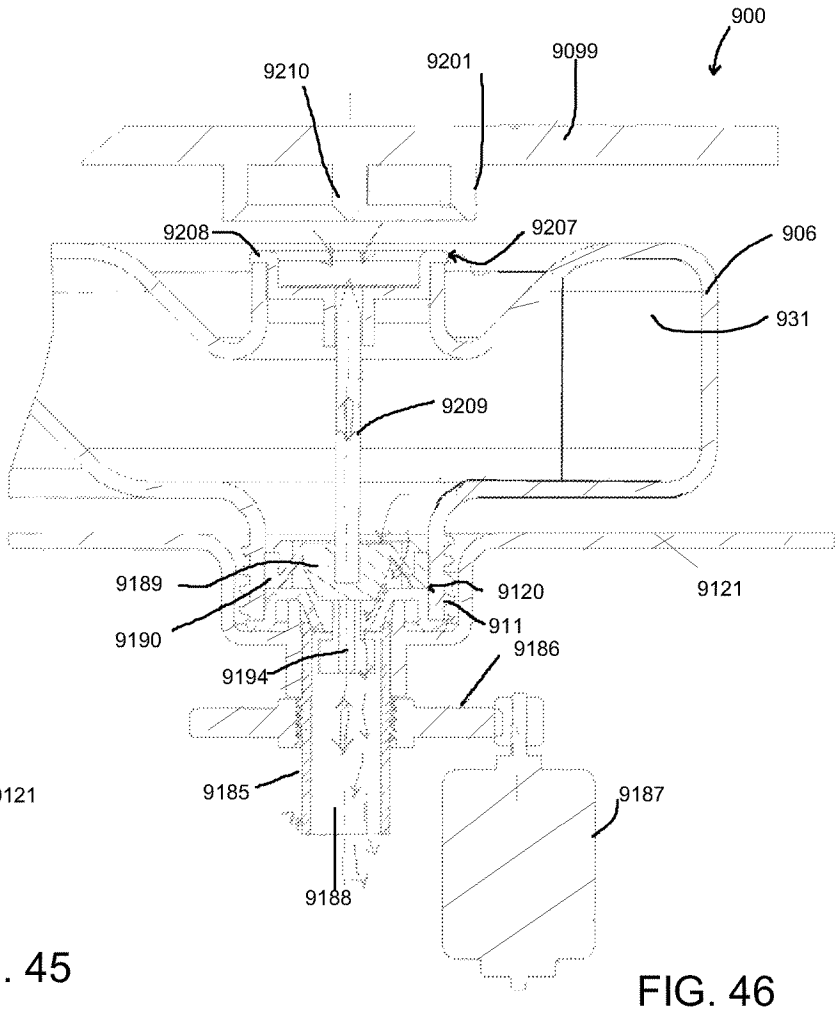
FIG. 46 is a longitudinal cross-sectional view of the reservoir and gear motor of FIG. 45.
Figure 45:
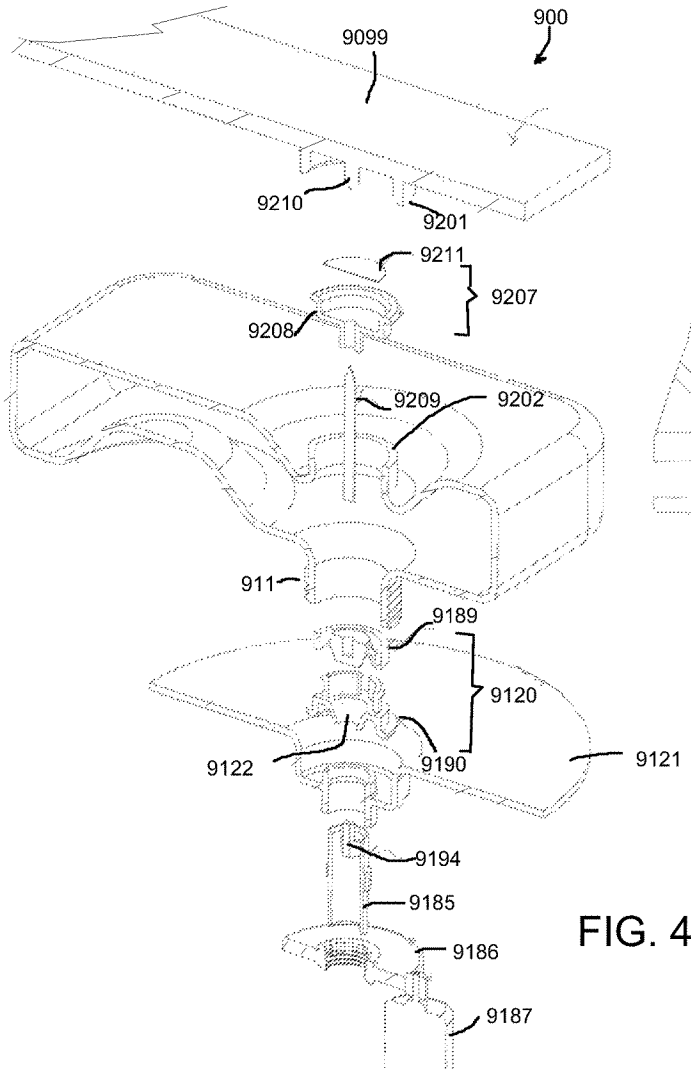
FIG. 45 is an exploded longitudinal cross-sectional view of a further embodiment of a reservoir and gear motor for use in the cleaning systems described herein.

With reference to FIGS. 45-46, yet another embodiment 900 is shown which, like embodiment 800, introduces an alternative reservoir 906 and alternative valve 9120 for use in the various embodiments mentioned for use with embodiments 700 and 800. In this embodiment, the valve 9120 is identical with the valve 8120 and so is not further described herein. The assembly is also in other respects the same as in 10, 500, 1600, 1700, 1800, or 1900 as noted above, with like numerals being used to indicate like parts throughout. In this embodiment 900, a reservoir 906 has a liquid supply valve 9120 positioned so as to be situated within the optional outlet portion 911 of the reservoir 906 when it is seated in a complementary housing 9121. The liquid supply valve 9120 directs a cleaning agent solution or other fluid from the interior space 931 of the reservoir 906 through the valve 9120 when in place and into and through an interior 9188 of an actuator 9185 which is in fluid communication with a first end of a supply conduit such as those described in embodiment 10.

In operation, valve 9120 includes an elastomer valve 9189 and a valve body 9190 which are like those in valve 8120 and so are not further described herein. A motor 9187 operates a gear(s) 8186 which has a threaded interior gear surface 9204 defining a gear opening 9205. As the motor operates and the gear(s) turn, the interior threaded gear surface 9204 turns long mating threads 9206 on the actuator 9185. The plunger 9194 of the actuator 9185 then engages the elastomer valve 9189 in the same manner described above with respect to the plunger 8194 in embodiment 800. This pushes the plunger 9194 into a passage 9122 in the valve body 9190 to engage elastomer valve 9189 and push it upward to open a gap between the valve body 9190 and the elastomer valve 9189 for cleaning agent to flow between elastomer valve ribs. In other respects the valve in embodiment 900 operates the same as the valve in embodiment 800 as does the cleaning system with which it is used.

The liquid supply valve 9120 having the actuator may be fitted so as to be in fluid communication through the actuator passage 9188 to the supply conduit. The elastomeric valve configuration may be modified as well. The reservoir 906 may be seated in any housing described herein.

Also as shown, in this embodiment 900, an alternative, optional vent assembly 9207 is provided. The vent assembly 9207 has a vent cap 9208 that which fits within an insert opening 9202 in the reservoir. The cover 9099 which may be otherwise like other covers and inserts for the tank(s) herein may be configured so as to have depending pins 9201 like those of embodiment 800 that interfere with the cap an engage the cap so that it is preferably positioned and seated. When the reservoir is seated a foil 9211 is positioned over the vent cap 9208. When the valve operates and the spinning gear(s) 9186 activate the valve actuator 9185 the valve is opened and the piercing point air of a rod 9209 is pushed upward so that fluid is drawn downward. The piercing of the foil by the rod allows for air intake into the reservoir for venting. The lid 9099 may also be configured to act instead of a rod such as rod 9209 by being fitted with an optional piercing depending pin 9210 on the cover. Thus, when cover 9099 is put in place, the pin 9210 can pierce the foil as an alternate option. It should be understood that the vent assembly 9207 with optional foil and piercing features as well as the alternate valve actuation features may be provided also to any other reservoir assembly herein in addition to or in place of any existing vent lines provided.

Figure 48:
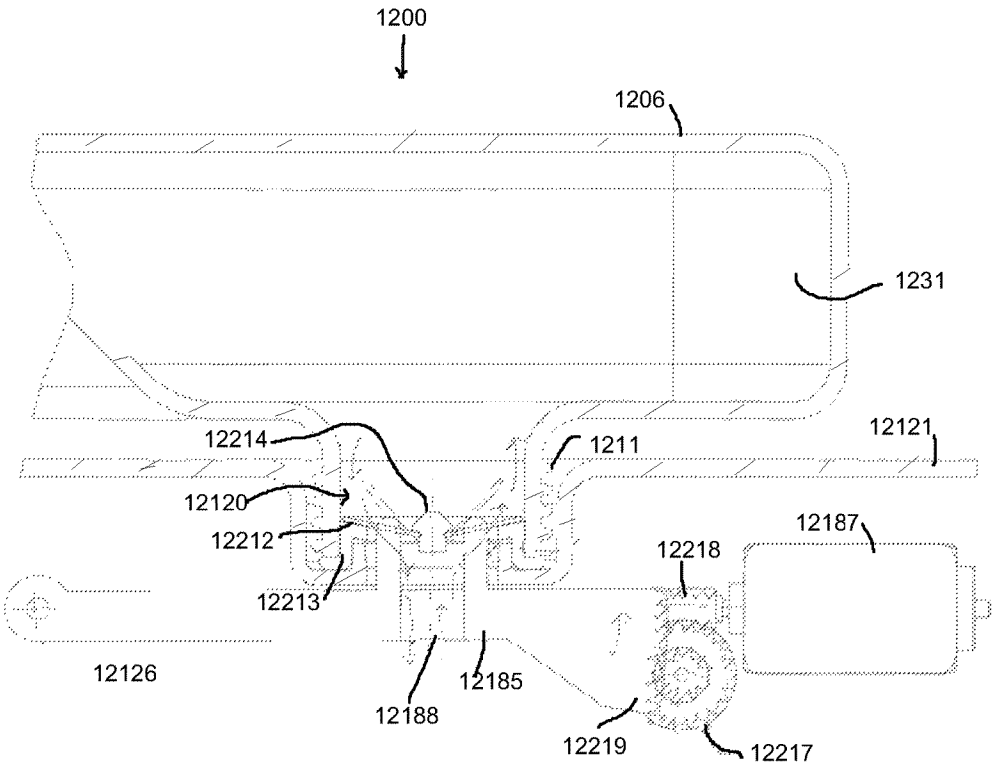
FIG. 48 is a longitudinal cross-sectional view of the reservoir and gear motor of FIG. 47.
Figure 47:
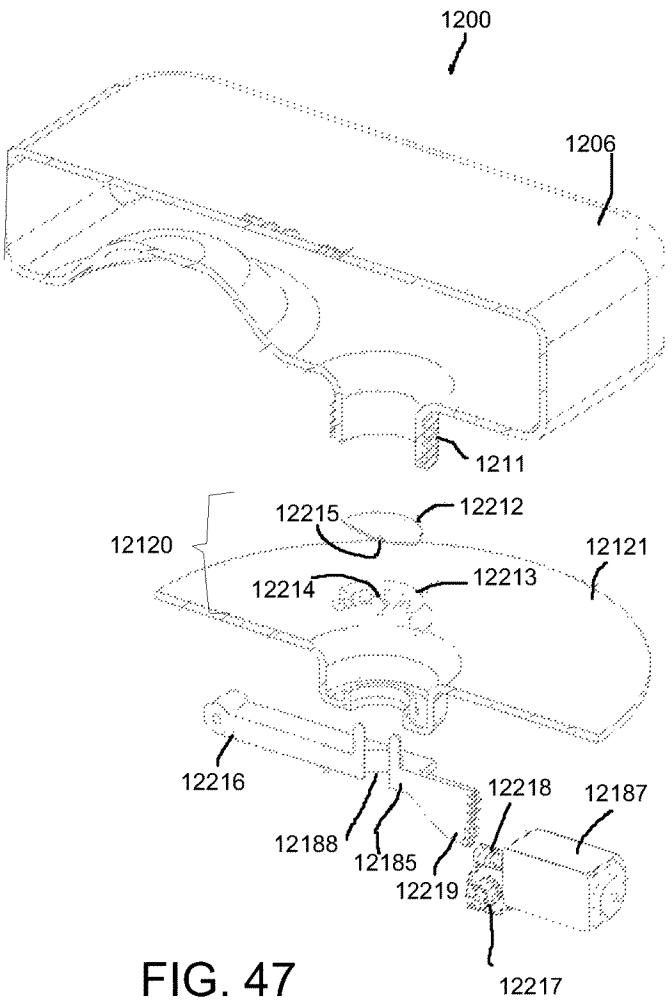
FIG. 47 is an exploded longitudinal cross-sectional view of yet a further embodiment of a reservoir and gear motor for use in the cleaning systems described herein.

With reference to FIGS. 47-48, a further embodiment is shown, generally referred to herein as 1200, which introduces yet a further alternative reservoir 1206 and alternative valve 12120. It would be in other respects the same as embodiments 10, 500, 1600, 1700, 1800 or 1900, with like numerals being used to indicate like parts throughout. In this embodiment 1200, a reservoir 2106 has a liquid supply valve 12120 positioned so as to be situated within the optional outlet portion 1211 of the reservoir 1206 when it is seated in a complementary housing 12121. The liquid supply valve 12120 directs a cleaning agent solution or other fluid from the interior space 1231 of the reservoir 1206 through the valve 12120 when in place and into and through an interior 12188 of an actuator 12185 which is in fluid communication with a first end of a supply conduit such as those described in embodiment 100.

In operation, valve 12120 is a flap valve and includes an flap elastomer 12212 and a flap valve body 12213. The flap valve body is formed of a more rigid material and has an upward extending pin 21214 that when in an open position as in FIG. 48 pushes through an opening 12215 in the flap elastomer 12212. The flap elastomer valve then bends upwards to allow the flow of fluid through the body and around the flap. A motor 12187 engaging a worm gear 21218 that further engages a spur gear 12217 as the gear moves along engaging threads 12219 on the pivot arm 12216 cause the pivot arm to push upward on the actuator 12185 thereon to open the valve by pushing up the flap elastomer.

In all other respects the embodiment 1200 may be the same as other cleaning systems in embodiments, 10, 500, 1600, 1700, 1800 or 1900 herein and the reservoir and valve design are simple. It should be understood that the vent assemblies and shaped portions, foils, etc. of other reservoirs described herein in embodiments 800 and 900 and elsewhere herein may be provided with this described valve and reservoir portion of the system.

Figure 50:
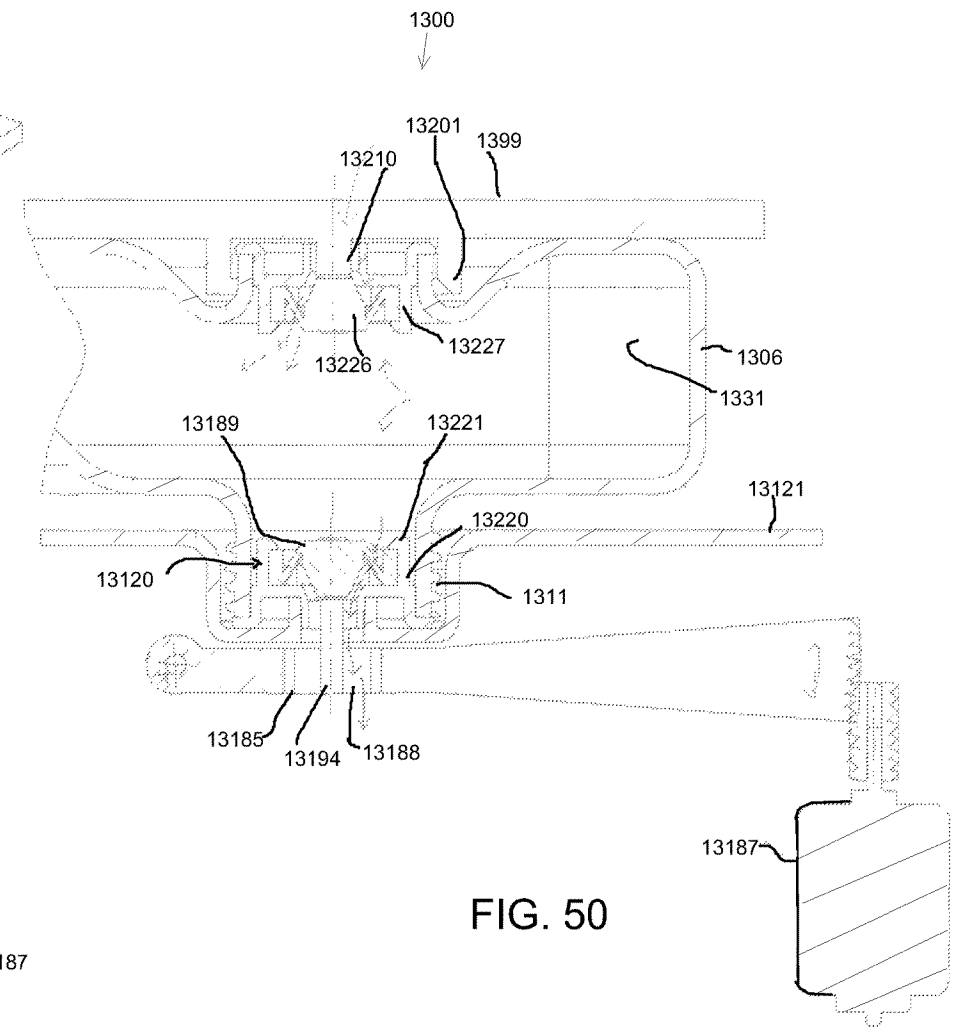
FIG. 50 is a longitudinal cross-sectional view of the reservoir and gear motor of FIG. 49.
Figure 49:
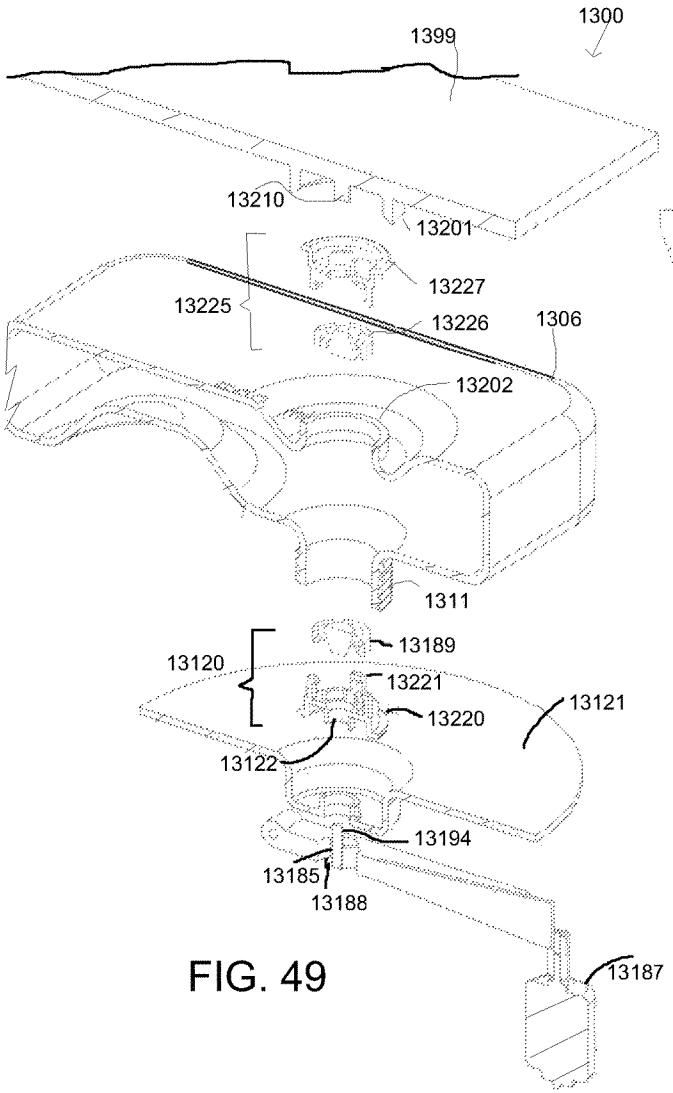
FIG. 49 is an exploded longitudinal cross-sectional view of another embodiment of a reservoir and gear motor for use in the cleaning systems described herein.

With reference to FIGS. 49-50, yet another embodiment 1300 is shown that provides an additional alternative reservoir 1306 and valve 13120. In this embodiment, the valve 13120 is identical with the valve 8120 with the exception of its valve body 13220. The valve body 13220 includes a slightly different snap-in engagement feature with a plurality of upward snapping arms 13221 that can engage and better seat the elastomer valve 13189. The cleaning system and toilet in the assembly are in other respects the same as any of those in embodiments, 10, 500, 1600, 1700, 1800 or 1900 herein, with like numerals being used to indicate like parts throughout. In this embodiment 1300, a reservoir 1306 has a liquid supply valve 13120 positioned so as to be situated within the optional outlet portion 1311 of the reservoir 1306 when it is seated in a complementary housing 13121. The liquid supply valve 13120 directs a cleaning agent solution or other fluid from the interior space 1331 of the reservoir 1306 through the valve 13120 when in place and into and through an interior 13188 of an actuator 13185 which is in fluid communication with a first end of a supply conduit such as those described in embodiment 10.

In operation, valve 13120 includes an elastomer valve 13189 and a valve body 13220, wherein the elastomer valve is like those of embodiments 800 and 900. A motor 13187 operates a worm gear(s) 13220 which has/have a threaded gear surface. As the motor operates and the gear(s) engages and moves along threaded engaging surface 13224 of pivot arm 13223, which then pushes upward on the pivot arm driving plunger 13194 into the elastomer valve 13189 in the same manner described above with respect to the plunger 8194 in embodiment 800. This pushes the plunger 13194 into a passage 13122 in the valve body 13220 to engage elastomer valve 13189 and push it upward to open a gap between the valve body 13220 and the elastomer valve 13189 for cleaning agent to flow between elastomer valve ribs. In other respects the valve in embodiment 800 and 900 operate the same as the valve in embodiment 1300 as does the cleaning system with which embodiment 1300 is used.

The liquid supply valve 13120 having the actuator may be fitted so as to be in fluid communication through the actuator passage 13188 to the supply conduit. The elastomeric valve configuration may be modified as well. The reservoir 1306 may be seated in any housing described herein.

Also as shown, in this embodiment 1300, a further alternative, optional vent assembly 13225 is provided. The vent assembly 13225 has a vent assembly valve body 13226 that is shaped similar to valve body 13220 with arms to seat a vent assembly elastomer valve 13227. This assembly 13225 fits within an inlet opening 13202 in the reservoir 1306. The cover 1399 which may be otherwise like other covers and inserts for the tank(s) herein may be configured so as to have depending pins 13201 like those of embodiment 800 that interfere with the cap an engage the cap so that it is preferably positioned and seated. The lid 1399 may also be configured to have an optional piercing depending pin 13210 on the cover. Thus, when cover 1399 is put in place, the pin 13210 can push open the vent assembly elastomer valve 13226 to allow air intake into the reservoir. It should be understood that the vent assembly 13225 as well as the alternate valve actuation features may be provided also to any other reservoir assembly herein in addition to or in place of any existing vent lines provided.

Figure 52:
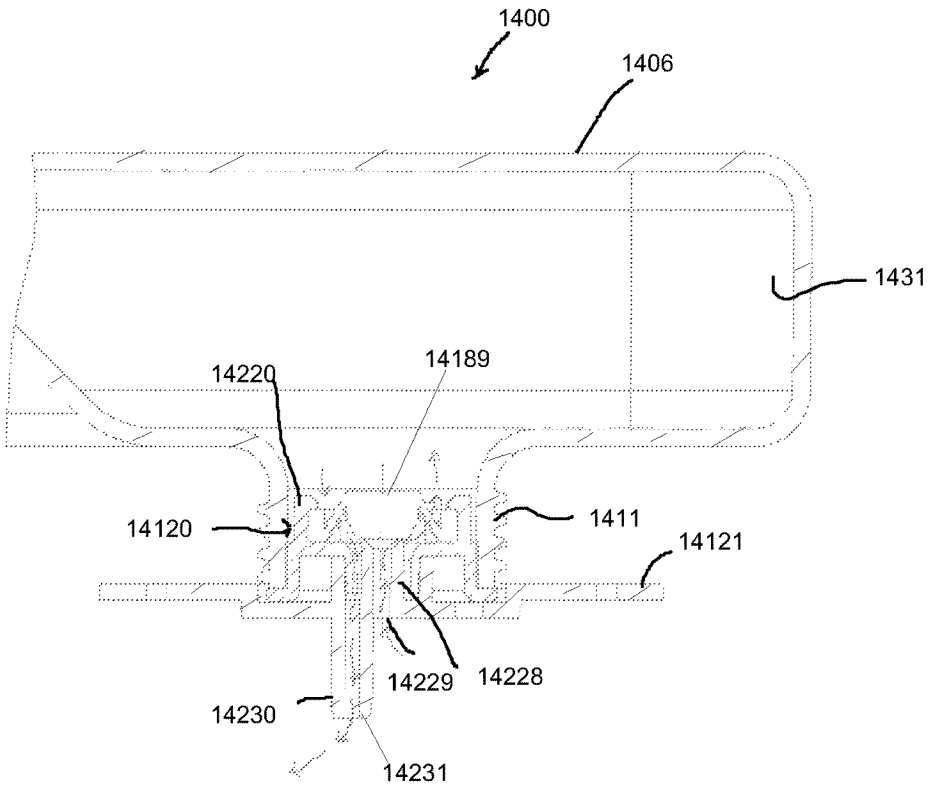
FIG. 52 is a longitudinal cross-sectional view of the reservoir of FIG. 51.
Figure 51:
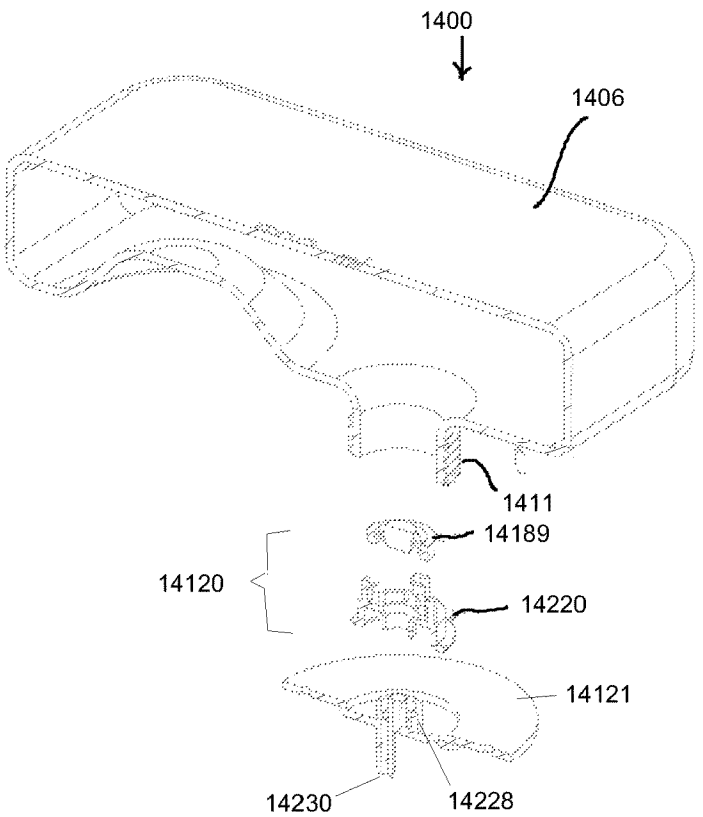
FIG. 51 is an exploded longitudinal cross-sectional view of a further reservoir embodiment for use in the cleaning systems described herein.

With reference to FIGS. 51-52, yet another embodiment 1400 with a further alternative reservoir 1406 and valve 14120 is shown. In this embodiment, the valve 14120 is identical with the valve 13120 and so is not further described herein. The assembly and cleaning system may in all other respects be like those of embodiments 10, 500, 1600, 1700, 1800 or 1900 herein, with like numerals being used to indicate like parts throughout. In this embodiment 1400, a reservoir 1406 has a liquid supply valve 14120 positioned so as to be situated within the optional outlet portion 1411 of the reservoir 1406 when it is seated in a complementary housing 14121. The liquid supply valve 14120 directs a cleaning agent solution or other fluid from the interior space 1431 of the reservoir 1406 through the valve 14120 when in place. Unlike other embodiments herein, the housing is fitted so as to have a first air intake tube 14228 which when engaged allows air to flow inward through passage 14229 formed within the intake tube 14228 into and through openings between ribs in elastomer valve 14189. Cleaning agent solution flowing out of the reservoir flows through the ribs in the elastomer valve 14189 and into a fluid passage 14231 in a fluid outflow tube 14230. The stationary tubes in the seat engage the valve when the reservoir is seated. No other air vents are needed but optional additional vents as noted above and other reservoir features may be provided.

The fluid flow may be engaged by use of a gear pump or gear motor as described with respect to embodiment 10. The fluid flow tube 14230 is configured so as to be in fluid communication with the supply conduit. The elastomeric valve configuration may be modified as well. The reservoir 1406 may be seated in any housing described herein provided that it has the tubes 14230 and 14228 formed therein.

Figure 54:
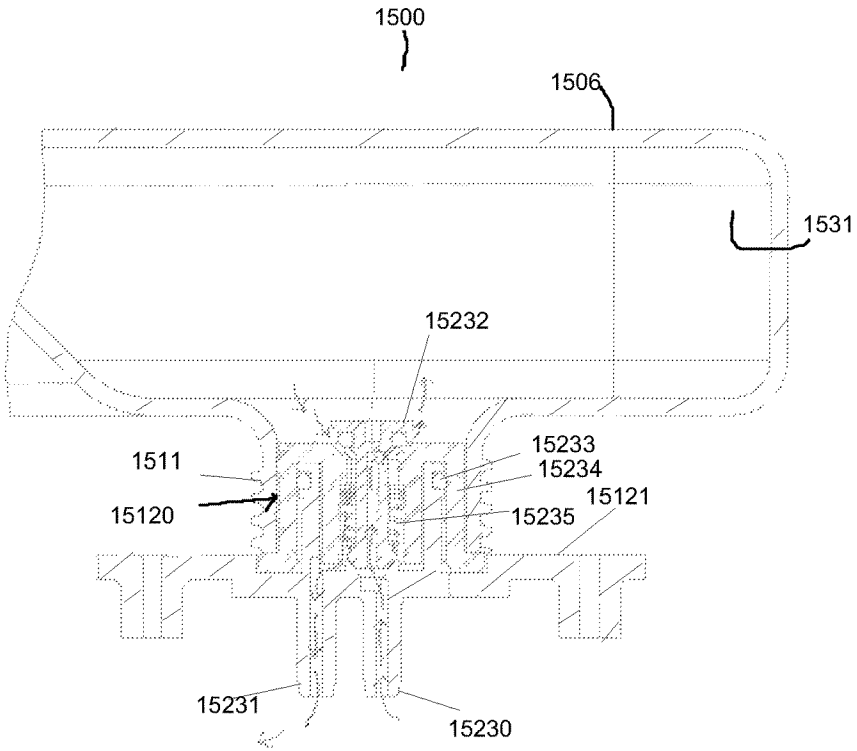
FIG. 54 is a longitudinal cross-sectional view of the reservoir of FIG. 53.
Figure 53:
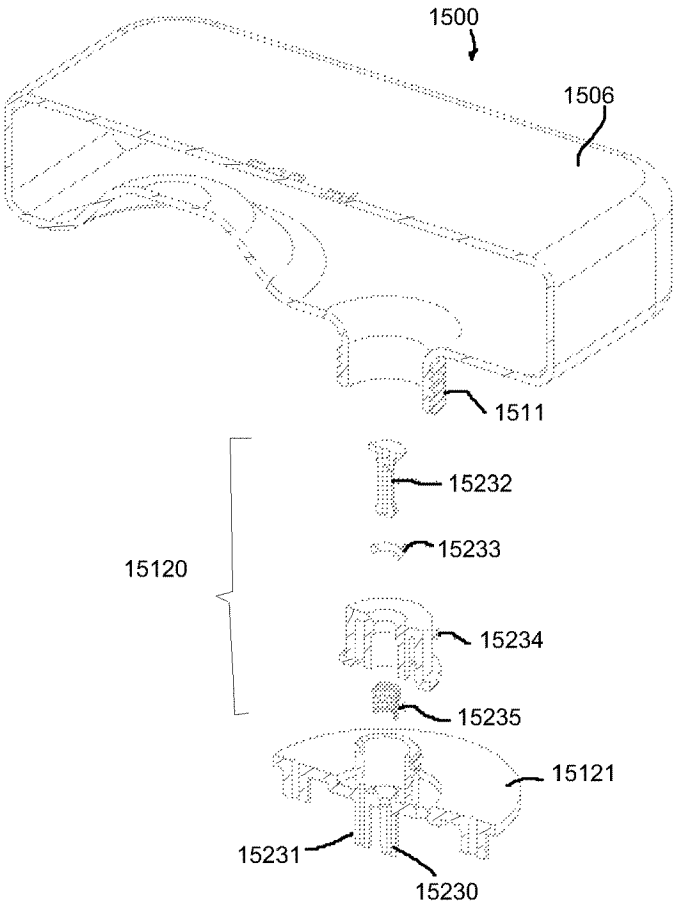
FIG. 53 is an exploded longitudinal cross-sectional view of a further reservoir embodiment for use in the cleaning systems described herein.

FIGS. 53-54 show a further fluid supply valve embodiment 1500 for use in an embodiment such as the assembly and cleaning systems of 10, 500, 1600, 1700, 1800 or 1900 herein. In this embodiment, the valve 15120 operates having tubes for air inlet and liquid outlet flow like embodiment 1400, but the tubes are formed and positioned slightly differently than in embodiment 1400. The valve 15120 is a simple spring loaded o-ring valve with a valve body 15232, a valve stem for position in the body in a passage 15122 therein, an o-ring 15233 for sealing engagement, and a spring 15235 for movement up and down of the stem for opening and closing the valve. The cleaning system is also in other respects the same as system 100 or 600 as noted above, with like numerals being used to indicate like parts throughout. In operation it is otherwise like embodiment 1400. Other vents and features described herein may also be employed in this embodiment.

Figure 55:
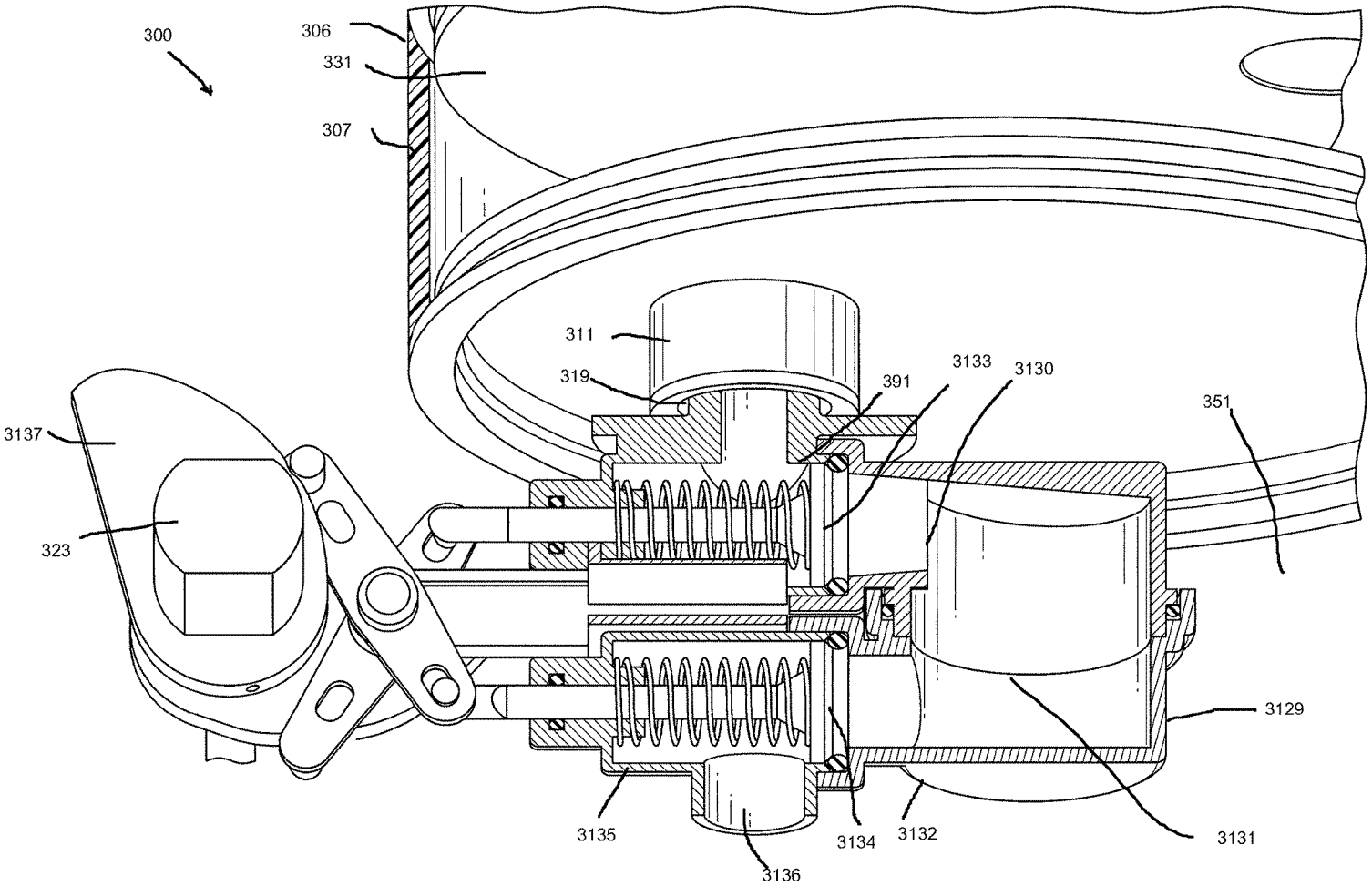
FIG. 55 is a perspective, partial cross-sectional schematic view of dosing chamber and alternate reservoir with mechanized valves for use in a cleaning system according to an alternative embodiment of the cleaning system of the invention.
Figure 56:
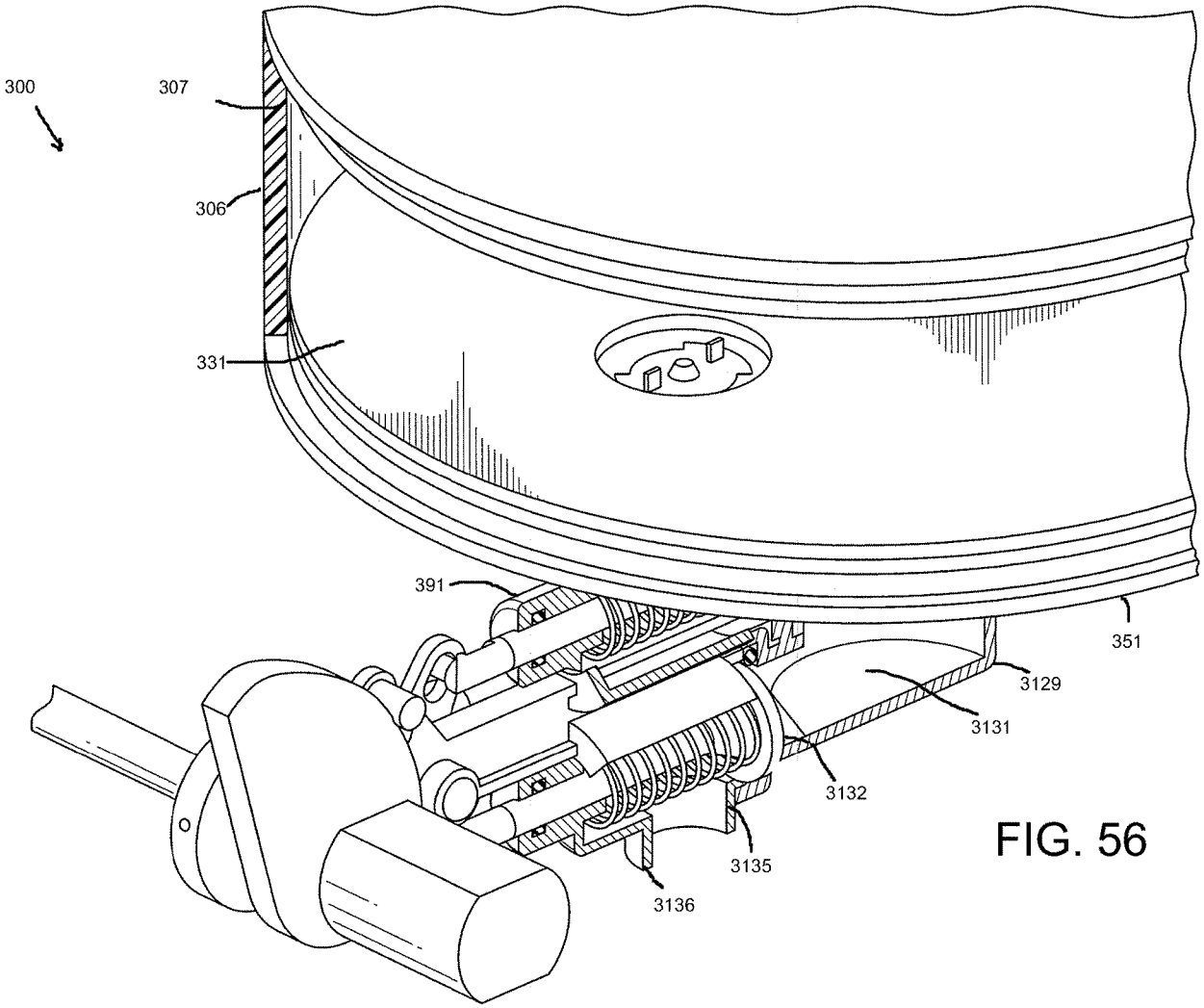
FIG. 56 is a further perspective, partial cross-sectional schematic view of the dosing chamber according to FIG. 55.

A further embodiment of reservoir and liquid supply valve for a cleaning system for a toilet bowl may be seen in FIGS. 55-56. This embodiment generally referred to herein as 300 is in other respects the same as embodiments 10 with the exception that an alternative reservoir 306 is provided which is in communication with a dosing chamber 3129. The reservoir 306 holds the liquid cleaning agent as noted with respect to other reservoirs, but may have an alternate shape (shown here as generally round in transverse cross-section) to fit within the tank space along with the additional dosing chamber taking advantage of additional space on the side of the tank more distant from the fill valve. The reservoir 306 has a body 307 defining an interior space 331. The reservoir body 307 has an outlet port 319 and as shown, the outlet port 319 is in an optional outlet portion 311 which extends from the bottom surface 351 of the reservoir 306. The outlet port 319 is in fluid communication with the interior space 331 of the reservoir body 307 and with an inlet to a first mechanized valve 391. The mechanized valve 391 may be like the mechanized valves in embodiment 10 and other embodiments herein. This valve 391, however, instead of being in-line in the supply conduit, is positioned to connect the outlet port 319 to the inlet 3130 of the dosing chamber 3129. As shown, the valve 391 is a spring loaded valve.

The dosing chamber 3129 is preferably configured and sized so as to retain a desired dose of the liquid cleaning agent from the reservoir 306. The dosing chamber 3129 defines an interior space 3131. The dosing chamber further has an outlet port 3132 on the downstream end of the dosing chamber. The inlet port 3130 of the dosing chamber 3129 is in fluid communication with an outlet port 3133 of the first mechanized valve 391. The outlet port 3132 of the dosing chamber 3129 is in fluid communication with an inlet 3134 of a second mechanized valve 3135. The outlet 3136 of the second mechanized valve 3135 is in fluid communication with a first end of a supply conduit 79. The supply conduit 79 may function otherwise in the same manner as the supply conduits of embodiments 10 and other embodiments herein.

The embodiment 300 also has a housing having a seat portion configured to receive the alternate reservoir 306 and the dosing chamber 3129. The seat portion would have to be modified so as to be configured to have a first opening in fluid communication with a vent line in the manner of prior embodiments running from the bottom portion of the reservoir and to also have a second opening for receiving the first end of the supply conduit. The vent line would be configured as in prior embodiments to have a first end situated to receive entrained air and/or liquid from the reservoir; the second open end located at least above a height of a full liquid level in the reservoir. The first and the second mechanized valves 391, 3135 respectively would be operated by a control system 30000 in this embodiment programmed so as to control flow into and out of the dosing chamber and into the supply conduit. The purpose of the dosing chamber would be to use the operation of the valves to ensure precise measurement of the dose as opposed to relying on the timing of actuation.

The cleaning system 300 may also include a gear motor 323 activatable by the control system for operating the first and the second mechanized valves with a cam 3137 as shown in the embodiment of FIGS. 39-40 that can work to operate the a lift rod and associated lift rod mechanism as described herein or wherein the gear motor can simply operate the dosing chamber for periodic supply of fluid to a overflow tube and/or a supply conduit, with an alternative lift actuation mechanism lifting the flush valve to open the flush valve cover.

In a preferred arrangement of system 300, due to the gravity flow aspect of the chambers, it may be desirable to align the reservoir 306 and the dosing chamber 3126 at an angle with respect to a transverse plane through the housing to provide better flow and loading of the cleaning fluid into, for example, a funnel and/or top of an overflow tube without the need for an additional tubing.

A housing and tray specifically configured to hold the reservoir as well as the dosing chamber along with a lid cover that facilitates the reservoir design may also be provided having parts as in other embodiments but specially adapted in size and shape for the dosing chamber and alternate reservoir. The bottom tray and lid cover would still be configured to be positioned as a tank lid on a top of a toilet tank so that the tank lid sits in place of a conventional tank cover and the bottom tray is within an interior of a toilet tank above a toilet flush valve but the tray of the tank lid may be positioned so that the lower hanging dosing chamber is positioned to the side of the tank away from the fill valve so as to provide more space available.

In a further embodiment 1900 of the assembly herein, a preferred mechanized flush handle actuator, similar to that of embodiments 10, 500, but with some modifications as described herein is adopted along with a preferred modified tank similar to that of embodiment 10. The flush handle actuator operates so that the majority of internal operating elements are within an actuator housing that is configured to sit within the tank and mounts in an opening in a reservoir housing. This provides operational stability, protects working parts and improves the ease of operation and maintenance. Thus the assembly tray is modified to accommodate this feature. Further, in such embodiment 1900 (or other embodiments as noted above) the embodiment may include any of the various reservoir designs noted above in embodiments 10, 200, 300, 400, 500, 700, 800, 900, 1200, 1300, 1400 or 1500, or may incorporate a modified reservoir having a tube actuator (similar to that of embodiment 700) as described herein. It may also be adapted using the flush valves of embodiments 1600, 1700 and 1800 to work with other types of toilet assemblies other than the primed toilet preferred and described in embodiment 10.

Figure 62:
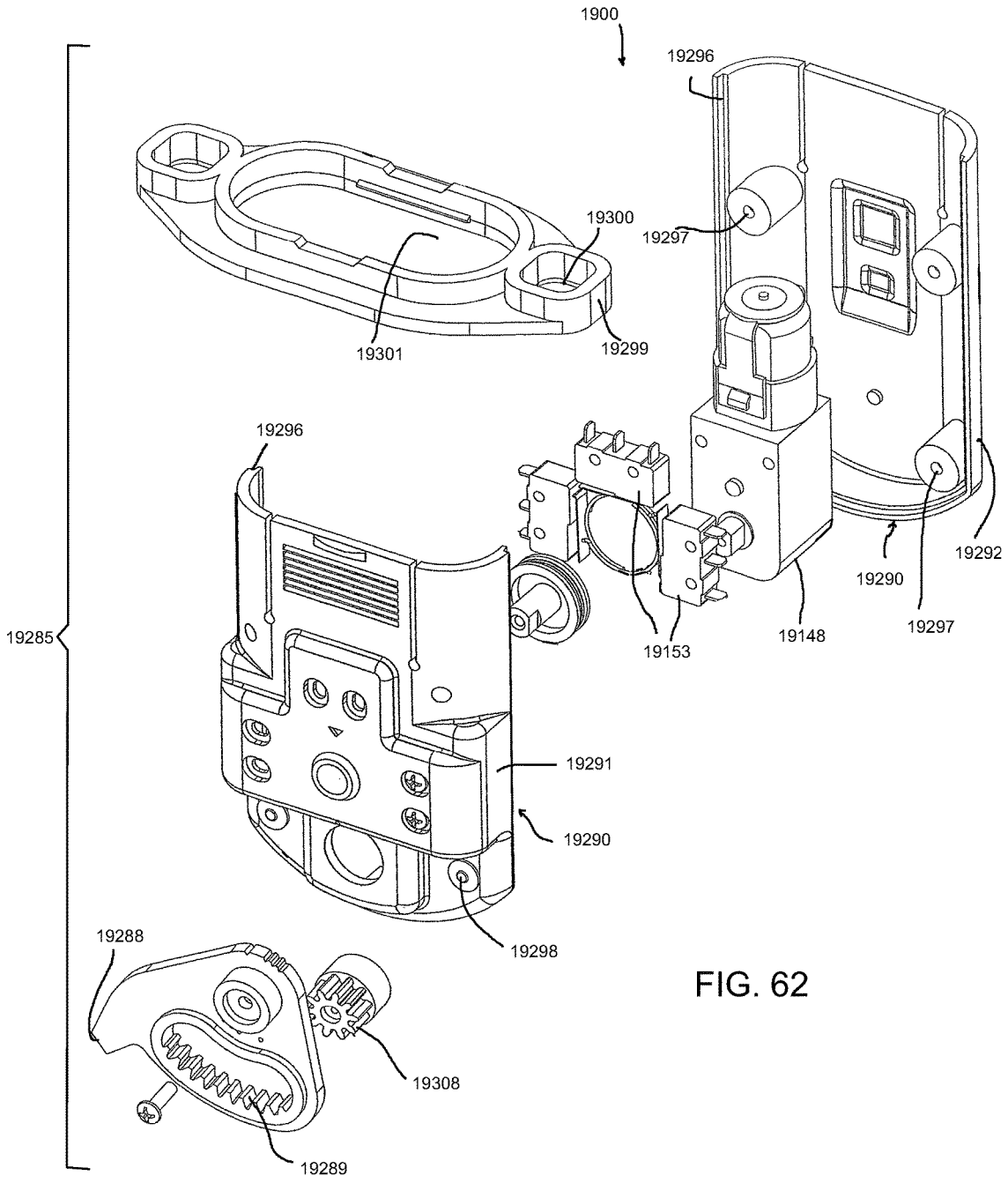
FIG. 62 is an exploded perspective view of the gear motor housing, gear motor assembly and housing mounting flange of FIG. 57.
Figure 63:
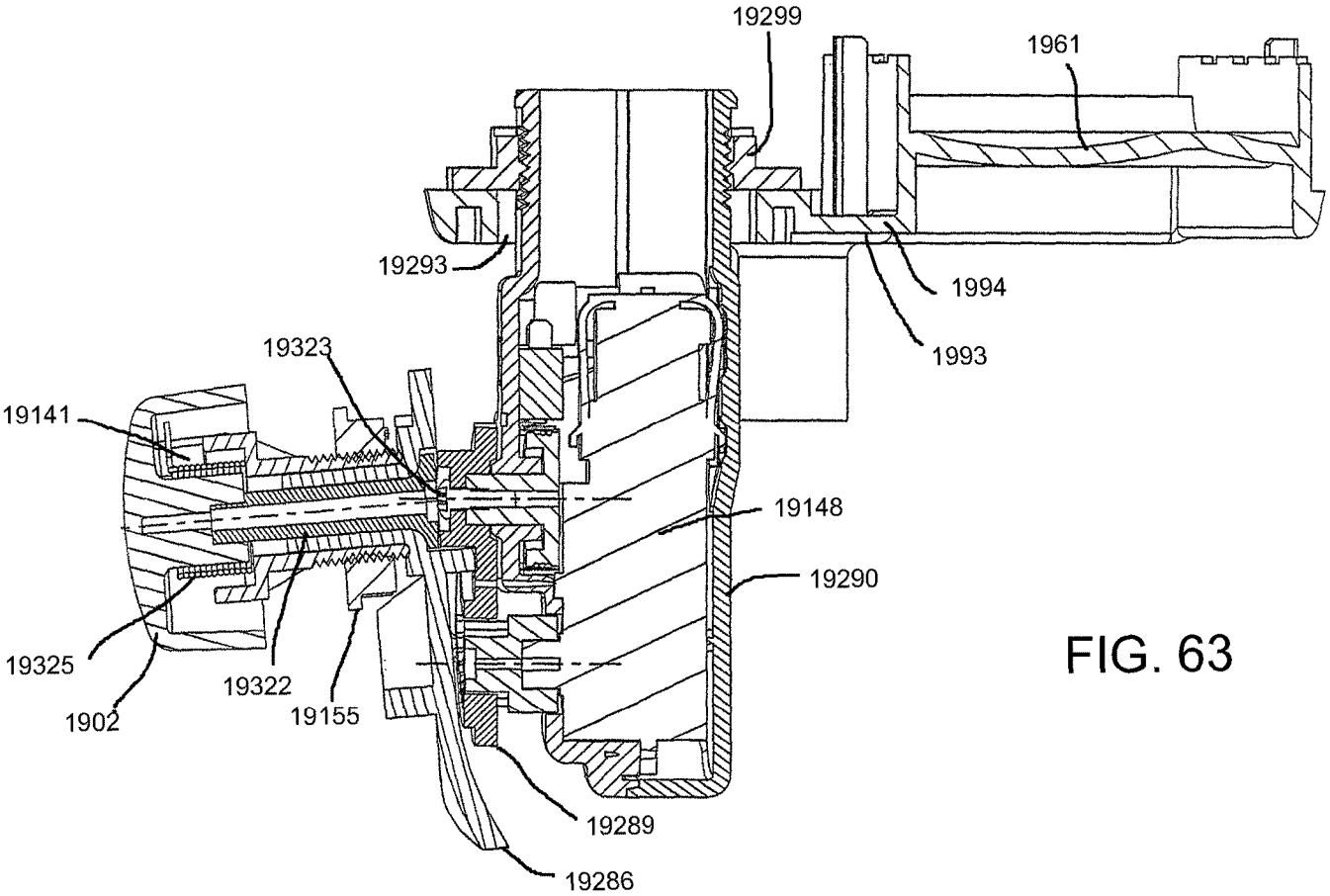
FIG. 63 is a longitudinal cross-sectional view of the gear motor housing and lift arm assembly installed on a tray in the clean system of FIG. 57 in assembled form.
Figure 64:
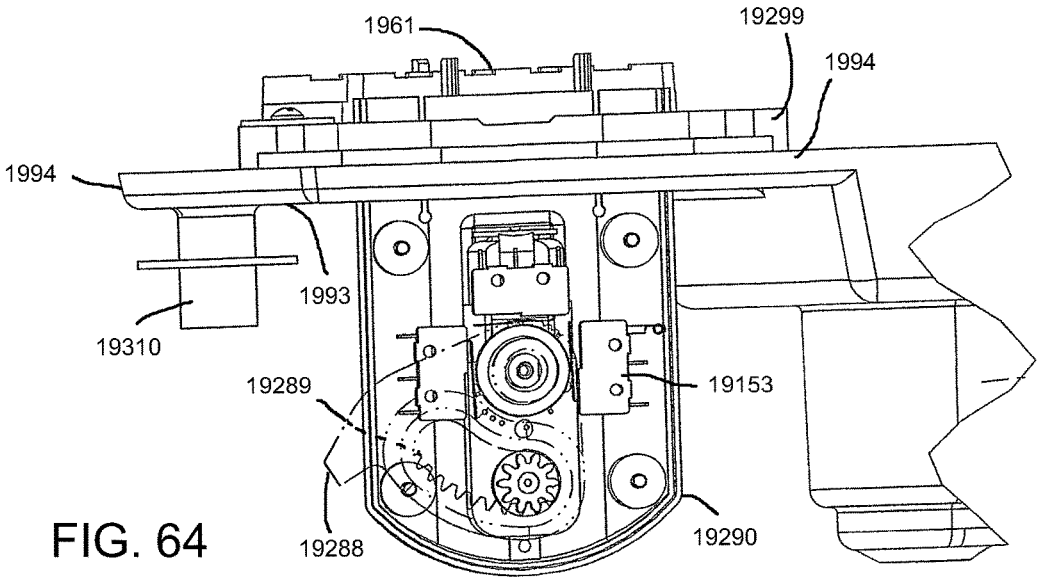
FIG. 64 is a front longitudinal cross-sectional view of the gear motor housing installed on the tray taken in front of the gear motor for the clean system of FIG. 57.
Figure 65:
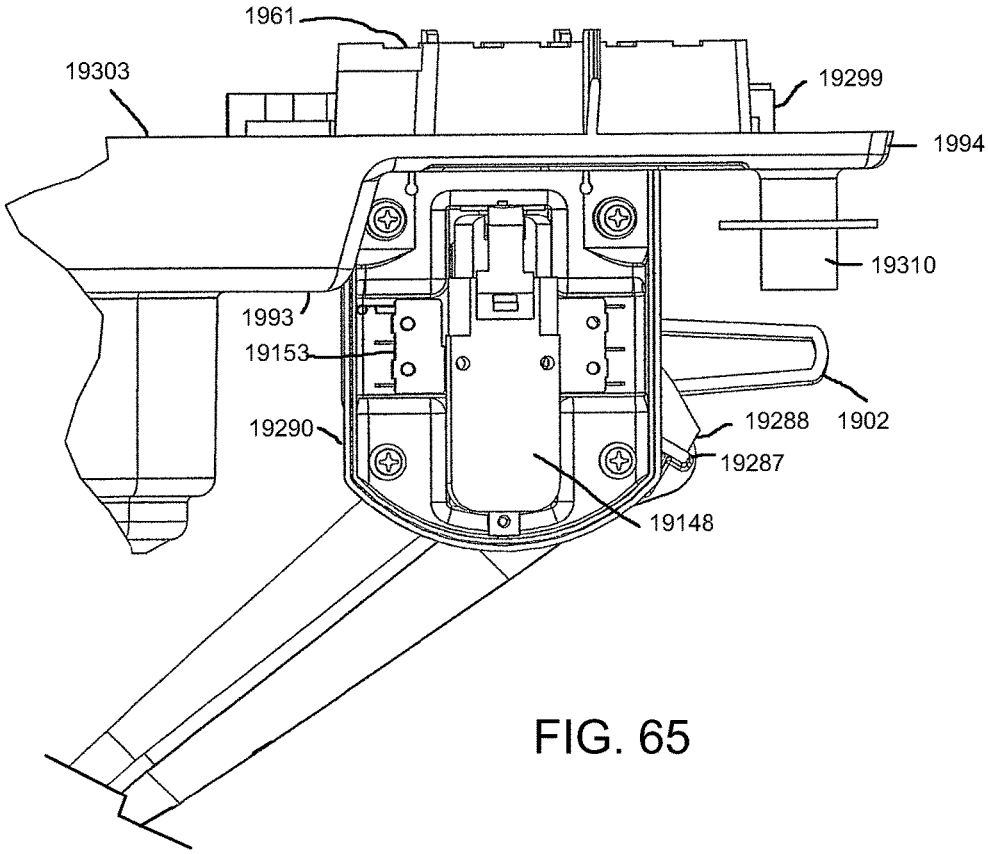
FIG. 65 is a rear longitudinal cross-sectional view of the gear motor housing installed on the tray taken in back of the gear motor for the clean system of FIG. 57.
Figure 66:
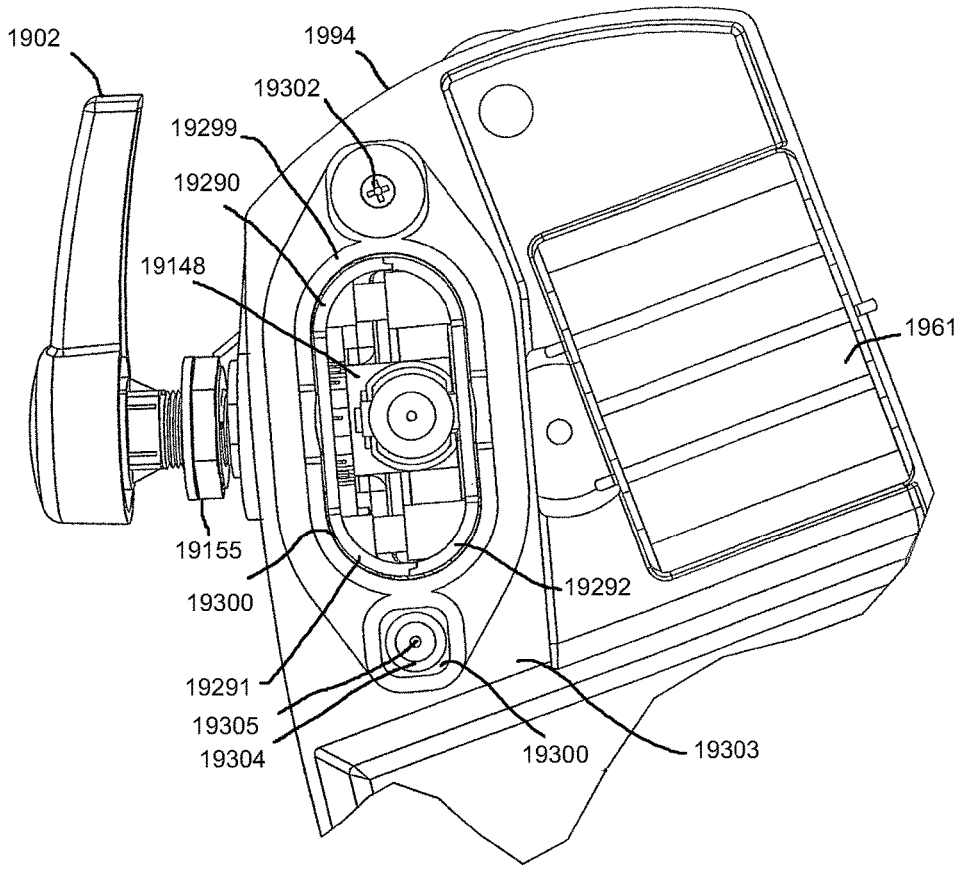
FIG. 66 is a top elevational view of the gear motor housing, gear motor with the lift arm actuation mechanism assembled on the tray for the clean system of FIG. 57.
Figure 67:
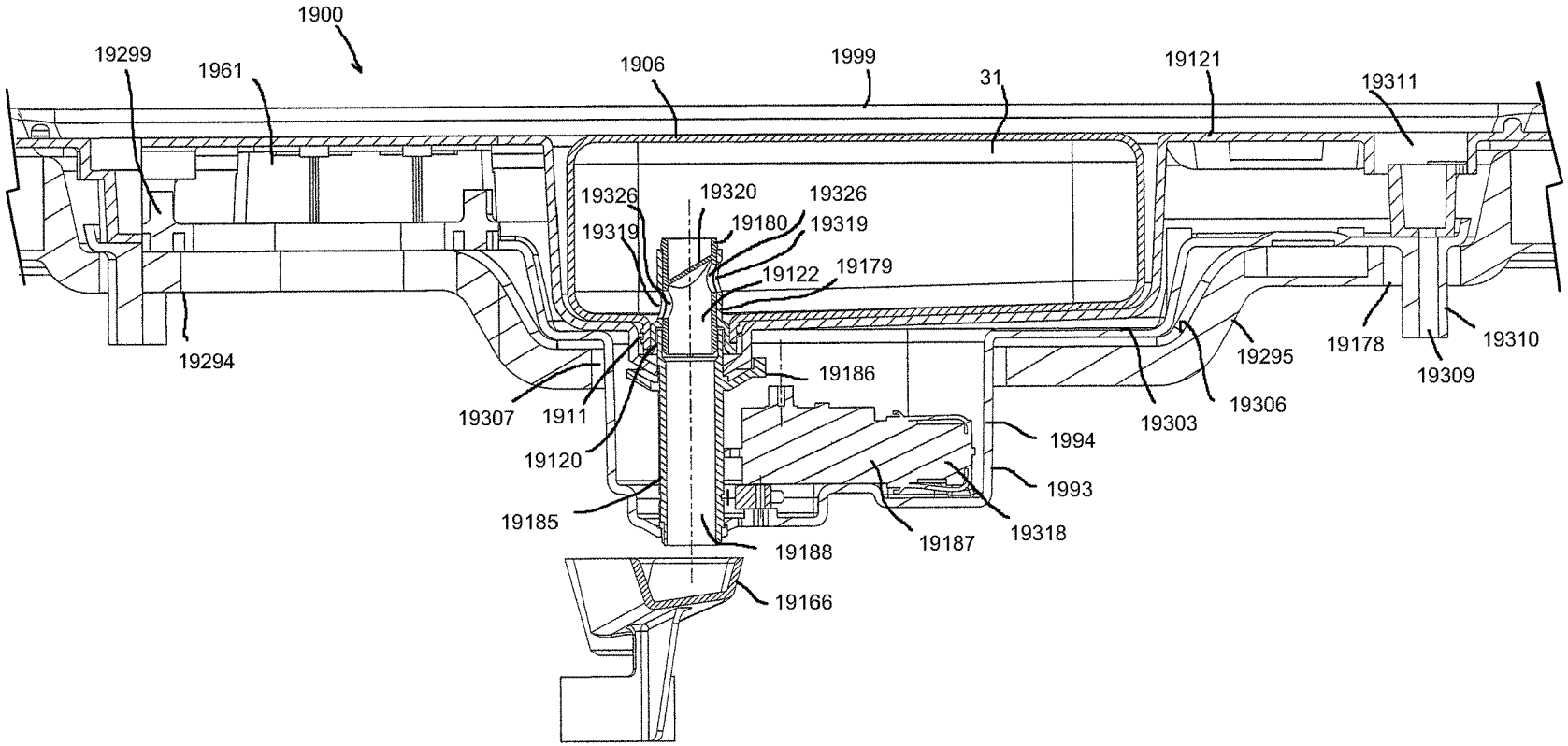
FIG. 67 is a longitudinal cross-sectional view through the assembled tank lid, tray, reservoir housing, cover and reservoir showing operation of the liquid supply valve, supply valve gear motor and reservoir as part of the clean system of FIG. 57.

Similarly to the embodiment 500, FIGS. 57-69 are directed to embodiment 1900 as noted above. This embodiment functions with fewer working parts in a simple manner to actuate the cleaning system and also advantageously allows for the activation mechanism to be maintained in a cover unit that is uncoupled to the body of the toilet tank by, for example, cables, wires, etc. This allows for easy removal of the cleaning system from the toilet tank as with embodiment 10, facilitating access to other tank components for repair or maintenance. In this embodiment, with reference to FIG. 57, a tank 1906 is shown, which is configured for sitting on top of a toilet bowl as described elsewhere herein, preferably a toilet as described with respect to embodiment 10. It preferably has a tank lining 19169 as shown as part of the assembly 1900 in broken apart form along with cleaning system parts also shown in broken apart form. (The tank and bowl are not shown but are preferably the tank and bowl of embodiment 10). This embodiment 1900 provides a further alternative lift mechanism in the form of a lift arm actuator assembly 19285 (as best shown in FIG. 62).

The lift arm actuator assembly 19285 is adapted to operate independently of a flush actuator handle 1902. That is, when normal flushing mode is enabled, flush actuator handle engages a lift arm to open the valve or valves in the toilet, but when the cleaning system is engaged, and the control system is activated, the handle would not operate or move along with the lift arm mechanism, and instead it would be independently operated as described below. The lift arm actuator assembly 19285 is adapted with features to enable the flush actuator handle 1902 to operate in a first standard mode to simply work with a pivot rod or other flush lift mechanism for opening the flush valves such as flush valve 1980 shown in FIG. 57 for standard operation, or to operate in a second clean cycle mode.

The assembly 19285 includes a lift arm 19286 which can be connected to and/or engage a standard flush lift mechanism (such as a pivot rod or linkage assembly as described elsewhere herein) to operate the valves as desired (rim and jet valves in the preferred embodiment, or at least one flush valve if using a standard toilet as described in embodiments 1600, 1700 and 1800). When in the clean cycle mode, the assembly 19285 will lift the rim flush valve (such as valve 1980 otherwise analogous to valve 80 shown in embodiment 10). This portion would operate as noted above in the assembly 10, and that lift arm 19286 is able to be directly engaged by the assembly 19285.

Figure 59:
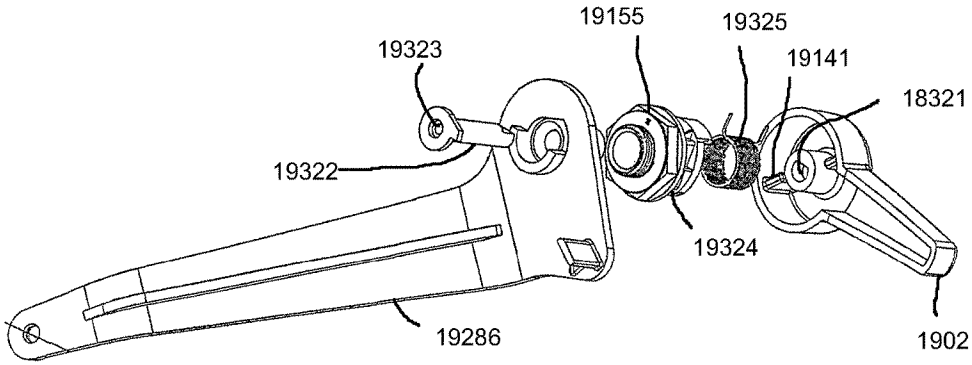
FIG. 59 is a rear perspective exploded view of the lift arm mechanism of FIG. 58.
Figure 60:
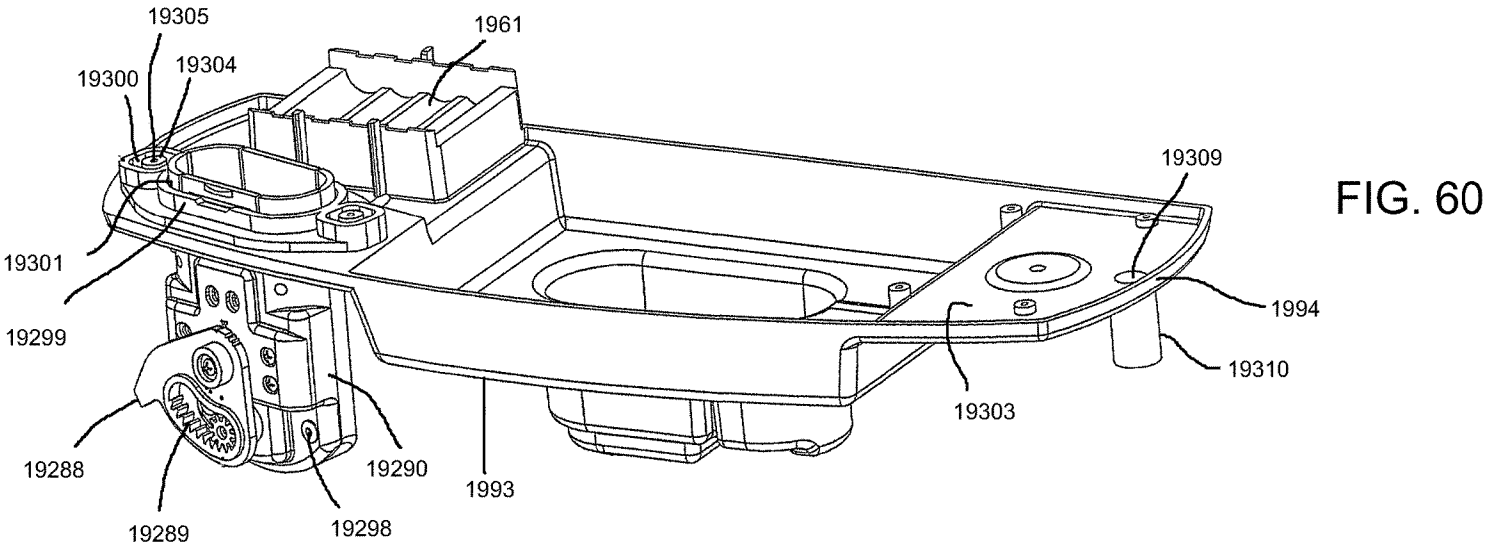
FIG. 60 is a front perspective view of a tray of the clean system of FIG. 57 having a gear motor housing and mounting flange thereon.
Figure 61:
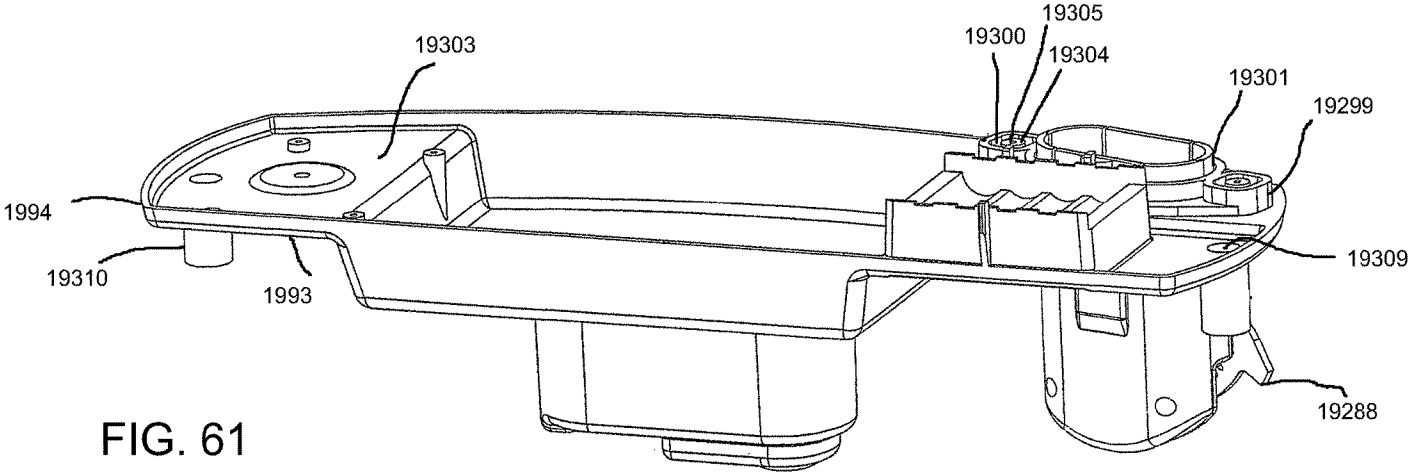
FIG. 61 is a rear perspective view of the tray of the clean system of FIG. 57 having a gear motor housing and mounting flange thereon.

The lift arm 19286 has an extension 19287 as best seen in FIG. 59 (which may have varying shapes, and here is shown as an angled tab) that engages a further engagement extension 19288 on an actuator gear 19289. The actuator gear is positioned on an exterior of a housing 19290. The housing may be molded of any of the polymeric or other materials noted above, and may be a single piece, or multiple attachable/detachable pieces. It is preferred that the housing be in some manner detachable if easy access to interior parts is desired in maintenance of the system.

Figure 57:
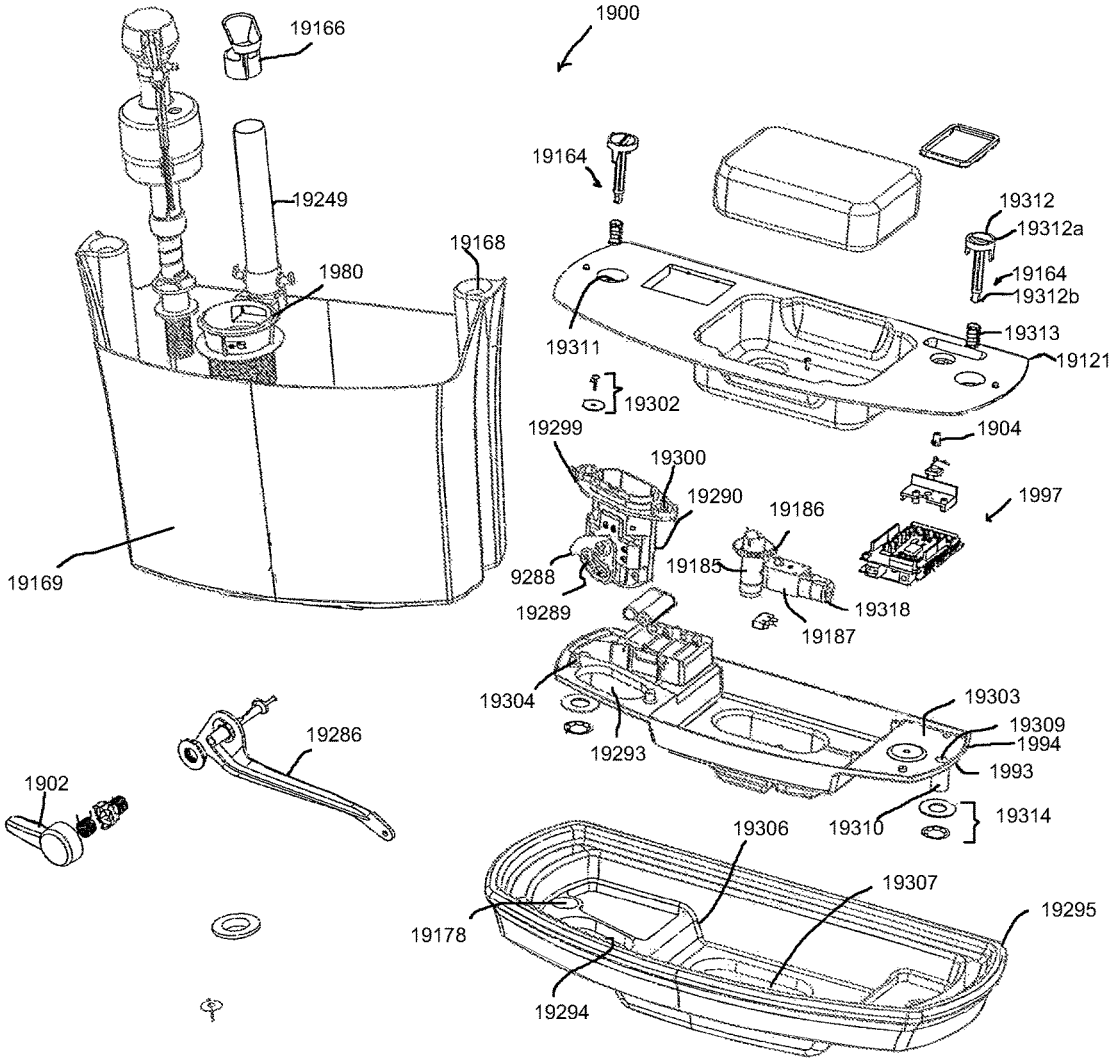
FIG. 57 is an exploded perspective view of some of the components of a further embodiment of the clean system of FIG. 1 with modified parts.
Figure 58:
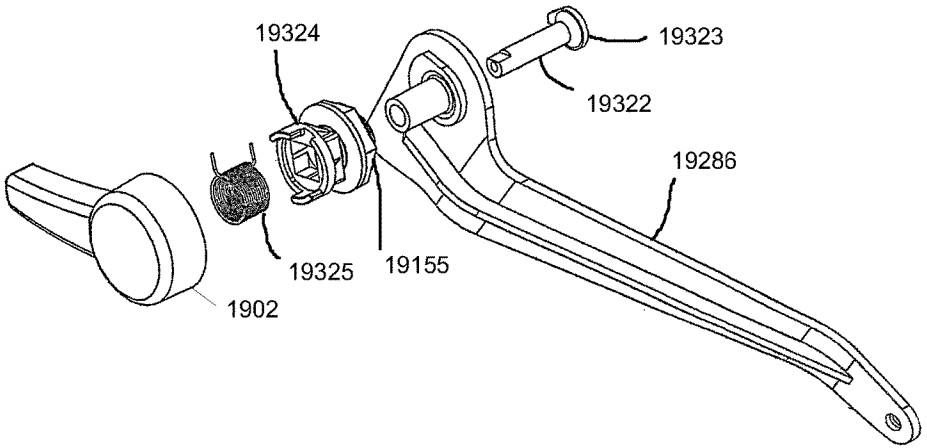
FIG. 58 is a front perspective exploded view of an alternative lift arm mechanism of the embodiment of FIG. 57.

The housing 19290 is a two-piece housing (see FIG. 62) having an actuator side 19291 configured to receive and be a base for the actuator gear 19289 which operates as a lift gear and its related parts (which would face the front of a toilet bowl when installed) and an opposite side 19292 or rearward-facing side. Such parts could have mating edges 19296 as shown, be snapped together using other mating features or screwed or otherwise fit together. As shown, there are also fastener holes 19297 for mating fasteners 19298. The housing extends upwardly through an opening 19293 in a tray 1994 that sits below the reservoir housing 19121 when assembled and in front of a battery receiving well 1961 which may be any type of battery tray sized to receive a battery as a power source, and upwardly also through a corresponding opening 19294 in a tank lid 19295 as shown in FIG. 57.

As the lift arm extension 19287 and engagement extension 19288 make contact, the lift arm 19286 is actuated to operate the opening mechanism for the flush valve (which can be configured as described elsewhere herein to operate lifting of the flapper of the flush valve).

During the clean cycle, a controller 19000 (which may be programmed in the same manner as the controller of the above-embodiments 10, 200, 300, 400, etc.) engages a gear motor 19148 in the lift arm actuator assembly 19285. The actuator assembly gear motor 19148 is thus preferably in electronic communication with the controller. The gear motor 19148 as shown is positioned in the housing 19290 and is thus kept dry and protected during operation. The gear motor and associated limit switches 19153 are thus positioned in the housing 19290 which can be secured to the tray 1994 through a mounting flange 19299. The mounting flange has at least one fastener opening 19300 extending longitudinally through the mounting flange (as shown there are two such openings, one on either end of the flange, but the number may vary depending on design). A further, preferably larger opening 19300 extends also longitudinally through the mounting flange and is preferably configured to receive, preferably in mating and stable engagement) the housing 19290. Fasteners 19302 are tightened downwardly into upwardly extending portions 19304 of the tray 1994, each having a fastener receiving opening 19305 therein, which portions 19304 fit within fastener openings 19300 of the mounting flange 19299 to secure the mounting flange 19299 to the upper surface 19303 of the tray.

The tray 1994 sits on top of a modified tank lid 19295 configured so as to receive the housing 19290 through opening 19294 for additional stability. The lid 19295 has an upper surface 19306 that also has a recess 19307 for receiving both the lower portion of the tray 1994 housing the supply valve gear motor as described below, and the reservoir seat 1957 in the reservoir housing 19121.

In operation, the pinion gear 19308 engages the downwardly positioned actuator gear 19289 which is mounted on the housing 19290. When the actuator gear 19289 turns, it is positioned so as to operate the actuator lift arm 19286 as a trip lever in that the extension 19287 of the lift arm 19286 will contact the engaging extension 19288 of the actuator gear 19289 which then will limit movement of the lift arm 19186 to open the flush valve(s).

In operation, the controller activates the gear motor 19148 that operates pinion gear 19308. Pinion gear 19208 engages and moves actuator gear 19289. The lift arm will operate the valve mechanism until the actuator gear engagement extension 19288 pushes against the extension 19287 on the lift arm 19286 which halts operation. Limit switches 19153 can also be utilized to stop the lift arm at the desired position. In preferred embodiments in toilet designs incorporating isolated rim and jet channels, the lift arm is preferable moved to a position sufficiently high to open the rim flush valve but insufficiently high to open the jet flush valve. The lift arm can thus operate either directly in connection with the rim flush valve or through a connecting or linking mechanism, to controllably lift the cover and open the flush valve for the clean cycle.

When the controller turns off the gear motor, the action stops and can be reversed by controlled operation of the gear motor. In a normal flush cycle when the gear motor is not operating, the lift arm would then operate the normal flush mechanism without moving to engage the actuator gear which would remain positioned so as not to contact the lift arm extension. Thus, in the clean cycle, when the gear motor returns the mechanism to its original position, and the handle 1902 would operate in standard flush mode. In normal flush mode, the handle 1902 has internal ribs 19141 that interact with stud 19324.

The handle also has an opening 19321 for receiving a flush handle axle 19322 which may have a screw pan head 19323 for engaging the central mount of the actuation gear as shown in FIG. 62. The stud 19324 compresses a torsion spring (or similar torsion mechanism) 19325 against the handle in use. A nut 19155 or similar fastening mechanism can secure the stud 13324 against the handle 1902 for compression of the spring by the stud.

The toilet assembly thus may include the tank of embodiment 10 or the preferred tank shown and a modified lid 19295 as described above having upper surface 19306 which is configured to be seated on top of a tank such as tank 60. The upper surface 19306 of the tank lid is configured to receive both the reservoir housing 19121 and tray 1994 and includes the recessed opening 19307 configured to receive the tray 1994 and reservoir housing 19121 as they depend downwardly. The lid 19295 preferably has a lock mechanism 19164 (similar to embodiment 10). As shown in embodiment 1900, the lid has at least one opening 19178 and as shown herein has at least two such openings. Similar openings 19309 are provided through the tray 1994 and through tray extensions 19310 for receiving the lock. Additional lock openings 19311 are provided in the reservoir housing 19121 as well. The number of the parts or locks in the lock mechanism (one or more) may vary provided that the lid is stable. Such lock mechanism is optional but advantageous for safety and security as well as smooth operation of the gear and cleaning system. The opening(s) 19178 extend through the lid 19295. They are shaped, sized and otherwise configured for receiving a lock mechanism such as that shown (but the openings may vary to accommodate other and more varied designs).

The lock mechanism in the embodiment shown (see FIG. 57) may include as shown herein at least one extending fastener 19312, and preferably at least two or more such fasteners, each having a screwable or turnable head 19312*a* for extending through the various opening(s) noted above and a second locking end 19312*b* which may be configured in various ways to engage a mating locking feature. As shown, a snap end 19312*b* fits within a quick lock securement. A snap washer assembly 19314 may be provided having a push nut and washer or similar features. A compression spring 19313 may be provided for adjustably locking the fasteners 19312. Such lock features then fit within receiving tube(s) 19168 within the liner 19169, which can be placed in a toilet tank such as tank 60 of embodiment 10. Other lock mechanisms could be used (such as a rod lock, a screw on cap with interior threads to engage threaded end of a locking rod; other snap fit engagements and the like).

As the reservoir housing, tray and tank lid are integrated they are easily removed for maintenance as one assembly after unlocking the assembly from the liner of the tank, at any time the interior of the tank needs to be accessed. The tank lid 19295 may be chinaware like the toilet or its tank or formed of a polymeric material such as a molded composite or molded thermoplastic or thermosetting polymer. The tank may further have a cover such as 1999 seated over the lid 19295 and reservoir housing 19121 and positioned thereon for a clean appearance, but still providing easy access for replacement or refilling of the reservoir. The cover 1999 should be shaped, sized or otherwise configured to be positioned over the tank lid and may have an access opening (or optional door as described in other embodiments herein) for viewing and accessing a control panel/electronic assembly 1997 which may also have an actuator button thereon or touch pad control.

The liner 19169 as noted above may be formed of a variety of materials such as polyvinyl chloride or similar water-safe polymer materials. A small air gap between the liner and the tank can be used to provide anti-condensation properties. The liner may also be used to form the locking rod receiving tubes as shown. A funnel 19166 or similar guide feature is preferably also provided to guide or direct flow of cleaning agent from the reservoir directly into the downstream flow for combination with flush water before entering the bowl. As shown, it would direct water into a supply conduit and/or an overflow tube 19249.

The lift arm as discussed above is preferably in operable connection to the flush valve 1980 and also may be connected to a jet valve such as those described above through a direct or indirect linkage, which linkage may be adjustable. The lift arm is preferably also in operable connection with the flush handle 1902, and the flush handle and lift arm 19286 may also be connected so as to operate the flush valve during a normal flush cycle. The lift arm actuator assembly is also arranged so as to operate the flush valve without the handle by operation of the lift arm actuator gear motor and at least one gear. Thus, during the clean cycle, the user need only use an actuator button or touch pad or other actuator feature 1904 (shown as a button herein) to engage cleaning and will not see operation of the handle nor need to depress the flush handle. Once the cleaning cycle is over and the flush handle is actuated, the toilet returns to normal flushing.

Figure 68:
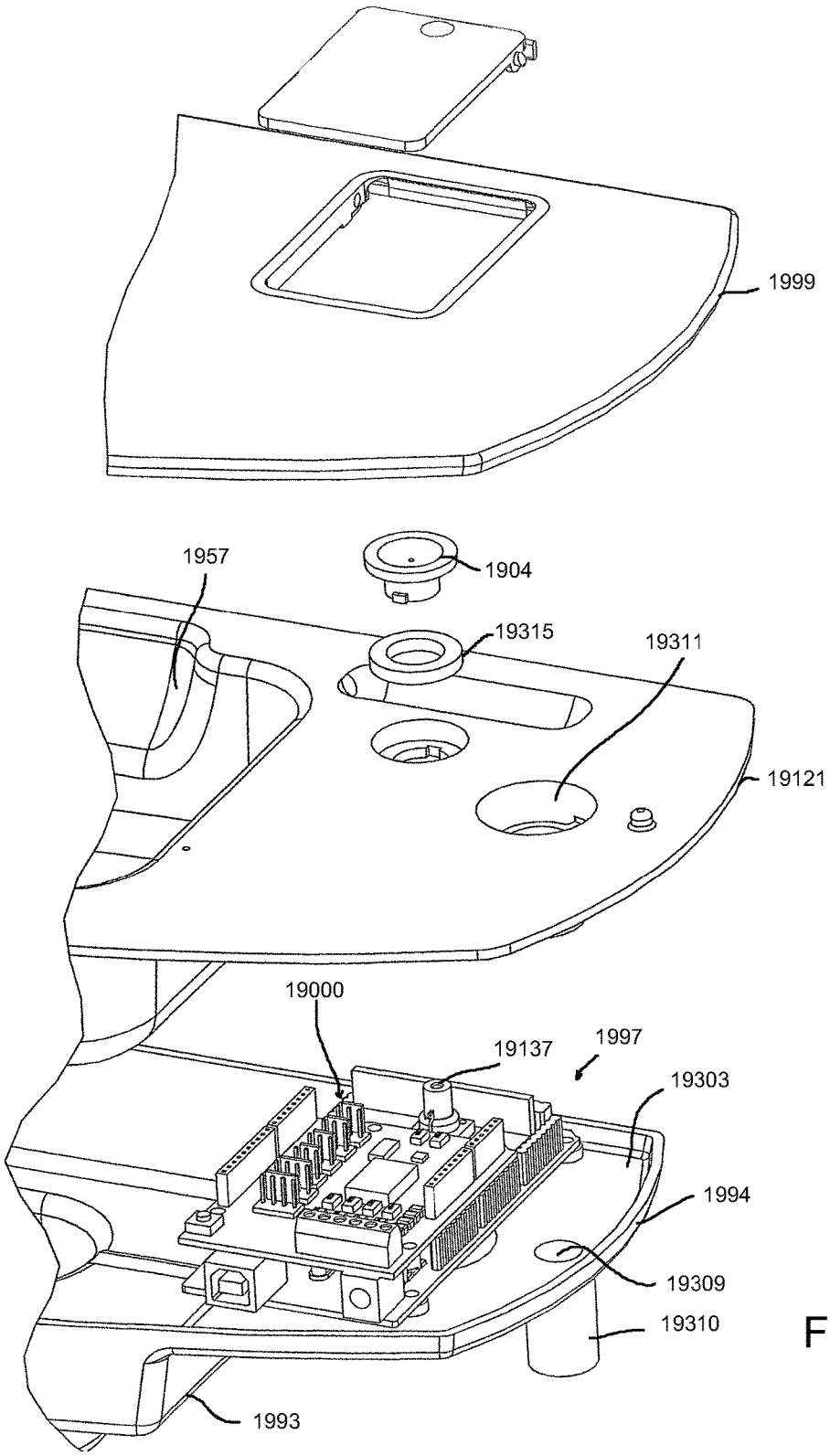
FIG. 68 is a partially exploded view of an enlarged section of the assembled cover, reservoir housing and tray of the clean system of FIG. 57.
Figure 69:
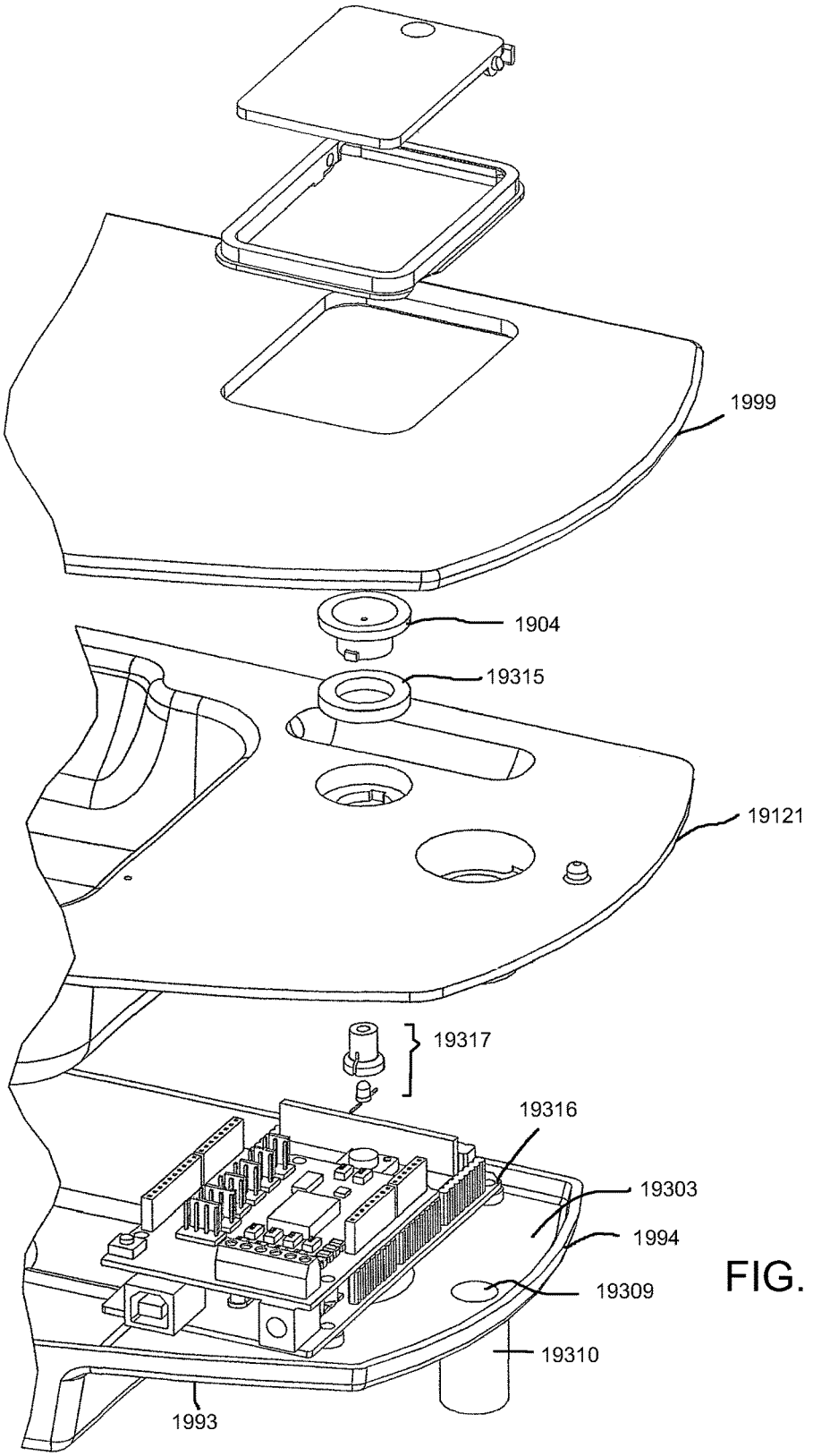
FIG. 69 is a fully exploded view of the same enlarged section of the assembled cover, reservoir housing and tray of FIG. 68.

As shown in FIGS. 68 and 69, a button actuator feature 1904 may be seated on a receiving ring 19315. Upon depressing the button contact is made on the lower portion of the panel 1997 positioned on top of the tray 1994. An Arduino assembly 13316 has receiving contact mechanism 19317 for actuating the control system 19000 (which may be the same as any control system in any embodiments herein). The control system then actuates the timing of the gear motor 19148 for the lift arm assembly 19285 and also regulates the timing of release of cleaning agent from within a reservoir shown as reservoir 1906.

Yet a further embodiment 500 of the invention is provided having a cleaning system for a toilet bowl herein as may be seen with reference to FIGS. 70-73. This embodiment 500 provides an alternative flush valve operation mechanism 582 in the form of a lift arm actuator assembly 5140. The lift arm actuator assembly is adapted to a flush actuator handle 502 that is adapted with features to enable the flush actuator handle 502 to operate in a first standard mode to simply work with a pivot rod or other flush lift mechanism for opening the flush valves for standard operation, or to operate in a second clean cycle mode. As can be seen from the exploded back perspective view of FIG. 73, the flush actuator handle 502 can operate also as a trip lever in that it is adapted to have features such as ribs 5141 on an inside of the actuator handle 502 that function with the trip lever stop feature 5142 positioned within a stud 5143. When in the second, standard mode, for everyday flushing, the trip lever stop 5142 engages the ribs 5141 in the flush actuator handle 502 acting as a trip lever to hold the otherwise active mechanism of the assembly 5140 in a normal flushing position. In such a situation, the lift arm 5144 can be connected to and/or engage a standard flush mechanism (such as a flush activation bar or linkage assembly as described elsewhere herein) to operate both valves as desired.

When in the second clean cycle mode, the mechanism will lift the rim flush valve (such as valve 80 shown in embodiment 10). To do so, an extending shaft portion 5145 of lift arm 5144 passes through the assembly 5140 so that the end 5146 of the extending shaft portion of the lift arm 5144 engages an mating opening 5147 in the trip lever stop 5142. During the clean cycle, a controller 50000 (which may be programmed in the same manner as the controller of the above-embodiments e.g., 10, 200, 300, 700, 800, 900, 1200, 1300, 1400, 1500, and 1900) and engages a gear motor 5148 positioned in the lift arm actuator assembly 5140. The actuator assembly gear motor 5148 is thus preferably in electronic communication with the controller. The gear motor 5148 as shown is positioned on a mounting bracket 5149. The bracket has a recess 5149*a* to seat the base of the pinion gear 5151. The pinion gear base 5151*a* has a recess 5151*b* in the side opposite the pinion gear 5151 configured to receive the gear stem 5150 of the actuator assembly gear motor 5148. Thus, when the controller activates the gear motor, stem 5150 moves and turns pinion gear 5151. The pinion gear has teeth 5151*c* configured to engage teeth 5152*a* on actuator gear 5152.

When the actuator gear 5152 turns, it moves between limit switches 5153 on the mounting bracket 5149. A rotatable mounting stem 5154 extending on the opposite side of the mounting bracket from the actuator and pinion gears is hollow and has an interior surface 5154*a* configured to receive within a passage 5154*b* in the stem 5154 the extending shaft portion 5145 of the lift arm 5144. The exterior surface 5154*c* of the mounting bracket stem 5154 is configured to fit within an extending portion 5143*a* of the stud 5143. More specifically, the mounting bracket stem 5154 fits within a passage 5143*e* defined by an interior surface 5143*f* of the extending portion 5143*a* of the stud 5143. The exterior surface 5143*b* of the stud may have optional threads 5143*c* or other similar features to engage a nut 5155 or other fastening device capable of securely holding the mounting bracket to the stud so that the extending portion of the stud is stably fit around the mounting bracket mounting stem.

Figure 72:
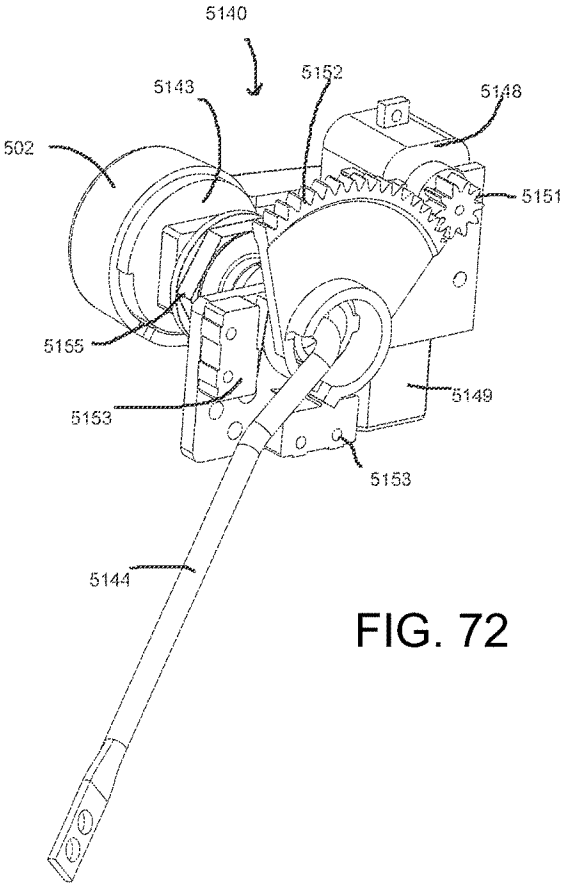
FIG. 72 is a back perspective view of the actuator assembly of FIG. 70.
Figure 70:
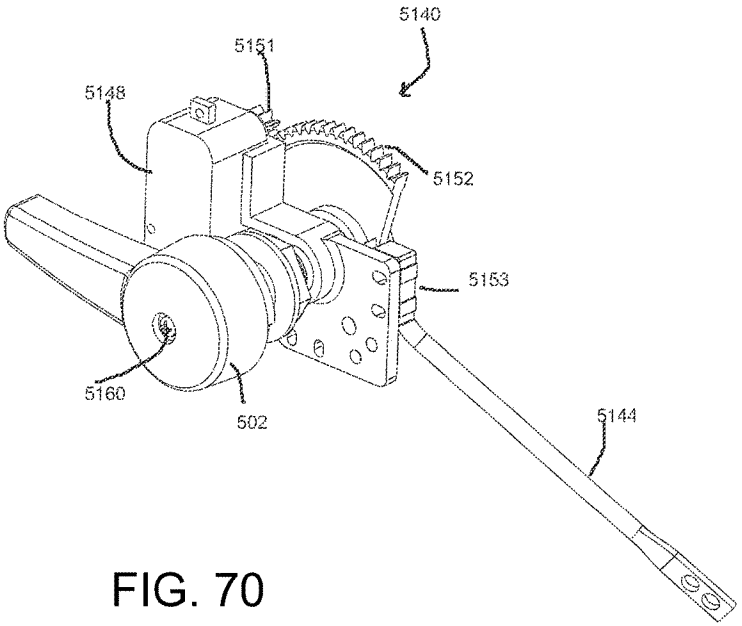
FIG. 70 is a front perspective view of a further alternative body of a lift arm actuator assembly for use in a further embodiment of the invention.
Figure 71:
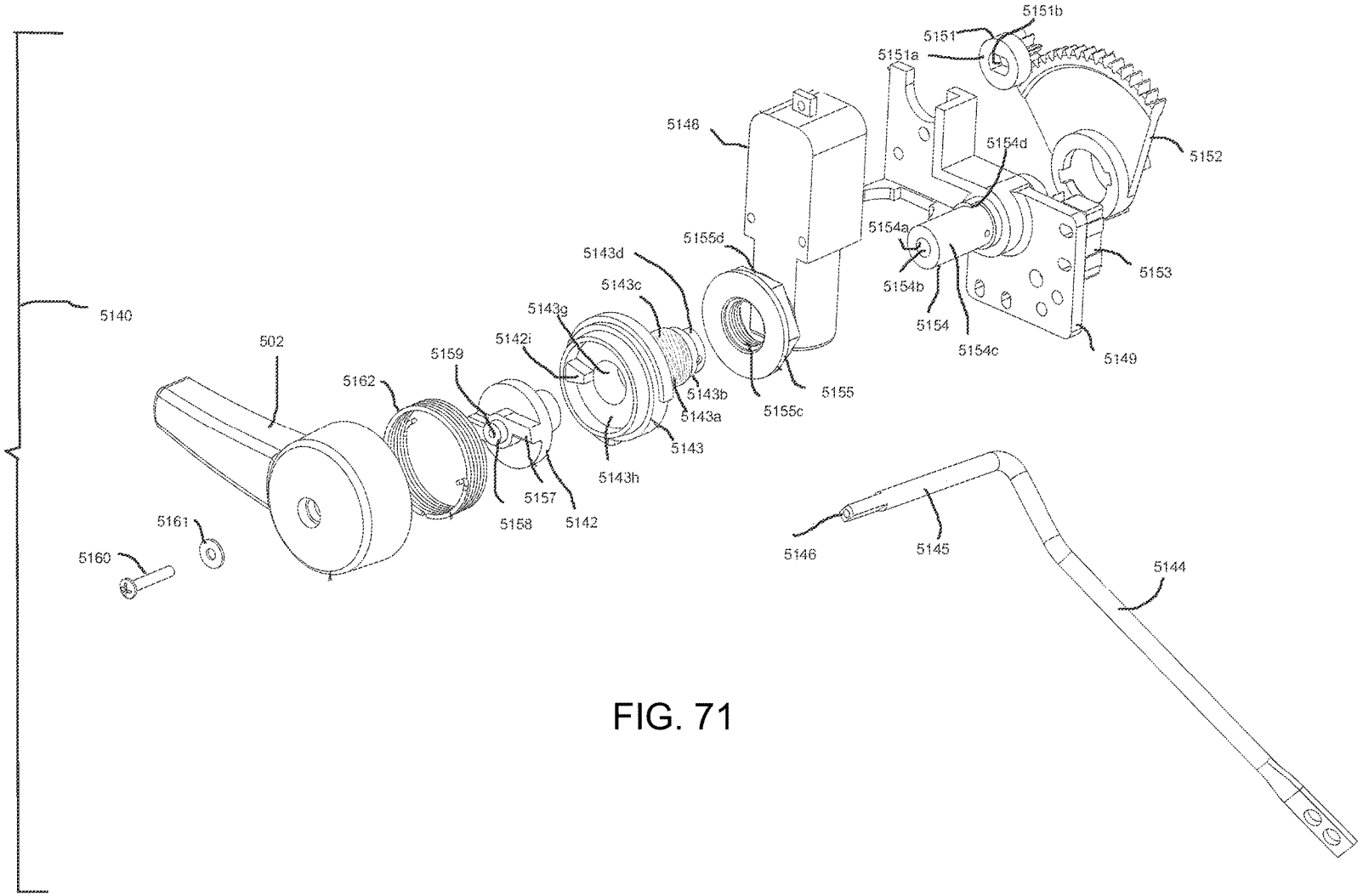
FIG. 71 is an exploded front perspective view of the actuator assembly of FIG. 70.
Figure 73:
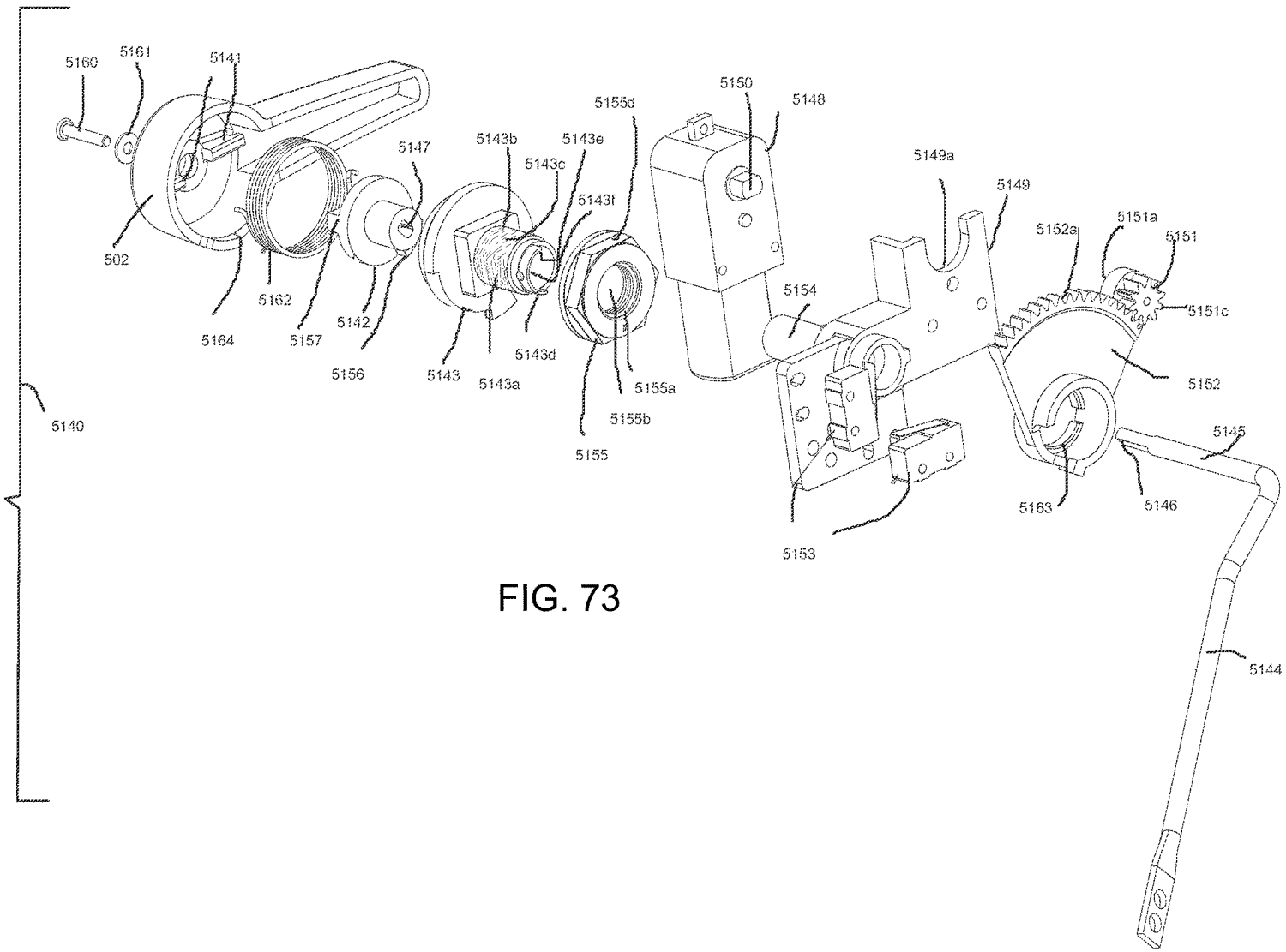
FIG. 73 is an exploded back perspective view of the actuator assembly of FIG. 70.

As shown, a nut 5155 is provided which has an interior surface 5155*a* defining a passage 5155*b* or hole therethrough. The interior surface 5155*a* may have mating threads 5155*c* which can engage exterior threads 5143*c* on the stud 5143. Other locking, snap-fit features or interlocking mating features may be used to hold these features together. Optional tightening features such as hexagonal surfaces 5155*d* may be provided to the nut for tightening it in place. When assembled as shown in FIGS. 70 and 72, the nut tightens the stud towards the mounting bracket so that the mounting stem 5154 of the mounting bracket 5149 is rotatably within the passage 5143*f* of the extending portion 5143*a* of the stud 5143. Each of the mounting stem 5154 and the extending portion 5143*a* of the stud 5143 has a stop feature 5154*d*, 5143*d*, respectively, to position the parts for alignment and operation.

On the portion of the stud 5143 opposite the extending portion 5143*a*, the stud includes a wider opening 5143*g* in a recessed portion 5143*h* configured to receive in a seated and rotatable manner trip lever stop 5142. The wider opening 5143*g* is in communication with the passage 5143*f* through the extending portion 5143*a* of the stud 5143. As the extending portion 5145 of the lift arm 5144 passes through the passage 5154*a* of the mounting stem, which is seated within the passage 5143*f* of the extending portion 5143*a* of the stud 5143, the end 5146 of the extending portion 5145 of the lift arm 5144 fits within and engages opening 5147 on the trip lever stop 5142. The recessed portion also includes an engaging stop feature 5143*i* that contacts a mating engaging feature 5156 on a side of the trip lever stop 5142 facing the recessed portion.

The surface of the trip lever stop 5142 facing the interior of the flush actuator handle 502 has additional or second engaging features 5157 on an outwardly extending portion 5158 thereof. The outwardly extending portion 5158 also has an optional receiving hole 5159 for a screw 5160 and washer 5161 or other fastener to connect the flush actuator handle 502 to the trip lever stop 5142. A spring mechanism 5162 which is a trip lever return spring may also be provided to maintain tension when the clean cycle is activated.

In operation, the controller activates the gear motor 5148, having stem 5150 that operates pinion gear 5151. Pinion gear 5151 engages and moves actuator gear 5152. Actuator gear recess 5163 is configured to engage the back of rotatable mounting stem 5154. As the gear turns the stem, the stem, which moves the trip lever stop 5142 within the recessed portion 5143*h* of the stud 5143, enables the trip lever stop to move into position and the trip lever return spring maintains tension on the flush actuator handle 502 having a recess feature 5164 so that the handle remains in steady state while the gear motor is turning the trip lever stop. As the mounting stem turns, the extending portion 5145 of the lift arm 5144 also turns and can operate either directly in connection with the rim flush valve or through a connecting or linking mechanism, to controllably lift the cover and open the flush valve for the clean cycle. When the controller turns off the gear motor, the action stops and can be reversed by spring action or more preferably by controlled operation of the gear motor.

After the clean cycle is over, the actuator assembly operates in standard flush mode again, and the flush actuator handle with features 5141 moves the trip lever stop to simply manually engage the extending portion 5145 of the lift arm 5144 which can directly or through other flush lift mechanisms (such as a flush activation bar) open both the rim and jet flush valves in a desired manner. In all other respects, the embodiment 500 can be used with the other various valve, and toilet assemblies in the other embodiments herein.

A method is provided herein for periodically cleaning a toilet having a cleaning system, the method may be practiced with any of the cleaning systems 10, 200, 300, 400, 500, 700, 800, 900, 1200, 1300, 1400, 1500 and 1900 as described above. It may also be used with modification with embodiments 1600, 1700 and 1800. For the sake of brevity, it will be described with respect to embodiment 10, but all steps can be carried out according to the additional information noted above for embodiments 200, 300, 400, 500, 700, 800, 1200, 1300, 1400, 1500 and 1900 without departing from the spirit of scope of the invention. The method includes providing a cleaning system 100 for a toilet bowl 30 in a toilet assembly 10 having a toilet bowl 30 defining an interior area 36, a toilet tank 60 defining a tank interior 119, a flush valve 80 and a rim inlet port 28. These features are described in further detail above. The flush valve 80 is one that is configured to deliver fluid to the rim inlet port 28 of the toilet bowl 30. The type of flush valves used, the shape of the bowl and tank as well as the rim inlets may be varied to accommodate a wide variety of toilet assemblies.

The control system is activated by the actuator feature 4 to initiate the clean cycle. The flow control device 66*a*, e.g., a mechanized valve 91 as shown or liquid supply valve 120, is then operated and opened for a first period of time sufficient to deliver the dose of a liquid cleaning agent from the supply conduit to the interior space 103 of the flush valve body 104 of the flush valve 80 when in a closed position as described above.

The flush valve is then operated by use of a flush valve operation mechanism so as to open the valve by lifting of the flapper 105 of the flush valve 80 to introduce the dose of a liquid cleaning agent carried by at least about 3 l of flush water over the second period of time as described above. Mechanisms such as that of embodiments 10, 400, 500 or 1900 may be used.

The flush valve 80 is preferably operated to at least partially close after delivering the dose of a liquid cleaning agent. The flow control device **66*a*** and flush valve operation mechanism are operated by the control system and timing programmed therein as described above.

The flush valve may then be optionally operated to re-open after a third period of time (cleaning hold period) to introduce at least about 3 l to purge the interior of the toilet bowl with new flush water at the end of the clean cycle. Additional flush water, at least about 0.5 l, may be also introduced through the jet flush valve 70, with the timing of introduction adjusted as desired.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A toilet assembly having a cleaning system, comprising:

(a) a toilet assembly comprising a toilet bowl defining an interior space, a toilet tank defining a tank interior, a flush valve, and a rim in fluid communication with the interior of the bowl through a rim flow path extending from an outlet of the flush valve to at least one rim outlet port, wherein the flush valve is configured to deliver fluid to the at least one rim outlet port, and wherein the flush valve is configured to operate in a flush actuation mode wherein the flush valve is able to provide flush water flow sufficient for the toilet assembly to initiate a flush siphon or provide a wash down flush and to operate in a cleaning actuation mode wherein the flush valve is only partially opened to allow for introduction of a cleaning agent and flush water mixture to the bowl that is insufficient to initiate a siphon but sufficient for cleaning the bowl; and (b) the cleaning system having the cleaning actuation mode that operates independently of the flush actuation mode of the toilet assembly, the cleaning system comprising a reservoir for holding a liquid cleaning agent having a body defining an interior space and having an outlet port in fluid communication with the interior space of the reservoir body;

a housing configured to receive the reservoir;

a supply conduit in fluid communication with the interior of the reservoir and having a first end for receiving fluid from within the reservoir;

a flow control device capable of controlling flow through the supply conduit; and a control system activatable by an actuator feature, wherein upon activation of the actuator feature, the control system is adapted to initiate a clean cycle by:

operating the flow control device for a first period of time sufficient to deliver a dose of the liquid cleaning agent from the reservoir to one or more rim outlets, and operating the flush valve in the cleaning actuation mode to open the flush valve so as to introduce flush water to carry the dose of the liquid cleaning agent through the at least one rim outlet port into the toilet bowl at a flow rate insufficient to initiate a siphon but sufficient for cleaning the bowl.

2. The toilet assembly according to claim 1, wherein the flush valve introduces flush water at a flow rate that is about 20% to about 80% slower in the cleaning actuation mode than the flow rate through the flush valve during a normal flush mode.

3. The toilet assembly according to claim 2, wherein the flush valve introduces flush water at a flow rate that is about 40% to about 60% slower in the cleaning actuation mode than the flow rate through the flush valve during the normal flush mode.

4. The toilet assembly according to claim 2, wherein flush water enters the valve in a flush actuation mode over a period of about 2 s to about 30 s.

5. The toilet assembly according to claim 4, wherein flush water and cleaning agent are introduced into the bowl and have a residence time of about 30 s to about 30min. for cleaning the bowl.

6. The toilet assembly according to claim 1, wherein the bowl is a direct-fed jet, siphonic, gravity-powered bowl.

7. The toilet assembly according to claim 1, wherein the bowl is a non-jetted, siphonic, gravity-powered bowl.

8. The toilet assembly according to claim 1, wherein the bowl is a rim-jetted, siphonic, gravity powered bowl.

9. The toilet assembly according to claim 1, wherein the bowl is a gravity-powered, wash-down bowl.

10. The toilet assembly according to claim 1, wherein the flush valve is a flapper-type flush valve with a poppet feature in the valve cover for use in opening the valve during the cleaning actuation mode.

11. The toilet assembly according to claim 1, wherein the flush valve is a flapper-type flush valve with a hook and catch feature for use in opening the valve during the cleaning actuation mode.

12. The toilet assembly according to claim 1, wherein the flush valve is a poppet-type flush valve, wherein a poppet-type valve cover opens the flush valve in a normal flush mode and the flush valve has a side port having a cover thereon for use in opening the valve during the cleaning actuation mode.

13. A method for periodically cleaning the toilet in the toilet assembly with the cleaning system according to claim 1, the method comprising providing the toilet assembly according to claim 1;

activating the control system by the actuator feature to initiate the clean cycle;

operating the flow control device and opening it for the first period of time sufficient to deliver at least one dose of the liquid cleaning agent from the supply conduit to an interior space of a flush valve in a closed position; and operating the flush valve to open the flush valve to introduce flush water along with the at least one dose of the liquid cleaning agent through the at least one rim outlet port into the toilet bowl at a flow rate insufficient to initiate a siphon but sufficient for cleaning the toilet bowl in the toilet assembly.

14. A cleaning system for use with a toilet assembly, comprising a reservoir for holding a liquid cleaning agent having a body defining an interior space and having an outlet port in fluid communication with the interior space of the reservoir body;

a housing configured to receive the reservoir;

a supply conduit in fluid communication with the interior of the reservoir and having a first end for receiving fluid from within the reservoir;

a flow control device capable of controlling flow through the supply conduit; and a control system activatable by an actuator feature, wherein upon activation of the actuator feature, the control system is adapted to initiate a clean cycle by:

operating the flow control device for a first period of time sufficient to deliver a dose of the liquid cleaning agent from the reservoir to one or more rim outlets of the toilet assembly, and operating a flush valve in the toilet assembly in a cleaning actuation mode to open a flush valve in the toilet assembly so as to introduce flush water to carry the dose of the liquid cleaning agent through at least one rim outlet port of a toilet assembly into a toilet bowl of the toilet assembly at a flow rate insufficient to initiate a siphon but sufficient for cleaning the toilet bowl in the toilet assembly, wherein the cleaning actuation mode operates independently of a flush actuation mode, the flush actuation mode operating at a flow rate sufficient to initiate a flush siphon in the toilet assembly.

15. The cleaning system according to claim 14, wherein the cleaning system is installed in the toilet assembly having the toilet bowl and the toilet bowl is for use in a non-jetted, siphonic, gravity-powered bowl.

16. The cleaning system according to claim 14, wherein the cleaning system is installed in the toilet assembly having the toilet bowl and the toilet bowl is for use in a rim-jetted, siphonic, gravity powered bowl.

17. The cleaning system according to claim 14, wherein the cleaning system is installed in the toilet assembly having the toilet bowl and the toilet bowl is for use in a gravity-powered, wash-down bowl.

18. The cleaning system according to claim 14, wherein the cleaning system is installed in the toilet assembly having the flush valve, wherein the flush valve is a flapper-type flush valve with a flapper cover and a poppet feature in the flapper cover and the control system operates the flush valve in the toilet assembly valve cover for use in opening to open the valve during the cleaning actuation mode.

19. The cleaning system according to claim 14, wherein the cleaning system is installed in the toilet assembly having the flush valve, wherein the flush valve is a flapper-type flush valve with a hook and catch feature and the control system operates the flush valve in the toilet assembly to open the valve during the cleaning actuation mode.

20. The cleaning system according to claim 14, wherein the cleaning system is installed in a toilet assembly having a flush valve that is a poppet-type flush valve having a poppet-type valve cover and a side port having a cover thereon and the control system operates the flush valve in the toilet assembly that is a poppet type flush valve, wherein a poppet type valve cover opens to open the poppet-type valve cover of the flush valve in a normal flush mode and to open the side port cover of the flush valve has a side port having a cover thereon for use in opening the valve during the cleaning actuation mode.

21. The toilet assembly of claim 1, wherein the cleaning system further comprises a housing configured to engage an extension on an actuator lift arm of the flush assembly.

22. The toilet assembly of claim 1, wherein the cleaning system further comprises a gear motor, and wherein in the flush actuation mode the gear motor is not operating and in the cleaning actuation mode the gear motor is operating.

* * * * *